US005582944A

United States Patent [19]

Yamamura et al.

[11] Patent Number: 5,582,944

[45] Date of Patent: Dec. 10, 1996

[54] LIGHT RECEIVING MEMBER

[75] Inventors: Masaaki Yamamura; Toshiyasu Shirasuna; Junichiro Hashizume; Kazuyoshi Akiyama, all of Nagahama; Shigeru Shirai, Hikone, all of Japan

[73] Assignee: Canon Kabushiki Kaisha, Tokyo, Japan

[21] Appl. No.: 264,234

[22] Filed: Jun. 22, 1994

Related U.S. Application Data

[63] Continuation of Ser. No. 890,538, May 28, 1992, abandoned.

[30] Foreign Application Priority Data

| | | | |
|---|---|---|---|
| May 30, 1991 | [JP] | Japan | 3-153706 |
| May 30, 1991 | [JP] | Japan | 3-153710 |
| May 30, 1991 | [JP] | Japan | 3-153718 |
| May 30, 1991 | [JP] | Japan | 3-153741 |
| May 30, 1991 | [JP] | Japan | 3-153754 |
| May 30, 1991 | [JP] | Japan | 3-153797 |
| May 30, 1991 | [JP] | Japan | 3-153816 |
| May 30, 1991 | [JP] | Japan | 3-153823 |
| Nov. 8, 1991 | [JP] | Japan | 3-293389 |

[51] Int. Cl.[6] ..... G03G 5/082

[52] U.S. Cl. ..... 430/66; 430/57; 430/63

[58] Field of Search ..... 430/57, 61, 63, 430/66

[56] References Cited

U.S. PATENT DOCUMENTS

| | | | |
|---|---|---|---|
| 4,265,991 | 5/1981 | Hirai et al. | 430/66 |
| 4,536,459 | 8/1985 | Misumi et al. | 430/57 |
| 4,539,283 | 9/1985 | Shirai et al. | 430/61 |
| 4,585,720 | 4/1986 | Saitoh et al. | 430/57 |
| 4,609,601 | 9/1986 | Shirai et al. | 430/31 |
| 4,780,387 | 10/1988 | Shirai et al. | 430/60 |
| 4,786,574 | 11/1988 | Shirai et al. | 430/66 |
| 4,853,309 | 8/1989 | Hayakawa et al. | 430/66 |
| 5,273,851 | 12/1993 | Takei et al. | 430/66 |

FOREIGN PATENT DOCUMENTS

| | | |
|---|---|---|
| 2746967 | 4/1979 | Germany . |
| 2855718 | 6/1979 | Germany . |
| 3201146 | 9/1982 | Germany . |
| 54-145540 | 11/1979 | Japan . |
| 56-83746 | 7/1981 | Japan . |
| 58-219560 | 12/1983 | Japan . |
| 60-67950 | 4/1985 | Japan . |
| 60-67951 | 4/1985 | Japan . |

OTHER PUBLICATIONS

Patent Abstracts of Japan, vol. 12, No. 216 (P-719) (3063) Jun. 21, 1983.

Patent Abstracts of Japan, vol. 12, No. 354 (P-761) (3201) Sep. 22, 1988.

*Primary Examiner*—Christopher D. Rodee

*Attorney, Agent, or Firm*—Fitzpatrick, Cella, Harper & Scinto

[57] ABSTRACT

An electrophotographic light-receiving member comprises a conductive substrate and a light-receiving layer having a photoconductive layer and a surface layer which are successively layered on the conductive substrate, wherein;

the photoconductive layer is comprised of a non-monocrystalline material mainly composed of a silicon atom and containing at least a carbon atom, a hydrogen atom and a fluorine atom;

the surface layer is mainly composed of a silicon atom and contains a carbon atom, a hydrogen atom and a halogen atom;

the carbon atom in the photoconductive layer is in a non-uniform content in the layer thickness direction and in a higher content on the side of the conductive substrate and in a lower content on the side of the surface layer at every point in the layer thickness direction, and is in a content of from 0.5 atomic % to 50 atomic % at, or in the vicinity of, its surface on the side of the conductive substrate and substantially 0% R at, or in the vicinity of, its surface on the side of the surface layer;

the fluorine atom in the photoconductive layer is in a content of not more than 95 atomic ppm; and the hydrogen atom in the photoconductive layer is in a content of from 1 to 40 atomic %.

21 Claims, 17 Drawing Sheets

LIGHT RECEIVING MEMBER

This application is a continuation of application Ser. No. 07/890,538 filed May 28, 1992, now abandoned.

BACKGROUND OF THE INVENTION

1. Field of the Invention

The present invention relates to a light-receiving member sensitive to an electromagnetic wave such as light in a broad sense, which includes ultraviolet rays, visible light, infrared rays, X-ray, γ-ray, etc., and more particularly to a light-receiving member having an important significance in the image-forming fields such as electrophotography, etc.

2. Related Background Art

In the image-forming fields, the following characteristics are required for photoconductive materials that form a light-receiving layer in a light-receiving member:

(1) High sensitivity (2) High SN ratio [photoelectric current (Ip)/dark current (Id)]

(3) Possession of absorption spectra matched to the spectrum characteristics of irradiating electromagnetic waves (4) Possession of rapid light response and desired dark resistance (5) Harmlessness to human bodies when used.

Particularly in the case of light-receiving members for electrophotography which are incorporated in electrophotographic apparatuses for office services such as office machines, the harmlessness when used, as mentioned under the item (5), is important. From this viewpoint, amorphous silicon, which will be hereinafter referred to as "a-Si" is regarded as an important photoconductive material, and its application as light-receiving members for electrophotography is disclosed, for example, in DE-A-2746967 and DE-A-2855718.

FIG. 1 is a schematic cross-sectional view of a layer structure of a conventional light-receiving member 200 for electrophotography. The light-receiving member 200 for electrophotography comprises an electroconductive substrate 201 and a light-receiving layer 202 composed of a-Si. The light-receiving layer 202 comprises a photoconductive layer and a surface layer successively laminated on the electroconductive substrate 201 generally by forming these layers on the electroconductive substrate 201 heated to 50°–400° C. by vacuum vapor deposition, sputtering, ion plating, hot CVD, photo CVD, plasma CVD or other film-forming process. Particularly, a plasma CVD process, that is, a process for forming an a-Si deposition film on an electroconductive substrate 201 by decomposing a raw material gas by DC glow discharge, high frequency glow discharge or microwave glow discharge, is suitable and has been practically used so far.

The following light-receiving members for electrophotography have been so far proposed:

(1) Japanese Patent Application Laid-Open No. 56-83746 proposes a light-receiving member for electrophotography, which comprises an electroconductive substrate and an a-Si photoconductive layer containing a halogen atom as a constituent element, where the localized level density is reduced in the energy gap by adding 1–40 atomic % of a halogen atom to a-Si, thereby compensating for dangling bonds and obtaining suitable electrical and optical characteristics as a photoconductive layer in the light-receiving member for electrophotography.

(2) Japanese Patent Application Laid-Open No. 54-145540 proposes a light-receiving member for electrophotography, where the photoconductive layer is composed of amorphous silicon containing carbon, that is, amorphous silicon carbide, which will be hereinafter referred to as "a-SiC". It is known that a-SiC has high heat resistance and surface hardness, a higher dark resistivity than that of a-Si, and a variable optical band gap in a range of 1.6 to 2.8 eV by the carbon content. The Japanese Patent Application discloses that use of a-Si containing 0.1–30 atomic % of carbon atoms as a photoconductive layer in the light-receiving member for electrophotography, where the carbon atoms are used as a chemically modifying substance, produces distinguished electrophotographic characteristics such as a high dark resistance and a good photosensitivity.

(3) Japanese Patent Publication No. 63-35026 proposes a light-receiving member for electrophotography, which comprises an electroconductive substrate, an intermediate layer of a-Si containing a carbon atom and at least one of hydrogen atoms and fluorine atoms as constituent elements, which will be hereinafter referred to as "a-SiC(H,F)", and an a-Si photoconductive layer, successively laid on the electroconductive substrate, where cracking or peeling of the a-Si photoconductive layer is intentionally reduced by the a-Si intermediate layer containing at least one of hydrogen atoms and fluorine atoms without deteriorating the photoconductive characteristics.

(4) Japanese Patent Application Laid-Open No. 58-219560 proposes a light-receiving member for electrophotography, which comprises a surface layer of amorphous hydrogenated or fluorinated silicon carbide, which will be hereinafter referred to as "a-SiC:H,F", further containing an element belonging to Group IIIA of the Periodic Table.

(5) Japanese Patent Application Laid-Open Nos. 60-67950 and 60-67951 propose a light-receiving member for electrophotography, which comprises a light transmission insulating overcoat layer of a-Si containing carbon atoms, fluorine atoms and oxygen atoms.

The conventional light-receiving members for electrophotography containing a photoconductive layer comprising an a-Si material are improved in the individual characteristics, for example, electrical characteristics such as dark resistance, etc.; optical characteristics such as photosensitivity, etc.; photoconductive characteristics such as light response, etc.; service circumstance characteristics; chronological stability; and durability, but actually still have room for improvements in overall characteristics.

Particularly a higher image quality, a higher speed, and a higher durability are now keenly desired for electrophotographic apparatuses, and as a result further improvements in the electrical characteristics and photoconductive characteristics and also in the durability in any service circumstance are required for the light-receiving members for electrophotography, while maintaining a high chargeability and a high sensitivity.

For example, when an a-Si material is used as a light-receiving member for electrophotography, there have been the following disadvantages:

(1) When a higher sensitivity and a higher dark resistance are to be obtained at the same time, a residual potential has been often observed in the actual service, and in case of prolonged service accumulation of fatigue due to repeated use has occurred to produce the so called ghost phenomena.

(2) It has been difficult to obtain high levels of chargeability and prevention of smeared images at the same time.

(3) In order to improve the photoconductive characteristics and electrical characteristics such as resistance, etc., hydrogen atoms (H), halogen atoms (X) such as fluorine atoms (F) and chlorine atoms (Cl), or boron atoms (B) or phosphorus atoms (P) for control of electrical conduction type, or other atom species for improving other characteristics have been added to the photoconductive layer as constituent atoms, and there have been problems in the electrical characteristics, photoconductive characteristics or uniformity of the resulting layer, depending on the state of added constituent atoms. That is, when there is an unevenness in the charge transfer ability throughout the photoconductive layer, an uneven image density appears. Particularly in case of halftone image, it is much pronounced, and thus a higher evenness has been required for the layer from the structural, electrical and optical viewpoints.

(4) Temperature of a light-receiving member for electrophotography changes due to the initiation state of an apparatus for heating the light-receiving member for electrophotography to stabilize an electrostatic latent image, fluctuation in the temperature control or change in the room temperature, and consequently the dark resistance changes, resulting in occurrence of uneven image density among the images when copy images are continuously obtained.

(5) Uneven image density has been often pronounced among the images due to fatigue caused by repeated use in the prolonged service.

(6) In the case of obtaining higher chargeabilty and sensitivity at the same time, smeared images have been liable to appear and it has been difficult to maintain image characteristics of high quality without any smeared image in the prolonged service.

As a result of recent improvements of the optical light exposure system, the developing system and a transfer system in electrophotographic apparatuses to improve the image characteristics of electrophotographic apparatuses, more improvements have been required also for light-receiving members for electrophotography. Particularly as a result of improvements in the image resolution, reduction of coarse images (unevenness in the fine image density zone) and reduction of spots (black or white spot image defects), particularly 10 reduction of fine spots, which have been so far disregarded, have been keenly desired.

Particularly, spots are due to abnormal growth of a film called "spherical projections", and it is important to reduce the number of the spherical projections. In case of continuous formation of a large number of images, more spots are observable sometimes on the later images than on the initial images as a phenomenon, and thus reduction of increased spots due to the prolonged service has been also desired.

The spots so generated include the so called "leak spots" generated by accumulation of transfer sheet powder on the charging wires of a shared electrostatic charger in case of continuous image formation, thereby inducing an abnormal discharge and bringing a portion of the light-receiving member for electrophotography to a dielectric breakdown. Furthermore, due to the abnormal growth of "spherical projections", etc. on the surface of the light-receiving member for electrophotography, the cleaning blade is damaged after repetitions of continuous image formation, resulting in poor cleaning and deterioration of image quality. Toners are accumulated on the charging wires of a shared electrostatic charger due to scattering of residual toners toward the shared electrostatic charger, and abnormal discharge is liable to be induced. This is also a cause of "leak spot" generation. Furthermore, dropoff of relative large abnormal growth parts due to friction between the light-receiving member for electrophotography and the transfer sheets or the cleaning blade is also a for the spot increase.

Other adverse influences include easy wearing of separator nail for separating the transfer sheets from the light-receiving member for electrophotography due to the abnormal growth and easy occurrence of transfer sheet clogging due to the separation failure.

Use of reprocessed sheets is now increasing even in the electrophotographic apparatuses as a result of the recent policy for protecting the global atmosphere. In case of reprocessed sheets, dusting of additives or paper powder from the paper-making process is more than in the case of conventional fresh paper making. For example, the surfaces of the light-receiving members for electrophotography are damaged by additives used as a bleaching agent for waste newspapers such as China clay, etc., or rosin, etc. used as a size (a surface-treating agent) deposit on the surfaces of the light-receiving members for electrophotography to causing fusion of toners or formation of smeared images. Thus, improvement of reprocessed sheet quality and at the same time further improvement of the surfaces of the light-receiving members for electrophotography have been also desired.

That is, from the viewpoint of reduction of image defects and durability of an image-forming apparatus, prevention of occurrence of abnormal growth as a reason for the image defects, an increase in the durability to a high voltage and a considerable increase in the durability under every circumstances have been required for the light-receiving member for electrophotography, while maintaining the electrical characteristics and photoconductive characteristics at higher levels.

Furthermore, when the photoconductive layer of a light-receiving member for electrophotography is formed at a higher deposition rate by a process for forming a deposition film such as a microwave plasma CVD process, which will be described later, to reduce the production cost of the light-receiving member for electrophotography, the film quality sometimes becomes uneven, or fine cracking or peeling sometimes appears on the a-Si film due to stresses within the film, resulting in yield reduction in the productivity.

Thus, improvements of characteristics of a-Si materials themselves have been attempted, and at the same time overall improvements of layer structure, chemical composition of each layer and processes for forming layers have been desired to solve the foregoing problems.

SUMMARY OF THE INVENTION

The present invention has been made in view of the foregoing problems and is directed to the problems encountered in a light-receiving member for electrophotography having a conventional light-receiving layer composed of materials containing silicon atoms as a matrix as described above.

That is, a primary object of the present invention is to provide a light-receiving member for electrophotography having a light-receiving layer composed of a material containing silicon atoms as a matrix, which is always substantially stable in the electrical characteristics, optical characteristics and photoconductive characteristics, substantially independently from the service circumstances, and distinguished in the light fatigue resistance, free from deterioration phenomena even when repeatedly used, and particularly distinguished in the image characteristics and durability with no observation or no substantial observation of residual potential.

Another object of the present invention is to provide a light-receiving member for electrophotography having a light-receiving layer composed of a material containing silicon atoms as a matrix, which shows an electrophotographic characteristic such as a sufficient charge-holding capacity at the electrostatic charging treatment for forming an electrostatic image and a very effective application to the ordinary electrophotographic process.

Another object of the present invention is to provide a light-receiving member for electrophotography having a light-receiving layer composed of a material containing silicon atoms as a matrix, which can readily produce a high quality image of high density, clear halftone and high resolution without any increase in the image defects, any smeared image and any toner fusion in the prolonged service.

A further object of the present invention is to provide a light-receiving member for electrophotography having a light-receiving layer composed of a material containing silicon atoms as a matrix, which has a high sensitivity, a high S/N ratio and a high durability to a high voltage.

Still another object of the present invention is to provide a light-receiving member for electrophotography having a light-receiving layer composed of a material containing silicon atoms as a matrix, which has a high density, particularly distinguished durability and moisture resistance without changes in the image defects and smeared images and with no substantial observation of residual potential in the prolonged service.

Still another object of the present invention is to provide a light-receiving member for electrophotography having a light-receiving layer composed of a material containing silicon atoms as a matrix, which is distinguished in the adhesiveness between a substrate and a layer laid on the substrate or among laminated layers and has a highly uniform layer quality.

DESCRIPTION OF THE PREFERRED EMBODIMENTS

Figure 1:
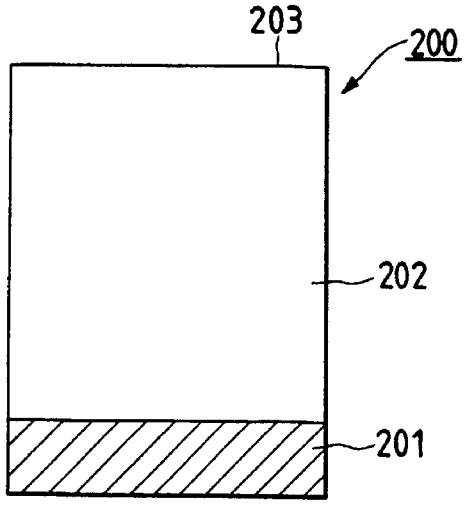
FIG. 1 PRIOR ART
FIG. 1 is a schematic cross-sectional view for illustrating a layer structure of a prior art light-receiving member.

The above-mentioned objects of the present invention can be attained by a light-receiving member for electrophotography, which comprises an electroconductive substrate, a photoconductive layer and a surface layer successively laid one upon another on the electroconductive substrate. The photoconductive layer is composed of a non-monocrystalline material containing silicon atoms as a matrix and containing at least carbon atoms, hydrogen atoms in and fluorine atoms the entire layer. The surface layer is composed of silicon atoms as a matrix and containing carbon atoms, hydrogen atoms and a halogen atom, and, if necessary, an element belonging to Group III of the Periodic Table at the same time, and, if necessary, further containing at least one of oxygen atoms and nitrogen atoms. The content of the carbon atoms in the photoconductive layer is uneven in the layer thickness direction and higher toward the electroconductive substrate and smaller toward the surface layer in each point in the layer thickness direction and is 0.5 to 50 atomic % on or near the surface of the photoconductive layer on the side of the electroconductive substrate and substantially 0% on the surface of the photoconductive layer on the side of the surface layer. The content of the fluorine atoms in the photoconductive layer is not more than 95 ppm, and the content of the hydrogen atoms in the photoconductive layer is 1 to 40 atomic %.

The content of the fluorine atoms in the photoconductive layer may be uneven in the layer thickness direction, and may be a maximum on or near the interface with the surface layer.

The above-mentioned objects of the present invention can be also attained by dividing the photoconductive layer into a first photoconductive layer on the side of the substrate and a second photoconductive layer on the side of the surface layer, that is, by using the photoconductive layer as a first photoconductive layer and providing thereon a second photoconductive layer composed of a non-monocrystalline material containing silicon atoms as a matrix.

Furthermore, the surface layer may contain carbon atoms, nitrogen atoms and oxygen atoms at the same time, and further may contain hydrogen atoms and a halogen atom. The sum total of contents of the carbon atoms, oxygen atoms and nitrogen atoms may be 40 to 90 atomic %, the content of the halogen atom may be not more than 90 atomic % and the sum total of the contents of the hydrogen atoms and the halogen atom may be 30 to 70 atomic %, on the basis of the sum total of the contents of the silicon atoms, carbon atoms and nitrogen atoms. "atomic %" is a percentage o based on the number of atoms and "atomic ppm" is parts per million based on the number of atoms.

The photoconductive layer may partially contain an element belonging to Group III of the Periodic Table or to Group V of the Periodic Table. The photoconductive layer preferably contains oxygen atoms and may have a portion containing the oxygen atoms in an uneven distribution state in the layer thickness direction. The content of the oxygen atoms in the photoconductive layer may be 10 to 5,000 atomic ppm.

The content of the fluorine atoms in the photoconductive layer is preferably 1 to 50 atomic ppm, and preferably 5 to 50 atomic ppm particularly in case of uneven distribution in the layer thickness direction.

In the surface layer, the carbon atoms, the halogen atom, the element belonging to Group III of the Periodic Table contained therein when required, and at least one of the oxygen atoms and the nitrogen atoms contained therein when required may be distributed in the layer thickness direction.

In the surface layer, the content of the carbon atoms on or near the surface of the surface layer may be 63 to 90 atomic % on the basis of the sum total of the contents of the silicon atoms and the carbon atoms.

In the surface layer, the content of the oxygen atoms may be not more than 30 atomic % and the content of the nitrogen atoms not more than 30 atomic %. The sum total of the contents of the oxygen atoms and the nitrogen atoms may not be more than 30 atomic % and the sum total of the contents of the hydrogen atoms and the halogen atom not more than 80 atomic %. The content of the element belonging to Group III of the Periodic Table may not be more than $1\times10^5$ atomic ppm.

When an element belonging to Group III of the Periodic table is not contained, it is preferable that oxygen atoms and nitrogen atoms are contained in the surface layer at the same time. In this case since an improvement of electrical characteristics due to the atoms belonging to Group III is reduced, the sum total of the contents of oxygen atoms and nitrogen atoms is preferably not more than 10 atomic %.

The present light-receiving member of the above-mentioned structure can solve the foregoing problems and shows very distinguished electrical characteristics, optical characteristics, photoconductive characteristics, image characteristics, durability and service circumstance characteristics.

The present light-receiving member for electrophotography can make smooth connection between generation of charges (photocarriers) and transport of the generated charges, i.e. important functions of the light-receiving member for electrophotography, by continuously changing the content of carbon atoms throughout the photoconductive layer from the side of the electroconductive substrate. It can prevent a charge travelling failure due to an optical energy gap between the charge generation layer and the charge transport layer, which is the problem of the so called functionally separated, light-receiving member, i.e. the conventional separated type of charge generation layer and charge transport layer, contributing to an increase in the photosensitivity and reduction in the residual potential.

Furthermore, since the photoconductive layer contains carbon atoms, the dielectric constant of the light-receiving layer can be decreased and consequently the electrostatic capacity per layer thickness can be reduced. That is, a higher chargeability and a remarkable improvement in the photosensitivity can be obtained, and the resistance to a high voltage can be also improved.

By making the content of carbon atoms in the electroconductive layer higher toward the electroconductive substrate side than toward the surface layer side, injection of charges from the electroconductive substrate into the photoconductive layer can be inhibited, and consequently the chargeability can be improved. Furthermore, the adhesiveness between the electroconductive substrate and the photoconductive layer can be improved to suppress peeling of the film and generation of fine defects.

In addition, the evenness of the deposition film can be improved by adding a trace amount (up to 95 ppm) of at least fluorine atoms to the photoconductive layer in the present invention, and consequently the carriers can travel uniformly through the a-SiC to improve the image characteristics such as ghosts and coarse images. By adding 10 to 5,000 atomic ppm of oxygen atoms to the photoconductive layer, the stress on the deposition film can be effectively lessened due to the resulting synergistic effect of fluorine atoms and oxygen atoms to suppress structural defects of the film. That is, travelling of carriers through the a-SiC can be improved thereby, and the surface potential characteristics such as potential shift, sensitivity, residual potential, etc. can be also improved. Image characteristics such as ghosts and coarse images can be also improved.

The present light-receiving member for electrophotography can drastically improve durability, while maintaining the electrical characteristics at a high level, by using the above-mentioned photoconductive layer. That is, film strain on the photoconductive layer can be effectively lessened and the adhesiveness of the film can be improved. At the same time the number of occurrences of abnormal growth can be drastically reduced, and even if a large number of image formations are carried out continuously, the cleaning blade and the separator nail are less damaged, resulting in improvement of cleanability and transfer paper separability. Thus, the durability of an image forming apparatus can be drastically improved. Furthermore, the durability to a high voltage can be improved due to the decrease in the dielectric constant, and the "leak spots" generated by dielectric breakdown of part of the light-receiving member for electrophotography appear much less.

Furthermore, in the present light-receiving member for electrophotography, at least fluorine atoms are distributed unevenly in the layer thickness direction throughout the photoconductive layer, and consequently changes in the internal stress generated between the electroconductive substrate side and the surface layer side due to changes in the content of carbon atoms in the layer thickness direction can be lessened and the defects in the deposition film are decreased, resulting in an increase in the film quality. As a result, changes in the characteristics of a light-receiving member for electrophotography due to changes in the service circumstance temperature, that is, the so-called temperature characteristics, can be improved, and such electrophotographic characteristics as unevenness in the chargeability and the image density among copy images can be improved.

Still furthermore, the present light-receiving member for electrophotography can drastically improve the durability with a high chargeability, a high sensitivity and a low residual potential without any ghost, any coarse image and any unevenness in the image density among copy images by using the above-mentioned photoconductive layer, while maintaining distinguished electrical characteristics.

When the surface layer is composed of silicon atoms, hydrogen atoms and halogen atoms as main constituent elements and further contains at least one of carbon atoms, oxygen atoms and nitrogen atoms and an element belonging to Group III of the Periodic Table, durability to a high voltage can be improved due to their synergistic effect. As a result, occurrences of "spots", etc. as image defects can be much reduced, even if there are spherical projections as abnormal growth of the film to some extent. It has been found in the durability test that, even if a shared electrostatic charger undergoes an abnormal electric discharge in the electrophotographic process, part of the light-receiving member never undergoes dielectric breakdown and occurrences of "leak spots" can be reduced.

Particularly, it has been found in the durability test for continuous image formation that occurrences of "leak spots" can be reduced, and distinguished wear resistance and moisture resistance as well as stable electrical characteristics can be obtained together with a high sensitivity and a high S/N ratio. Furthermore, owing to good repeated service characteristics and durability to a high voltage, a high image density and a good halftone can be obtained without any smeared image even during a prolonged service, and images of high quality with a high resolution can be obtained repeatedly and stably. Furthermore, a large allowance for service circumstances and a high reliability without such problems as toner fusion, etc., even if reprocessed paper sheets are used, can be obtained. Furthermore, the present light-receiving member for electrophotography can be also applied to image formation based on digital signals. "Spots" are liable to appear selectively at spherical projections as abnormal growth parts of a film, and thus reduction of the number of spherical projections and an increase in the durability to a high voltage of a light-receiving member, thereby suppressing occurrences of dielectric breakdown at the same time, are very effective for preventing occurrence of leak spots".

Still furthermore, when the surface layer composed of silicon atoms and hydrogen atoms as the main constituents further contains at least one of carbon atoms, oxygen atoms and nitrogen atoms and a halogen atom and an element belonging to Group III of the Periodic Table (at the same time in case of using reprocessed paper sheets in the durability test), it has been found that the surface hardness of the surface layer can be improved due to their synergistic effect. Occurrences of surface damages by additives in the reprocessed paper sheets can be prevented, and also deposition of sizes contained in the reprocessed paper sheets, such as rosin, etc., onto the surface of a light-receiving member can be effectively prevented. Fusion of toners and smeared images can be entirely eliminated during the prolonged service.

When at least one of carbon atoms and nitrogen atoms, oxygen atoms, a halogen atom and an element belonging to Group III of the Periodic Table are contained in the surface layer at the same time, an increase in the internal stress of the film can be prevented, even if the content of carbon atoms in the surface layer is made more than 63 atomic % on the basis of the sum total of contents of oxygen atoms and carbon atoms. Consequently the adhesiveness of the film can be improved, thereby preventing film peeling.

When the photoconductive layer is composed of a first photoconductive layer and a second photoconductive layer in the present invention, smooth connection can be obtained between the generation of charges (photocarriers) and transport of the generated charges as an important function for a light-receiving member for electrophotography by continuously changing concentration of carbon atoms from the electroconductive substrate side throughout the first photoconductive layer. Charge travelling failure due to an optical energy gap difference between the charge generation layer and the charge transport layer as a problem of the so-called functionally separated light-receiving member, that is, the conventional separated type of a charge generation layer and a charge transport layer, can be prevented, contributing to an increase in the photosensitivity and reduction in the residual potential. Furthermore, the absorbability of light of long wavelength can be improved by providing the second photoconductive layer containing no carbon atoms on the surface layer side, and an increase in the photosensitivity can be obtained.

Furthermore, the dielectric constant of the light-receiving layer can be decreased by adding carbon atoms to the photoconductive layer, and thus the electrostatic capacity per layer thickness can be reduced. That is, a remarkable improvement in the chargeability and the photosensitivity can be obtained, and also the durability to a high voltage can be improved.

Furthermore, the chargeability can be improved by providing more carbon atoms toward the substrate side in the photoconductive layer, thereby inhibiting inflection of charges from the substrate, and the adhesiveness between the substrate and the photoconductive layer can be improved, thereby suppressing film peeling and occurrence of fine defects.

In the present invention, carriers can evenly travel throughout the non-monocrystalline photoconductive layer containing silicon atoms and carbon atoms (nc-SiC) by adding a trace amount (up to 95 ppm) of at least fluorine atoms to the nc-SiC photoconductive layer, thereby improving the evenness of the deposited film. The image characteristics such as ghosts and coarse images can be improved thereby.

Furthermore, in the present invention, changes in the internal stress generated between the substrate side and the surface layer side due to changes in the content of carbon atoms in the layer thickness direction can be lessened by unevenly distributing at least fluorine atoms in the layer thickness direction throughout the nc-SiC photoconductive layer. The defects in the deposited layer can be decreased and the film quality can be improved thereby. As a result, changes in the characteristics of a light-receiving member due to changes in the service circumstance temperature of the light-receiving member, that is, the so-called temperature characteristics, can be improved, and such electrophotographic characteristics as unevenness in the chargeability and image density among copy images can be improved. Furthermore, oxygen atoms (O) may be contained in a range of 10 to 5,000 atomic ppm, and may be unevenly distributed in the layer thickness direction in the nc-SiC photoconductive layer. In that case, the stress on the deposition film can be effectively lessened due to the synergistic effect of fluorine atoms and oxygen atoms, and the structural defects of the film can be suppressed. That is, the travelling of carriers through the nc-SiC can be improved, and the surface potential characteristics such as potential shift, etc. can be improved.

With the present photoconductive layer, the durability can be drastically improved together with a high chargeability, a high sensitivity and a low residual potential without ghosts, smeared images and uneven image density among copy images, while maintaining the distinguished electrical characteristics.

Owing to the improvement in the film adhesiveness, the cleaning blade and separator nail are less damaged even if a large number of image formations are carried out continuously, and the cleanability and transfer sheet separability can be also improved. Thus, the durability of an image-forming apparatus can be drastically improved. Furthermore, owing to the decrease in the dielectric constant, the durability to a high voltage can be also improved, and "leak spots" caused by dielectric breakdown of part of the light-receiving member occur less.

That is, in the present invention, the hydrogen atoms and/or the halogen atom contained in the photoconductive layer compensate for the unbonded sites of silicon atoms to improve the layer quality and particularly effectively improve the photoconductive characteristics.

The foregoing effects are particularly remarkable when the layer formation is carried out at a high deposition rate, for example, by microwave CVD.

Since the surface layer of the present light-receiving member for electrophotography contains carbon atoms, hydrogen atoms and a halogen atom, and, if necessary, an element belonging to Group III of the Periodic Table at the same time and further contains at least one of oxygen atoms and nitrogen atoms, the surface strength can be drastically improved due to their synergistic effect. Particularly when the surface layer contains an element belonging to group III of the Periodic Table, the durability to a high voltage can be drastically improved. When reprocessed paper sheets are used in the durability test, it has been found that occurrence of surface damage due to the additives contained in the reprocessed paper sheets can be prevented owing to the improved surface strength. Furthermore, deposition of sizes much contained in the reprocessed paper sheets, such as rosin, etc. onto the surface of the light-receiving member for electrophotography can be effectively prevented, and fusion of toners and smeared images can be eliminated during the prolonged service. Since the durability to a high voltage can be much more improved by the presence of the element belonging to Group III of the Periodic Table, occurrences of image defects such as "spots", etc. can be much reduced even if there are spherical projections as abnormal growth of the film to some extent. Furthermore, it has been found in the durability test that even if the shared electrostatic charger undergoes abnormal electric discharge in the electrophotographic process, occurrences of "leak spots" can be much reduced without partial breakage of the light-receiving member for electrophotography.

The same effect can be obtained by adding either oxygen atoms or nitrogen atoms to the surface layer, or similar effect can be obtained by adding both oxygen atoms and nitrogen atoms thereto at the same time.

Furthermore, the surface layer can have a dense film of high mechanical strength by adding carbon atoms, oxygen atoms and nitrogen atoms to the surface layer at the same time. Surface water repellency of the light-receiving member can be increased by adding up to 20 atomic % of a halogen atom to the surface layer, and consequently the moisture resistance can be improved, resulting in less occurrence of smeared images in the circumstance of high temperature and humidity.

Owing to more dense film, injection of charges from the surface can be effectively inhibited in the electrostatic charging treatment, and thus the chargeability, service circumstance characteristics, durability and durability to a high voltage can be improved. Furthermore, owing to a decrease in the light absorption in the surface layer, the sensitivity can be improved. Still furthermore, accumulation of carriers at the interface between the photoconductive layer and the surface layer can be reduced, and thus occurrence of the smeared images can be suppressed even if the chargeability is maintained at a high level.

Embodiments

Embodiments of the present invention will be explained below, referring to drawings.

Figure 2:
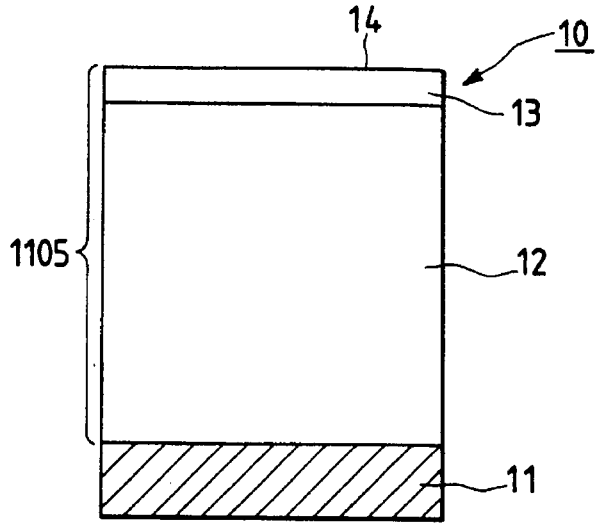
FIGS. 2 and 3 are respectively schematic cross-sectional views for illustrating layer structure of a light-receiving member according to the present invention.

FIG. 2 is a schematic cross-sectional view showing a structure of one embodiment of the present light-receiving member. The present invention will be explained below, referring to applications to a light-receiving member for electrophotography.

A light-receiving member 10 according to the present embodiment is identical with the conventional light-receiving member for electrophotography in the light-receiving layer comprising an electroconductive substrate 11, and a photoconductive layer 12 and a surface layer 13 (acting as a protective layer and a charge infection-inhibiting layer) laid successively on the electroconductive substrate 11. The structures of the photoconductive layer 12 and the surface layer 13 of the present invention will be briefly explained below:

(1) The photoconductive layer 12 is composed of a non-monocrystalline material comprising silicon atoms as a matrix body and at least hydrogen atoms and fluorine atoms throughout the entire layer, which will be hereinafter referred to as "nc-SiC (H,F)".

(2) The surface layer 13 comprises silicon atoms as a matrix body and contains carbon atoms, hydrogen atoms, a halogen atom, and, if necessary, an element belonging to Group III of the Periodic Table at the same time, and, if necessary, at least one of oxygen atoms and nitrogen atoms.

(3) In the photoconductive layer 12, the content of carbon atoms is uneven in the layer thickness direction and higher toward the electroconductive substrate 11 and lower toward the surface layer 13 at every point in the layer thickness direction, and 0.5 to 50 atomic % on or near the surface on the side of the electroconductive substrate 11 and substantially 0% on or near the surface on the side of the surface layer 13.

(4) In the photoconductive layer 12, the content of fluorine atoms is not more than 95 ppm.

(5) In the photoconductive layer 12, the content of hydrogen atoms is 1 to 40 atomic %.

(6) In the surface layer 13, sum total of the content of carbon atoms, oxygen atoms and nitrogen atoms is 40 to 90 atomic %.

(7) In the surface layer 13, the content of a halogen atom is not more than 20 atomic %.

(8) In the surface layer 13, sum total of the content of hydrogen atoms and a halogen atom is 30 to 70 atomic %, and the light-receiving layer has a free surface 14.

A charge injection-inhibiting layer may be provided between the electroconductive substrate 11 and the photoconductive layer 12.

Figure 3:
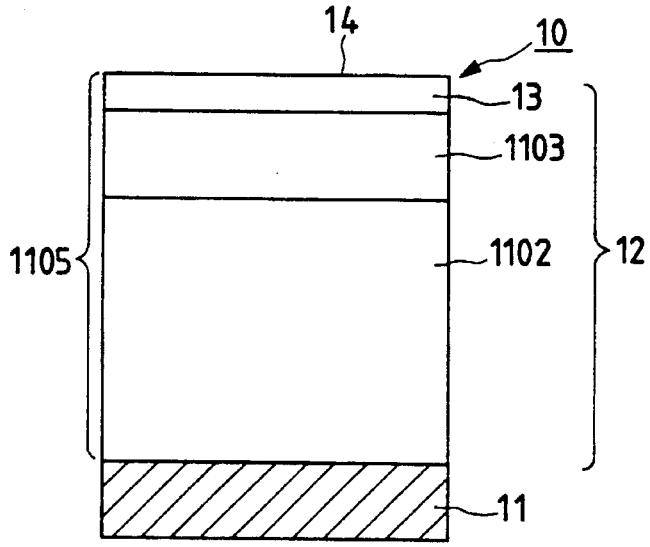

FIG. 3 is a schematic cross-sectional view showing another layer structure of the present light-receiving member.

The light-receiving member 10 for electrophotography shown in FIG. 3 comprises an electroconductive substrate 11, and a light-receiving layer 1105 having a layer structure comprising a first photoconductive layer 1102 composed of nc-SiC:H,F, a second photoconductive layer 1103 composed of nc-Si:H, and a surface layer 13 as a protective layer or as a charge inflection-inhibiting layer, laid on the electroconductive substrate 11, and the light-receiving layer 1105 has a free surface 14.

A charge inflection-inhibiting layer may be provided between the electroconductive substrate 11 and the photoconductive layer 12.

The respective constituents of the light-receiving member 10 according to this embodiment will be explained in detail below:

(1) Electroconductive substrate 11:

Materials for the electroconductive substrate 1 include such metals as Al, Cr, Mo, Au, In, Nb, Te, V, Ti, Pt, Pd, Fe, etc. and their alloys, for example, stainless steel. Furthermore, electrically insulating substrates such as films or sheets of synthetic resin such as polyester, polyethylene, polycarbonate, cellulose acetate, polypropylene, polyvinyl chloride, polystyrene, polyamide, etc., or glass, ceramics, etc. can be used upon electroconductive treatment of at least the surface on which the light-receiving layer is formed. It is more preferable to conduct an electroconductive treatment also of the opposite surface of the substrate to the surface on which the photoconductive layer 12 is formed.

The electroconductive substrate 11 can be in a cylindrical shape or a plate-like endless belt shape with a smooth surface or uneven surface, and can have a thickness as small as possible within such a range as to thoroughly show the function as the electroconductive substrate 11, when a flexibility is required for the light-receiving member 10 for electrophotography, and is usually 10 μm or more from the viewpoint of manufacture of the electroconductive substrate 11, handling and mechanical strength of the electroconductive substrate 11.

Particularly when image recording is carried out with an interference-inducing light such as a laser beam, etc., the surface of the electroconductive substrate 11 may be made uneven to eliminate the poor images due to the so-called interference striped patterns, which appear on the visible images. Uneven surface of electroconductive substrate 11 can be formed according to well known methods disclosed in Japanese Patent Application Laid-Open Nos. 60-168156, 60-178457, 60-225854, etc. The poor images due to the interference striped patterns with an interference-inducing light such as a laser beam, etc. can be eliminated by providing a plurality of spherical indents at uneven levels on the surface of an electroconductive substrate 11. That is, the surface of the electroconductive substrate 11 has finer unevenness than the resolving power required for the light-receiving member 10 for electrophotography, where the unevenness is due to a plurality of spherical indents. The unevenness due to a plurality of spherical indents can be formed on the surface of an electroconductive substrate 11 according to a well known method disclosed in Japanese Patent Application Laid-Open No. 61-231561.

(2) Photoconductive layer 12:

Photoconductive layer 12 is composed of nc-SiC(H,F), comprising silicon atoms as a matrix body and containing carbon atoms, hydrogen atoms and fluorine atoms, and has desired photoconductive characteristics, particularly charge-retaining characteristics, charge generation characteristics and charge transport characteristics.

The carbon atoms contained in the photoconductive layer 12 are distributed unevenly in the layer thickness direction, where the content of carbon atoms is higher toward the electroconductive substrate 11 and lower toward the surface layer 13 at every point in the layer thickness direction. When the content of carbon atoms is less than 0.5 atomic % on or near the surface on the side of the electroconductive substrate 11, the adhesiveness to the electroconductive substrate 11 and the charge injection-inhibiting function are deteriorated, losing an increase in the chargeability due to the reduction of the electrostatic capacity, whereas when the content of carbon atoms exceeds 50 atomic %, the residual potential is generated. Practically, when it is 0.5 to 50 atomic %, preferably 1 to 40 atomic %, more preferably 1 to 30 atomic %.

It is necessary that the photoconductive layer 12 contains hydrogen atoms, because hydrogen atoms are essential for compensation for unbonded sites of silicon atoms and an increase in the layer quality, particularly in the photoconductivity and charge-retaining characteristics. Particularly, when carbon atoms are contained, much more hydrogen atoms are required for maintaining the film quality. Thus, the content of hydrogen atoms is desirably adjusted according to the content of carbon atoms. That is, the content of hydrogen atoms on the surface on the side of an electroconductive substrate 11 is 1 to 40 atomic %, preferably 5 to 35 atomic %, more preferably 10 to 30 atomic %.

Fluorine atoms contained in the photoconductive layer 12 suppress aggregation of carbon atoms and hydrogen atoms contained in the photoconductive layer 12 and reduce localized level density in the band gap, resulting in improvement of ghosts and coarse images and an effective increase in the uniformity of the film quality. When the content of fluorine atoms is less than 1 atomic ppm, no effective increase in the ghosts and coarse images by fluorine atoms can be obtained fully, whereas when it exceeds 95 atomic ppm, the film quality is lowered, and ghost phenomena appear. Thus, practically, the content of fluorine atoms is 1 to 95 atomic ppm, preferably 3 to 80 atomic ppm, more preferably 5 to 50 atomic ppm.

It has been experimentally confirmed that particularly when the photoconductive layer 12 contains carbon atoms in the above-mentioned range, the photoconductive characteristics, image characteristics and durability can be considerably improved by setting the content of fluorine atoms to the above-mentioned range.

Furthermore, changes in the internal stress generated between the side of the electroconductive substrate 11 and that of the surface layer 13 due to the change in the content of carbon atoms in the layer thickness direction by uneven distribution of fluorine atoms in the layer thickness direction throughout the photoconductive layer 12 composed at least of nc-SiC can be lessened, resulting in the reduction of defects in the deposition film and the increase in the film thickness. As a result, changes in the characteristics of a light-receiving member 10 for electrophotography due to a change in the service circumstance temperature, that is, an increase in the so-called temperature characteristics, can be attained, resulting in the improvement of uneven image density between the copy images and also in the chargeability.

Furthermore, the photoconductive layer can contain oxygen atoms and the stresses on the deposition layer can be effectively lessened due to the synergistic action with fluorine atoms, and the film structural defects can be suppressed. Consequently, travelling of carriers through the a-SiC can be improved and the potential shift, that is, a problem encountered in an a-SiC photoconductive layer 12, can be reduced and the sensitivity and surface potential characteristics such as the residual potential, etc. can be also improved.

The photoconductive layer 12 can contain the oxygen atoms in an evenly distributed state through the photoconductive layer 12, or may contain the oxygen atoms partially in an unevenly distributed state in the layer thickness direction. When the content of oxygen atoms is less than 10 atomic ppm in the photoconductive layer, a further increase in the adhesiveness of the film and suppression of generation of abnormal growth cannot be fully obtained, and the potential shift is also increased. When it exceeds 5,000 atomic ppm, electrical characteristics that meet a higher speed required for the electrophotography are not satisfactory. Thus, it is preferable that the content of oxygen atoms is 10 to 5,000 atomic ppm.

Still furthermore, the stresses on the deposition film can be much more effectively lessened by unevenly distributing at least the oxygen atoms in the layer thickness direction throughout the photoconductive layer 12, and the film structural defects can be much more reduced. Thus, deterioration of the photoconductive layer 12 due to prolonged continuous service can be suppressed, and the electrophotographic characteristics such as sensitivity, residual potential, potential shift, etc. after the prolonged service can be significantly improved.

When the present photoconductive layer is composed of a first electroconductive layer 1102 and a second electroconductive layer 1103, the first electroconductive layer 1102 comprises nc-SiC:H,F composed of silicon atoms as a matrix body, and containing at least one of hydrogen atoms and/or a fluorine atom, and has desired photoconductive characteristics, particularly, charge-retaining characteristics, charge generation characteristics and charge transport characteristics. In that case, the above-mentioned photoconductive layer 12 in a single layer structure can be regarded as a first photoconductive layer 1102. That is, when the above-mentioned photoconductive layer 12 is regarded as a first photoconductive layer 1102 in this modified embodiment, a second photoconductive layer 1103 is formed on the photoconductive layer 12 (i.e. 1102) to form a two-layer structure, which corresponds to the photoconductive layer 12 of this modified embodiment. Thus, by presuming the photoconductive layer 12 explained, referring to the above-mentioned case of the photoconductive layer 12 of single layer, as a first photoconductive layer 1102, and the above-mentioned surface layer 13 as a second photoconductive layer 1103, the first photoconductive layer 1102 of this modified embodiment can be thoroughly described.

The photoconductive layer (or the first photoconductive layer 1102, which will be hereinafter referred to typically as "photoconductive layer 12") can be formed by a vacuum deposition film-forming process while setting numerical conditions for film-forming parameters properly so as to obtain the desired characteristics, for example, by any of thin film-depositing processes such as a glow discharge process (AC discharge CVD processes including a low frequency CVD process, a high frequency CVD process or a microwave CVD process, etc. or DC discharge CVD processes), a sputtering process, a vacuum vapor deposition process, an ion plating process, a photo CVD process, a heat CVD process, etc. One of these thin film deposition processes can be appropriately selected and used in view of such factors as production conditions, degree of load of plant capital investment, production scale, desired characteristics for a light-receiving member 10 for electrophotography to be produced, etc. Among them, a glow discharge process, a sputtering process and an ion plating process are preferable, because conditions for producing a light-receiving member 10 having desired characteristics can be more readily controlled. These processes may be used together in one reactor vessel to form the light-receiving layer. For example, a photoconductive layer 12 composed of nc-SiC(H,F) can be formed by a glow discharge process, that is, basically by introducing a Si source gas capable of supplying silicon atoms (Si), a C source gas capable of supplying carbon atoms (C), a H source gas capable of supplying hydrogen atoms (H), and a F source gas capable of supplying fluorine atoms (F) in desired gaseous states, respectively, into a reactor vessel, whose inside pressure can be reduced, and generating a glow discharge in the reactor vessel to form a layer composed of nc-SiC(H,F) on the predetermined surface of an electroconductive substrate 11 provided at a predetermined position.

Effective Si gas source materials include, for example, $SiH_4$, $Si_2H_6$, $Si_3H_8$, $Si_4H_{10}$, etc. in a gaseous state, and gasifiable silicon hydride (silanes). In view of easy handling during the layer formation and high Si supply efficiency, $SiH_4$ and $Si_2H_6$ are preferable. These Si source gases can be diluted with a gas such as $H_2$, He, Ar, Ne, etc., if necessary, before their application.

Carbon atom source raw materials are preferably those in a gaseous state at ordinary temperature and pressure or those easily gasifiable at least under the layer-forming conditions.

Effective gasifyable carbon atom (C) source materials include, for example, those comprising C and H as constituent atoms, such as saturated hydrocarbons having 1 to 5 carbon atoms, ethylenic hydrocarbons having 2 to 4 carbon atoms, and acetylenic hydrocarbons having 2 to 3 carbon atoms, and more specifically include methane ($CH_4$), ethane ($C_2H_6$), propane ($C_3H_8$), n-butane (n-$C_2H_{10}$), pentane ($C_5H_{10}$), etc. as saturated hydrocarbons; ethylene ($C_2H_4$), propylene ($C_3H_6$), butene-1 ($C_4H_8$), butane-2 ($C_4H_8$), isobutylene ($C_4H_8$), pantene ($C_5H_{10}$), etc. as ethylenic hydrocarbons; and acetylene ($C_2H_2$), methylacetylene ($C_3H_4$), butine ($C_4H_6$), etc. as acetylenic hydrocarbons.

Raw material gas comprising Si and C as constituent atoms include alkyl silicates such as $Si(CH_3)_4$, $Si(C_2H_5)_4$, etc.

Furthermore, carbon fluoride compounds such as $CF_4$, $CF_3$, $C_2F_6$, $C_3F_8$, $C_4F_8$, etc. can be used, because not only carbon atoms (C) but also fluorine atoms (F) can be introduced thereto at the same time.

Effective fluorine atom source gases include, for example, gaseous or gasifiable fluorine compounds such as a fluorine gas, fluorides, interhalogen compounds, and fluorine-substituted silane derivatives. Gaseous or gasifiable, fluorine atom-containing silicon hydride compounds comprising silicon atoms and fluorine atoms as constituent atoms are also effective.

Fluorine compounds include, for example, a fluorine gas ($F_2$), and interhalogen compounds such as BrF, ClF, $ClF_3$, $BrF_3$, $BrF_5$, $IF_3$, $IF_7$, etc. Preferable fluorine atom-containing silicon compounds, that is, fluorine atom-substituted silane derivatives, include, for example, silicon fluorides such as $SiF_4$, $Si_2F_6$, etc. When the present light-receiving member for electrophotography is formed by glow discharge with such a fluorine atom-containing silicon compound as mentioned above, a photoconductive layer 12 composed of nc-Si(H,F) containing fluorine atoms can be formed on a desired electroconductive substrate 11 without using any silicon hydride gas as a Si source gas, but it is desirable to form the layer by adding a predetermined amount of a hydrogen gas or a gas of hydrogen atom-containing silicon compound to the source gas to facilitate control of a proportion of hydrogen atoms to be introduced into the photoconductive layer 12. Not only single species but also a plurality of species in a predetermined mixing ratio of the respective gas species can be used.

As the fluorine atom source gas, the above-mentioned fluorides or fluorine-containing silicon compounds are used as effective ones. Furthermore, gaseous or gasifiable fluorine-substituted silicon hydrides, etc. such as HF, $SiH_3F$, $SiH_2F_2$, $SiHF_3$, etc. can be used as raw materials for forming an effective photoconductive layer 12. Since the hydrogen-containing fluorides among them can introduce fluorine atoms and also hydrogen atoms effective for controlling the electrical or photoconductive characteristics to the photoconductive layer 12 during its formation, the hydrogen-containing fluorides can be used as a suitable fluorine atom source gas.

Structural introduction of hydrogen atoms into the photoconductive layer 12 can be also carried out by providing $H_2$ or silicon halides such as $SiH_4$, $Si_2H_6$, $Si_3H_8$, $Si_4H_{10}$, etc. and silicon or a silicon compound capable of supplying Si together in the reactor vessel, and generating an electric discharge therein.

The amount of hydrogen atoms and/or fluorine atoms contained in the photoconductive layer 12 can be controlled, for example, by controlling the temperature of an electroconductive substrate 11, amounts of source materials capable of supplying hydrogen atoms or fluorine atoms into the photoconductive layer to the reactor vessel, discharge power, etc.

Effective oxygen atom source materials are those which are in a gaseous state at ordinary temperature and pressure or which can be readily gasified at least under conditions for forming the photoconductive layer 12, and include, for example, oxygen ($O_2$), ozone ($O_3$), nitrogen monoxide (NO), nitrogen dioxide ($NO_2$), dinitrogen monoxide ($N_2O$), dinitrogen trioxide ($N_2O_3$), dinitrogen tetroxide ($N_2O_4$), dinitrogen pentoxide ($N_2O_5$), etc. Furthermore, such compounds as CO, $CO_2$, etc. can be used, since carbon atoms (C) and oxygen atoms (O) can be introduced at the same time.

Structural introduction of hydrogen atoms (H) into the first photoconductive layer can be also carried out by providing $H_2$ or silicon hydrides such as $SiH_4$, $Si_2H_6$, $Si_3H_8$, $Si_4H_{10}$, etc. and silicon or a silicon compound for supplying Si together in the reactor vessel, and generating an electric discharge therein.

The amount of hydrogen atoms and/or fluorine atoms contained in the photoconductive layer 12 can be controlled, for example, by controlling the temperature of a substrate, amounts of source materials capable of supplying hydrogen atoms or fluorine atoms into the photoconductive layer to the reactor vessel, discharge power, etc.

It is preferable that the photoconductive layer 12 contains conductivity-controlling atoms (M), when required. The conductivity-controlling atoms may be distributed evenly throughout the photoconductive layer 12 or may be partly unevenly distributed in the layer thickness direction.

The conductivity-controlling atoms include the so-called impurities used in the field of semiconductors, for example, atoms belonging to Group III of the Periodic Table and giving p-type conduction characteristics (which will be hereinafter referred to as "atoms of Group III") or atoms belonging to Group V of the Periodic Table and giving n-type conduction characteristics (which will be hereinafter referred to as "atoms of Group V"). Atoms of Group III include, for example, B (boron), Al (aluminum), Ga (gallium), In (indium), Tl (thalium), etc., among which B, Al and Ga are preferable. Atoms of Group V include, for example, P (phosphorus), As (arsenic), Sb (antimony), Bi (bismuth), etc., among which P and As are preferable.

It is desirable that the content of conductivity-controlling atoms (M) in the photoconductive layer 12 is preferably $1\times10^{-3}$ to $5\times10^{4}$ atomic ppm, more preferably $1\times10^{\times2}$ to $1\times10^{4}$ atomic ppm, most preferably $1\times10^{-1}$ to $5\times10^{3}$ atomic ppm. It is particularly desirable that when the content of carbon atoms (C) is less than $1\times10^{3}$ atomic ppm in the photoconductive layer 12, the content of atoms (M) in the photoconductive layer 12 is preferably $1\times10^{-3}$ to $1\times10^{3}$ atomic ppm, and when the content of carbon atoms (C) exceeds $1\times10^{3}$ atomic ppm, the content of atom (M) is preferably $1\times10^{-3}$ to $5\times10^{4}$ atomic ppm. Structurally, introduction of conductivity-controlling atoms (atoms of Group III or V) into the photoconductive layer 12 can be carried out by introducing into a reactor vessel a raw material for introducing the atoms of Group III or V and also other gases for forming the photoconductive layer 12 during the formation of the layer. Desirable raw materials for introducing the atoms of Group III or V are those which are in a gaseous state at ordinary temperature and pressure or which can be readily gasified at least under the film-forming conditions.

The raw materials for introducing the atoms of Group III include, for example, boron hydrides such as $B_2H_6$, $B_4H_{10}$, $B_5H_9$, $B_5H_{11}$, $B_6H_{10}$, $B_6H_{12}$, $B_6H_{14}$, etc. and boron fluorides such as $BF_3$, $BCl_3$, $BBr_4$, etc. for the introduction of boron atoms. In addition, $AlCl_3$, $GaCl_3$, $Ga(CH_3)_3$, $InCl_3$, $TlCl_3$, etc. can be used. The raw materials for introducing the atoms of Group V include, for example, phosphorus hydrides such as $PH_3$, $P_2H_4$, etc. and phosphorus halides such as $PH_4I$, $PF_3$, $PF_5$, $PCl_3$, $PCl_5$, $PBr_3$, $PBr_5$, $PI_3$, etc. for the introduction of phosphorus atoms. Besides, $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_3$, etc. can be used as effective raw materials for the introduction of the atoms of Group V.

These raw materials for introducing the conductivity-controlling atoms can be diluted with a gas such as $H_2$, He, Ar, Ne, etc. before its application.

The photoconductive layer 12 may contain 0.1 to 10,000 atomic ppm of at least one element selected from Groups Ia, IIa, VIb and VIII of the Periodic Table. The element may be evenly distributed throughout the photoconductive layer 12, or may be partly unevenly distributed in the layer thickness direction, though contained throughout the photoconductive layer 12. In any case, however, it is desirable from the viewpoint of obtaining even characteristics in the in-plane direction that the element is evenly distributed in the in-plane direction parallel with the surface of the electroconductive substrate 11 (or the free surface of the light-receiving member).

Atoms of Group Ia include, for example, Li (lithium), Na (sodium), and K (potassium). Atoms of Group IIa include, for example, Be (beryllium), Mg (magnesium), Ca (calcium), SF (strontium), Ba (barium), etc. Atoms of Group VIb include, for example, CF (chromium), Mo (molybdenum), W (tungsten), etc. Atoms of Group VIII include, for example, Fe (iron), Co (cobalt), Ni (nickel), etc.

In the present invention, the thickness of the photoconductive layer 12 (or a first photoconductive layer 1102) is selected appropriately from the viewpoint of obtaining desired electrophotographic characteristics, chronological effect, etc., and is 5 to 50 μm, preferably 10 to 40 μm, more preferably 15 to 30 μm for the photoconductive layer 12.

In order to form a photoconductive layer 12 composed of nc-SiC(H,F) having characteristics that can attain the objects of the present invention, it is necessary to appropriately set the temperature of the electroconductive substrate 11 and the gas pressure in the reactor vessel to desired ones. An appropriate range for the temperature (Ts) of the electroconductive substrate 11 is selected according to the layer design, and is usually 20° to 500° C., preferably 50° to 480° C., more preferably 100° to 450° C. An appropriate range for the gas pressure in the reactor vessel is also selected according to the layer design, and is usually $1\times10^{-5}$ to 10 Torr, preferably $5\times10^{-5}$ to 5 Torr, more preferably $1\times10^{-4}$ to 1 Torr.

In the present invention, the temperature of the electroconductive substrate 11 and the gas pressure in the reactor vessel for forming the photoconductive layer 12 are in the above-mentioned ranges as desirable numerical ranges. These factors for forming the layer are usually not determined independently of each other, but it is desirable that optimum values are determined for the respective factors for forming each layer on the basis of mutual and organic correlations in the formation of a photoconductive layer 12 having the desired characteristics.

In the present light-receiving member 10 for electrophotography, a layer region, whose composition is continuously changed, may be provided between the photoconductive layer 12 and the surface layer 13, whereby the adhesiveness between the respective layers can be much more improved.

Furthermore, it is desirable that there is at least a layer zone containing aluminum atoms, silicon atoms, carbon atoms and hydrogen atoms in an unevenly distributed state in the layer thickness direction in the photoconductive layer 12 in a position toward the side of the electroconductive substrate 11.

In the present invention, the second photoconductive layer 1103 is composed of nc-Si:H containing silicon atoms and hydrogen atoms as constituent elements and has desired photoconductive characteristics, particularly charge generation characteristics and charge transport characteristics.

The second photoconductive layer 1103 is composed of a non-monocrystalline material of silicon atoms and hydrogen atoms and contains 1 to 40 atomic % of hydrogen atoms. The second photoconductive layer 1103 is provided to efficiently form photo carriers, increase absorption of light with a long wavelength and improve the sensitivity. Reduction of ghosts can be also obtained, because travelling of carriers having a reversed electrical polarity to the electrostatic charging polarity is better than that of the first photoconductive layer 1102.

In the present invention, the second photoconductive layer 1103 can be formed by a vacuum deposition film-forming process while setting numerical conditions for film-forming parameters properly so as to obtain the desired characteristics, for example, by any of thin film-depositing processes such as a glow discharge process (AC discharge CVD processes including a low frequency CVD process, a high frequency CVD process or a microwave CVD process, etc. or DC discharge CVD process), a sputtering process, a vacuum vapor deposition process, an ion plating process, a photo CVD process, a heat CVD process, etc. One of these thin film deposition processes can be appropriately selected and used in view of such factors as production conditions, degree of load of plant capital investment, production scale, desired characteristics for a light-receiving member for electrophotography to be produced, etc. Among them, a glow discharge process, a sputtering process and an ion plating process are preferable, because conditions for producing a light-receiving member having desired characteristics can be more readily controlled. These processes may be used together in one reactor vessel to form the light-receiving layer. For example, a second photoconductive layer can be formed by a glow discharge process, that is, basically by introducing a Si source gas capable of supplying silicon atoms and a H source gas capable of supplying hydrogen atoms (H) in desired gaseous state, respectively, into a reactor vessel, whose inside pressure can be reduced, and generating a glow discharge in the reactor vessel to form a desired layer on the predetermined surface of an electroconductive substrate 11 provided at a predetermined position.

Effective Si gas source material includes, for example, $SiH_4$, $Si_2H_6$, $Si_3H_8$, $Si_4H_{10}$, etc. in a gaseous state, and gasifiable silicon hydrides (silanes). In view of easy handling during the layer formation and high Si supply efficiency, $SiH_4$ and $Si_2H_6$ are preferable. These Si source gases can be diluted with a gas such as $H_2$, He, Ar, Ne, etc., if necessary, before their application.

It is desirable to form the layer by adding a predetermined amount of a hydrogen gas or a gas of hydrogen atom-containing silicon compound to the Si source gas to facilitate control of a proportion of hydrogen atoms to be introduced into the photoconductive layer. Not only single species but also a plurality of species in a predetermined mixing ratio to the respective gas species can be used.

Structural introduction of hydrogen atoms into the second photoconductive layer 1103 can be also carried out by providing $H_2$ or silicon halides such as $SiH_4$, $Si_2H_6$, $Si_3H_8$, $Si_4H_{10}$, etc. and silicon or a silicon compound capable of supplying Si together in the reactor vessel, and generating an electric discharge therein.

The amount of hydrogen atoms contained in the second photoconductive layer 1103 can be controlled, for example, by controlling the temperature of an electroconductive substrate 11, an amount of the source material capable of supplying hydrogen atoms into the second photoconductive layer to the reactor vessel, discharge power, etc.

In the present invention, it is preferable that the second photoconductive layer 1103 contains conductivity-controlling atoms (M), when required. The conductivity-controlling atoms may be distributed evenly throughout the second photoconductive layer 1103, or may be partly unevenly distributed in the layer thickness direction.

The conductivity-controlling atoms include the so-called impurities used in the field of semiconductors, for example, atoms belonging to Group III of the Periodic Table and giving p-type conduction characteristics (which will be hereinafter referred to as "atoms of Group III") or atoms belonging to Group V of the Periodic Table and giving n-type conduction characteristics (which will be hereinafter referred to as "atoms of Group V").

Atoms of Group III include, for example, B (boron), Al (aluminum), Ga (gallium), In (indium), Tl (thalium), etc., among which B, Al and Ga are preferable. Atoms of Group V include, for example, P (phosphorus), As (arsenic), Sb (antimony), Bi (bismuth), etc., among which P and As are preferable.

It is desirable that the content of conductivity-controlling atoms (M) in the second photoconductive layer 1103 is preferably $1\times10^{-3}$ to $5\times10^{4}$ atomic ppm, more preferably $1\times10^{-2}$ to $1\times10^{4}$ atomic ppm, most preferably $1\times10^{-1}$ to $5\times10^{3}$ atomic ppm.

Structural introduction of conductivity-controlling atoms, for example, atoms of Group III or V, into the second photoconductive layer 1103 can be carried out by introducing into a reactor vessel a raw material for introducing atoms of Group III or V and also other gases for forming the second photoconductive layer 1103 during the formation of the layer. Desirable raw materials for introducing the atoms of Group III or V are those which are in a gaseous state at ordinary temperature and pressure or which can be readily gasified at least under the film-forming conditions. The raw materials for introducing the atoms of Group III include, for example, boron hydrides such as $B_2H_6$, $B_4H_{10}$, $B_5H_9$, $B_5H_{11}$, $B_6H_{10}$, $B_6H_{12}$, $B_6H_{14}$, etc. and boron fluorides such as $BF_3$, $BCl_3$, $BBr_4$, etc. for the introduction of boron atoms. In addition, $AlCl_3$, $GaCl_3$, $Ga(CH_3)_3$, $InCl_3$, $TlCl_3$, etc. can be used.

The raw materials for introducing the atoms of Group V include, for example, phosphorus hydrides such as $PH_3$, $P_2H_4$, etc. and phosphorus halides such as $PH_4I$, $PF_3$, $PF_5$, $PCl_3$, $PCl_5$, $PBr_3$, $PBr_5$, $PI_3$, etc. for the introduction of phosphorus atoms. Besides, $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_5$, etc. can be used as effective raw materials for the introduction of the atoms of Group V.

These Paw materials for introducing the conductivity-controlling atoms can be diluted with a gas such as $H_2$, He, Ar, Ne, etc. before its application.

The second photoconductive layer 1103 of the present light-receiving member may contain 0.1 to 10,000 atomic ppm of at least one element selected from Groups Ia, IIa, VIb and VIII of the Periodic Table. The element may be evenly distributed throughout the second photoconductive layer 1103, or may be partly unevenly distributed in the layer thickness direction, though contained throughout the second photoconductive layer 1103.

Atoms of Group Ia include, for example, Li (lithium), Na (sodium) and K (potassium). Atoms of Group IIa include, for example, Be (beryllium), Mg (magnesium), Ca (calcium), Sr (strontium), Ba (barium), etc. Atoms of Group VIb include, for example, Cr (chromium), Mo (molybdenum), W (tungsten), etc. Atoms of Group VIII include, for example, Fe (iron), Co (cobalt), Ni (nickel), etc.

In the present invention, the thickness of the second photoconductive layer 1103 is selected appropriately from the viewpoints of obtaining desired electrophotographic characteristics, and economical effect, etc. and is preferably 0.5 to 15 μm, more preferably 1 to 10 μm, most preferably 1 to 5 μm.

In order to form a second photoconductive layer 1103 composed of nc-Si:H having characteristics that can attain the objects of the present invention, it is necessary to appropriately set the temperature of the electroconductive substrate 11 and the gas pressure in the reactor vessel to desired ones. An appropriate range for the temperature (Ts) of the substrate 11 is selected according to the layer design, and is usually 20° to 500° C., preferably 50° to 480° C., more preferably 100° to 450° C. An appropriate range for the gas pressure in the reactor vessel is also selected according to the layer design, and is usually $1\times10^{-5}$ to 10 Torr, preferably $5\times10^{-5}$ to 3 Torr, more preferably $1\times10^{-4}$ to 1 Torr.

In the present invention, the temperature of the substrate 11 and the gas pressure in the reactor vessel for forming the second electroconductive layer 1103 are in the above-mentioned ranges as desired numerical ranges. These factors for forming the layer are usually not determined independently of each other, but it is desirable that optimum values are determined for the respective factors for forming each layer on the basis of mutual and organic correlations in the formation of a second photoconductive layer 1103 having the desired characteristics.

In the present light-receiving member, a layer region, whose composition is continuously changed, may be provided between the second photoconductive layer and the surface layer, whereby the adhesiveness between the respective layers can be much more improved.

(3) Surface layer 13:

The surface layer 13 is composed of a nonsingle crystal material of silicon atoms and hydrogen atoms as constituent elements, further containing at least carbon atoms, a halogen atom and, if necessary, an element belonging to Group III of the Periodic Table at the same time, and, if necessary, at least one of oxygen atoms and nitrogen atoms.

Silicon atoms, hydrogen atoms, carbon atoms, a halogen atom, and an element belonging to Group III, oxygen atoms and nitrogen atoms, when required, contained in the surface layer 13 may be evenly distributed throughout the layer, or may be partly unevenly distributed in the layer thickness direction. In any case it is desirable in view of obtaining evenness in the characteristics that they are evenly distributed in the in plane direction parallel with the surface of the electroconductive substrate (or free surface of the light-receiving member).

Owing to the addition of silicon atoms, hydrogen atoms, carbon atoms, a halogen atom, and an element of Group III and at least one of oxygen atoms and nitrogen atoms, when required, to the surface layer 13 at the same time, the durability to a high voltage can be improved and suppression of the generation of "spots" and "leak spots" over a prolonged service can be obtained due to their synergistic effect. It has been found in the durability test that, when reprocessed paper sheets are used, the surface hardness and circumstance resistance characteristics can be improved by adding carbon atoms and a halogen atom, and an element of Group III and at least one of oxygen atoms and nitrogen atoms, when required, to the surface layer 13 of silicon atoms and hydrogen atoms as constituent elements at the same time. Thus deposition of a size in the reprocessed paper sheets, such as rosin, etc. onto the surface of the light-receiving member 10 for electrophotography can be prevented and fusion of toners and smeared images in the prolonged service can be effectively eliminated. The same effect can be obtained with any one of the oxygen atoms and nitrogen atoms, and a similar effect can be obtained when both are used, The surface hardness of the surface layer 13 can be more improved when the content of carbon atoms on or near the topmost surface is 63 atomic % or more on the basis of sum total of the contents of silicon atoms and carbon atoms. Injection of charges from the surface when subjected to an electrostatic charging treatment can be effectively inhibited, and the chargeability and durability can be improved. When the content of carbon atoms exceeds 90 atomic % on the basis of the above-mentioned sum total, the sensitivity is lowered. Thus, the content of carbon atoms on or near the topmost surface of the surface layer 13 is preferably 63 to 90 atomic %, more preferably 63 to 86 atomic %, most preferably 63 to 83 atomic % on the basis of sum total of the contents of silicon atoms and carbon atoms.

By adding carbon atoms, a halogen atom, an element of Group III of the Periodic Table and at least one of oxygen atoms and nitrogen atoms to the surface layer 13 at the same time, the stress on the deposition film can be effectively lessened and thus the adhesiveness of the film can be improved. That is, peeling of the film due to the stress on the film can be prevented, even if the content of carbon atoms on or near the topmost surface of the surface layer 13 exceeds 63 atomic % on the basis of sum total of silicon atoms and carbon atoms.

It is desirable that the content of oxygen atoms is preferably $1\times10^{-4}$ to 30 atomic %, more preferably $3\times10^{-4}$ to 20 atomic % and the content of nitrogen atoms is preferably $1\times10^{-4}$ to 30 atomic %, more preferably $3\times10^{-4}$ to 20 atomic %. When both oxygen atoms and nitrogen atoms are contained at the same time, it is desirable that the sum total of the contents of these two atom species is preferably $1\times10^{-4}$ to 30 atomic %, more preferably $3\times10^{-4}$ to 20 atomic %.

Hydrogen atoms and halogen atom contained in the surface layer 13 compensate for the unbonded sites existing in nc-SiC(H,F), giving an increase in the film quality and reducing the amount of carriers trapped on the interface between the photoconductive layer 12 and the surface layer 13, thereby eliminating smeared images. Furthermore, the halogen atom can improve the water repellency of the surface layer 13 and thus can reduce occurrence of smearing under a high humidity condition due to absorption of water vapor. It is desirable that the content of halogen atom in the surface layer 13 is preferably not more than 20 atomic % and the sum total of the contents of hydrogen atoms and halogen atom is preferably 15 to 80 atomic %, more preferably 20 to 75 atomic %, most preferably 25 to 70 atomic %.

An element of Group III to be added thereto, when required, includes B (boron), Al (aluminum), Ga (gallium), In (indium), Tl (thalium), etc., among which B, Al and Ga are particularly preferable. It is desirable that the content of element of Group III is preferably $1\times10^{-5}$ to $1\times10^{5}$ atomic ppm, more preferably $5\times10^{-5}$ to $5\times10^{4}$ atomic ppm, most preferably $1\times10^{-4}$ to $3\times10^{4}$ atomic ppm.

The surface layer 13 may contain 0.1 to 10,000 atomic ppm of at least one element selected from Groups Ia, IIa, VIb and VIII of the Periodic Table. The element may be evenly distributed throughout the surface layer 13 or may be partly unevenly distributed in the layer thickness direction, though distributed throughout the surface layer 13. In any case, it is preferable from the viewpoint of obtaining evenness of characteristics in the in-plane direction that the element is evenly distributed throughout the surface layer in the in-plane direction parallel with the surface of the substrate (or free surface of the light-receiving member).

Atoms of Group Ia include, for example, Li (lithium), Na (sodium), K (potassium), etc. Atoms of Group IIa include, for example, Be (beryllium), Mg (magnesium), Ca (calcium), Sr (strontium), Ba (barium), etc. Atoms of Group VIb include, for example, Cr (chromium), Mo (molybdenum), W (tungsten), etc. Atoms of Group VIII include, for example, Fe (iron), Co (cobalt), Ni (nickel), etc.

However, the surface layer is composed of a non-monocrystalline material containing silicon atoms, carbon atoms, nitrogen atoms and oxygen atoms as constituent elements at the same time, and further containing hydrogen atoms and a halogen atom. That is, the surface layer may not substantially contain the above-mentioned conductivity-controlling element.

When the surface layer contains no such atoms of Group III, carbon atoms, oxygen atoms and nitrogen atoms may be evenly distributed throughout the surface layer or may be partially unevenly distributed, though distributed in the layer thickness direction throughout the surface layer. However, it is desirable from the viewpoint of obtaining evenness of the characteristics in the in-plane direction that they are evenly distributed throughout the surface layer in the in-plane direction parallel with the surface of the substrate (or free surface of the light-receiving member).

The carbon atoms, oxygen atoms and nitrogen atoms contained at the same time throughout the surface layer can give such remarkable effects as a higher dark resistance, a higher hardness, etc. It is desirable that the sum total of the contents of carbon atoms, oxygen atoms and nitrogen atoms contained in the surface layer is preferably 40 to 90 atomic % more preferably 45 to 85 atomic %, most preferably 50 to 80 atomic % o on the basis of sum total of the contents of silicon atoms, carbon atoms, oxygen atoms and nitrogen atoms. In order to obtain much higher effects of the present invention, the sum total of the contents of oxygen atoms and nitrogen atoms is preferably not more than 10 atomic %.

Effective Si gas source materials include, for example, $SiH_4$, $Si_2H_6$, $Si_3H_8$, $Si_4H_{10}$, etc. in a gaseous state and gasifiable silicon hydrides (silanes). $SiH_4$ and $Si_2H_6$ are preferable from the viewpoint of easy handling and Si supply efficiency during the film formation. These Si source gas may be diluted with such a gas as $H_2$, He, Ar, Ne, etc. before application.

Preferable raw materials capable of introducing carbon atoms are those which are in a gaseous state at ordinary temperature and pressure or those which can be readily gasified at least under the layer-forming conditions. Effective raw material gases for introducing carbon atoms (C) include hydrocarbons composed of C and H as constituent elements, that is, saturated hydrocarbons having 1 to 5 carbon atoms, ethylenic hydrocarbons having 2 to 4 carbon atoms, acetylenic hydrocarbons having 2 to 3 carbon atoms, etc. Specifically, saturated hydrocarbons include methane ($CH_4$), ethane ($C_2H_6$), propane ($C_3H_8$), n-butane (n-$C_2H_{10}$), pentane ($C_5H_{12}$), etc. Ethylenic hydrocarbons include ethylene ($C_2H_4$), propylene ($C_3H_6$), butene-1 ($C_4H_8$), butene-2 ($C_4H_8$), isobutylene ($C_4H_8$), pentene ($C_5H_{10}$), etc. Acetylenic hydrocarbons include acetylene ($C_2H_2$), methylacetylene ($C_3H_4$), butene ($C_4H_6$), etc.

Source gases composed of Si and C as constituent elements include alkyl silicates such as $Si(CH_3)_4$, $Si(C_2H_5)_4$, etc. In addition, carbon fluoride compounds such as $CF_4$, $CF_3$, $C_2F_6$, $C_3F_8$, $C_4F_8$, etc. can be used, because they can introduce carbon atoms (C) and fluorine atoms (F) at the same time.

Effective source materials capable of introducing oxygen atoms (O) and/or nitrogen atoms (N) include, for example, oxygen ($O_2$), ozone ($O_3$), nitrogen ($N_2$), nitrogen dioxide ($NO_2$), dinitrogen monoxide ($N_2O$), dinitrogen trioxide ($N_2O_3$), dinitrogen tetroxide ($N_2O_4$), dinitrogen pentoxide ($N_2O_5$), etc. Furthermore, such compounds as CO, $CO_2$, etc. can be used, since carbon atoms (C) and oxygen atoms (O) can be supplied at the same time.

Effective halogen atom source gases include, for example, gaseous or gasifiable halogen compounds such as a halogen gas, halides, halogen-containing interhalogen compounds, halogen-substituted silane derivatives, etc. Furthermore, gaseous or gasifiable halogen atoms-containing silicon hydride compounds, composed of silicon atom and a halogen atom as constituent elements can be effectively used. The halogen compounds suitable for use in the present invention include, for example, a fluorine gas ($F_2$), and interhalogen compounds such as BrF, ClF, $ClF_3$, $BrF_3$, $BrF_5$, $IF_3$, $IF_7$, etc. Preferable halogen atom-containing silicon compounds, that is, the so called halogen atom-substituted silane derivatives, include, for example, silicon fluorides such as $SiF_4$, $Si_2F_6$, etc. When the present light-receiving member for electrophotography is formed by glow discharge, etc. with such a halogen atom-containing silicon compound as mentioned above, a surface layer containing a halogen atom can be formed without using the silicon hydride gas as a Si source gas. However, it is desirable to form the layer by adding a desired amount of a hydrogen gas or a gas of hydrogen-containing silicon compound to these source gases to facilitate better control of a proportion of hydrogen atoms to be introduced into the resulting surface layer. Not only single species but also a plurality of species in a predetermined mixing ratio of the respective gas species can be used.

In the present invention, as the halogen atom source gas, the above-mentioned halides or halogen-containing silicon compounds can be used as effective source gases. Furthermore, gaseous or gasifiable materials such as halogen-substituted silicon hydrides, for example, HF, $SiH_3F$, $SiH_2F_2$, $SiHF_3$, etc. can be also used as effective source materials for forming the photoconductive layer, among which the hydrogen atom-containing halides can be used as suitable halogen atom source gases, because the hydrogen atom-containing gas can introduce halogen atoms and very effective hydrogen atoms for control of electrical or photoelectrical characteristics at the same time during the formation of the photoconductive layer.

Structural introduction of hydrogen atoms into the surface layer 13 can be also carried out by providing $H_2$ or silicon hydrides such as $SiH_4$, $Si_2H_6$, $Si_3H_8$, $Si_4H_{10}$, etc., and silicon or a silicon compound capable of supplying Si together into the reactor vessel and generating an electric discharge therein.

It is desirable from the viewpoint of obtaining the desired electrophotographic characteristics, and chronological effects, etc. that the thickness of the surface layer 13 is preferably 0.01 to 30 μm, more preferably 0.05 to 20 μm, most preferably 0.1 to 10 μm.

The surface layer 13 can be formed by the same vacuum deposition process as used for the formation of the photoconductive layer 12.

In case of forming the surface layer 13 having characteristics that can attain the objects of the present invention, temperature of the electroconductive substrate 11 and gas pressure in the reactor vessel are important factors that influence the characteristics of the surface layer 13. An appropriate range can be properly selected for the temperature of the electroconductive substrate 11, and is preferably 20° to 500° C., more preferably 50° to 480° C., most preferably 100° to 450° C. An appropriate range can be also properly selected for the gas pressure in the reactor vessel, and is preferably $1\times10^{-5}$ to 10 Torr, more preferably $5\times10^{-5}$ to 3 Torr, most preferably $1\times10^{-4}$ to 1 Torr.

The above-mentioned ranges for the temperature of the electroconductive substrate 11 and the gas pressure in the reactor vessel are desirable numerical ranges for forming the surface layer 13, but these layer-forming factors are usually not determined independently of each other, and it is desirable to determine optimum values for the respective factors for forming the layer on the basis of mutual and organic correlations in the formation of a surface layer 13 having the desired characteristics.

Figure 4:
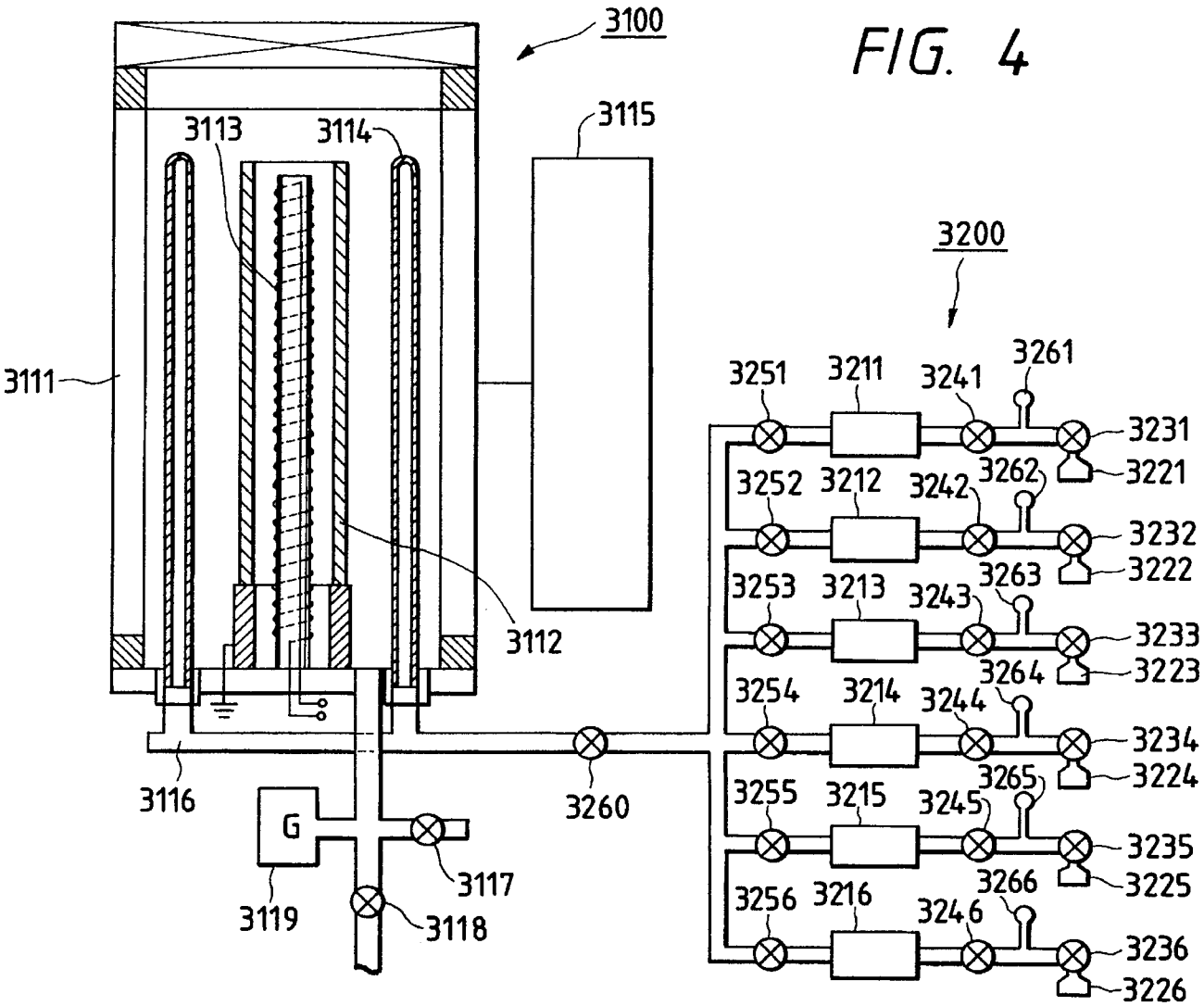
FIGS. 4 to 7 are respectively schematic structural views for illustrating one embodiment of apparatus for producing a light-receiving member.

An apparatus and process for forming deposited films by a high frequency plasma CVD process or a microwave plasma CVD process will be explained in detail below:

FIG. 4 is a schematic structural view of an apparatus for producing a light-receiving member for electrophotography by a high frequency plasma CVD process (which will be hereinafter referred to as "RFP-CVD process") according to one embodiment of the present invention.

The apparatus for forming deposited film by a RF-PCVD process comprises a deposition unit 3100, a source gas supply unit 3200 and an evacuating unit (not shown) for reducing the pressure in a reactor vessel 3111 in the deposition unit 3100.

In the reactor vessel 3111, a cylindrical substrate 3112, a heater 3113 for heating the substrate, and source gas inlet pipes 3114 are provided. The reactor vessel 3111 is connected to a high frequency matching box 3115. The source gas supply unit 3200 comprises gas cylinders 3221 to 3226 each for the respective source gases such as $SiF_4$, $H_2$, $CH_4$, NO, $NH_3$,$SiF_4$, etc., respective valves 3231 to 3236, respective inflow valves 3241 to 3246, respective outflow valves 3251 to 3256, and respective mass flow controllers 3211 to 3216, where the gas cylinders 3221 to 3226 for the respective source gases are connected to the gas inlet pipes 3114 in the reactor vessel 3111 through an auxiliary valve 3260.

Deposited films can be formed in the apparatus in the following manner:

The cylindrical substrate 3112 is set in the predetermined position in the reactor vessel 3111, and the inside of the reactor vessel 3111 is evacuated by an evacuating unit, not shown in FIG. 4, for example, a vacuum pump. Then, the cylindrical substrate 3112 is controlled to a desired temperature between 20° and 500° C. by the heater 3113 for heating the substrate. Source gases for forming deposited films are led into the reactor vessel 3111 by confirming that the valves 3231 to 3236 at the respective gas cylinders 3221 to 3226 and a leak valve 3117 of the reactor vessel are closed and that the respective inflow valves 3241 to 3246, the respective outflow valves 3251 to 3256 and the auxiliary valve 3260 are opened. Then a main valve 3118 is opened to evacuate the insides of the reactor vessel 3111 and the gas piping 3116. The auxiliary valve 3260 and the respective outflow valves 3251 to 3256 are closed when a vacuum meter 3119 indicates about $5\times10^{-6}$ Torr, and the respective valves 3231 to 3236 are slowly opened to introduce the respective source gases from the respective gas cylinders 3221 to 3226, adjusting the respective gas pressures each to 2 kg/cm$^2$ by respective gas controllers 3261 to 3266, and then slowly opening the respective inflow valves 3241 to 3246 to introduce the respective source gases into the respective mass flow controllers 3211 to 3216.

After the film-forming preparation has been completed as above, each of the photoconductive layer 12 and the surface layer 13 are formed on the cylindrical substrate 3112.

When the cylindrical substrate 3112 reaches a desired temperature, necessary valves of the respective outflow valves 3251 to 3256 and the auxiliary valve 3260 are slowly opened to introduce the desired source gases into the reactor vessel 3111 from the respective gas cylinders 3221 to 3226 through the gas inlet pipes 3114. Then, the respective source gases are adjusted to the desired flow rates by the respective mass flow controllers 3211 to 3216. At the same time, the opening of the main valve 3118 is adjusted while watching the vacuum meter 3119 so as to bring the pressure in the reactor vessel 3111 to a desired pressure under 1 Torr. When the inside pressure is stabilized, an RF power source, not shown in the drawing, is set to a desired power and the RF power is applied to the reactor vessel 3111 through the high frequency matching box to generate an RF glow discharge. The respective source gases introduced into the reactor vessel 3111 are decomposed by the discharge energy to form a desired deposited film composed of silicon as the main component on the cylindrical substrate 3112. After formation of desired film thickness, the application of the RF power is discontinued. The respective outflow valves 3251 to 3256 are closed to discontinue inflow of the respective source gases into the reactor vessel 3111, where the formation of the deposited film is completed.

By conducting a plurality of runs of the similar procedure, the desired light-receiving layer of multilayer structure can be formed.

In the formation of the respective layers, other outflow valves than the necessary ones are all closed among the outflow valves 3251 to 3256. In order to avoid retaining the respective source gases in the reactor vessel 3111 and piping from the respective outflow valves 3251 to 3256 to the reactor vessel 3111, the respective outflow valves 3251 to 3256 are closed, while the auxiliary valve 3260 is opened, and the main valve 3118 is fully opened to evacuate the entire system to a high vacuum, when required. In order to obtain evenness in the film formation, the cylindrical substrate 3112 is made to rotate at a desired speed by a dividing unit, not shown in the drawing, during the film formation.

The source gas species and the respective valve operations can be changed according to conditions for forming the respective layers.

The cylindrical substrate 3112 can be heated by any heater working in vacuum, for example, an electrical resistance heater such as a coiled heater, a plate heater, a ceramic heater, etc. of sheathed heater type; a heat radiation lamp heater such as a halogen lamp, an ultraviolet lamp, etc.; a heater based on a heat exchange means using a liquid, a gas, etc. as a heating means, etc. Surface materials for the heater can be metals such as stainless steel, nickel, aluminum, copper, etc., ceramics, heat-resistant polymer resins, etc. In addition, such a process comprising providing a vessel destined only to heating besides the reactor vessel 3111, heating the cylindrical substrate 3112 therein, and conveying the heated cylindrical substrate 3112 to the reactor vessel 3111, while keeping the substrate in vacuum can be used.

A process for forming a light-receiving member for electrophotography by a microwave plasma CVD (which will be hereinafter referred to as "μW-PCVD process") will be explained below.

Figure 5:
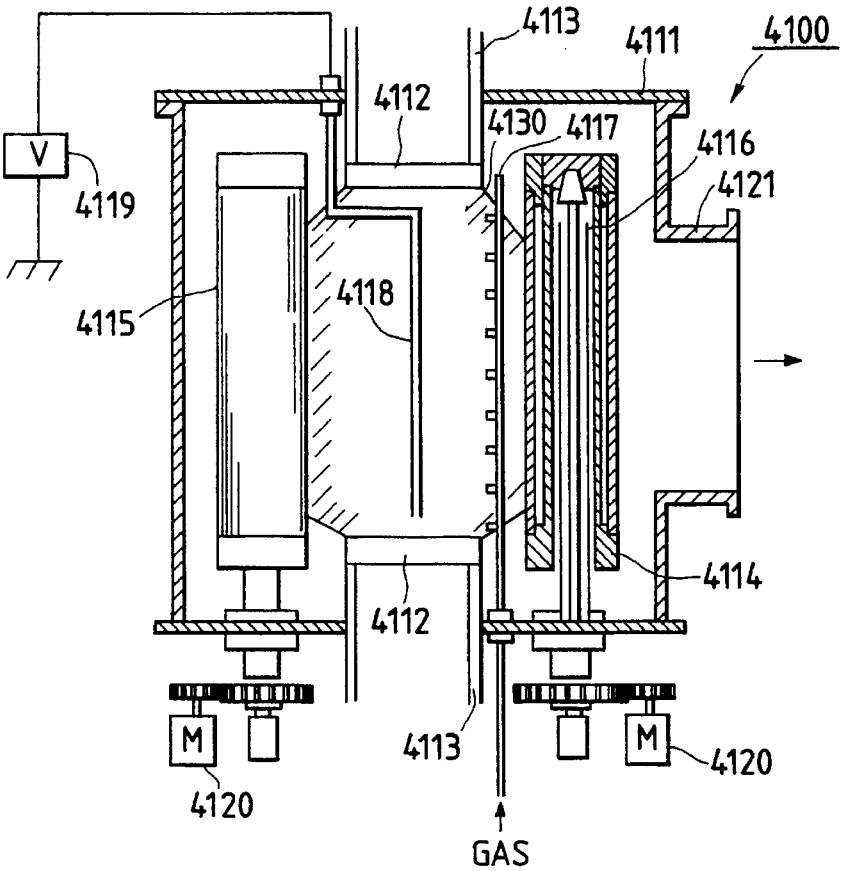
Figure 6:
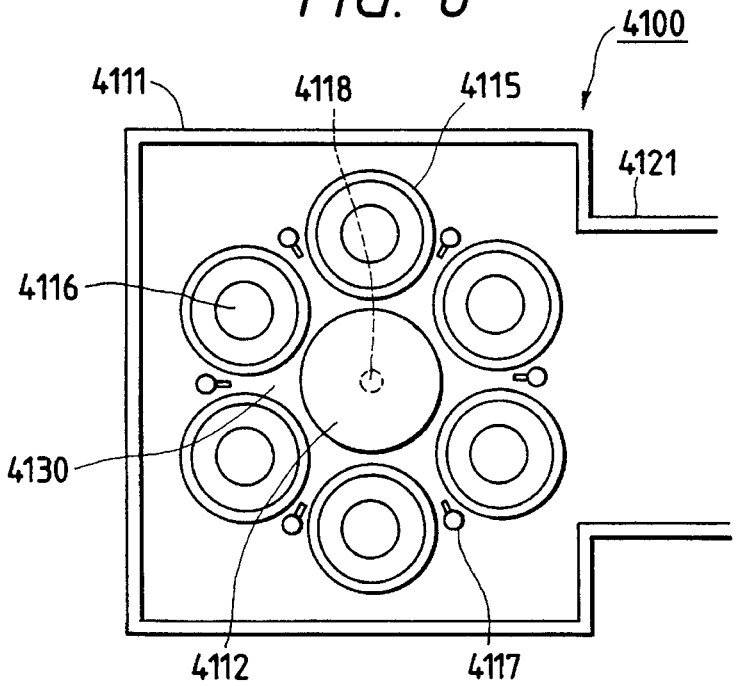

FIGS. 5 and 6 are schematic structural views of a reactor vessel for forming deposited films for a light-receiving member for electrophotography by the μW-PCVD process according to the present invention.

Figure 7:
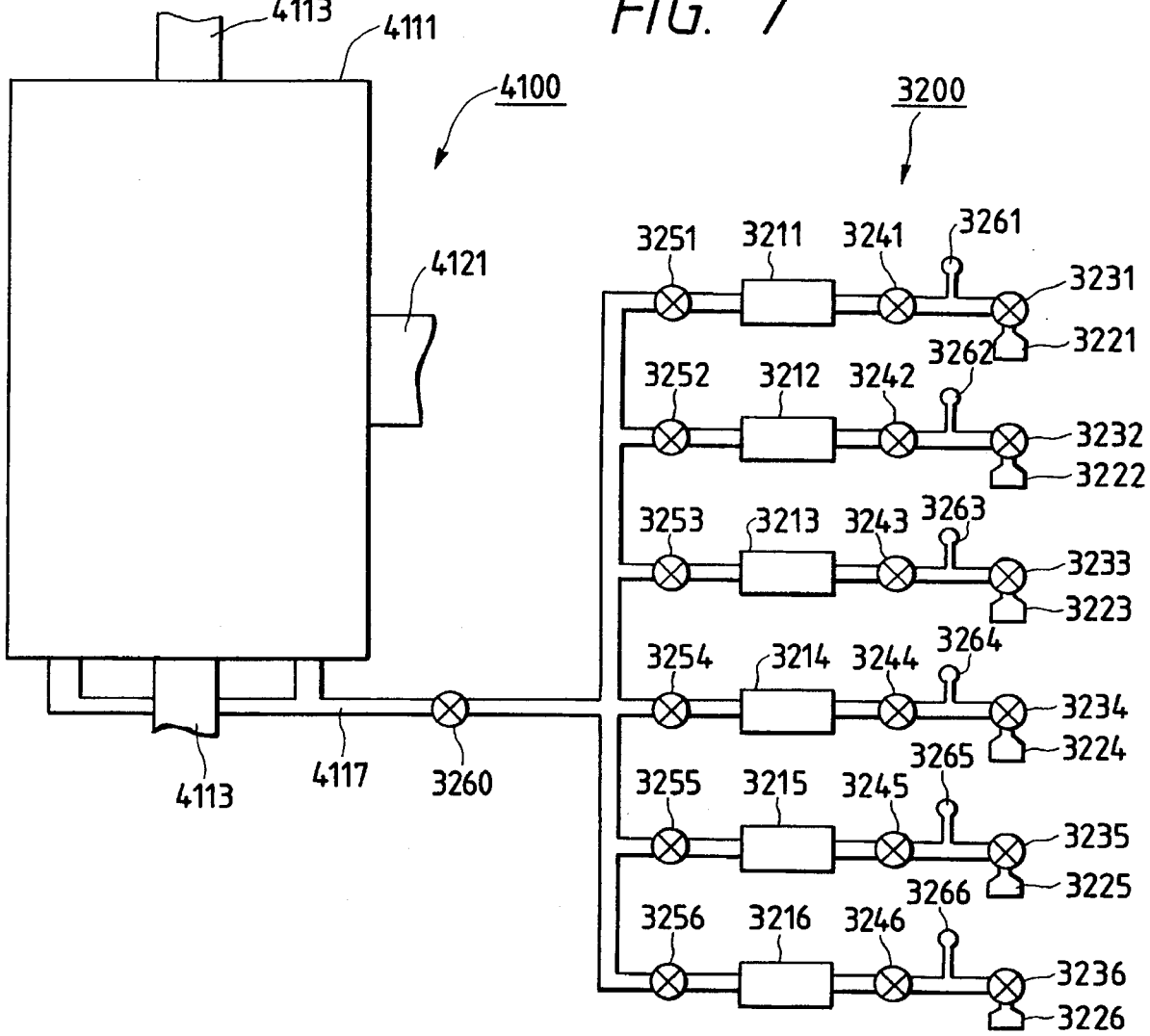

FIG. 7 is a schematic view for producing a light-receiving member for electrophotography by the μW-PCVD process according to the present invention. The reactor vessel for forming deposited films can be of any shape, for example, a circular cylindrical, square cylindrical or polygonal cylindrical shape.

By replacing the unit 3100 for forming a deposited films by a RF-PCVD process in the apparatus shown in FIG. 4 with a unit 4100 for forming deposited film shown in FIG. 7 and connecting the unit 4100 to the unit 3200 for supplying source gases, an apparatus for producing a light-receiving member for electrophotography of the following structure by a μW-PCVD process can be obtained.

The apparatus comprises a reactor vessel 4111 of vacuum, gas-tight structure, whose inside pressure can be reduced, a unit 3200 for supplying source gases, and an evacuation unit (not shown in the drawing) for reducing the inside pressure of the reactor vessel 4111. In the reactor vessel 4111, microwave-introducing windows 4112 capable of efficiently transmitting microwave power into the reactor vessel 4111, made from a material capable of keeping a vacuum gas tightness (such as quartz glass, alumina ceramics, etc.); a stub tuner (not shown in the drawing); a microwave guide tube 4113 connected to a microwave power source (not shown in the drawing) through an isolator (not shown in the drawing); cylindrical substrates 4115, on which deposited films are formed, as shown in FIG. 6; heaters 4116 for heating the substrates; source gas inlet pipes 4117; and an electrode 4118 capable of giving an external electrical bias for controlling the plasma potential are provided. The inside of the reactor vessel 4111 is connected to a diffusion pump (not shown in the drawing) through an evacuation pipe 4121. The unit 3200 for supplying source gases comprises gas cylinders 3221 to 3226 for the respective source gases such as $SiH_4$, $H_2$, $CH_4$, NO, $NH_3$,$SiF_4$, etc., the respective valves 3231 to 3236, the respective inflow valves 3241 to 3246, the respective outflow valves 3251 to 3256, and the respective mass flow controllers 3211 to 3216, as shown in FIG. 7, and the gas cylinders 3221 to 3226 for the respective source gases are connected to the gas inlet pipes 4117 in the reactor vessel 4111 through an auxiliary valve 3260. As shown in FIG. 6, the space surrounded by the cylindrical substrates 4115 forms a discharge space 4130.

Deposited films are formed by a μW-PCVD process in the apparatus in the following manner.

Cylindrical substrates 4115 are each set at predetermined positions in the reactor vessel 4111, as shown in FIG. 5 and are rotated by driving means 4120, while the reactor vessel 4111 is evacuated by an evacuating unit (not shown in the drawing) such as a vacuum pump through the evacuating pipe 4121 to adjust the pressure in the reactor vessel 4111 to not more than $1\times10^{-6}$ Torr. Then, the cylindrical substrates 4115 are heated and kept at a desired temperature between 20° and 500° C. by the heaters 4116 for heating the substrates.

The source gases for forming deposited films can be introduced into the reactor vessel 4111 by confirming that the valves 3231 to 3236 of the respective gas cylinders 3221 to 3226 and the leak valve (not shown in the drawing) of the reactor vessel 4111 are closed and that the respective inflow valves 3241 to 3246, the respective outflow valves 3251 to 3256 and the auxiliary valve 3260 are opened. The main valve (not shown in the drawing) is opened to evacuate the insides of the reactor vessel 4111 and the gas piping 4117. The auxiliary valve 3260 and the respective outflow pipes 3251 to 3256 are closed when the vacuum meter (not shown in the drawing) indicates about $5\times10^{-6}$ Torr; and the respective valves 3231 to 3236 are opened to introduce the source gases from the respective gas cylinders 3221 to 3226. The respective inflow valves 3241 to 3246 are slowly opened after the respective source gas pressures are adjusted to 2 $kg/cm^2$ by the respective pressure controllers 3261 to 3266 to introduce the respective source gases into the respective mass flow controllers 3211 to 3216.

After the film-forming preparation has been completed as above, a photoconductive layer 12 and a surface layer 13 are formed on the surfaces of the cylindrical substrates 4115.

When the cylindrical substrates 4115 reach a desired temperature, the necessary outflow valves of the valves 3251 to 3256 and the auxiliary valve 3260 are slowly opened to introduce the desired source gases into the discharge space 4130 in the reactor vessel 4111 from the respective gas cylinders 3221 to 3226 through the gas inlet pipe 4117. Then, the respective source gases are adjusted to the desired flow rates through the respective mass flow controllers 3211 to 3216, where the opening of the main valve is adjusted, while watching the vacuum meter, so that the pressure in the discharge space 4130 may be kept to a pressure of not more than 1 Torr. After the pressure has been stabilized, microwaves of a frequency of not less than 500 MHz, preferably 2.45 GHz, are generated by a microwave power source (not shown in the drawing), and the microwave power source is set to a desired power to introduce the microwave energy into the discharge space 4130 through the wave guide tube 4113 and the microwave-introducing windows 4112 to generate microwave glow discharge. At the same time, an electric bias such as DC, etc. is applied to the electrode 4118 from a power source 4119. In the discharge space 4130 surrounded by the cylindrical substrates 4115, the introduced source gases are decomposed by excitation caused by the microwave energy, and a desired deposited film is formed on the cylindrical substrates 4115. In order to obtain evenness of the film formation, the cylindrical substrates 4115 are rotated at a desired revolution speed by motors 4120 for rotating the substrates at the same time. After the formation of the film to a desired thickness, supply of the microwave power is discontinued and the respective outflow valves 3251 to 3256 are closed to discontinue inflow of the respective source gases into the reactor vessel 4111, thereby terminating the formation of the deposited film.

By conducting a plurality of runs of similar operations, a light-receiving layer of desired multilayer structure can be formed.

In the formation of the respective layers, all other outflow valves than those for the necessary source gases are closed. In order to avoid retaining of respective source gases in the reactor vessel 4111 and piping from the respective outflow valves 3251 to 3256 to the reactor vessel 4111, the respective outflow valves 3251 to 3256 are closed, whereas the auxiliary valve 3260 is opened and the main valve is fully opened to evacuate the system inside to a high vacuum, when required.

The above-mentioned gas species and valve operations can be changed according to conditions for forming the respective layers. For example, in the apparatus for forming deposited films by a RF-CVD process as shown in FIG. 4, the unit 3200 for supplying source gases may comprise gas cylinders 3221 to 3226 for SUCh source gases as $SiH_4$, $GeH_4$, $H_2$, $CH_4$, $B_2H_6$, $PH_3$, etc., valves 3231 to 3236, 3241 to 3246, and 3251 to 3256, and mass flow controllers 3211 to 3216, where the gas cylinders for the respective source gases may be connected to the gas inlet pipe 3114 in the reactor vessel 3111 through the auxiliary valve 3260.

In the apparatus for forming deposited films by a μW-PCVD process, as shown in FIG. 5, the unit 3200 for supplying SOUrCe gases may comprise gas cylinders 3221 to 3226 for source gases such as $SiH_4$, $GeH_4$, $H_2$, $CH_4$, $B_2H_6$, $PH_3$, etc., valves 3231 to 3236, 3241 to 3246, and 3251 to 3256 and mass flow controllers 3211 to 3216, where the gas cylinders for the respective source gases may be connected to the gas inlet pipe 4117 in the reactor vessel through the main valve 3260.

In these cases, a photoconductive layer can be formed according to conditions for forming a desired layer, as described above.

The cylindrical substrates 4115 can be heated by any heater working in vacuum, for example, an electrical resistance heater such as a coiled heater, a plate heater, a ceramic heater, etc. of sheathed heater type, a heat radiation lamp heater such as a halogen lamp, an ultraviolet lamp, etc., and a heater based on a heat exchange means using a liquid, a gas, etc. as a heating medium. The surface material of the heating means can be a metal such as stainless steel, nickel, aluminum, copper, etc., ceramics, heatresistant polymer resins, etc. Besides, a process comprising providing a vessel destined only to heating in addition to the reactor vessel 4111, heating the cylindrical substrates 4115 in the heating vessel and conveying the heated substrates in vacuum into the reactor vessel 4111 can be also used.

In the μW-PCVD process, it is desirable that the pressure in the discharge space 4130 is set to a pressure of preferably $1\times10^{-3}$ Torr to $1\times10^{-1}$ Torr, more preferably $3\times10^{-3}$ to $5\times10^{-2}$ Torr, most preferably $5\times10^{-3}$ Torr to $3\times10^{-2}$ Torr, while the pressure outside the discharge space 4130 may be lower than that in the discharge space 4130. When the pressure in the discharge space 4130 is not more than $1\times10^{-1}$ Torr, particularly $5\times10^{-2}$ Torr and when the pressure in the discharge space 4130 is at least 3 times as large as that outside the discharge space 4130, the improvement of the deposited film characteristics is remarkable.

Introduction of microwave into the reactor vessel can be made, for example, through a wave guide pipe, and introduction of microwave into the reactor vessel can be made, for example, through one or more microwave-introducing windows. Materials of microwave-introducing windows into the reactor vessel are usually those of less microwave loss such as alumina ($Al_2O_3$), aluminum nitride (AlN), boron nitride (BN), silicon nitride (SiN), silicon carbide (SiC), silicon oxide ($SiO_2$), beryllium oxide (BeO), teflon, polystyrene, etc.

Preferable electric field generated between the electrode 4118 and the cylindrical substrates 4115 is a DC electric field, and preferable direction of the electric field is from the electrode 4118 toward the cylindrical substrates 4115. An average range for the DC voltage to be applied to the electrode 4118 to generate the electric field is 15 to 300 V, preferably 30 to 200 V. DC voltage wave form is not particularly limited, and various wave forms are effective. That is, any wave form is applicable, so long as its direction of voltage is not changed with time. For example, not only is a constant voltage that undergoes no large change with time effective, so are a pulse form voltage and a pulsating voltage which is rectified by a rectifier and undergoes large changes with time. Application of AC voltage is also effective. Any AC frequency is applicable without any trouble, and practically suitable frequency is 50 Hz or 60 Hz for a low frequency and 13.56 MHz for a high frequency. AC wave form may be a sine wave form or a rectangular wave form or any other wave form, but practically the sine wave form is suitable. In any case, the voltage refers to an effective value.

Size and shape of the electrode 4118 are not limited, so long as they do not disturb the discharge, and practically a cylindrical form having a diameter of 0.1 to 5 cm is preferable. At that time, the length of the electrode 4118 can be set to any desired one, so long as it applies the electric field evenly to the cylindrical substrates 4115. Materials of the electrode 4118 can be any material which makes the surface electroconductive. For example, a metal such as stainless steel, Al, Cr, Mo, Au, In, Nb, Te, V, Ti, Pt, Pd, Fe, etc. or their alloys or glass, ceramics, plastics whose surfaces are made electroconductive, can be usually used.

The present invention will be explained in detail below, referring to Examples, which are not limitative of the present invention.

EXAMPLE A1

Figure 8:
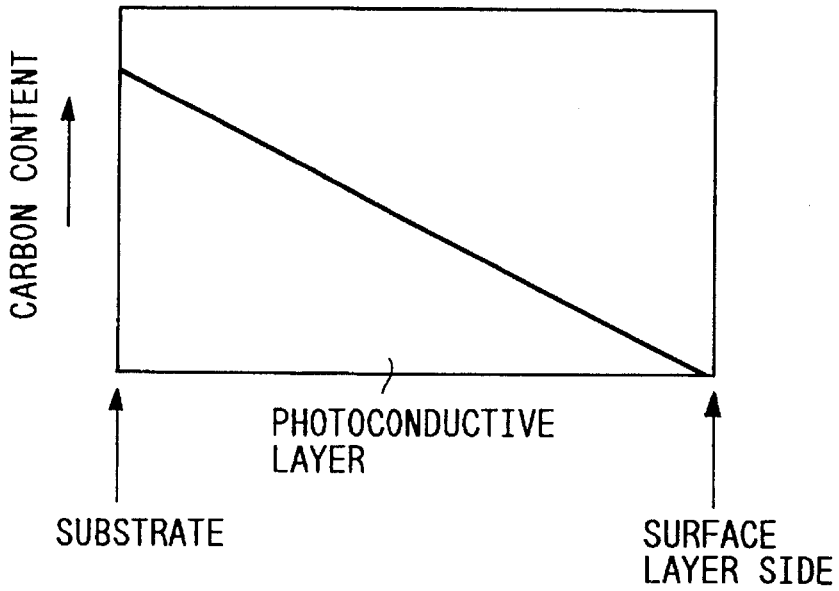
FIGS. 8 to 12 are respectively schematic distribution diagrams for illustrating carbon distribution in a layer thickness direction in a photoconductive layer (or a first photoconductive layer) of a light-receiving member.

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table A1. An electrophotographic light-receiving member 10 was thus produced. In the present Example, the flow rate of $CH_4$ fed when the photoconductive layer 12 was formed was varied so that the carbon atom content in the photoconductive layer 12 was changed in a pattern of changes as shown in FIG. 8. The carbon atom content in the photoconductive layer 12 at its surface on the side of the conductive substrate 11 was so controlled as to be 30 atomic % The carbon atom content was measured by elementary analysis using the Rutherford backward scattering method.

The electrophotographic light-receiving member 10 thus produced was set in a test-purpose modified electrophotographic apparatus of a copier NP-7550, manufactured by Canon Inc., and chargeability, sensitivity and residual potential were evaluated. Evaluation for each item was made in the following manner.

(1) Chargeability:

The electrophotographic light-receiving member 10 is set in the test apparatus, and a high voltage of +6 kV is applied to a charger to effect corona charging. The dark portion surface potential of the electrophotographic light-receiving member 10 is measured using a surface potentiometer.

(2) Sensitivity:

The electrophotographic photosensitive member 10 is charged to have a given dark portion surface potential, and immediately thereafter irradiated with light to form a light image. The light image is formed using a xenon lamp light source, by irradiating the surface with light from which light with a wavelength in the region of 550 nm or less has been removed using a filter. At this time the light portion surface potential of the electrophotographic light-receiving member 10 is measured using a surface potentiometer. The amount of exposure is adjusted so as for the light portion surface potential to be at a given potential, and the amount of exposure used at this time is regarded as the sensitivity.

(3) Residual potential:

The electrophotographic light-receiving member 10 is charged to have a given dark portion surface potential, and immediately thereafter irradiated with light with a constant amount of light having a relatively high intensity. A light image is formed using a xenon lamp light source, by irradiating the surface with light from which light with a wavelength in the region of 550 nm or less has been removed using a filter. At this time the light portion surface potential of the electrophotographic light-receiving member 10 is measured using a surface potentiometer.

Comparative Example A1

What is called a function-separated electrophotographic light-receiving member having on a conductive substrate a first photoconductive layer, a second photoconductive layer and a surface layer in a three-layer structure was produced in the same manner as in Example A1 and under conditions shown in Table A2.

Characteristics of the electrophotographic light-receiving member thus produced were evaluated in the same manner as in Example A1. Results of evaluation in Example A1 and Comparative Example A1 are shown in Table A3. In Table A3, "AA" indicates "particularly good"; "A", "Good"; "B", "no problem in practical use"; and "C", "problematic in practical use in some cases".

As is seen from the results of evaluation, the electrophotographic light-receiving member 10 with the layer structure according to the present invention (Example A1) is improved in chargeability and sensitivity, and also undergoes no changes in residual potential, showing better results in chargeability, sensitivity and residual potential than Comparative Example A1.

EXAMPLE A2

Using the μW (microwave) glow discharge manufacturing apparatus as shown in FIG. 5 and according to the procedure previously described in detail, a light-receiving layer was formed on a mirror-finished aluminum cylinder of 108 mm in diameter under conditions shown in Table A4. An electrophotographic light-receiving member 10 was thus produced in the same manner as in Example A1.

Characteristics of the electrophotographic light-receiving member 10 thus produced were evaluated in the same manner as in Example A1.

Comparative Example A2

What is called a function-separated electrophotographic light-receiving member having on a conductive substrate a first photoconductive layer, a second photoconductive layer and a surface layer in a three-layer structure was produced in the same manner as in Example A2 and under conditions shown in Table A5.

Characteristics of the electrophotographic light-receiving member thus produced were evaluated in the same manner as in Example A1. Results of evaluation in Example A2 and Comparative Example A2 were entirely the same as the results of evaluation in Example A1 and Comparative Example A1, respectively.

EXAMPLE A3

Figure 9:
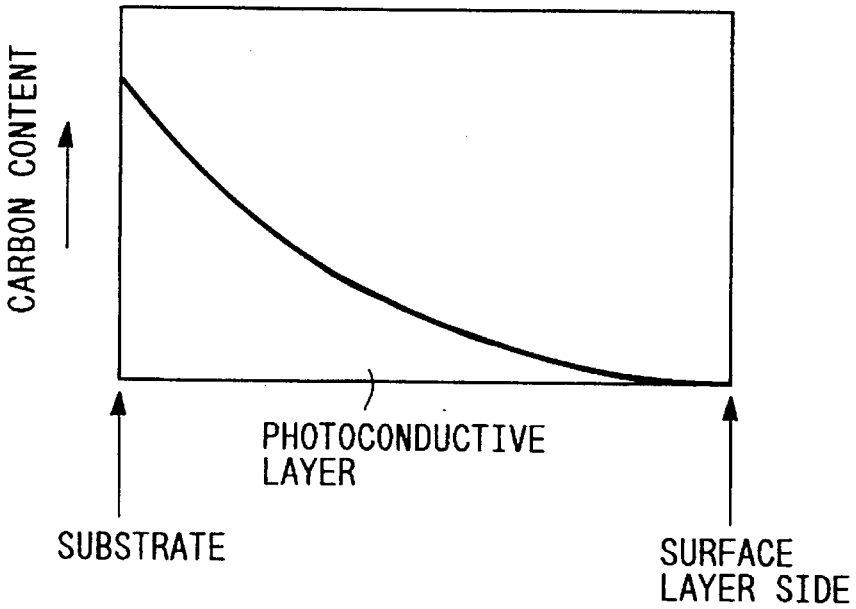
Figure 10:
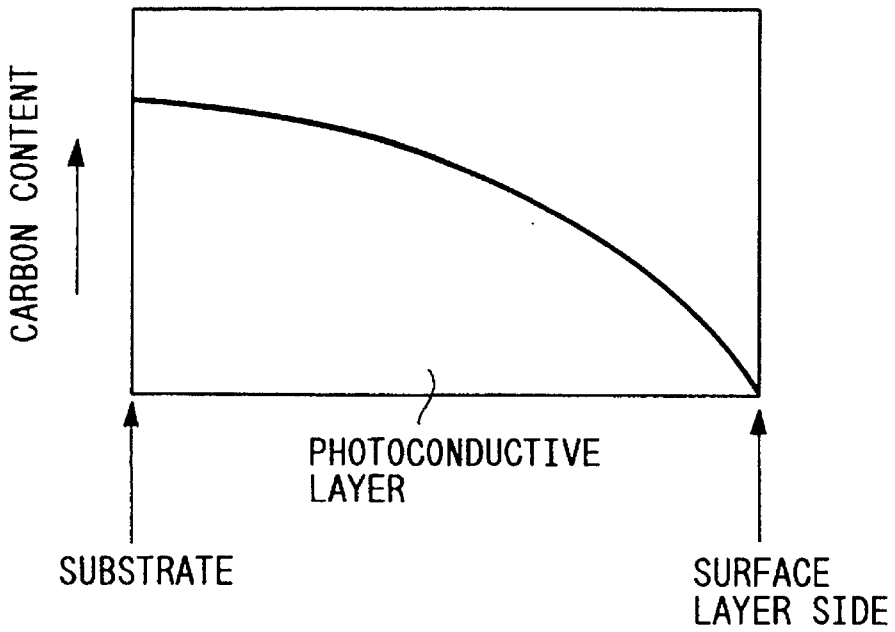

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table A6. Electrophotographic light-receiving members 10 were thus produced. In the present Example, the flow rate of $CH_4$ fed when the photoconductive layer 12 was formed was varied so that the carbon atom content in the photoconductive layer 12 was varied in patterns of changes as shown in FIGS. 8 to 10. In all patterns, the carbon atom content in the photoconductive layer 12 at its surface on the side of the conductive substrate 11 was so controlled as to be 30 atomic %. The carbon atom content was measured by elementary analysis using the Rutherford backward scattering method.

The electrophotographic light-receiving members 10 thus produced were each set in a test-purpose modified electrophotographic apparatus of a copier NP-7550, manufactured by Canon Inc., and chargeability, sensitivity and residual potential were evaluated. Evaluation for each item was made in the same manner as in Example A1.

Comparative Example A3

Figure 11:
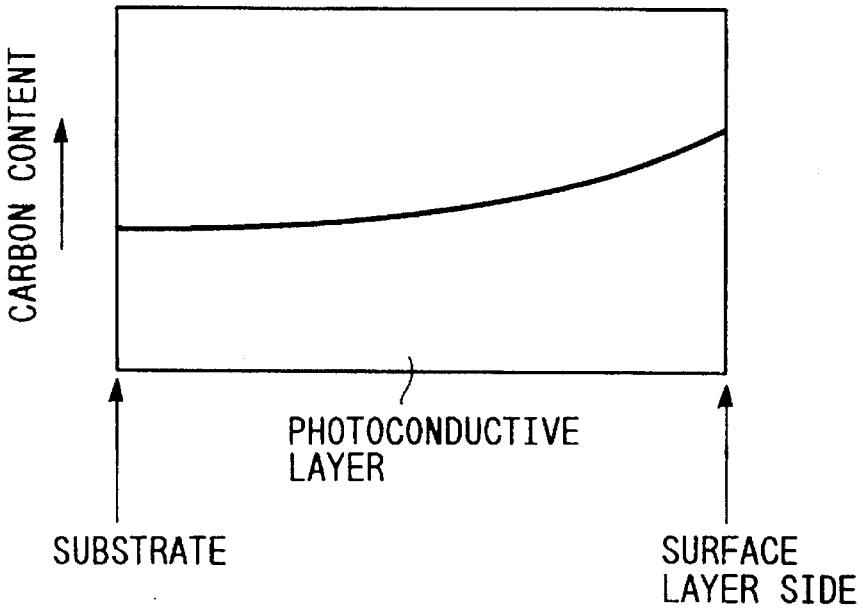
Figure 12:
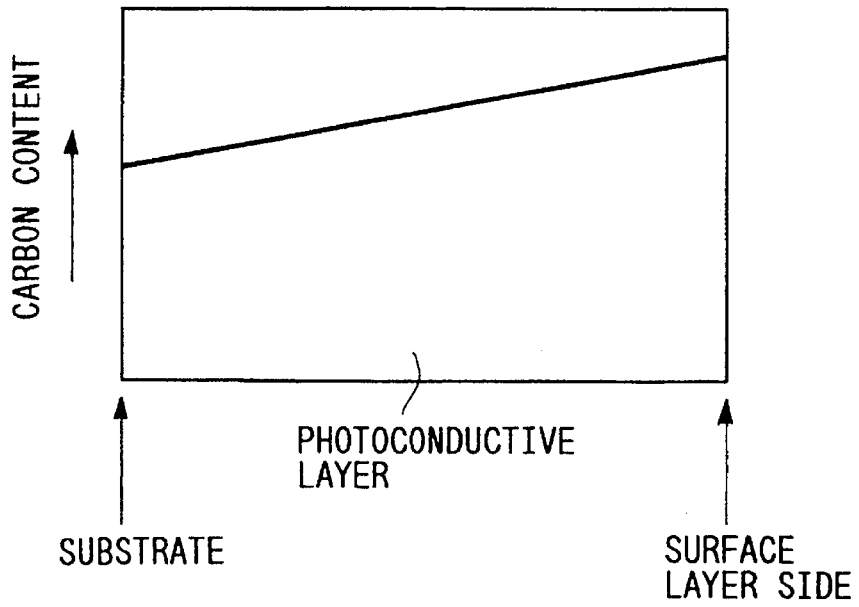

Electrophotographic light-receiving members were produced in the same manner as in Example A3 but in patterns of changes in carbon atom content as shown in FIGS. 11 and 12. Characteristics of the electrophotographic light-receiving member thus produced were evaluated in the same manner as in Example A3. Results of evaluation in Example A3 and Comparative Example A3 are shown in Table A7. In Table A7, "AA" indicates "particularly good"; "A", "Good"; "B", "no problem in practical use"; and "C", "problematic in practical use in some cases".

As is seen from the results of evaluation, the electrophotographic light-receiving members 10 having in the photoconductive layer 12 the pattern of carbon atom content according to the present invention (Example A3) were improved in chargeability and sensitivity, and also underwent no changes in residual potential, showing better results in chargeability, sensitivity and residual potential than Comparative Example A3.

EXAMPLE A4

Using the μW glow discharge manufacturing apparatus as shown in FIG. 5 and according to the procedure previously described in detail, light-receiving layers were each formed on a mirror-finished aluminum cylinder of 108 mm in diameter under conditions shown in Table A8. Electrophotographic light-receiving members 10 were thus produced. In the present Example, the flow rate of $CH_4$ fed when the photoconductive layer 12 was formed was varied so that the carbon atom content in the photoconductive layer 12 was varied in patterns of changes as shown in FIGS. 8 to 10. In all patterns, the carbon atom content in the photoconductive layer 12 at its surface on the side of the conductive substrate 11 was so controlled as to be 30 atomic %. The carbon atom content was measured by elementary analysis using the Rutherford backward scattering method.

Characteristics of the electrophotographic light-receiving members 10 thus produced were evaluated in the same manner as in Example A3.

Comparative Example A4

Electrophotographic light-receiving members were produced in the same manner as in Example A4 but in patterns of changes in carbon atom content as shown in FIGS. 11 and 12.

Characteristics of the electrophotographic light-receiving members thus produced were evaluated in the same manner as in Example A4. Results of evaluation in Example A4 and Comparative Example A4 were entirely the same as the results of evaluation in Example A3 and Comparative Example A3, respectively.

EXAMPLE A5

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table A9. Electrophotographic light-receiving members 10 were thus produced. In the present Example, the pattern shown in FIG. 8 was used as a pattern of changes of carbon atom content in the photoconductive layer 12, and the flow rate of $CH_4$ fed when the photoconductive layer 12 was formed was varied so that the carbon atom content in that layer 12 at its surface on the side of the conductive substrate 11 was varied from 0.5 atomic % to 50 atomic %. Thus, electrophotographic light-receiving members 10 corresponding to such variations were produced. The carbon atom content in the photoconductive layer 12 at its surface on the side of the conductive substrate 11 was measured by elementary analysis using the Rutherford backward scattering method.

The electrophotographic light-receiving members 10 thus produced were each set in a test-purpose modified electrophotographic apparatus of a copier NP-7550, manufactured by Canon Inc., and their electrophotographic characteristics concerning chargeability, sensitivity, residual potential, white spots, coarse image and ghost were evaluated. Number of spherical projections occurred on the surfaces of electrophotographic light-receiving members 10 was also examined to make evaluation. Evaluation for each item was made in the following manner.

(1) Chargeability, sensitivity and residual potential:

Evaluated in the same manner as in Example A1.

(2) White spots:

A whole-area black chart prepared by Canon Inc. (parts number: FY9-9073) is placed on a copy board to make copies. White spots of 0.2 mm or less in diameter, present in the same area of the copied images thus obtained, are counted.

(3) Coarse image:

A halftone chart prepared by Canon Inc (parts number: FY-9042) is placed on a copy board to make copies. On the copied images thus obtained, assuming a round region of 0.5 mm in diameter as one unit, image densities on 100 spots are measured to make evaluation on the scattering of the image densities.

(4) Ghost:

A ghost test chart prepared by Canon Inc. (parts number: FY9-9040) on which a solid black circle with a reflection density of 1.1 and a diameter of 5 mm has been stuck is placed on a copy board at an image leading area, and a halftone chart prepared by Canon Inc. is superposed thereon, in the state of which copies are made. In the copied images thus obtained, the difference between the reflection density in the area with the diameter of 5 mm on the ghost chart and the reflection density of the halftone area is measured, which difference is seen on the halftone copy.

(5) Number of spherical projections:

The whole area of the surface of the electrophotographic light-receiving member 10 produced is observed with an optical microscope to examine the number of spherical projections with diameters of 20 μm or larger in the area of 100 $cm^2$. Results are obtained in all the electrophotographic light-receiving members 10. A largest number of the spherical projections among them is assumed as 100% to make relative comparison.

Comparative Example A5

Example A5 was repeated except that the carbon atom content at the surface on the conductive substrate side was changed to 0.3 atomic %, 60 atomic % and 70 atomic %. Electrophotographic light-receiving members corresponding to such changes were thus produced. Evaluation was made in the same manner as in Example A5. Results of evaluation in Example A5 and Comparative Example A5 are shown in Table A10. In Table A10, with regard to chargeability, sensitivity, residual potential, white spots, coarse image and ghost, "AA" indicates "particularly good"; "A", "good"; "B", "no problem in practical use"; and "C", "problematic in practical use in some cases". With regard to number of spherical projections, "AA" indicates "60% or less"; "A", "80 to 60%; and "B", "100 to 80%.

As is seen from the results, the photoconductive layer 12 with a carbon atom content of from 0.5 to 50 atomic % at its surface on the side of the conductive substrate 11, which is in accordance with the present invention, can contribute improvements in the characteristics. As is also seen therefrom, the photoconductive layer 12 with a carbon atom content of from 1 to 30 atomic % at its surface on the side of the conductive substrate 11 can bring about very good results.

EXAMPLE A6

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table A11. Electrophotographic light-receiving members 10 were thus produced in the same manner as in Example A5. In the present Example, the pattern shown in FIG. 8 was used as a pattern of changes of carbon atom content in the photoconductive layer 12, and the flow rate of $CH_4$ fed when the photoconductive layer 12 was formed was varied so that the carbon atom content in that layer at its surface on the side of the photoconductive substrate 11 was varied from 0.5 atomic % to 50 atomic %. Thus, electrophotographic light-receiving members corresponding to such variations were produced.

Characteristics of the electrophotographic light-receiving members 10 thus produced were evaluated in the same manner as in Example A5.

Comparative Example A6

Example A6 was repeated except that the carbon atom content at the surface on the conductive substrate side was changed to 0.3 atomic %, 60 atomic and 70 atomic %. Electrophotographic light-receiving members corresponding to such changes were thus produced. Evaluation was made in the same manner as in Example A6.

Results of evaluation in Example A6 and Comparative Example A6 were the same as the results of evaluation in Example A5 and Comparative Example A5, respectively.

EXAMPLE A7

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table A12. Electrophotographic light-receiving members 10 were thus produced. In the present Example, the flow rate of $SiF_4$ fed when the photoconductive layer 12 was formed was varied so that the fluorine atom content in the photoconductive layer 12 was varied in the range of from 1 to 95 atomic ppm. Thus, electrophotographic light-receiving members 10 corresponding to such variations were produced. The fluorine atom content in the photoconductive layer 12 was measured by elementary analysis using SIMS (secondary ion mass spectroscopy; CAMECA IMS-3F).

The electrophotographic light-receiving members 10 thus produced were each set in a test-purpose modified electrophotographic apparatus of a copier NP-7550, manufactured by Canon Inc., and electrophotographic characteristics concerning white spots, coarse image and ghost were evaluated in the same manner as in Example A5 before an accelerated durability test was carried out. Next, the electrophotographic light-receiving members 10 thus produced were each set in the test-purpose modified electrophotographic apparatus of a copier NP-7550, manufactured by Canon Inc., and electrophotographic characteristics concerning white spots, coarse image and ghost were similarly evaluated after an accelerated durability test which corresponded to copying of 2,500,000 sheets was carried out.

Comparative Example A7

Example A7 was repeated except that the fluorine atom content in the photoconductive layer was changed to 100 atomic ppm, 200 atomic ppm and 500 atomic ppm, to give electrophotographic light-receiving members corresponding to such changes. Evaluation was made in the same manner as in Example A7. Results of evaluation in Example A7 and Comparative Example A7 before the accelerated durability test are shown in Table A13. Results of evaluation in Example A7 and Comparative Example A7 after the accelerated durability test are shown in Table A14.

As is seen from the results, the photoconductive layer 12 with a fluorine atom content set to 95 atomic ppm or less, which is in accordance with the present invention, can contribute improvements in image characteristics and durability.

EXAMPLE A8

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table A15. Electrophotographic light-receiving members 10 were thus produced in the same manner as in Example A7.

Comparative Example A8

Example A8 was repeated except that the fluorine atom content in the photoconductive layer was changed to 100 atomic ppm, 200 atomic ppm and 500 atomic ppm, to give electrophotographic light-receiving members corresponding to such changes.

Characteristics of the electrophotographic light-receiving members 10 thus produced were evaluated in the same manner as in Example A7. Results of evaluation were the same as the results of evaluation in Example A7 and Comparative Example A7, respectively.

EXAMPLE A9

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table A16. Electrophotographic light-receiving members 10 were thus produced. In the present Example, the power applied and the flow rate of $CH_4$ fed when the surface layer 13 was formed were varied so that the carbon atom content in the surface layer 13 was varied in the range of from 40 to 90 atomic %.

The electrophotographic light-receiving members 10 thus produced were each set in a test-purpose modified electrophotographic apparatus of a copier NP-7550, manufactured by Canon Inc., and electrophotographic characteristics concerning chargeability and residual potential and images were evaluated. Characteristics of the electrophotographic light-receiving members 10 were again evaluated after an accelerated durability test which corresponded to copying of 2,500,000 sheets using reprocessed paper. Evaluation for each item was made in the following manner.

(1) Chargeability and residual potential:

Evaluated in the same manner as in Example A1.

(2) Evaluation of images:

Five-rank criterion samples were prepared for evaluation concerning white spots and scratches, and evaluation was made as to the total of the results of evaluation.

Comparative Example A9

Example A9 was repeated except that the carbon atom content in the surface layer was changed to 20 atomic % and 30 atomic %. Electrophotographic light-receiving members corresponding to such changes were thus produced. Evaluation was made in the same manner as in Example A9. Results of evaluation in Example A9 and Comparative Example A9 are shown in Table A17. In Table A17, "AA" indicates "particularly good"; "A", "good"; "B", "no problem in practical use"; and "C", "problematic in practical use in some cases".

As is seen from the results of evaluation, the electrophotographic light-receiving members 10 according to the present invention in which the surface layer 13 with a carbon atom content of from 40 to 90 atomic % can achieve improvements in chargeability and durability.

Example A10

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table A18. Electrophotographic light-receiving members 10 were thus produced in the same manner as in Example A9.

Comparative Example A10

Example A10 was repeated except that the carbon atom content in the surface layer was changed to 20 atomic %, 30 atomic % and 95 atomic %, to give electrophotographic light-receiving members corresponding to such changes.

Characteristics of the electrophotographic light-receiving members thus produced were evaluated in the same manner as in Example A9. Results thereof were the same as those in Example A9 and Comparative Example A9, respectively.

EXAMPLE A11

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table A19. Electrophotographic light-receiving members 10 were thus produced. In the present Example, the power applied and the flow rate of $H_2$ and/or flow rate of $SiF_4$ fed when the surface layer 13 was formed were varied so that the fluorine atom content in the surface layer 13 was not more than 20 atomic % and the total of the hydrogen atom content and fluorine atom content was in the range of from 30 to 70 atomic %.

The electrophotographic light-receiving members 10 thus produced were each set in a test-purpose modified electrophotographic apparatus of a copier NP-7550, manufactured by Canon Inc., and electrophotographic characteristics concerning sensitivity and residual potential and image characteristics concerning smeared images were respectively evaluated. Evaluation for each item was made in the following manner.

(1) Sensitivity and residual potential:

Evaluated in the same manner as in Example A1.

(2) Smeared image:

A test chart manufactured by Canon Inc. (parts number FY9-9058) with a white background having characters on its whole area was placed on a copy board, and copies are made at an amount of exposure twice the amount of usual exposure. Copy images obtained were observed to examine whether or not the fine lines on the image are continuous without break-off. When uneveness was seen on the image during this evaluation, the evaluation was made on the whole-area image region and the results are given in respect of the worst area.

Comparative Example A11

Example A11 was repeated except that the total of the hydrogen atom content and fluorine atom content in the surface layer was changed to less than 30 atomic % and more than 70 atomic %. Electrophotographic light-receiving members corresponding to such changes were thus produced. Evaluation was made in the same manner as in Example A11 .

Comparative Example A12

Example A11 was repeated except that the fluorine atom content in the surface layer was changed to more than 20 atomic %. Electrophotographic light-receiving members corresponding to such changes were thus produced. Evaluation was made in the same manner as in Example A11.

Comparative Example A13

Example A11 was repeated except that no $SiF_4$ was used when the surface layer was formed. Electrophotographic light-receiving members corresponding to such changes were thus produced. Evaluation was made in the same manner as in Example A11.

Results of evaluation in Example A11 and Comparative Examples 11 to 13 are shown in Table A20. In Table A20, with regard to sensitivity and residual potential,"AA" indicates "particularly good"; "A", "good"; "B", "no problem in practical use"; and "C", "problematic in practical use in some cases". With regard to smeared image, "AA" indicates "good"; "A", "lines are broken off in part"; "B", "lines are broken off at many portions, but can be read as characters without no problem in practical use", and "C", "problematic in practical use in some cases".

As is seen from the results of evaluation, the electrophotographic light-receiving members 10 according to the present invention in which the total of the hydrogen atom content and fluorine atom content in the surface layer 13 was so controlled as to be in the range of from 30 to 70 atomic % and the fluorine atom content not more than 20 atomic % can bring about good results in both the sensitivity and the image characteristics and also can greatly prohibit smeared images from occurring under strong exposure.

EXAMPLE A12

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table A21. Electrophotographic light-receiving members 10 were thus produced in the same manner as in Example A11.

Characteristics of the electrophotographic light-receiving members thus produced were evaluated in the same manner as in Example A11. Results of evaluation were the same as those in Example A12.

Comparative Example A14

Example A12 was repeated except that the total of the hydrogen atom content and fluorine atom content in the surface layer was changed to less than 30% and more than 70 atomic %. Electrophotographic light-receiving members corresponding to such changes were thus produced. Evaluation was made in the same manner as in Example A12.

Comparative Example A15

Example A12 was repeated except that the fluorine atom content in the surface layer was changed to more than 20 atomic %. Electrophotographic light-receiving members corresponding to such changes were thus produced. Evaluation was made in the same manner as in Example A12.

Comparative Example A16

Example A12 was repeated except that no $SiF_4$ was used when the surface layer was formed. Electrophotographic light-receiving members corresponding to such changes were thus produced. Evaluation was made in the same manner as in Example A12.

Results of evaluation in Example A12 and Comparative Examples 14 to 16 were the same as the results of evaluation in Example A11 and Comparative Examples 11 to 13, respectively.

EXAMPLE A13

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table A22. Electrophotographic light-receiving members 10 were thus produced. In the present Example, the boron atom content in the photoconductive layer 12 was varied as shown in Table A23. Hydrogen-based diborane (100 ppm $B_2H_6/H_2$) was used as the starting material gas.

The electrophotographic light-receiving members 10 thus produced were each set in a test-purpose modified electrophotographic apparatus of a copier NP-6650, manufactured by Canon Inc., and chargeability, sensitivity and residual potential were respectively evaluated in the same manner as in Example A1. Results of evaluation in Example A13 and Comparative Example A17 are shown in Table A24.

As is seen from the results of evaluation, the photoconductive layer 12 doped with boron atoms can contribute improvements particularly in sensitivity and residual potential.

EXAMPLE A14

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table A25. Electrophotographic light-receiving members 10 were thus produced in the same manner as in Example A13.

Characteristics of the electrophotographic light-receiving members thus produced were evaluated in the same manner as in Example A13. Results of evaluation were the same as those in Example A13.

EXAMPLE B1

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table B1. An electrophotographic light-receiving member 10 was thus produced. In the present Example, the flow rate of $CH_4$ fed when the photoconductive layer 12 was formed was varied so that the carbon atom content in the photoconductive layer 12 was changed in a pattern of changes as shown in FIG. 8. The carbon atom content in the photoconductive layer 12 at its surface on the side of the conductive substrate 11 was so controlled as to be 30 atomic %. The carbon atom content was measured by elementary analysis using the Rutherford backward scattering method.

The electrophotographic light-receiving member 10 thus produced was set in a test-purpose modified electrophotographic apparatus of a copier NP-7550, manufactured by Canon Inc., and chargeability, sensitivity and residual potential were evaluated. Evaluation for each item was made in the same manner as in Example A1.

Comparative Example B1

What is called a function-separated electrophotographic light-receiving member having on a conductive substrate, a first photoconductive layer, a second photoconductive layer and a surface layer in a three-layer structure was produced in the same manner as in Example B1 and under conditions shown in Table B2.

Characteristics of the electrophotographic light-receiving member thus produced were evaluated in the same manner as in Example B1. Results of evaluation in Example B1 and Comparative Example B1 are shown in Table B3.

As is seen from the results of evaluation, the electrophotographic light-receiving member 10 with the layer structure according to the present invention (Example B1) is improved in chargeability and sensitivity, and also undergoes no changes in residual potential, showing better results in chargeability, sensitivity and residual potential than Comparative Example B1.

EXAMPLE B2

Using the μW (microwave) glow discharge manufacturing apparatus as shown in FIG. 5 and according to the procedure previously described in detail, a light-receiving layer was formed on a mirror-finished aluminum cylinder of 108 mm in diameter under conditions shown in Table B4. An electrophotographic light-receiving member 10 was thus produced in the same manner as in Example B1.

Characteristics of the electrophotographic light-receiving member 10 thus produced were evaluated in the same manner as in Example B1.

Comparative Example B2

What is called a function-separated electrophotographic light-receiving member having on a conductive substrate, a first photoconductive layer, a second photoconductive layer and a surface layer in a three-layer structure was produced in the same manner as in Example B2 and under conditions shown in Table B5.

Characteristics of the electrophotographic light-receiving member thus produced were evaluated in the same manner as in Example B1. Results of evaluation in Example B2 and Comparative Example B2 were entirely the same as the results of evaluation in Example B1 and Comparative Example B1, respectively.

EXAMPLE B3

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table B6. Electrophotographic light-receiving members 10 were thus produced. In the present Example, the flow rate of $CH_4$ fed when the photoconductive layer 12 was formed was varied so that the carbon atom content in the photoconductive layer 12 was varied in patterns of changes as shown in FIGS. 8 to 10. In all patterns, the carbon atom content in the photoconductive layer 12 at its surface on the side of the conductive substrate 11 was so controlled as to be 30 atomic %. The carbon atom content was measured by elementary analysis using the Rutherford backward scattering method.

The electrophotographic light-receiving members 10 thus produced were each set in a test-purpose modified electrophotographic apparatus of a copier NP-7550, manufactured by Canon Inc., and chargeability, sensitivity and residual potential were evaluated. Evaluation for each item was made in the same manner as in Example B1.

Comparative Example B3

Electrophotographic light-receiving members were produced in the same manner as in Example B3 but in patterns of changes in carbon atom content as shown in FIGS. 11 and 12. Characteristics of the electrophotographic light-receiving member thus produced were evaluated in the same manner as in Example B3. Results of evaluation in Example B3 and Comparative Example B3 are shown in Table B7.

As is seen from the results of evaluation, the electrophotographic light-receiving members 10 having in the photoconductive layer 12 the pattern of carbon atom content according to the present invention (Example B3) are improved in chargeability and sensitivity, and also underwent no changes in residual potential, showing better results in chargeability, sensitivity and residual potential than Comparative Example B3.

EXAMPLE B4

Using the μW glow discharge manufacturing apparatus as shown in FIG. 5 and according to the procedure previously described in detail, light-receiving layers were each formed on a mirror-finished aluminum cylinder of 108 mm in diameter under conditions shown in Table B8. Electrophotographic light-receiving members 10 were thus produced. In the present Example, the flow rate of $CH_4$ fed when the photoconductive layer 12 was formed was varied so that the carbon atom content in the photoconductive layer 12 was varied in patterns of changes as shown in FIGS. 8 to 10. In all patterns, the carbon atom content in the photoconductive layer 12 at its surface on the side of the conductive substrate 11 was so controlled as to be 30 atomic %. The carbon atom content was measured by elementary analysis using the Rutherford backward scattering method.

Characteristics of the electrophotographic light-receiving members 10 thus produced were evaluated in the same manner as in Example B3.

Comparative Example B4

Electrophotographic light-receiving members were produced in the same manner as in Example B4 but in patterns of changes in carbon atom content as shown in FIGS. 11 and 12.

Characteristics of the electrophotographic light-receiving members thus produced were evaluated in the same manner as in Example B4. Results of evaluation in Example B4 and Comparative Example B4 were entirely the same as the results of evaluation in Example B3 and Comparative Example B3, respectively.

EXAMPLE B5

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table B9. Electrophotographic light-receiving members 10 were thus produced. In the present Example, the pattern shown in FIG. 8 was used as a pattern of changes of carbon atom content in the photoconductive layer 12, and the flow rate of $CH_4$ fed when the photoconductive layer 12 was formed was varied so that the carbon atom content in that layer at its surface on the side of the conductive substrate 11 was varied from 0.5 atomic % to 50 atomic %. Thus, electrophotographic light-receiving members 10 corresponding to such variations were produced. The carbon atom content in the photoconductive layer 12 at its surface on the side of the conductive substrate 11 was measured by elementary analysis using the Rutherford backward scattering method.

The electrophotographic light-receiving members 10 thus produced were each set in a test-purpose modified electrophotographic apparatus of a copier NP-7550, manufactured by Canon Inc., and their electrophotographic characteristics concerning chargeability, sensitivity, residual potential, white spots, coarse image and ghost were evaluated. Number of spherical projections occurred on the surfaces of electrophotographic light-receiving members 10 was also examined to make evaluation. Evaluation for each item was made in the same manner as in Example A5.

Comparative Example B5

Example B5 was repeated except that the carbon atom content at the surface on the conductive substrate side was changed to 0.3 atomic %, 60 atomic and 70 atomic %. Electrophotographic light-receiving members corresponding to such changes were thus produced. Evaluation was made in the same manner as in Example B5. Results of evaluation in Example B5 and Comparative Example B5 are shown in Table B10.

As is seen from the results, the photoconductive layer 12 with a carbon atom content of from 0.5 to 50 atomic % at its surface on the side of the conductive substrate 11, which is in accordance with the present invention, can contribute improvements in the characteristics. As is also seen therefrom, the photoconductive layer 12 with a carbon atom content of from 1 to 30 atomic % at its surface on the side of the conductive substrate 11 can bring about very good results.

EXAMPLE B6

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table B11. Electrophotographic light-receiving members 10 were thus produced in the same manner as in Example B5. In the present Example, the pattern shown in FIG. 8 was used as a pattern of changes of carbon atom content in the photoconductive layer 12, and the flow rate of $CH_4$ fed when the photoconductive layer 12 was formed was varied so that the carbon atom content in that layer at its surface on the side of the conductive substrate 11 was varied from 0.5 atomic % to 50 atomic %. Thus, electrophotographic light-receiving members 10 corresponding to such variations were produced.

Characteristics of the electrophotographic light-receiving members 10 thus produced were evaluated in the same manner as in Example B5.

Comparative Example B6

Example B6 was repeated except that the carbon atom content at the surface on the conductive substrate side was changed to 0.3 atomic %, 60 atomic and 70 atomic %. Electrophotographic light-receiving members corresponding to such changes were thus produced. Evaluation was made in the same manner as in Example B6.

Results of evaluation in Example B6 and Comparative Example B6 were the same as the results of evaluation in Example B5 and Comparative Example B5, respectively.

EXAMPLE B7

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table B12. Electrophotographic light-receiving members 10 were thus produced. In the present Example, the flow rate of $SiF_4$ fed when the photoconductive layer 12 was formed was varied so that the fluorine atom content in the photoconductive layer 12 was varied in the range of from 1 to 95 atomic ppm. Thus, electrophotographic light-receiving members 10 corresponding to such variations were produced. The fluorine atom content in the photoconductive layer 12 was measured by elementary analysis using SIMS (CAMECA IMS-3F).

The electrophotographic light-receiving members 10 thus produced were each set in a test-purpose modified electrophotographic apparatus of a copier NP-7550, manufactured by Canon Inc., and electrophotographic characteristics concerning white spots, coarse image and ghost were evaluated in the same manner as in Example B5 before an accelerated durability test was carried out. Next, the electrophotographic light-receiving members 10 thus produced were each set in the test-purpose modified electrophotographic apparatus of a copier NP-7550, manufactured by Canon Inc., and electrophotographic characteristics concerning white spots, coarse image and ghost were similarly evaluated after an accelerated durability test which corresponded to copying of 2,500,000 sheets was carried out.

Comparative Example B7

Example B7 was repeated except that the fluorine atom content in the photoconductive layer was changed to 100 atomic ppm, 200 atomic ppm and 500 atomic ppm to give electrophotographic light-receiving members corresponding to such changes. Evaluation was made in the same manner as in Example B7. Results of evaluation in Example B7 and Comparative Example B7 before the accelerated durability test are shown in Table B13. Results of evaluation in Example B7 and Comparative Example B7 after the accelerated durability test are shown in Table B14.

As is seen from the results shown in the tables, the photoconductive layer 12 with a fluorine atom content set to 95 atomic ppm or less, which is in accordance with the present invention, can contribute improvements in image characteristics and durability.

EXAMPLE B8

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table B15. Electrophotographic light-receiving members 10 were thus produced in the same manner as in Example B7.

Comparative Example B8

Example B8 was repeated except that the fluorine atom content in the photoconductive layer was changed to 100 atomic ppm, 200 atomic ppm and 500 atomic ppm, to give electrophotographic light-receiving members corresponding to such changes.

Characteristics of the electrophotographic light-receiving members 10 thus produced were evaluated in the same manner as in Example B7. Results of evaluation were the same as the results of evaluation in Example B7 and Comparative Example B7, respectively.

EXAMPLE B9

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table B16. Electrophotographic light-receiving members 10 were thus produced. In the present Example, the power applied and the flow rates of $CH_4$, $CO_2$ and $NH_3$ fed when the surface layer 13 was formed were varied so that total of the carbon atom content, oxygen atom content and nitrogen atom content in the surface layer 13 was varied in the range of from 40 to 90 atomic %.

The electrophotographic light-receiving members 10 thus produced were each set in a test-purpose modified electrophotographic apparatus of a copier NP-6650, manufactured by Canon Inc., and electrophotographic characteristics concerning chargeability, sensitivity and residual potential and image characteristics concerning smeared images and so forth were evaluated. Characteristics of the electrophotographic light-receiving members 10 were again evaluated after an accelerated durability test which corresponded to copying of 2,500,000 sheets using reprocessed paper. Evaluation for each item was made in the following manner.

(1) Chargeability, sensitivity and residual potential:

Evaluated in the same manner as in Example B1.

(2) Smeared image:

A test chart manufactured by Canon Inc. (parts number FY9-9058) with a white background having characters on its whole area was placed on a copy board, and copies are made at an amount of exposure twice the amount of usual exposure. Copy images obtained are observed to examine whether or not the fine lines on the image are continuous without break-off. When unevenness was seen on the image during this evaluation, the evaluation was made on the whole-area image region and the results are given in respect of the worst area.

(3) Evaluation of images:

Five-rank criterion samples were prepared for evaluation concerning white spots and scratches, and evaluation was made as the total of the results of evaluation.

Comparative Example B9

Example B9 was repeated except that the total of the hydrogen atom content, oxygen atom content and nitrogen atom content in the surface layer was changed to less than 40 atomic % and more than 90 atomic %. Electrophotographic light-receiving members corresponding to such changes were thus produced. Evaluation was made in the same manner as in Example B9.

Comparative Example B10

Example B9 was repeated except that no $CH_4$ was used when the surface layer was formed and the total of the oxygen atom content and nitrogen atom content in the surface layer was changed to 60 atomic %. An electrophotographic light-receiving member was thus produced. Evaluation was made in the same manner as in Example B9.

Comparative Example B11

Example B9 was repeated except that no $CO_2$ was used when the surface layer was formed and the total of the carbon atom content and nitrogen atom content in the surface layer was changed to 60 atomic %. An electrophotographic light-receiving member was thus produced. Evaluation was made in the same manner as in Example B9.

Comparative Example B12

Example B9 was repeated except that no $NH_3$ was used when the surface layer was formed and the total of the carbon atom content and oxygen atom content in the surface layer was changed to 60 atomic %. An electrophotographic light-receiving member was thus produced. Evaluation was made in the same manner as in Example B9.

Results of evaluation in Example B9 and Comparative Examples B9 to B12 are shown in Table B17.

As is seen from the results of evaluation, the surface layer 13 in which the total of the carbon atom content, oxygen atom content and nitrogen atom content is controlled in the range of from 40 to 90 atomic % can contribute remarkable improvements in chargeability and durability, and also the surface layer in which the total of the oxygen atom content and nitrogen atom content is controlled to be not more than 10 atomic % can bring about very good results.

EXAMPLE B10

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table B18. Electrophotographic light-receiving members 10 were thus produced in the same manner as in Example B9.

Characteristics of the electrophotographic light-receiving members 10 thus produced were evaluated in the same manner as in Example B9.

Comparative Example B13

Example B10 was repeated except that the total of the carbon atom content, oxygen atom content and nitrogen atom content in the surface layer was changed to less than 40 atomic % and more than 90 atomic %. Electrophotographic light-receiving members corresponding to such changes were thus produced. Evaluation was made in the same manner as in Example B10.

Comparative Example B14

Example B10 was repeated except that no $CH_4$ was used when the surface layer was formed and the total of the oxygen atom content and nitrogen atom content in the surface layer was changed to 60 atomic Electrophotographic light-receiving members were thus produced. Evaluation was made in the same manner as in Example B10.

Comparative Example B15

Example B10 was repeated except that no $CO_2$ was used when the surface layer was formed and the total of the carbon atom content and nitrogen atom content in the surface layer was changed to 60 atomic %. Electrophotographic light-receiving members were thus produced. Evaluation was made in the same manner as in Example B10.

Comparative Example B16

Example B10 was repeated except that no $NH_3$ was used when the surface layer was formed and the total of the carbon atom content and oxygen atom content in the surface layer was changed to 60 atomic %. Electrophotographic light-receiving members were thus produced. Evaluation was made in the same manner as in Example B10.

Results of evaluation in Example B10 and Comparative Examples B13 to B16 were the same as the results of evaluation in Example B9 and Comparative Examples B9 to B12, respectively.

EXAMPLE B11

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table B19. Electrophotographic light-receiving members 10 were thus produced. In the present Example, the power applied and the flow rate of $H_2$ and/or flow rate of $SiF_4$ fed when the surface layer 13 was formed were varied so that the fluorine atom content in the surface layer 13 was not more than 20 atomic % and the total of the hydrogen atom content and fluorine atom content was in the range of from 30 to 70 atomic %.

The electrophotographic light-receiving members 10 thus produced were each set in a test-purpose modified electrophotographic apparatus of a copier NP-7550, manufactured by Canon Inc., and characteristics on 3 items concerning sensitivity, residual potential and smeared images were respectively evaluated. Evaluation for each item was made in the following manner.

(1) Sensitivity and residual potential:

Evaluated in the same manner as in Example B1.

(2) Smeared image:

Evaluated in the same manner as in Example B9.

Comparative Example B17

Example B11 was repeated except that the total of the hydrogen atom content and fluorine atom content in the surface layer was changed to less than 30 atomic % and more than 70 atomic %. Electrophotographic light-receiving members corresponding to such changes were thus produced. Evaluation was made in the same manner as in Example B11.

Comparative Example B18

Example B11 was repeated except that the fluorine atom content in the surface layer was changed to more than 20 atomic %. Electrophotographic light-receiving members corresponding to such changes were thus produced. Evaluation was made in the same manner as in Example B11.

Comparative Example B19

Example B11 was repeated except that no $SiF_4$ was used when the surface layer was formed. Electrophotographic light-receiving members corresponding to such changes were thus produced. Evaluation was made in the same manner as in Example B11.

Results of evaluation in Example B11 and Comparative Examples B17 to B19 are shown in Table B20.

As is seen from the results of evaluation, the electrophotographic light-receiving members 10 according to the present invention in which the total of the hydrogen atom content and fluorine atom content in the surface layer 13 was so controlled as to be in the range of from 30 to 70 atomic % and the fluorine atom content not more than 20 atomic % can bring about good results in both the sensitivity and the characteristic, and also can greatly prohibit smeared images from occurring under strong exposure.

EXAMPLE B12

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table B21. Electrophotographic light-receiving members 10 were thus produced in the same manner as in Example B11.

Characteristics of the electrophotographic light-receiving members thus produced were evaluated in the same manner as in Example B11. Results of evaluation were the same as those in Example B12.

Comparative Example B20

Example B12 was repeated except that the total of the hydrogen atom content and fluorine atom content in the surface layer was changed to less than 30% and more than 70 atomic %. Electrophotographic light-receiving members corresponding to such changes were thus produced. Evaluation was made in the same manner as in Example B12.

Comparative Example B21

Example B12 was repeated except that the fluorine atom content in the surface layer was changed to more than 20 atomic %. Electrophotographic light-receiving members corresponding to such changes were thus produced. Evaluation was made in the same manner as in Example B12.

Comparative Example B22

Example B12 was repeated except that no $SiF_4$ was used when the surface layer was formed. Electrophotographic light-receiving members corresponding to such changes were thus produced. Evaluation was made in the same manner as in Example B12.

Results of evaluation in Example B12 and Comparative Examples B20 to B22 were the same as the results of evaluation in Example B11 and Comparative Examples B17 to B19, respectively.

EXAMPLE B13

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table B22. Electrophotographic light-receiving members 10 were thus produced. In the present Example, the boron atom content in the photoconductive layer 12 was varied as shown in Table B23. Hydrogen-based diborane (100 ppm $B_2H_6/H_2$) was used as the starting material gas.

The electrophotographic light-receiving members 10 thus produced were each set in a test-purpose modified electrophotographic apparatus of a copier NP-6650, manufactured by Canon Inc., and chargeability, sensitivity and residual potential were respectively evaluated in the same manner as in Example B1. Results of evaluation in Example B13 and Comparative Example B23 are shown in Table B24. Comparative Example 23 was conducted in the same manner as in Example B13 except that diborane was not employed.

As is seen from the results of evaluation, the photoconductive layer 12 doped with boron atoms can contribute improvements particularly in sensitivity and residual potential.

EXAMPLE B14

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table B25. Electrophotographic light-receiving members 10 were thus produced in the same manner as in Example B13.

Characteristics of the electrophotographic light-receiving members thus produced were evaluated in the same manner as in Example B13. Results of evaluation were the same as those in Example B13.

EXAMPLE C1

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table C1. An electrophotographic light-receiving member 10 was thus produced. In the present Example, the flow rate of $CH_4$ fed when the photoconductive layer 12 was formed was varied so that the carbon atom content in the photoconductive layer 12, was changed in a pattern of changes as shown in FIG. 8. The carbon atom content in the photoconductive layer 12 at its surface on the side of the conductive substrate 11 was so controlled as to be 30 atomic %. The carbon atom content was measured by elementary analysis using the Rutherford backward scattering method.

The electrophotographic light-receiving member 10 thus produced was set in a test-purpose modified electrophotographic apparatus of a copier NP-7550, manufactured by Canon Inc., and chargeability, sensitivity and residual potential were evaluated. Evaluation for each item was made in the same manner as in Example A1.

Comparative Example C1

An electrophotographic light-receiving member was produced in the same manner as in Example C1 and under conditions shown in Table C2, except that the carbon atom content in the photoconductive layer was made constant throughout the layer.

Characteristics of the electrophotographic light-receiving member thus produced were evaluated in the same manner as in Example C1. Results of evaluation in Example C1 and Comparative Example C1 are shown in Table C3.

As is seen from the results of evaluation, the electrophotographic light-receiving member 10 with the layer structure according to the present invention (Example C1) is improved in chargeability and sensitivity, and also underwent no changes in residual potential, showing better results in chargeability, sensitivity and residual potential than Comparative Example C1.

EXAMPLE C2

Using the μW (microwave) glow-discharging manufacturing apparatus as shown in FIG. 5 and according to the procedure previously described in detail, a light-receiving layer was formed on a mirror-finished aluminum cylinder of 108 mm in diameter under conditions shown in Table C4. An electrophotographic light-receiving member 10 was thus produced in the same manner as in Example C1.

Characteristics of the electrophotographic light-receiving member 10 thus produced were evaluated in the same manner as in Example C1.

Comparative Example C2

An electrophotographic light-receiving member was produced in the same manner as in Example C2 and under conditions shown in Table C5, except that the carbon atom content in the photoconductive layer was made constant throughout the layer.

Characteristics of the electrophotographic light-receiving member thus produced were evaluated in the same manner as in Example C1. Results of evaluation in Example C2 and Comparative Example C2 were entirely the same as the results of evaluation in Example C1 and Comparative Example C1, respectively.

EXAMPLE C3

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table C6. Electrophotographic light-receiving members 10 were thus produced. In the present Example, the flow rate of $CH_4$ fed when the photoconductive layer 12 was formed was varied so that the carbon atom content in the photoconductive layer 12 was varied in patterns of changes as shown in FIGS. 8 to 10. In all patterns, the carbon atom content in the photoconductive layer 12 at its surface on the side of the conductive substrate 11 was so controlled as to be 30 atomic %. The carbon atom content was measured by elementary analysis using the Rutherford backward scattering method.

The electrophotographic light-receiving members 10 thus produced were each set in a test-purpose modified electrophotographic apparatus of a copier NP-7550, manufactured by Canon Inc., and chargeability, sensitivity and residual potential were evaluated. Evaluation for each item was made in the same manner as in Example C1.

Comparative Example C3

Electrophotographic light-receiving members were produced in the same manner as in Example C3 but in patterns of changes in carbon atom content as shown in FIGS. 11 and 12. Characteristics of the electrophotographic light-receiving member thus produced were evaluated in the same manner as in Example C3. Results of evaluation in Example C3 and Comparative Example C3 are shown in Table C7.

As is seen from the results of evaluation, the electrophotographic light-receiving members 10 having in the photoconductive layer 12 the pattern of carbon atom content according to the present invention (Example C3) are improved in chargeability and sensitivity, and also underwent no changes in residual potential, showing better results in chargeability, sensitivity and residual potential than Comparative Example C3.

EXAMPLE C4

Using the μW glow discharge manufacturing apparatus as shown in FIG. 5 and according to the procedure previously described in detail, light-receiving layers were each formed on a mirror-finished aluminum cylinder of 108 mm in diameter under conditions shown in Table C8. Electrophotographic light-receiving members 10 were thus produced. In the present Example, the flow rate of $CH_4$ fed when the photoconductive layer 12 was formed was varied so that the carbon atom content in the photoconductive layer 12 was varied in patterns of changes as shown in FIGS. 8 to 10. In all patterns, the carbon atom content in the photoconductive layer 12 at its surface on the side of the conductive substrate 11 was so controlled as to be 30 atomic %. The carbon atom content was measured by elementary analysis using the Rutherford backward scattering method.

Characteristics of the electrophotographic light-receiving members 10 thus produced were evaluated in the same manner as in Example C3.

Comparative Example C4

Electrophotographic light-receiving members were produced in the same manner as in Example C4 but in patterns of changes in carbon atom content as shown in FIGS. 11 and 12.

Characteristics of the electrophotographic light-receiving members thus produced were evaluated in the same manner as in Example C4. Results of evaluation in Example C4 and Comparative Example C4 were entirely the same as the results of evaluation in Example C3 and Comparative Example C3, respectively.

EXAMPLE C5

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table C9. Electrophotographic light-receiving members 10 were thus produced. In the present Example, the pattern shown in FIG. 8 was used as a pattern of changes of carbon atom content in the photoconductive layer 12, and the flow rate of $CH_4$ fed when the photoconductive layer 12 was formed was varied so that the carbon atom content in that layer at its surface on the side of the conductive substrate 11 was varied from 0.5 atomic % to 50 atomic %. Thus, electrophotographic light-receiving members 10 corresponding to such variations were produced. The carbon atom content in the photoconductive layer 12 at its surface on the side of the conductive substrate 11 was measured by elementary analysis using the Rutherford backward scattering method.

The electrophotographic light-receiving members 10 thus produced were each set in a test-purpose modified electrophotographic apparatus of a copier NP-7550, manufactured by Canon Inc., and their electrophotographic characteristics concerning chargeability, sensitivity, residual potential, white spots, coarse image and ghost were evaluated. Number of spherical projections on the surfaces of electrophotographic light-receiving members 10 was also examined to make evaluation. Evaluation for each item was made in the same manner as in Example A5.

Comparative Example C5

Example C5 was repeated except that the carbon atom content at the surface on the conductive substrate side was changed to 0.3 atomic %, 60 atomic % and 70 atomic %. Electrophotographic light-receiving members corresponding to such changes were thus produced. Evaluation was made in the same manner as in Example C5. Results of evaluation in Example C5 and Comparative Example C5 are shown in Table C10.

As is seen from the results, the photoconductive layer 12 with a carbon atom content of from 0.5 to 50 atomic % at its surface on the side of the conductive substrate 11, which is in accordance with the present invention, can contribute improvements in the electrophotographic characteristics and achievement of a decrease in spherical projections. As is also seen therefrom, the photoconductive layer 12 with a carbon atom content of from 1 to 30 atomic % at its surface on the side of the conductive substrate 11 can bring about very good results.

EXAMPLE C6

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table C11. Electrophotographic light-receiving members 10 were thus produced in the same manner as in Example C5. In the present Example, the pattern shown in FIG. 8 was used as a pattern of changes of carbon atom content in the photoconductive layer 12, and the flow rate of $CH_4$ fed when the photoconductive layer 12 was formed was varied so that the carbon atom content in that layer at its surface on the side of the conductive substrate 11 was varied from 0.5 atomic % to 50 atomic %. Thus, electrophotographic light-receiving members 10 corresponding to such variations were produced.

Characteristics of the electrophotographic light-receiving members 10 thus produced were evaluated in the same manner as in Example C5.

Comparative Example C6

Example C6 was repeated except that the carbon atom content at the surface on the conductive substrate side was changed to 0.3 atomic %, 60 atomic and 70 atomic %. Electrophotographic light-receiving members corresponding to such changes were thus produced. Evaluation was made in the same manner as in Example C6.

Results of evaluation in Example C6 and Comparative Example C6 were the same as the results of evaluation in Example C5 and Comparative Example C5, respectively.

EXAMPLE C7

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table C12. Electrophotographic light-receiving members 10 were thus produced. In the present Example, the flow rate of $SiF_4$ fed when the photoconductive layer 12 was formed was varied so that the fluorine atom content in the photoconductive layer 12 was varied in the range of from 1 to 95 atomic ppm. Thus, electrophotographic light-receiving members 10 corresponding to such variations were produced. The fluorine atom content in the photoconductive layer 12 was measured by elementary analysis using SIMS (CAMECA IMS-3F).

The electrophotographic light-receiving members 10 thus produced were each set in a test-purpose modified electrophotographic apparatus of a copier NP-7550, manufactured by Canon Inc., and electrophotographic characteristics concerning white spots, coarse image and ghost were evaluated in the same manner as in Example C5 before an accelerated durability test was carried out. Next, the electrophotographic light-receiving members 10 thus produced were each set in the test-purpose modified electrophotographic apparatus of a copier NP-7550, manufactured by Canon Inc., and electrophotographic characteristics concerning white spots, coarse image and ghost were similarly evaluated after a durability test for continuous paper-feeding image formation of 2,500,000 sheets was carried out.

Comparative Example C7

Example C7 was repeated except that the fluorine atom content in the photoconductive layer was changed to 0.5 atomic ppm, 100 atomic ppm, 150 atomic ppm and 300 atomic ppm, to give electrophotographic light-receiving members corresponding to such changes. Evaluation was made in the same manner as in Example C7. Results of evaluation in Example C7 and Comparative Example C7 before the accelerated durability test are shown in Table C13. Results of evaluation in Example C7 and Comparative Example C7 after the accelerated durability test are shown in Table C14.

As is seen from the results, the photoconductive layer 12 with a fluorine atom content set within the range of from 1 to 95 atomic ppm, which is in accordance with the present invention, can contribute improvements in image characteristics and durability.

EXAMPLE C8

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table C15. Electrophotographic light-receiving members 10 were thus produced in the same manner as in Example C7.

Comparative Example C8

Example C8 was repeated except that the fluorine atom content in the photoconductive layer was changed to 0.5 atomic ppm, 150 atomic ppm and 300 atomic ppm, to give electrophotographic light-receiving members corresponding to such changes. Their characteristics were evaluated in the same manner as in Example C8. Results of evaluation in Example C8 and Comparative Example C8 were the same as the results of evaluation in Example C7 and Comparative Example C7, respectively.

EXAMPLE C9

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table C16. Electrophotographic light-receiving members 10 were thus produced. In the present Example, the fluorine atom content in the photoconductive layer 12 was controlled to be 50 atomic %. The flow rate of $CO_2$ fed when the photoconductive layer 12 was formed was varied so that the oxygen atom content therein was varied in the range of from 10 to 5,000 atomic ppm. The oxygen atom content in the photoconductive layer 12 was measured by elementary analysis using SIMS (CAMECA IMS-3F).

The electrophotographic light-receiving members 10 thus produced were each set in a test-purpose modified electrophotographic apparatus of a copier NP-7550, manufactured by Canon Inc., and electrophotographic characteristics concerning chargeability, sensitivity, residual potential and potential shift were evaluated in the following manner.

(1) Chargeability, sensitivity and residual potential:

Evaluated in the same manner as in Example C1.

(2) Potential shift:

The electrophotographic light-receiving member 10 is set in the test apparatus, and a high voltage of +6 kV is applied to a charger to effect corona charging. The dark portion surface potential of the electrophotographic light-receiving member 10 is measured using a surface potentiometer. A difference between Vdo and Vd wherein Vdo is a dark portion surface potential at the stage where the voltage is begun to be applied to the charger and Vd is a dark portion surface potential after 2 minutes has lapsed is regarded as the amount of potential shift.

Comparative Example C9

Example C9 was repeated except that the oxygen atom content in the photoconductive layer was changed to 5 atomic ppm, 7 atomic ppm, 5,500 atomic ppm, 6,000 atomic ppm and 8,000 atomic ppm, to give electrophotographic light-receiving members corresponding to such changes, and their characteristics were evaluated in the same manner as in Example C9. Results of evaluation in Example C9 and Comparative Example C9 are shown in Table C17.

As is seen from the results shown in the tables, the photoconductive layer 12 with an oxygen atom content set within the range of from 10 to 5,000 atomic ppm, which is in accordance with the present invention, can be very effective for improving potential shift.

EXAMPLE C10

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table C18. Electrophotographic light-receiving members 10 were thus produced in the same manner as in Example C9.

Comparative Example C10

Example C10 was repeated except that the oxygen atom content in the photoconductive layer was changed to 5 atomic ppm, 7 atomic ppm, 5,500 ppm, 6,000 ppm and 8,000 atomic ppm, to give electrophotographic light-receiving members corresponding to such changes. Their characteristics were evaluated in the same manner as in Example C10. Results of evaluation in Example C10 and Comparative Example C10 were the same as the results of evaluation in Example C9 and Comparative Example C9, respectively.

EXAMPLE C11

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table C19. Electrophotographic light-receiving members 10 were thus produced. In the present Example, the power applied and the flow rate of $CH_4$ fed when the surface layer 13 was formed were varied so that the carbon atom content in the vicinity of the outermost surface of the surface layer 13 was varied in the range of from 63 to 90 atomic % based on the total of silicon atom content and carbon atom content. Here, the carbon atom content in the surface layer 13 at its surface on the side of the photoconductive layer 12 was controlled to be 10 atomic %.

The electrophotographic light-receiving members 10 thus produced were each set in a test-purpose modified electrophotographic apparatus of a copier NP-7550, manufactured by Canon Inc., and electrophotographic characteristics concerning chargeability, sensitivity and residual potential and image characteristics concerning smeared image, white spots, black dots caused by melt-adhesion of toner, and scratches were respectively evaluated. Characteristics of the electrophotographic light-receiving members 10 were again evaluated on the above items after a durability test for continuous paper-feeding image formation of 2,500,000 sheets using reprocessed paper. Evaluation for each item was made in the following manner.

(1) Chargeability, sensitivity and residual potential:

Evaluated in the same manner as in Example C1.

(2) Smeared image:

A test chart manufactured by Canon Inc. (parts number FY9-9058) with a white background having characters on its whole area was placed on a copy board, and copies are taken at an amount of exposure twice the amount of usual exposure. Copy images obtained are observed to examine whether or not the fine lines on the image are continuous without break-off. When unevenness was seen on the image during this evaluation, the evaluation was made on the whole-area image region and the results are given in respect of the worst area.

(3) White spots:

Evaluated in the same manner as in Example C3.

(4) Black dots caused by melt-adhesion of toner:

A whole-area white test chart prepared by Canon Inc. was placed on a copy board to make copies. Black dots of 0.1 mm or more in width and 0.5 mm or more in length, present in the same area of the copied images thus obtained, were counted.

(5) Scratches:

A halftone test chart prepared by Canon Inc. was placed on a copy board to make copies. Scratches of 0.05 mm or more in width and 0.2 mm or more in length were counted, which are present in the area of 340 mm in width (corresponding to one rotation of the electrophotographic light-receiving member 10) and 297 mm in length of the copied images thus obtained, were counted.

Comparative Example C11

Example C11 was repeated except that the carbon atom content in the vicinity of the outermost surface of the surface layer was changed to 20 to 60 atomic % and 93 to 95 atomic % based on the total of silicon atom content and carbon atom content, to give electrophotographic light-receiving members corresponding to such changes. Evaluation was made in the same manner as in Example C11. Results of evaluation in Example C11 and Comparative Example C11 before the durability test are shown in Table C20. Results of evaluation in Example C11 and Comparative Example C11 after the durability test are shown in Table C21.

As is seen from the results shown in the tables, the electrophotographic light-receiving members 10 according to the present invention in which the carbon atom content in the vicinity of the outermost surface of the surface layer 13 is set within the range of from 63 to 90 atomic % based on the total of silicon atom content and carbon atom content can bring about good electrophotographic characteristics.

EXAMPLE C12

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table C22. Electrophotographic light-receiving members 10 were thus produced in the same manner as in Example C10.

Characteristics of the electrophotographic light-receiving members 10 thus produced were evaluated in the same manner as in Example C11. Results obtained were the same as those in Example C11.

Comparative Example C12

Example C11 was repeated except that the carbon atom content in the vicinity of the outermost surface of the surface layer was changed to 20 to 60 atomic % and 93 to 95 atomic % based on the total of silicon atom content and carbon atom content, to give electrophotographic light-receiving members corresponding to such changes. Their characteristics were evaluated in the same manner as in Example C11. As a result, a deterioration of characteristics was seen.

EXAMPLE C13

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table C23. Electrophotographic light-receiving members 10 were thus produced. In the present Example, the flow rate of $CO_2$ fed when the surface layer 13 was formed was varied so that the oxygen atom content in the surface layer 13 was varied in the range of from $1\times10^{-4}$ to 30 atomic %.

The electrophotographic light-receiving members 10 thus produced were each set in a test-purpose modified electrophotographic apparatus of a copier NP-7550, manufactured by Canon Inc., and electrophotographic characteristics concerning chargeability, sensitivity and residual potential and image characteristics concerning smeared image, white spots, black dots caused by melt-adhesion of toner, and scratches were respectively evaluated in the same manner as in Example C11. Characteristics of the electrophotographic light-receiving members 10 were again evaluated on the above items after a durability test for continuous paper-feeding image formation of 2,500,000 sheets using reprocessed paper.

Comparative Example C13

Example C13 was repeated except that the oxygen atom content in the surface layer was changed to $1\times10^{-5}$ atomic % and 40 to 50 atomic %, to give electrophotographic light-receiving members corresponding to such changes. Evaluation was made in the same manner as in Example C13. Results of evaluation in Example C13 and Comparative Example C13 before the durability test are shown in Table C24. Results of evaluation in Example C13 and Comparative Example C13 after the durability test are shown in Table C25.

As is seen from the results shown in the tables, the electrophotographic light-receiving members 10 according to the present invention in which the oxygen atom content in the surface layer 13 is set within the range of from $1\times10^{-4}$ to 30 atomic % can bring about good electrophotographic characteristics.

EXAMPLE C14

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table C26. Electrophotographic light-receiving members 10 were thus produced in the same manner as in Example C13.

Characteristics of the electrophotographic light-receiving members 10 thus produced were evaluated in the same manner as in Example C13. Results obtained were the same as those in Example C13.

Comparative Example C14

Example C14 was repeated except that the oxygen atom content in the surface layer was changed to $1\times10^{-5}$ atomic % and 40 to 50 atomic % to give electrophotographic light-receiving members corresponding to such changes. Evaluation was made in the same manner as in Example C13. As a result, a deterioration of characteristics was seen.

EXAMPLE C15

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table C27. Electrophotographic light-receiving members 10 were thus produced. In the present Example, the flow rate of $N_2$ fed when the surface layer 13 was formed was varied so that the nitrogen atom content in the surface layer 13 was varied in the range of from $1\times10^{-4}$ to 30 atomic %.

The electrophotographic light-receiving members 10 thus produced were each set in a test-purpose modified electrophotographic apparatus of a copier NP-7550, manufactured by Canon Inc., and electrophotographic characteristics concerning chargeability, sensitivity and residual potential and image characteristics concerning smeared image, white spots, black dots caused by melt-adhesion of toner, and scratches were respectively evaluated in the same manner as in Example C11. Characteristics of the electrophotographic light-receiving members 10 were again evaluated on the above items after a durability test for continuous paper-feeding image formation of 2,500,000 sheets using reprocessed paper.

Comparative Example C15

Example C15 was repeated except that the nitrogen atom content in the surface layer was changed to $1\times10^{-5}$ atomic % and 40 to 50 atomic %, to give electrophotographic light-receiving members corresponding to such changes. Evaluation was made in the same manner as in Example C15. Results of evaluation in Example C15 and Comparative Example C15 before the durability test are shown in Table C28. Results of evaluation in Example C15 and Comparative Example C15 after the durability test are shown in Table C29.

As is seen from the results of evaluation, the electrophotographic light-receiving members 10 according to the present invention in which the nitrogen atom content in the surface layer is set within the range of from $1\times10^{-4}$ to 30 atomic % can bring about good electrophotographic characteristics.

EXAMPLE C16

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table C30. Electrophotographic light-receiving members 10 were thus produced in the same manner as in Example C15.

Characteristics of the electrophotographic light-receiving members 10 thus produced were evaluated in the same manner as in Example C15. Results obtained were the same as those in Example C15.

Comparative Example C16

Example C16 was repeated except that the nitrogen atom content in the surface layer was changed $1\times10^{-5}$ atomic % and 40 to 50 atomic %, to give electrophotographic light-receiving members corresponding to such changes. Evaluation was made in the same manner as in Example C16. As a result, a deterioration of characteristics was seen.

EXAMPLE C17

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table C31. Electrophotographic light-receiving members 10 were thus produced. In the present Example, the flow rate of $B_2H_6$ fed when the surface layer 13 was formed was varied so that the content of boron atoms used as Group III element in the surface layer 13 was varied in the range of from $1\times10^{-5}$ to $1\times10^{5}$ atomic ppm.

The electrophotographic light-receiving members 10 thus produced were each set in a test-purpose modified electrophotographic apparatus of a copier NP-7550, manufactured by Canon Inc., and electrophotographic characteristics concerning chargeability, sensitivity and residual potential and image characteristics concerning smeared image, white spots, black dots caused by melt-adhesion of toner, and scratches were respectively evaluated in the same manner as in Example C11. Characteristics of the electrophotographic light-receiving members 10 were again evaluated on the above items after a running test for continuous paper-feeding image formation of 2,500,000 sheets using reprocessed paper.

Comparative Example C17

Example C17 was repeated except that the boron atom content in the surface layer was changed to $1\times10^{-6}$ atomic ppm and $1\times10^{6}$ atomic ppm, to give electrophotographic light-receiving members corresponding to such changes. Evaluation was made in the same manner as in Example C17. Results of evaluation in Example C17 and Comparative Example C17 before the durability test are shown in Table C32. Results of evaluation in Example C17 and Comparative Example C17 after the durability test are shown in Table C33.

As is seen from the results shown in the tables, the electrophotographic light-receiving members 10 according to the present invention in which the boron atom (Group III element) content in the surface layer 13 is set within the range of from $1\times10^{-5}$ to $1\times10^{5}$ atomic ppm can bring about good electrophotographic characteristics.

EXAMPLE C18

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table C34. Electrophotographic light-receiving members 10 were thus produced in the same manner as in Example C17.

Characteristics of the electrophotographic light-receiving members 10 thus produced were evaluated in the same manner as in Example C17. Results obtained were the same as those in Example C17.

Comparative Example C18

Example C18 was repeated except that the boron atom content in the surface layer was changed to $1\times10^{-6}$ atomic ppm and $1\times10^{6}$ atomic ppm, to give electrophotographic light-receiving members corresponding to such changes. Evaluation was made in the same manner as in Example C18. As a result, a deterioration of characteristics was seen.

EXAMPLE C19

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table C35. Electrophotographic light-receiving members 10 were thus produced. In the present Example, the powder applied and flow rate of $SiF_4$ fed when the surface layer 13 was formed were varied so that the hydrogen atom content and fluorine atom (used as a halogen atom) content in the surface layer 13 were varied to control the total of the hydrogen atom content and fluorine atom content so as to be not more than 80 atomic %.

The electrophotographic light-receiving members 10 thus produced were each set in a test-purpose modified electrophotographic apparatus of a copier NP-7550, manufactured by Canon Inc., and electrophotographic characteristics concerning chargeability, sensitivity and residual potential and image characteristics concerning smeared image, white spots, black dots caused by melt-adhesion of toner, and scratches were respectively evaluated in the same manner as in Example C11. Characteristics of the electrophotographic light-receiving members 10 were again evaluated on the above items after a durability test for continuous paper-feeding image formation of 2,500,000 sheets using reprocessed paper.

Comparative Example C19

Example C19 was repeated except that no $SiF_4$ was fed when the surface layer was formed, to give electrophotographic light-receiving members corresponding to such changes. Evaluation was made in the same manner as in Example C19. Results of evaluation in Example C19 and Comparative Example C19 before the durability test are shown in Table C36. Results of evaluation in Example C19 and Comparative Example C19 after the durability test are shown in Table C37.

In Tables C36 and C37, instances in which fluorine atom content is zero (with asterisks) show results of evaluation in Comparative Example C19; and other instances, results of evaluation in Example C19.

As is seen from the results shown in the tables, the electrophotographic light-receiving members 10 according to the present invention in which the surface layer 13 contains a halogen atom and the total of the hydrogen atom content and fluorine atom (halogen atom) content is set within the range of 80 atomic % or less can bring about good electrophotographic characteristics.

EXAMPLE C20

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table C38. Electrophotographic light-receiving members 10 were thus produced in the same manner as in Example C19.

Characteristics of the electrophotographic light-receiving members 10 thus produced were evaluated in the same manner as in Example C19. Results obtained were the same as those in Example C19.

Comparative Example C20

Example C20 was repeated except that no $SiF_4$ was fed when the surface layer was formed, to give electrophotographic light-receiving members corresponding to such changes. Evaluation was made in the same manner as in Example C20. As a result, a deterioration of characteristics was seen.

EXAMPLE C21

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table C39. Electrophotographic light-receiving members 10 were thus produced. In the present Example, the flow rate of NO fed when the surface layer 13 was formed was varied so that the total of the oxygen atom content and nitrogen atom content in the surface layer 13 was varied in the range of from $1\times10^{-4}$ to 30 atomic %.

The electrophotographic light-receiving members 10 thus produced were each set in a test-purpose modified electrophotographic apparatus of a copier NP-7550, manufactured by Canon Inc., and electrophotographic characteristics concerning chargeability, sensitivity and residual potential and image characteristics concerning smeared image, white spots, black dots caused by melt-adhesion of toner, and scratches were respectively evaluated in the same manner as in Example C11. Characteristics of the electrophotographic light-receiving members 10 were again evaluated on the above items after a durability test for continuous paper-feeding image formation of 2,500,000 sheets using reprocessed paper.

Comparative Example C21

Example C21 was repeated except that the total of the oxygen atom content and nitrogen atom content in the surface layer was changed to $1\times10^{-5}$ and 40 to 50 atomic %, to give electrophotographic light-receiving members corresponding to such changes. Evaluation was made in the same manner as in Example C21. Results of evaluation in Example C21 and Comparative Example C21 before the durability test are shown in Table C40. Results of evaluation in Example C21 and Comparative Example C21 after the durability test are shown in Table C41.

As is seen from the results of evaluation, the electrophotographic light-receiving members 10 according to the present invention in which the total of the oxygen atom content and nitrogen atom content in the surface layer 13 is set within the range of from $1\times10^{-4}$ to 30 atomic % can bring about good electrophotographic characteristics.

EXAMPLE C22

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table C42. Electrophotographic light-receiving members 10 were thus produced in the same manner as in Example C20.

Characteristics of the electrophotographic light-receiving members 10 thus produced were evaluated in the same manner as in Example C21. Results obtained were the same as those in Example C21.

Comparative Example C22

Example C22 was repeated except that the total of the oxygen atom content and nitrogen atom content in the surface layer was changed to $1\times10^{-5}$ atomic % and 40 to 50 atomic %, to give electrophotographic light-receiving members corresponding to such changes. Evaluation was made in the same manner as in Example C22. As a result, a deterioration of characteristics was seen.

EXAMPLE D1

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table D1. An electrophotographic light-receiving member 10 was thus produced. In the present Example, the flow rate of $CH_4$ fed when the photoconductive layer 12 was formed was varied so that the carbon atom content in the photoconductive layer 12 was changed in a pattern of changes as shown in FIG. 8. The carbon atom content in the photoconductive layer 12 at its surface on the side of the conductive substrate 11 was so controlled as to be 30 atomic %. The carbon atom content was measured by elementary analysis using the Rutherford backward scattering method.

The electrophotographic light-receiving member thus produced was set in a test-purpose modified electrophotographic apparatus of a copier NP-7550, manufactured by Canon Inc., and chargeability, sensitivity, residual potential and potential shift were evaluated. Evaluation for each item was made in the following manner.

(1) Chargeability:

Evaluated in the same manner as in Example A1.

(2) Sensitivity:

Evaluated in the same manner as in Example A1.

(3) Residual potential:

Evaluated in the same manner as in Example A1.

(4) Potential shift:

Evaluated in the same manner as in Example C9.

Comparative Example D1

What is called a function-separated electrophotographic light-receiving member having on a conductive substrate a first photoconductive layer, a second photoconductive layer and a surface layer in a three-layer structure was produced in the same manner as in Example D1 and under conditions shown in Table D2.

Characteristics of the electrophotographic light-receiving member thus produced were evaluated in the same manner as in Example D1. Results of evaluation in Example D1 and Comparative Example D1 are shown in Table D3.

As is seen from the results of evaluation, the electrophotographic light-receiving member 10 with the layer structure according to the present invention (Example D1) is improved in chargeability, sensitivity and potential shift, and also underwent no changes in residual potential, showing better results in chargeability, sensitivity, residual potential and potential shift than Comparative Example D1.

EXAMPLE D2

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table D4. An electrophotographic light-receiving member 10 was thus produced in the same manner as in Example D1.

Characteristics of the electrophotographic light-receiving member 10 thus produced were evaluated in the same manner as in Example D1.

Comparative Example D2

What is called a function-separated electrophotographic light-receiving member having on a conductive substrate a first photoconductive layer, a second photoconductive layer and a surface layer in a three-layer structure was produced in the same manner as in Example D2 and under conditions shown in Table D5.

Characteristics of the electrophotographic light-receiving member thus produced were evaluated in the same manner as in Example D1. Results of evaluation in Example D2 and Comparative Example D2 were entirely the same as the results of evaluation in Example D1 and Comparative Example D1, respectively.

EXAMPLE D3

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table D6. Electrophotographic light-receiving members 10 were thus produced. In the present Example, the flow rate of $CH_4$ fed when the photoconductive layer 12 was formed was varied so that the carbon atom content in the photoconductive layer 12 was varied in a pattern of changes as shown in FIGS. 8 to 10 each. In all patterns, the carbon atom content in the photoconductive layer 12 at its surface on the side of the conductive substrate 11 was so controlled as to be 30 atomic %. The carbon atom content was measured by elementary analysis using the Rutherford backward scattering method.

The electrophotographic light-receiving members 10 thus produced were each set in a test-purpose modified electrophotographic apparatus of a copier NP-7550, manufactured by Canon Inc., and chargeability, sensitivity, residual potential and potential shift were evaluated. Evaluation for each item was made in the same manner as in Example D1.

Comparative Example D3

Electrophotographic light-receiving members were produced in the same manner as in Example D3 but in patterns of changes in carbon atom content as shown in FIGS. 11 and 12. characteristics of the electrophotographic light-receiving member thus produced were evaluated in the same manner as in Example D3. Results of evaluation in Example D3 and Comparative Example D3 are shown in Table D7.

As is seen from the results of evaluation, the electrophotographic light-receiving members 10 having in the photoconductive layer 12 the pattern of carbon atom content according to the present invention (Example D3) are improved in chargeability, sensitivity and potential shift, and also underwent no changes in residual potential, showing better results in chargeability, sensitivity and residual potential than Comparative Example D3.

EXAMPLE D4

Using the μW glow discharge manufacturing apparatus as shown in FIG. 5 and according to the procedure previously described in detail, light-receiving layers were each formed on a mirror-finished aluminum cylinder of 108 mm in diameter under conditions shown in Table D8. Electrophotographic light-receiving members 10 were thus produced. In the present Example, the flow rate of $CH_4$ fed when the photoconductive layer 12 was formed was varied so that the carbon atom content in the photoconductive layer 12 was varied in patterns of changes as shown in FIGS. 8 to 10. In all patterns, the carbon atom content in the photoconductive layer 12 at its surface on the side of the conductive substrate 11 was so controlled as to be 30 atomic %. The carbon atom content was measured by elementary analysis using the Rutherford backward scattering method.

Characteristics of the electrophotographic light-receiving members 10 thus produced were evaluated in the same manner as in Example D3.

Comparative Example D4

Electrophotographic light-receiving members were produced in the same manner as in Example D4 but in patterns of changes in carbon atom content as shown in FIGS. 11 and 12 each.

Characteristics of the electrophotographic light-receiving members thus produced were evaluated in the same manner as in Example D4. Results of evaluation in Example D4 and Comparative Example D4 were entirely the same as the results of evaluation in Example D3 and Comparative Example D3, respectively.

EXAMPLE D5

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table D9. Electrophotographic light-receiving members 10 were thus produced. In the present Example, the pattern shown in FIG. 8 was used as a pattern of changes of carbon atom content in the photoconductive layer 12, and the flow rate of $CH_4$ fed when the photoconductive layer 12 was formed was varied so that the carbon atom content in that layer at its surface on the side of the conductive substrate 11 was varied from 0.5 atomic % to 50 atomic %. Thus, electrophotographic light-receiving members 10 corresponding to such variations were produced. The carbon atom content in the photoconductive layer 12 at its surface on the side of the conductive substrate 11 was measured by elementary analysis using the Rutherford backward scattering method.

The electrophotographic light-receiving members 10 thus produced were each set in a test-purpose modified electrophotographic apparatus of a copier NP-7550, manufactured by Canon Inc., and their electrophotographic characteristics concerning charge characteristic, sensitivity, residual potential, white spots, coarse image and ghost were evaluated. Number of spherical projections on the surfaces of electrophotographic light-receiving members 10 was also examined to make evaluation. Evaluation for each item was made in the same manner as in Example A5.

Comparative Example D5

Example D5 was repeated except that the carbon atom content at the surface on the conductive substrate side was changed to 0.3 atomic %, 60 atomic and 70 atomic %. Electrophotographic light-receiving members corresponding to such changes were thus produced. Evaluation was made in the same manner as in Example D5. Results of evaluation in Example D5 and Comparative Example D5 are shown in Table D10.

As is seen from the results, the photoconductive layer 12 with a carbon atom content of from 0.5 to 50 atomic % at its surface on the side of the conductive substrate 11, which is in accordance with the present invention, can contribute improvements in the characteristics. As is also seen therefrom, the photoconductive layer 12 with a carbon atom content of from 1 to 30 atomic % at its surface on the side of the conductive substrate 11 can bring about very good results.

EXAMPLE D6

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table D11. Electrophotographic light-receiving members 10 were thus produced in the same manner as in Example D5. In the present Example, the pattern shown in FIG. 8 was used as a pattern of changes of carbon atom content in the photoconductive layer 12, and the flow rate of $CH_4$ fed when the photoconductive layer 12 was formed was varied so that the carbon atom content in that layer at its surface on the side of the conductive substrate 11 was varied from 0.5 atomic % to 50 atomic %. Thus, electrophotographic light-receiving members 10 corresponding to such variations were produced.

Characteristics of the electrophotographic light-receiving members 10 thus produced were evaluated in the same manner as in Example D5.

Comparative Example D6

Example D6 was repeated except that the carbon atom content at the surface on the conductive substrate side was changed to 0.3 atomic %, 60 atomic and 70 atomic %. Electrophotographic light-receiving members corresponding to such changes were thus produced. Evaluation was made in the same manner as in Example D5.

Results of evaluation in Example D6 and Comparative Example D6 were the same as the results of evaluation in Example D5 and Comparative Example D5, respectively.

EXAMPLE D7

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table D12. Electrophotographic light-receiving members 10 were thus produced. In the present Example, the flow rate of $CO_2$ and/or flow rate of $SiF_4$ fed when the photoconductive layer 12 was formed were varied so that the oxygen atom content and fluorine atom content in the photoconductive layer 12 were varied. Thus, electrophotographic light-receiving members 10 corresponding to such variations were produced. The oxygen atom content and fluorine atom content in the photoconductive layer 12 were measured by elementary analysis using SIMS (CAMECA IMS-3F).

The electrophotographic light-receiving members 10 thus produced were each set in a test-purpose modified electrophotographic apparatus of a copier NP-7550, manufactured by Canon Inc., and electrophotographic characteristics concerning white spots, coarse image and ghost were evaluated in the same manner as in Example D5 before an accelerated durability test was carried out. Next, the electrophotographic light-receiving members 10 thus produced were each set in the test-purpose modified electrophotographic apparatus of a copier NP-7550, manufactured by Canon Inc., and electrophotographic characteristics concerning white spots, coarse image and ghost were similarly evaluated after an accelerated durability test which corresponded to copying of 200,000 sheets was carried out.

Comparative Example D7

Example D7 was repeated except that the fluorine atom content in the photoconductive layer was changed to 100 atomic ppm, 200 atomic ppm and 500 atomic ppm and the oxygen atom content therein was changed to 6,000 atomic ppm, 8,000 atomic ppm and 10,000 atomic ppm, to give electrophotographic light-receiving members corresponding to such changes. Evaluation was made in the same manner as in Example D7.

Results of evaluation concerning "white spots" are shown in Table D13; results of evaluation concerning "coarse image", in Table D14; results of evaluation concerning "ghost", in Table D15; results of evaluation concerning "sensitivity", in Table D16; and results of evaluation concerning "potential shift", in Table D17.

As is seen from the results shown in these tables, the photoconductive layer 12 with a fluorine atom content set to 95 atomic ppm or less and an oxygen content within the range of from 10 to 5,000 atomic ppm can contribute improvements in surface potential characteristics, image characteristics and durability.

During the accelerated durability test, the cleaning blade and the separating claw were each observed using a microscope to reveal that the electrophotographic light-receiving members 10 of the present invention caused very little damage of the cleaning blade and caused very little wear of the separating claw.

With regard to instances in which there was an increase in spots after the durability test, the cause thereof was investigated. As a result, the following were found to have caused the increase in spots.

(1) The spherical projections drop off as a result of slidable friction with the cleaning blade and transfer paper.

(2) The paper dust of the transfer paper or the toner remaining on the electrophotographic light-receiving member accumulates on the charge wire to cause abnormal discharge in the separating charge assembly, so that the potential localizes on the surface of the electrophotographic light-receiving member to cause insulation breakdown in the film.

In the case of the electrophotographic light-receiving members 10 according to the present invention, the above two phenomenons did not occur.

An accelerated durability test corresponding to copying of 200,000 sheets was further similarly made using reprocessed paper. In the electrophotographic light-receiving members 10 of the present invention, no increase in "white spots" was seen.

EXAMPLE D8

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table D18. Electrophotographic light-receiving members 10 were thus produced in the same manner as in Example D7.

Comparative Example D8

Example D8 was repeated except that the fluorine atom content in the photoconductive layer was changed to 100 atomic ppm, 200 atomic ppm and 500 atomic ppm and the oxygen atom content to 6,000 atomic ppm, 8,000 atomic ppm and 10,000 atomic ppm, to give electrophotographic light-receiving members corresponding to such changes.

Characteristics of the electrophotographic light-receiving members 10 thus produced were evaluated in the same manner as in Example D7. Results of evaluation in Example D8 and Comparative Example D8 were the same as the results of evaluation in Example D7 and Comparative Example D7, respectively.

EXAMPLE D9

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table D19. Electrophotographic light-receiving members 10 were thus produced. In the present Example, the power applied and the flow rates of $CH_4$, $CO_2$ and $NH_3$ fed when the surface layer 13 was formed were varied so that total of the carbon atom content, oxygen atom content and nitrogen atom content in the surface layer 13 was varied in the range of from 40 to 90 atomic %.

The electrophotographic light-receiving members 10 thus produced were each set in a test-purpose modified electrophotographic apparatus of a copier NP-6650, manufactured by Canon Inc., and electrophotographic characteristics concerning chargeability, sensitivity and residual potential and image characteristics concerning smeared images and so forth were evaluated. Characteristics of the electrophotographic light-receiving members 10 were again evaluated after an accelerated durability test which corresponded to copying of 2,500,000 sheets using reprocessed paper. Evaluation for each item was made in the following manner.

(1) Chargeability, sensitivity and residual potential:

Evaluated in the same manner as in Example D1.

(2) Smeared image:

A test chart manufactured by Canon Inc. (parts number FY9-9058) with a white background having characters on its whole area was placed on a copy board, and copies are made at an amount of exposure twice the amount of usual exposure. Copy images obtained are observed to examine whether or not the fine lines on the image are continuous without break-off. When unevenness was seen on the image during this evaluation, the evaluation was made on the whole-area image region and the results are given in respect of the worst area.

(3) Evaluation of images:

Five-rank criterion samples were prepared for evaluation concerning white spots and scratches, and evaluation was made as the total of the results of evaluation.

Comparative Example D9

Example D9 was repeated except that the total of the hydrogen atom content and fluorine atom content in the surface layer was changed to less than 40 atomic % and more than 90 atomic %. Electrophotographic light-receiving members corresponding to such changes were thus produced. Evaluation was made in the same manner as in Example D9.

Comparative Example D10

Example D9 was repeated except that no $CH_4$ was used when the surface layer was formed and the total of the oxygen atom content and nitrogen atom content in the surface layer was changed to 60 atomic %. An electrophotographic light-receiving member was thus produced. Evaluation was made in the same manner as in Example D9.

Comparative Example D11

Example D9 was repeated except that no $CO_2$ was used when the surface layer was formed and the total of the carbon atom content and nitrogen atom content in the surface layer was changed to 60 atomic %. An electrophotographic light-receiving member was thus produced. Evaluation was made in the same manner as in Example D9.

Comparative Example D12

Example D9 was repeated except that no $NH_3$ was used when the surface layer was formed and the total of the carbon atom content and oxygen atom content in the surface layer was changed to 60 atomic %. An electrophotographic light-receiving member was thus produced. Evaluation was made in the same manner as in Example D9.

Results of evaluation in Example D9 and Comparative Examples D9to D12 are shown in Table D20.

As is seen from the results of evaluation, the surface layer 13 in which the total of the carbon atom content, oxygen atom content and nitrogen atom content is controlled in the range of from 40 to 90 atomic % can contribute remarkable improvements in chargeability and durability, and also the surface layer in which the total of the oxygen atom content and nitrogen atom content is controlled to be not more than 10 atomic % can bring about very good results.

EXAMPLE D10

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table D21. Electrophotographic light-receiving members 10 were thus produced in the same manner as in Example D9.

Characteristics of the electrophotographic light-receiving members 10 thus produced were evaluated in the same manner as in Example D9.

Comparative Example D13

Example D10 was repeated except that the total of the carbon atom content, oxygen atom content and nitrogen atom content in the surface layer was changed to less than 40 atomic % and more than 90 atomic %. Electrophotographic light-receiving members corresponding to such changes were thus produced. Evaluation was made in the same manner as in Example D10.

Comparative Example D14

Example D10 was repeated except that no $CH_4$ was used when the surface layer was formed and the total of the oxygen atom content and nitrogen atom content in the surface layer was changed to 60 atomic %. Electrophotographic light-receiving members were thus produced. Evaluation was made in the same manner as in Example D10.

Comparative Example D15

Example D10 was repeated except that no $CO_2$ was used when the surface layer was formed and the total of the carbon atom content and nitrogen atom content in the surface layer was changed to 60 atomic %. Electrophotographic light-receiving members were thus produced. Evaluation was made in the same manner as in Example D10.

Comparative Example D16

Example D10 was repeated except that no $NH_3$ was used when the surface layer was formed and the total of the carbon atom content and oxygen atom content in the surface layer was changed to 60 atomic %. Electrophotographic light-receiving members were thus produced. Evaluation was made in the same manner as in Example D10.

Results of evaluation in Example D10 and Comparative Examples D13 to D16 were the same as the results of evaluation in Example D9 and Comparative Examples D9 to D12, respectively.

EXAMPLE D11

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table D22. Electrophotographic light-receiving members 10 were thus produced. In the present Example, the power applied and the flow rate of $H_2$ and/or flow rate of $SiF_4$ fed when the surface layer 13 was formed were varied so that the fluorine atom content in the surface layer 13 was not more than 20 atomic % and the total of the hydrogen atom content and fluorine atom content was in the range of from 30 to 70 atomic %.

The electrophotographic light-receiving members 10 thus produced were each set in a test-purpose modified electrophotographic apparatus of a copier NP-8550, manufactured by Canon Inc., and characteristics on 3 items concerning sensitivity, residual potential and smeared images were respectively evaluated. Evaluation for each item was made in the following manner.

(1) Sensitivity and residual potential:

Evaluated in the same manner as in Example D1.

(2) Smeared image:

Evaluated in the same manner as in Example D9.

Comparative Example D17

Example D11 was repeated except that the total of the hydrogen atom content and fluorine atom content in the surface layer was changed to less than 30 atomic % and more than 70 atomic %. Electrophotographic light-receiving members corresponding to such changes were thus produced. Evaluation was made in the same manner as in Example D11.

Comparative Example D18

Example D11 was repeated except that the fluorine atom content in the surface layer was changed to more than 20 atomic %. Electrophotographic light-receiving members corresponding to such changes were thus produced. Evaluation was made in the same manner as in Example D11.

Comparative Example D19

Example D11 was repeated except that no $SiF_4$ was used when the surface layer was formed. Electrophotographic light-receiving members corresponding to such changes were thus produced. Evaluation was made in the same manner as in Example D11.

Results of evaluation in Example D11 and Comparative Examples D17 to D19 are shown in Table D23.

As is seen from the results of evaluation, the electrophotographic light-receiving members 10 according to the present invention in which the total of the hydrogen atom content and fluorine atom content in the surface layer 13 was so controlled as to be in the range of from 30 to 70 atomic % and the fluorine atom content not more than 20 atomic % can bring about good results in both the sensitivity and the characteristic, and also can greatly prohibit smeared images from occurring under strong exposure.

EXAMPLE D12

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table D24. Electrophotographic light-receiving members 10 were thus produced in the same manner as in Example D11.

Characteristics of the electrophotographic light-receiving members thus produced were evaluated in the same manner as in Example D11. Results of evaluation were the same as those in Example D12.

Comparative Example D20

Example D12 was repeated except that the total of the hydrogen atom content and fluorine atom content in the surface layer was changed to less than 30% and more than 70 atomic % Electrophotographic light-receiving members corresponding to such changes were thus produced. Evaluation was made in the same manner as in Example D12.

Example D12 was repeated except that the fluorine atom content in the surface layer was changed to more than 20 atomic % Electrophotographic light-receiving members corresponding to such changes were thus produced. Evaluation was made in the same manner as in Example D12.

Comparative Example D22

Example D12 was repeated except that no $SiF_4$ was used when the surface layer was formed. Electrophotographic light-receiving members corresponding to such changes were thus produced. Evaluation was made in the same manner as in Example D12.

Results of evaluation in Example D12 and Comparative Examples D20 to D22 were the same as the results of evaluation in Example D11 and Comparative Examples D17 to D19, respectively.

EXAMPLE D13

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table D25. Electrophotographic light-receiving members 10 were thus produced. In the present Example, the boron atom content in the photoconductive layer 12 was varied as shown in Table D26. Hydrogen-based diborane (100 ppm $B_2H_6/H_2$) was used as the starting material gas.

The electrophotographic light-receiving members 10 thus produced were each set in a test-purpose modified electrophotographic apparatus of a copier NP-6650, manufactured by Canon Inc., and chargeability, sensitivity and residual potential were respectively evaluated in the same manner as in Example D1. Results of evaluation in Example D13 and Comparative Example D23 are shown in Table D27. Comparative Example D23 was conducted in the same manner as in Example B13 except that diborane was not employed.

As is seen from the results of evaluation, the photoconductive layer 12 doped with boron atoms can contribute improvements particularly in sensitivity and residual potential.

EXAMPLE D14

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table D28. Electrophotographic light-receiving members 10 were thus produced in the same manner as in Example D13.

Characteristics of the electrophotographic light-receiving members thus produced were evaluated in the same manner as in Example D13. Results of evaluation were the same as those in Example D13.

EXAMPLE E1

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table E1. An electrophotographic light-receiving member was thus produced. In the present Example, the flow rate of $CH_4$ fed when the photoconductive layer was formed was varied so that the carbon content in the photoconductive layer was changed in a pattern of changes as shown in FIG. 8. The carbon content in the photoconductive layer at its surface on the side of the substrate was so controlled as to be 30 atomic %. The carbon content was measured by elementary analysis using the Rutherford backward scattering method.

The electrophotographic light-receiving member thus produced was set in a test-purpose modified electrophotographic apparatus of a copier NP-7550, manufactured by Canon Inc., and chargeability, sensitivity and residual potential were evaluated. Evaluation for each item was made in the same manner as in Example A1.

Comparative Example E1

What is called a function-separated electrophotographic light-receiving member having on a substrate a first photoconductive layer, a second photoconductive layer and a surface layer in a three-layer structure was produced in the same manner as in Example E1 and under conditions shown in Table E2. Characteristics of the electrophotographic light-receiving member thus produced were evaluated in the same manner as in Example E1.

Results of evaluation in Example E1 and Comparative Example E1 are shown together in Table E3. The electrophotographic light-receiving member with the layer structure according to the present invention is improved in chargeability and sensitivity, and also undergoes no changes in residual potential.

EXAMPLE E2

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example E1 except for using μW (microwave) glow-discharging, under conditions shown in Table E4. An electrophotographic light-receiving member was thus produced. Characteristics of the electrophotographic light-receiving member thus produced were evaluated in the same manner as in Example E1.

Comparative Example E2

What is called a function-separated electrophotographic light-receiving member having on a substrate a first photoconductive layer, a second photoconductive layer and a surface layer in a three-layer structure was produced in the same manner as in Example E2 and under conditions shown in Table E5. Characteristics of the electrophotographic light-receiving member thus produced were evaluated in the same manner as in Example E2.

Results of evaluation in Example E2 and Comparative Example E2 were entirely the same as the results of evaluation in Example E1 and Comparative Example E1, respectively.

EXAMPLE E3

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table E6. Electrophotographic light-receiving members were thus produced. In the present Example, the flow rate of $CH_4$ fed when the photoconductive layer was formed was varied so that the carbon content in the photoconductive layer was varied in patterns of changes as shown in FIGS. 8 to 10. In all patterns, the carbon content in the photoconductive layer at its surface on the side of the substrate was so controlled as to be 30 atomic %. The carbon content was measured by elementary analysis using the Rutherford backward scattering method.

The electrophotographic light-receiving members thus produced were each set in a test-purpose modified electrophotographic apparatus of a copier NP-7550, manufactured by Canon Inc., and chargeability, sensitivity and residual potential were evaluated. Evaluation for each item was made in the same manner as in Example E1.

Comparative Example E3

Electrophotoeraphic light-receiving members were produced in the same manner as in Example E3 but in patterns of changes in carbon content as shown in FIGS. 11 and 12. Characteristics of the electrophotographic light-receiving member thus produced were evaluated in the same manner as in Example E3.

Results of evaluation in Example E3 and Comparative Example E3 are shown together in Table E7. The photoconductive layer having the carbon content in the pattern of changes according to the present invention contributes improvements in improved in chargeability and sensitivity, and also causes no deterioration of residual potential.

EXAMPLE E4

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example E3 except for using μW glow-discharging, under conditions shown in Table E8. Electrophotographic light-receiving members were thus produced. In the present Example, the flow rate of $CH_4$ fed when the photoconductive layer was formed was varied so that the carbon content in the photoconductive layer was varied in patterns of changes as shown in FIGS. 8 to 10. In all patterns, the carbon content in the photoconductive layer at its surface on the side of the substrate was so controlled as to be 30 atomic %. The carbon content was measured by elementary analysis using the Rutherford backward scattering method. Characteristics of the electrophotographic light-receiving member thus produced were evaluated in the same manner as in Example E3.

Comparative Example E4

Electrophotographic light-receiving members were produced in the same manner as in Example E4 but in patterns of changes in carbon content as shown in FIGS. 11 and 12. Characteristics of the electrophotographic light-receiving members thus produced were evaluated in the same manner as in Example E4.

Results of evaluation in Example E4 and Comparative Example E4 were entirely the same as the results of evaluation in Example E3 and Comparative Example E3, respectively.

EXAMPLE E5

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table E9. Electrophotographic light-receiving members were thus produced. In the present Example, the pattern shown in FIG. 8 was used as a pattern of changes of carbon content in the photoconductive layer, and the flow rate of $CH_4$ fed when the photoconductive layer was formed was varied so that the carbon content in that layer at its surface on the substrate side was varied from 0.5 atomic % to 50 atomic %. Thus, electrophotographic light-receiving members corresponding to such variations were produced. The carbon content in the photoconductive layer at its surface on the side of the substrate was measured by elementary analysis using the Rutherford backward scattering method.

The electrophotographic light-receiving members thus produced were each set in a test-purpose modified electrophotographic apparatus of a copier NP-7550, manufactured by Canon Inc., and their electrophotographic characteristics concerning chargeability, sensitivity, residual potential, white spots, coarse image and ghost were evaluated. Number of spherical projections on the surfaces of electrophotographic light-receiving members was also examined to make evaluation. Evaluation for each item was made in the following manner.

(1) Chargeability, sensitivity and residual potential:

Evaluated in the same manner as in Example E1.

(2) White spots, coarse image, ghost, and number of spherical projections:

Evaluated in the same manner as in Example A5.

Comparative Example E5

Example E5 was repeated except that the carbon content at the surface on the substrate side was changed to 0.3 atomic %, 60 atomic % and 70 atomic %. Electrophotographic light-receiving members corresponding to such changes were thus produced. Evaluation was made in the same manner as in Example E5.

Results of evaluation in Example E5 and Comparative Example E5 are shown together in Table E10. As is seen from the results, the photoconductive layer with a carbon content of from 0.5 to 50 atomic % at its surface on the side of the substrate 11, which is in accordance with the present invention, can contribute improvements in the characteristics of the electrophotographic light-receiving member, and also bring about a decrease in spherical projections. Very good results are obtained when the carbon content is 1 to 30 atomic %.

EXAMPLE E6

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example E5 except for using μW glow-discharging, under conditions shown in Table E11. Electrophotographic light-receiving members were thus produced. In the present Example, the pattern shown in FIG. 8 was used as a pattern of changes of carbon content in the photoconductive layer, and the flow rate of $CH_4$ fed when the photoconductive layer was formed was varied so that the carbon content in that layer at its surface on the substrate side was varied from 0.5 atomic % to 50 atomic %. Thus, electrophotographic light-receiving members corresponding to such variations were produced, Evaluation was made in the same manner as in Example E5.

Comparative Example E6

Example E6 was repeated except that the carbon content at the surface on the substrate side was changed to 0.3 atomic %, 60 atomic % and 70 atomic %. Electrophotographic light-receiving members corresponding to such changes were thus produced. Evaluation was made in the same manner as in Example E6.

Results of evaluation in Example E6 and Comparative Example E6 were the same as the results of evaluation in Example E5 and Comparative Example E5, respectively.

EXAMPLE E7

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table E12. Electrophotographic light-receiving members were thus produced. In the present Example, the flow rate of $SiF_4$ fed when the photoconductive layer was formed was varied so that the fluorine content in the photoconductive layer was varied as shown in FIGS. 13 to 20. Thus, electrophotographic light-receiving members corresponding to such variations were produced. The fluorine content in the photoconductive layer was measured by elementary analysis using SIMS (CAMECA IMS-3F).

(I) The electrophotographic light-receiving members thus produced were each set in a test-purpose modified electrophotographic apparatus of a copier NP-7550, manufactured by Canon Inc., and electrophotographic characteristics concerning white spots, coarse image and ghost were evaluated in the same manner as in Example E5 before an accelerated durability test was carried out.

(II) Next, the electrophotographic light-receiving members thus produced were each set in the test-purpose modified electrophotographic apparatus of a copier NP-7550, manufactured by Canon Inc., and an accelerated durability test which corresponded to copying of 2,500,000 sheets was carried out. Then, electrophotographic characteristics concerning white spots, coarse image ghost and the like were evaluated similarly to (I).

Comparative Example E7

Figure 21:
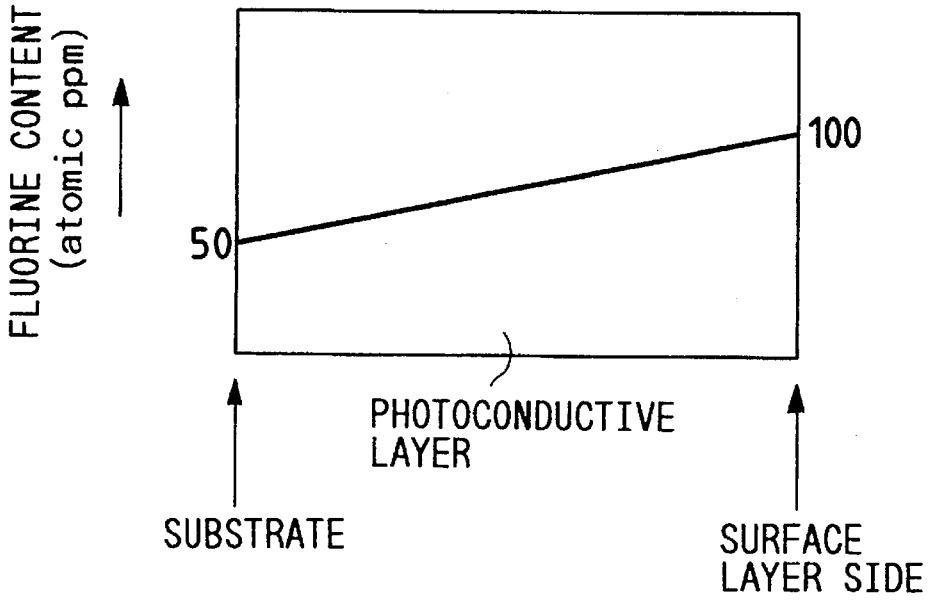
Figure 22:
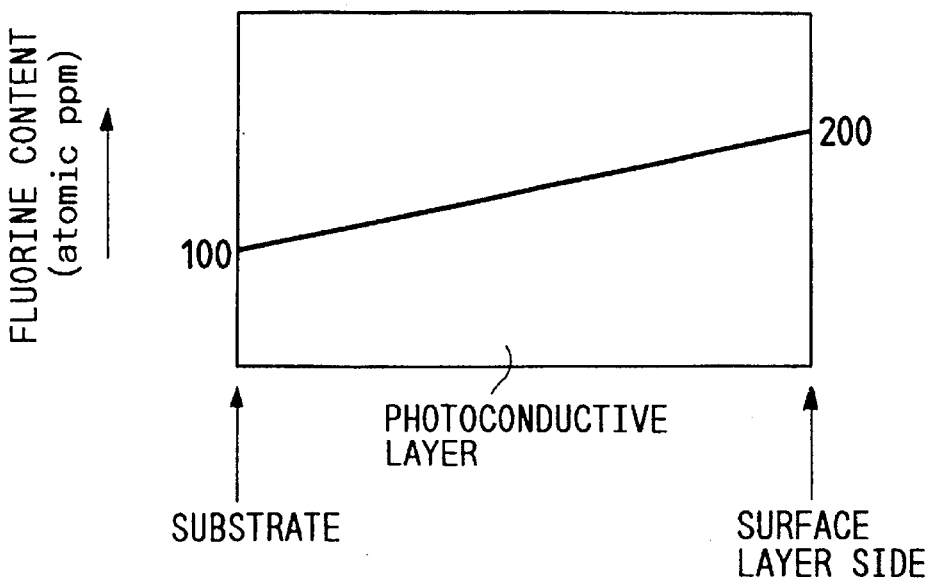

Example E7 was repeated except that the fluorine content in the photoconductive layer was varied as shown in FIGS. 21 and 22, to give electrophotographic light-receiving members corresponding to such variations. Evaluation was made in the same manner as in Example E7.

Results of evaluation in Example E7 and Comparative Example E7 are shown together in Tables E13 and E14, respectively. As is seen from the results, the photoconductive layer with a fluorine content set within the range of from 1 to 95 atomic ppm in the photoconductive layer, which is in accordance with the present invention, can contribute improvements in image characteristics and durability. Very good results are obtained when the fluorine content is 5 to 50 atomic ppm.

EXAMPLE E8

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example E7 except for using μW glow-discharging, under conditions shown in Table E15. Electrophotographic light-receiving members were thus produced. In the present Example, the flow rate of $SiF_4$ fed when the photoconductive layer was formed was varied so that the fluorine content in the photoconductive layer was varied as shown in FIGS. 13 to 20. Thus, electrophotographic light-receiving members corresponding to such variations were produced. Characteristics of the electrophotographic light-receiving members thus produced were evaluated in the same manner as in Example E7.

Comparative Example E8

Example E8 was repeated except that the fluorine content in the photoconductive layer was varied as shown in FIGS. 21 and 22, to give electrophotographic light-receiving members corresponding to such variations. Evaluation was made in the same manner as in Example E8.

Results of evaluation in Example E8 and Comparative Example E8 were the same as the results of evaluation in Example E7 and Comparative Example E7, respectively.

EXAMPLE E9

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table E16. Electrophotographic light-receiving members were thus produced. In the present Example, the flow rate of $SiF_4$ fed when the photoconductive layer was formed was varied so that the fluorine content in the photoconductive layer was varied as shown in FIGS. 23 to 26. Here, the fluorine content in the photoconductive layer was varied in the range of from 1 atomic ppm to 95 atomic ppm. The fluorine content in the photoconductive layer was measured by elementary analysis using SIMS (CAMECA IMS-3F).

(I) The electrophotographic light-receiving members thus produced were each set in a test-purpose modified electrophotographic apparatus of a copier NP-7550, manufactured by Canon Inc., and electrophotographic characteristics concerning temperature characteristics, chargeability, uneven images, white spots, coarse image, ghost and the like were evaluated in the following manner.

(1) Temperature characteristics:

Surface temperature of the electrophotographic light-receiving member produced was varied from 30° to 45° C., and a high voltage of +6 kV is applied to a charger to effect corona charging. The dark portion surface potential of the light-receiving member is measured using a surface potentiometer. The changes in surface temperature of the dark portion with respect to the surface temperature are approximated in a straight line. The slope thereof is regarded as "temperature characteristics", and shown in unit of [V/deg].

AA: Particularly good.

A: Good.

B: No problems in practical use.

C: Problematic in practical use in some cases.

(2) Chargeability:

Evaluated in the same manner as in Example E1.

(3) Uneven image density:

A halftone chart prepared by Canon Inc (parts number: FY9-9042) is placed on a copy board to make copies of 200 sheets. On the copied images thus obtained, assuming a round region of 0.5 mm in diameter as one unit, image densities on 100 spots are measured to determine average of the image densities. Then the average scattering of the image densities among images on 200 sheets is examined.

AA: Particularly good.

A: Good.

B: No problems in practical use.

C: Problematic in practical use in some cases.

(4) White spots, coarse image and ghost:

Evaluated in the same manner as in Example E5.

(II) Next, the electrophotographic light-receiving members thus produced were each set in the test-purpose modified electrophotographic apparatus of a copier NP-7550, manufactured by Canon Inc., and an accelerated durability test which corresponded to copying of 2,500,000 sheets was carried out. Then, electrophotographic characteristics concerning temperature characteristics, chargeability, uneven images, white spots, coarse image and ghost were evaluated similarly to (I).

Comparative Example E9

Figure 27:
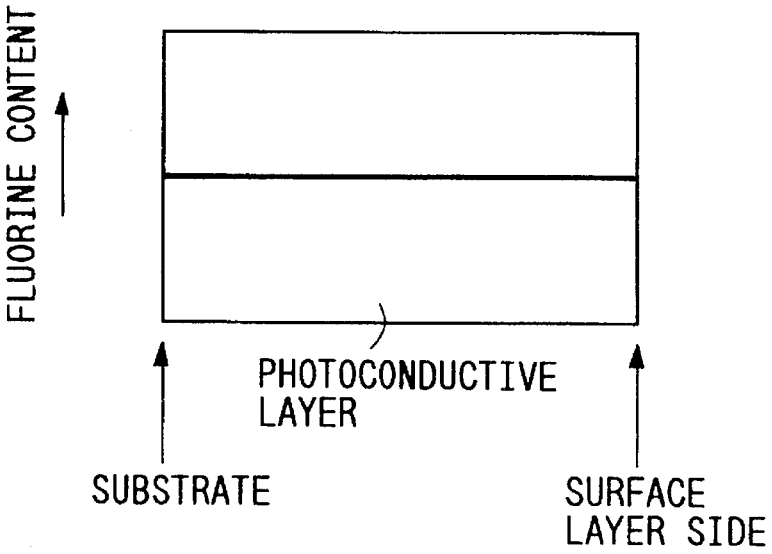

Example E9 was repeated except that fluorine content in the photoconductive layer was made constant in a pattern as shown in FIG. 27, to give an electrophotographic light-receiving member. Its characteristics were evaluated in the same manner as in Example E9. Here, the fluorine content in the photoconductive layer was measured by elementary analysis using SIMS (CAMECA IMS-3F) to reveal that it was constant at 25 atomic ppm.

Results of evaluation in Example E9 and Comparative Example E9 are shown together in Tables E17 and E18, respectively.

As is clear from the results shown in Tables E17 and E18, the photoconductive layer with a fluorine content varied in the layer thickness direction is very effective for improving image characteristics and durability.

EXAMPLE E10

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example E9 except for using μW glow-discharging, under conditions shown in Table E19. Electrophotographic light-receiving members were thus produced. Characteristics of the electrophotographic light-receiving members thus produced was evaluated in the same manner as in Example E9.

Comparative Example E10

Example E10 was repeated except that fluorine content in the photoconductive layer was made constant in a pattern as shown in FIG. 27, to give an electrophotographic light-receiving member. Its characteristics were evaluated in the same manner as in Example E10. Here, the fluorine content in the photoconductive layer was measured by elementary analysis using SIMS (CAMECA IMS-3F) to reveal that it was constant at 25 atomic ppm.

Results of evaluation in Example E10 and Comparative Example E10 were the same as those in Example E9 and Comparative Example E9, respectively.

EXAMPLE E11

Figure 28:
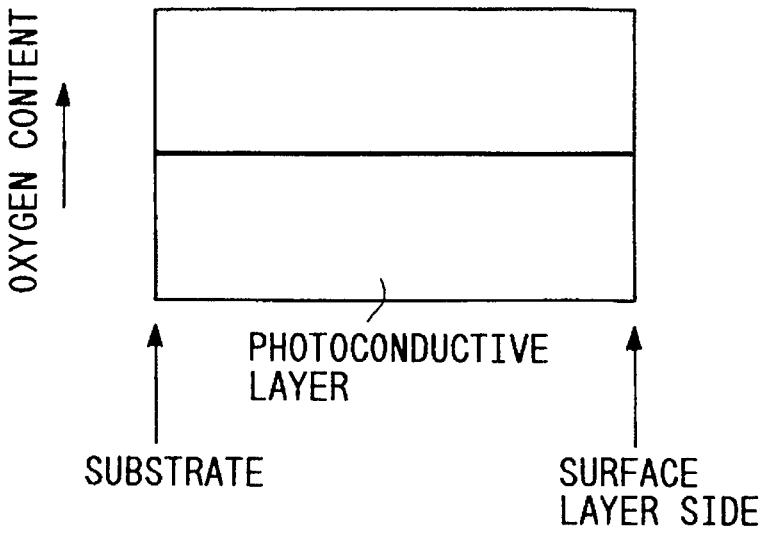
FIGS. 28 to 32 are respectively schematic distribution diagrams for illustrating oxygen distribution in a layer thickness direction in a photoconductive layer (or a first photoconductive layer) of a light-receiving member.

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table E20. Electrophotographic light-receiving members were thus produced. In the present Example, the oxygen content in the photoconductive layer in its layer thickness direction was made constant in a pattern as shown in FIG. 28, and the flow rate of $CO_2$ fed when the photoconductive layer was formed was varied so that the oxygen content in the photoconductive layer was varied in the range of from 10 atomic ppm to 5,000 atomic ppm. Thus, electrophotographic light-receiving members corresponding to such variations were produced. The oxygen content in the photoconductive layer was measured by elementary analysis using SIMS (CAMECA IMS-3F).

The electrophotographic light-receiving members thus produced were each set in a test-purpose modified electrophotographic apparatus of a copier NP-7550, manufactured by Canon Inc., and electrophotographic characteristics concerning chargeability, sensitivity, residual potential, potential shift and the like were evaluated.

(1) Chargeability, sensitivity and residual potential:

Evaluated in the same manner as in Example E1.

(2) Potential shift:

Evaluated in the same manner as in Example C9.

Comparative Example E11

Example E11 was repeated except that the oxygen content in the photoconductive layer was changed to 5 atomic ppm, 7 atomic ppm and 5,500 to 8,000 atomic ppm, to Give electrophotographic light-receiving members corresponding to such changes. Their characteristics were evaluated in the same manner as in Example E11.

Results of evaluation in Example E11 and Comparative Example E11 are shown together in Table E21. As is clear from the results, the photo-conductive layer with an oxygen content set within the range of from 10 to 5,000 ppm is very effective in regard to an improvement in potential shift.

EXAMPLE E12

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example E11 except for using μW Glow-discharging, under conditions shown in Table E22. Electrophotographic light-receiving members were thus produced. In the present Example, the oxygen content in the photoconductive layer in its layer thickness direction was made constant in a pattern as shown in FIG. 28, and the flow rate of $CO_2$ fed when the photoconductive layer was formed was varied so that the oxygen content in the photoconductive layer was varied in the range of from 10 atomic ppm to 5,000 atomic ppm. Thus, electrophotographic light-receiving members corresponding to such variations were produced. Characteristics of the electrophotographic light-receiving members produced were evaluated in the same manner as in Example E11.

Comparative Example E12

Example E12 was repeated except that the oxygen content in the photoconductive layer was changed to 5 atomic ppm, 7 atomic ppm and 5,500 to 8,000 atomic ppm, to give electrophotographic light-receiving members corresponding to such changes. Their characteristics were evaluated in the same manner as in Example E12.

Results of evaluation in Example E12 and Comparative Example E12 were the same as those in Example E11 and Comparative Example E11, respectively.

EXAMPLE E13

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table E23. Electrophotographic light-receiving members were thus produced. In the present Example, the flow rate of $CO_2$ fed when the photoconductive layer was formed was varied so that the oxygen content in the photoconductive layer was varied as shown in FIGS. 28 to 32. Here, the oxygen content in the photoconductive layer was varied in the range of from 10 atomic ppm to 500 atomic ppm. The oxygen content in the photoconductive layer was measured by elementary analysis using SIMS (CAMECA IMS-3F).

The electrophotographic light-receiving members thus produced were each set in a test-purpose modified electrophotographic apparatus of a copier NP-7550, manufactured by Canon Inc., and electrophotographic characteristics concerning chargeability, sensitivity, residual potential, potential shift and the like were evaluated in the same manner as in Examples E1 and E11, after an accelerated durability test which corresponded to copying of 2,500,000 sheets was carried out.

Comparative Example E13

Using the electrophotographic light-receiving member manufacturing apparatus as shown in FIG. 4, an electrophotographic light-receiving member was produced in the same manner as in Example E13 by RF glow discharging, under conditions shown in Table E26, except that in the present Comparative Example, no $CO_2$ was used when the photoconductive layer was formed and no oxygen was incorporated in the photoconductive layer. Characteristics of the electrophotographic light-receiving members produced were evaluated in the same manner as in Example E13.

Results of evaluation in Example E13 and Comparative Example E13 are shown together in Table E24. As is clear from the results shown in Table E24, the photoconductive layer containing oxygen atoms whose content is preferably varied in the layer thickness direction can contribute improvements in electrophotographic characteristics and durability.

EXAMPLE E14

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example E13 except for using μW glow-discharging, under conditions shown in Table E25. Electrophotographic light-receiving members were thus produced. Characteristics of the electrophotographic light-receiving members produced were evaluated in the same manner as in Example E13.

Comparative Example E14

Using the electrophotographic light-receiving member manufacturing apparatus as shown in FIG. 5 and according to the procedure previously described in detail, a light-receiving layer was formed on a mirror-finished aluminum cylinder of 108 mm in diameter by μW glow-discharging. An electrophotographic light-receiving member was thus produced in the same manner as in Example E14 under conditions shown in Table E25, except that in the present Comparative Example no $CO_2$ was used when the photoconductive layer was formed, and no oxygen was incorporated in the photoconductive layer. Characteristics of the electrophotographic light-receiving members produced were evaluated in the same manner as in Example E13.

Results of evaluation in Example E14 and Comparative Example E14 were the same as those in Example E13 and Comparative Example E13, respectively.

EXAMPLE E15

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table E26. Electrophotographic light-receiving members were thus produced. In the present Example, the power applied and the flow rates of $CH_4$, $CO_2$ and $NH_3$ fed when the surface layer was formed were varied so that the total of the carbon atom content, oxygen atom content and nitrogen atom content in the surface layer was varied in the range of from 40 atomic % to 90 atomic % based on the total of the silicon atom content, carbon atom content, oxygen atom content and nitrogen atom content. Thus, electrophotographic light-receiving members corresponding to such variations were produced.

In order to better evaluate the characteristics of the electrophotographic light-receiving members produced, they were each set in a test-purpose modified electrophotographic apparatus of a copier NP-6650, manufactured by Canon Inc., aiming at a higher image quality. Characteristics concerning chargeability, sensitivity, residual potential, smeared image, images before a durability test, and images after an accelerated durability test which corresponded to copying of 2,500,000 sheets, were evaluated in the following manner.

Chargeability

The electrophotographic light-receiving member is set in the test apparatus, and a high voltage of +6 kV is applied to a charger to effect corona charging. The dark portion surface potential of the electrophotographic light-receiving member is measured using a surface potentiometer.

AA: Particularly good.

A: Good.

B: No problems in practical use.

Sensitivity

The electrophotographic photosensitive member is charged to have a given dark portion surface potential, and immediately thereafter irradiated with light to form a light image. The light image is formed using a xenon lamp light source, by irradiating the surface with light from which light with a wavelength in the region of 550 nm or less has been removed using a filter. At this time the light portion surface potential of the electrophotographic light-receiving member is measured using a surface potentiometer. The amount of exposure is adjusted so as for the light portion surface potential to be at a given potential, and the amount of exposure used at this time is regarded as the sensitivity.

AA: Particularly good.

A: Good.

B: No problems in practical use.

Residual potential

The electrophotographic light-receiving member is charged to have a given dark portion surface potential, and immediately thereafter irradiated with light to form a light image. The light image is formed using a xenon lamp light source, by irradiating the surface with a given amount of light from which light with a wavelength in the region of 550 nm or less has been removed using a filter. At this time the light portion surface potential of the electrophotographic light-receiving member is measured using a surface potentiometer.

AA: Particularly good.

A: Good.

B: No problems in practical use.

Smeared image

A test chart manufactured by Canon Inc. (parts number FY9-9058) with a white background having characters on its whole area was placed on a copy board, and copies were made at an amount of exposure twice the amount of usual exposure. Copy images obtained are observed to examine whether or not the fine lines on the image are continuous without break-off. When unevenness was seen on the image during this evaluation, the evaluation was made on the whole-area image region and the results are given in respect of the worst area.

AA: Good.

A: Lines are broken off in part.

B: Lines are broken off at many portions, but can be read as characters with no problem in practical use.

Image evaluation

Five-rank criterion samples were prepared for evaluation concerning white spots and scratches, and the total of the results of evaluation is grouped into the following four grades.

AA: Particularly good.

A: Good.

B: No problems in practical use.

C: Problematic in practical use in some cases.

Comparative Example E15

Example E15 was repeated except that the total of the carbon atom content, oxygen atom content and nitrogen atom content in the surface layer was changed to less than 40 atomic % and more than 90 atomic %. Electrophotographic light-receiving members corresponding to such changes were thus produced. Evaluation was made in the same manner as in Example E15.

Comparative Example E16

Example E15 was repeated except that no $CH_4$ was used when the surface layer was formed, $CO_2$ was replaced with NO and the total of the oxygen atom content and nitrogen atom content in the surface layer was changed to 60 atomic %. Electrophotographic light-receiving members were thus produced. Evaluation was made in the same manner as in Example E15.

Comparative Example E17

Example E15 was repeated except that no $CO_2$ was used when the surface layer was formed and the total of the carbon atom content and nitrogen atom content in the surface layer was changed to 60 atomic %. An electrophotographic light-receiving member was thus produced. Evaluation was made in the same manner as in Example E15.

Comparative Example E18

Example E15 was repeated except that no $NH_3$ was used when the surface layer was formed and the total of the carbon atom content and oxygen atom content in the surface layer was changed to 60 atomic %. Electrophotographic light-receiving members were thus produced. Evaluation was made in the same manner as in Example E15.

Results of evaluation in Example E15 and Comparative Examples E15 to E18 are shown together in Table E27. As is seen from the results of evaluation, the surface layer in which the total of the carbon atom content, oxygen atom content and nitrogen atom content is controlled in the range of from 40 to 90 atomic % based on the total of the silicon atom content, carbon atom content, oxygen atom content and nitrogen atom content can contribute remarkable improvements in electrophotographic characteristics and durability, and also the surface layer in which the total of the oxygen atom content and nitrogen atom content is controlled to be not more than 10 atomic % can bring about very good results.

EXAMPLE E16

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example E15 except for using μW glow-discharging, under conditions shown in Table E28. Electrophotographic light-receiving members were thus produced. In the present Example, the power applied and the flow rates of $CH_4$, $CO_2$ and $NH_3$ fed when the surface layer was formed were varied so that the total of the carbon atom content, oxygen atom content and nitrogen atom content in the surface layer was varied in the range of from 40 atomic % to 90 atomic % based on the total of the silicon atom content, carbon atom content, oxygen atom content and nitrogen atom content. Thus, electrophotographic light-receiving members corresponding to such variations were produced. Characteristics of the electrophotographic light-receiving members produced were evaluated in the same manner as in Example E15.

Comparative Example E18a

Example E16 was repeated except that the total of the carbon atom content, oxygen atom content and nitrogen atom content in the surface layer was changed to less than 40 atomic % and more than 90 atomic %. Electrophotographic light-receiving members corresponding to such changes were thus produced. Evaluation was made in the same manner as in Example E16.

Comparative Example E19

Example E16 was repeated except that no $CH_4$ was used when the surface layer was formed, $CO_2$ was replaced with NO and the total of the oxygen atom content and nitrogen atom content in the surface layer was changed to 60 atomic %. Electrophotographic light-receiving members were thus produced. Evaluation was made in the same manner as in Example E16.

Comparative Example E20

Example E16 was repeated except that no $CO_2$ was used when the surface layer was formed and the total of the carbon atom content and nitrogen atom content in the surface layer was changed to 60 atomic %. Electrophotographic light-receiving members were thus produced. Evaluation was made in the same manner as in Example E16.

Comparative Example E21

Example E16 was repeated except that no $NH_3$ was used when the surface layer was formed and the total of the carbon atom content and oxygen atom content in the surface layer was changed to 60 atomic %. Electrophotographic light-receiving members were thus produced. Evaluation was made in the same manner as in Example E16.

Results of evaluation in Example E16 and Comparative Examples E18a to E21 were the same as those in Example E16 and Comparative Examples E15 to E18, respectively.

EXAMPLE E17

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table E29. Electrophotographic light-receiving members were thus produced. In the present Example, the power applied and the flow rate of $H_2$ and/or flow rate of $SiF_4$ fed when the surface layer was formed were varied so that the fluorine atom content in the surface layer was not more than 20 atomic % and the total of the hydrogen atom content and fluorine atom content was in the range of from 30 to 70 atomic %.

The electrophotographic light-receiving members thus produced were each set in a test-purpose modified electrophotographic apparatus of a copier NP-6650, manufactured by Canon Inc., and characteristics concerning residual potential, sensitivity and smeared images were respectively evaluated in the same manner as in Example E15.

Comparative Example E22

Example E17 was repeated except that the total of the hydrogen atom content and fluorine atom content in the surface layer was changed to less than 30 atomic % and more than 70 atomic %. Electrophotographic light-receiving members corresponding to such changes Were thus produced. Evaluation was made in the same manner as in Example E17.

Comparative Example E23

Example E17 was repeated except that the fluorine atom content in the surface layer was changed to more than 20 atomic %. Electrophotographic light-receiving members corresponding to such changes were thus produced. Evaluation was made in the same manner as in Example E17.

Comparative Example E24

Example E17 was repeated except that no $SiF_4$ was used when the surface layer was formed. Electrophotographic light-receiving members corresponding to such changes were thus produced. Evaluation was made in the same manner as in Example E17.

Results of evaluation in Example E17 and Comparative Examples E22 to E24 are shown together in Table E30. As is seen from the results shown in Table E30, the electrophotographic light-receiving members with a surface layer in which the total of the hydrogen atom content and fluorine atom content is set within the range of from 30 to 70 atomic % and the fluorine atom content within the range of not more than 20 atomic % can bring about good results on both the residual potential and the sensitivity, and also can greatly prohibit smeared images from occurring under strong exposure.

EXAMPLE E18

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example E17 except for using μW glow-discharging, under conditions shown in Table E31. Electrophotographic light-receiving members were thus produced. Characteristics of the electrophotographic light-receiving members produced were evaluated in the same manner as in Example E17.

Comparative Example E25

Example E18 was repeated except that the total of the hydrogen atom content and fluorine atom content in the surface layer was changed to less than 30 atomic % and more than 70 atomic %. Electrophotographic light-receiving members corresponding to such changes were thus produced. Evaluation was made in the same manner as in Example E18.

Comparative Example E26

Example E18 was repeated except that the fluorine atom content in the surface layer was changed to more than 20 atomic %. Electrophotographic light-receiving members corresponding to such changes were thus produced. Evaluation was made in the same manner as in Example E18.

Comparative Example E27

Example E18 was repeated except that no $SiF_4$ was used when the surface layer was formed. Electrophotographic light-receiving members corresponding to such changes were thus produced. Evaluation was made in the same manner as in Example E18.

Results of evaluation in Example E18 and Comparative Examples E25 to E27 were the same as those in Example E17 and Comparative Examples E22 to E24, respectively.

EXAMPLE E19

Using the RF glow-discharging manufacturing apparatus for the electrophotographic light-receiving member, as shown in FIG. 4, and according to the procedure previously described in detail, a light-receiving layer of an electrophotographic light-receiving member was formed on a mirror-finished aluminum cylinder of 108 mm in diameter under conditions shown in Table E32. In the present Example, the boron atom content in the photoconductive layer was varied as shown in Table E33. Hydrogen-based diborane (10 ppm $B_2H_6/H_2$) was used as the starting material gas.

The electrophotographic light-receiving members thus produced were each set in a test-purpose modified electrophotographic apparatus of a copier NP-7550, manufactured by Canon Inc., and chargeability, sensitivity and residual potential were evaluated. Evaluation for each item was made in the following manner.

(1) Chargeability, sensitivity and residual potential:

Evaluated in the same manner as in Example A1.

Results obtained are shown in Table E34. In Table E34, for comparison, results are shown as relative values assuming as 100 the values of the chargeability, sensitivity and residual potential obtained in the pattern a of boron atom content of Table E32.

As is clear from Table E34, the photoconductive layer doped with boron atoms can contribute improvements particularly in residual potential and sensitivity.

EXAMPLE E20

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example E27 except for using μW glow-discharging, under conditions shown in Table E35. Electrophotographic light-receiving members were thus produced. The pattern of changes of boron content was the same as shown in Table E33. Characteristics of the electrophotographic light-receiving members thus produced were evaluated in the same manner as in Example E27. Results of evaluation were the same as those in Example E34.

EXAMPLE F1

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table F1. An electrophotographic light-receiving member 10 was thus produced. In the present Example, the flow rate of $CH_4$ fed when the photoconductive layer 12 was formed was varied so that the carbon atom content in the photoconductive layer 12 was changed in a pattern of changes as shown in FIG. 8. The carbon atom content in the photoconductive layer 12 at its surface on the side of the conductive substrate 11 was so controlled as to be 30 atomic %. The carbon atom content was measured by elementary analysis using the Rutherford backward scattering method.

The electrophotographic light-receiving member 10 thus produced was set in a test-purpose modified electrophotographic apparatus of a copier NP-7550, manufactured by Canon Inc., and chargeability, sensitivity and residual potential were evaluated. Evaluation for each item was made in the same manner as described in Example A1.

Comparative Example F1

What is called a function-separated electrophotographic light-receiving member having on a conductive substrate a first photoconductive layer, a second photoconductive layer and a surface layer in a three-layer structure was produced in the same manner as in Example F1 and under conditions shown in Table F2.

Characteristics of the electrophotographic light-receiving member thus produced were evaluated in the same manner as in Example F1. Results of evaluation in Example F1 and Comparative Example F1 are shown in Table F3.

As is seen from the results of evaluation, the electrophotographic light-receiving member 10 with the layer structure according to the present invention (Example F1) is improved in chargeability and sensitivity, and also undergoes no changes in residual potential, showing better results in chargeability, sensitivity and residual potential than Comparative Example F1.

EXAMPLE F2

Using the pW glow discharge manufacturing apparatus as shown in FIG. 5 and according to the procedure previously described in detail, a light-receiving layer was formed on a mirror-finished aluminum cylinder of 108 mm in diameter under conditions shown in Table F4. An electrophotographic light-receiving member 10 was thus produced in the same manner as in Example F1.

Characteristics of the electrophotographic light-receiving member 10 thus produced were evaluated in the same manner as in Example F1.

Comparative Example F2

What is called a function-separated electrophotographic light-receiving member having on a conductive substrate a first photoconductive layer, a second photoconductive layer and a surface layer in a three-layer structure was produced in the same manner as in Example F2 and under conditions shown in Table F5.

Characteristics of the electrophotographic light-receiving member thus produced were evaluated in the same manner as in Example F1. Results of evaluation in Example F2 and Comparative Example F2 were entirely the same as the results of evaluation in Example F1 and Comparative Example F1, respectively.

EXAMPLE F3

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table F6. Electrophotographic light-receiving members 10 were thus produced. In the present Example, the flow rate of $CH_4$ fed when the photoconductive layer 12 was formed was varied so that the carbon atom content in the photoconductive layer 12 was varied in patterns of changes as shown in FIGS. 8 to 10. In all patterns, the carbon atom content in the photoconductive layer 12 at its surface on the side of the conductive substrate 11 was so controlled as to be 30 atomic %. The carbon atom content was measured by elementary analysis using the Rutherford backward scattering method.

The electrophotographic light-receiving members 10 thus produced were each set in a test-purpose modified electrophotographic apparatus of a copier NP-7550, manufactured by Canon Inc., and chargeability, sensitivity and residual potential were evaluated. Evaluation for each item was made in the same manner as in Example F1.

Comparative Example F3

Electrophotographic light-receiving members were produced in the same manner as in Example F3 but in patterns of changes in carbon atom content as shown in FIGS. 11 and 12. Characteristics of the electrophotographic light-receiving members thus produced were evaluated in the same manner as in Example F3. Results of evaluation in Example F3 and Comparative Example F3 are shown in Table F7.

As is seen from the results of evaluation, the electrophotographic light-receiving members 10 having in the photoconductive layer 12 the pattern of carbon atom content according to the present invention (Example F3) are improved in chargeability and sensitivity, and also undergoes no changes in residual potential, showing better results in all the chargeability, sensitivity and residual potential than Comparative Example F3.

EXAMPLE F4

Using the μW glow discharge manufacturing apparatus as shown in FIG. 5 and according to the procedure previously described in detail, light-receiving layers were each formed on a mirror-finished aluminum cylinder of 108 mm in diameter under conditions shown in Table F8. Electrophotographic light-receiving members 10 were thus produced in the same manner as in Example F3. In the present Example, the flow rate of $CH_4$ fed when the photoconductive layer 12 was formed was varied so that the carbon atom content in the photoconductive layer 12 was varied in patterns of changes as shown in FIGS. 8 to 10. In all patterns, the carbon atom content in the photoconductive layer 12 at its surface on the side of the conductive substrate 11 was so controlled as to be 30 atomic %. The carbon atom content was measured by elementary analysis using the Rutherford backward scattering method.

Characteristics of the electrophotographic light-receiving members 10 thus produced were evaluated in the same manner as in Example F3.

Comparative Example F4

Electrophotographic light-receiving members were produced in the same manner as in Example F4 but in patterns of changes in carbon atom content as shown in FIGS. 11 and 12.

Characteristics of the electrophotographic light-receiving members thus produced were evaluated in the same manner as in Example F4. Results of evaluation in Example F4 and Comparative Example F4 were entirely the same as the results of evaluation in Example F3 and Comparative Example F3, respectively.

EXAMPLE F5

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table F9. Electrophotographic light-receiving members 10 were thus produced. In the present Example, the pattern shown in FIG. 8 was used as a pattern of changes of carbon atom content in the photoconductive layer 12, and the flow rate of $CH_4$ fed when the photoconductive layer 12 was formed was varied so that the carbon atom content in that layer at its surface on the side of the conductive substrate 11 was varied from 0.5 atomic % to 50 atomic %. Thus, electrophotographic light-receiving members 10 corresponding to such variations were produced. The carbon atom content in the photoconductive layer 12 at its surface on the side of the conductive substrate 11 was measured by elementary analysis using the Rutherford backward scattering method.

The electrophotographic light-receiving members 10 thus produced were each set in a test-purpose modified electrophotographic apparatus of a copier NP-7550, manufactured by Canon Inc., and their electrophotographic characteristics concerning chargeability, sensitivity, residual potential, white spots, coarse image and ghost were evaluated. Number of spherical projections on the surfaces of electrophotographic light-receiving members 10 was also examined to make evaluation. Evaluation for each item was made in the same manner as in Example A5.

Comparative Example F5

Example F5 was repeated except that the carbon atom content at the surface on the conductive substrate side was changed to 0.3 atomic %, 60 atomic % and 70 atomic %. Electrophotographic light-receiving members corresponding to such changes were thus produced, Evaluation was made in the same manner as in Example F5, Results of evaluation in Example F5 and Comparative Example F5 are shown in Table F10.

As is seen from the results, the photoconductive layer 12 with a carbon atom content of from 0.5 to 50 atomic % at its surface on the side of the conductive substrate 11, which is in accordance with the present invention, can contribute improvements in the characteristics. As is also seen therefrom, the photoconductive layer 12 with a carbon atom content of from 1 to 30 atomic % at its surface on the side of the conductive substrate 11 can bring about very good results.

EXAMPLE F6

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table F11. Electrophotographic light-receiving members 10 were thus produced in the same manner as in Example F5. In the present Example, the pattern shown in FIG. 8 was used as a pattern of changes of carbon atom content in the photoconductive layer 12, and the flow rate of $CH_4$ fed when the photoconductive layer 12 was formed was varied so that the carbon atom content in that layer at its surface on the side of the conductive substrate 11 was varied from 0.5 atomic % to 50 atomic %. Thus, electrophotographic light-receiving members 10 corresponding to such variations were produced.

Characteristics of the electrophotographic light-receiving members 10 thus produced were evaluated in the same manner as in Example F5.

Comparative Example F6

Example F6 was repeated except that the carbon atom content at the surface on the conductive substrate side was changed to 0.3 atomic %, 60 atomic % and 70 atomic %.

Electrophotographic light-receiving members corresponding to such changes were thus produced. Evaluation was made in the same manner as in Example F6.

Results of evaluation in Example F6 and Comparative Example F6 were the same as the results of evaluation in Example F5 and Comparative Example F5, respectively.

EXAMPLE F7

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table F12. Electrophotographic light-receiving members 10 were thus produced. In the present Example, the flow rate of $SiF_4$ fed when the photoconductive layer 12 was formed was varied so that the fluorine atom content in the photoconductive layer 12 was varied as shown in FIGS. 13 to 20. Thus, electrophotographic light-receiving members 10 corresponding to such variations were produced. The fluorine atom content in the photoconductive layer 12 was measured by elementary analysis using SIMS (CAMECA IMS-3F).

The electrophotographic light-receiving members 10 thus produced were each set in a test-purpose modified electrophotographic apparatus of a copier NP-7550, manufactured by Canon Inc., and electrophotographic characteristics concerning white spots, coarse image and ghost were evaluated in the same manner before an accelerated durability test was carried out.

Next, the electrophotographic light-receiving members 10 thus produced were each set in the test-purpose modified electrophotographic apparatus of a copier NP-7550, manufactured by Canon Inc., and an accelerated durability test which corresponded to copying of 2,500,000 sheets was carried out. Then, electrophotographic characteristics concerning white spots, coarse image and ghost were similarly evaluated.

Comparative Example F7

Example F7 was repeated except that the fluorine atom content in the photoconductive layer was varied as shown in FIGS. 21 and 22, to give electrophotographic light-receiving members corresponding to such variations. Evaluation was made in the same manner as in Example F7. Results of evaluation in Example F7 and Comparative Example F7 before the accelerated durability test are shown in Table F13. Results of evaluation in Example F7 and Comparative Example F7 after the accelerated durability test are shown in Table F14.

As is seen from the results, the photoconductive layer 12 with a fluorine atom content set within the range of from 1 to 95 atomic %, which is in accordance with the present invention, can contribute improvements in image characteristics and durability. As is also seen therefrom, the photoconductive layer 12 with a fluorine atom content of from 5 to 50 atomic ppm can bring about very good results.

EXAMPLE F8

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table F15. Electrophotographic light-receiving members 10 were thus produced in the same manner as in Example F7. In the present Example, the flow rate of $SiF_4$ fed when the photoconductive layer 12 was formed was varied so that the fluorine atom content in the photoconductive layer 12 was varied as shown in FIGS. 13 to 20. Thus, electrophotographic light-receiving members 10 corresponding to such variations were produced. Characteristics of the electrophotographic light-receiving members 10 thus produced were evaluated in the same manner as in Example F7.

Comparative Example F8

Example F8 was repeated except that the fluorine atom content in the photoconductive layer was varied as shown in FIGS. 21 and 22, to give electrophotographic light-receiving members corresponding to such variations. Their characteristics were evaluated in the same manner as in Example F8. Results of evaluation in Example F8 and Comparative Example F8 were the same as the results of evaluation in Example F7 and Comparative Example F7, respectively.

EXAMPLE F9

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table F16. Electrophotographic light-receiving members 10 were thus produced. In the present Example, the flow rate of $SiF_4$ fed when the photoconductive layer 12 was formed was varied so that the fluorine atom content in the photoconductive layer 12 was varied in patterns of changes as shown in FIGS. 23 to 26. Thus, electrophotographic light-receiving members 10 corresponding to such variations were produced. Here, the fluorine atom content in the photoconductive layer 12 was varied in the range of from 1 atomic ppm to 95 atomic ppm. The fluorine atom content in the photoconductive layer 12 was measured by elementary analysis using SIMS (CAMECA IMS-3F).

The electrophotographic light-receiving members 10 thus produced were each set in a test-purpose modified electrophotographic apparatus of a copier NP-7550, manufactured by Canon Inc., and electrophotographic characteristics concerning white spots, coarse image, ghost, temperature characteristics, chargeability and uneven image density were evaluated in the following manner before an accelerated durability test was carried out.

(1) White spots, coarse image and ghost:
Evaluated in the same manner as in Example A5.
(2) Temperature characteristics:
Evaluated in the same manner as in Example E9.
(3) Chargeability:
Evaluated in the same manner as in Example A1.
(4) Uneven image density:
Evaluated in the same manner as in Example E9

Next, the electrophotographic light-receiving members 10 thus produced were each set in the test-purpose modified electrophotographic apparatus of a copier NP-7550, manufactured by Canon Inc., and an accelerated durability test which corresponded to copying of 2,500,000 sheets was carried out. Then, electrophotographic characteristics concerning white spots, coarse image, ghost, temperature characteristics, chargeability and uneven image density were similarly evaluated.

Comparative Example F9

Example F9 was repeated except that fluorine content in the photoconductive layer was made constant in a pattern as shown in FIG. 27, to give an electrophotographic light-receiving member. Its characteristics were evaluated in the same manner as in Example F9. Here, the fluorine content in the photoconductive layer was measured by elementary analysis using SIMS (CAMECA IMS-3F) to reveal that it was constant at 25 atomic ppm. Results of evaluation in Example F9 and Comparative Example F9 before the accelerated durability test are shown in Table F17, and results of evaluation in Example F9 and Comparative Example F9 after the accelerated durability test are shown in Table F18. In Tables F17 and 18, "AA" indicates "particularly good"; "A", "good"; "B", "no problem in practical use"; and "C", "problematic in practical use in some cases".

As is clear from the results of evaluation shown in Tables F17 and F18, the photoconductive layer 12 with a fluorine content varied in the layer thickness direction is very effective for improving image characteristics and durability.

EXAMPLE F10

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table F19. Electrophotographic light-receiving members 10 were thus produced in the same manner as in Example F9.

Characteristics of the electrophotographic light-receiving members 10 thus produced was evaluated in the same manner as in Example F9.

Comparative Example F10

Example F10 was repeated except that fluorine content in the photoconductive layer was made constant in a pattern as shown in FIG. 27, to give an electrophotographic light-receiving member. Its characteristics were evaluated in the same manner as in Example F10. Here, the fluorine content in the photoconductive layer was measured by elementary analysis using SIMS (CAMECA IMS-3F) to reveal that it was constant at 25 atomic ppm. Results of evaluation in Example F10 and Comparative Example F10 were the same as those in Example F9 and Comparative Example F9, respectively.

EXAMPLE F11

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table F20. Electrophotographic light-receiving members 10 were thus produced. In the present Example, the oxygen content in the photoconductive layer 12 in its layer thickness direction was made constant in a pattern as shown in FIG. 28, and the flow rate of $CO_2$ fed when the photoconductive layer 12 was formed was varied so that the oxygen content in the photoconductive layer 12 was changed in the range of from 10 atomic ppm to 5,000 atomic ppm. Thus, electrophotographic light-receiving members 10 corresponding to such changes were produced. The oxygen content in the photoconductive layer 12 was measured by elementary analysis using SIMS (CAMECA IMS-3F).

The electrophotographic light-receiving members 10 thus produced were each set in a test-purpose modified electrophotographic apparatus of a copier NP-7550, manufactured by Canon Inc., and electrophotographic characteristics concerning chargeability, sensitivity, residual potential and potential shift were evaluated.

(1) Chargeability, sensitivity and residual potential:
Evaluated in the same manner as in Example A1.

(2) Potential shift:
Evaluated in the same manner as in Example C9.

Comparative Example F11

Example F11 was repeated except that the oxygen content in the photoconductive layer 12 was changed to 5 atomic ppm, 7 atomic ppm and 5,500 to 8,000 atomic ppm, to give electrophotographic light-receiving members 10 corresponding to such changes. Their characteristics were evaluated in the same manner as in Example F11. Results of evaluation in Example F11 and Comparative Example F11 are shown in Table F21.

As is clear from the results, the photoconductive layer 12 with an oxygen content set within the range of from 10 to 5,000 atomic ppm is very effective in regard to an improvement in potential shift.

EXAMPLE F12

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table F22. Electrophotographic light-receiving members 10 were thus produced in the same manner as in Example F11. In the present Example, the oxygen content in the photoconductive layer 12 in its layer thickness direction was made constant in a pattern as shown in FIG. 28, and the flow rate of $CO_2$ fed when the photoconductive layer 12 was formed was varied so that the oxygen content in the photoconductive layer 12 was varied in the range of from 10 atomic ppm to 5,000 atomic ppm. Thus, electrophotographic light-receiving members 10 corresponding to such variations were produced.

Characteristics of the electrophotographic light-receiving members 10 produced were evaluated in the same manner as in Example F11.

Comparative Example F12

Example F12 was repeated except that the oxygen content in the photoconductive layer 12 was changed to 5 atomic ppm, 7 atomic ppm and 5,500 to 8,000 atomic ppm, to give electrophotographic light-receiving members corresponding to such changes. Their characteristics were evaluated in the same manner as in Example F12. Results of evaluation in Example F12 and Comparative Example F12 were the same as those in Example F11 and Comparative Example F11, respectively.

EXAMPLE F13

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table F23. Electrophotographic light-receiving members 10 were thus produced. In the present Example, the flow rate of $CO_2$ fed when the photoconductive layer 12 was formed was varied so that the oxygen content in the photoconductive layer 12 was varied as shown in FIGS. 28 to 32. Here, the oxygen content in the photoconductive layer 12 was varied in the range of from 10 atomic ppm to 500 atomic ppm. The oxygen content in the photoconductive layer 12 was measured by elementary analysis using SIMS (CAMECA IMS-3F).

The electrophotographic light-receiving members 10 thus produced were each set in a test-purpose modified electrophotographic apparatus of a copier NP-7550, manufactured by Canon Inc., and electrophotographic characteristics concerning chargeability, sensitivity, residual potential and potential shift were evaluated in the same manner as in Examples F1 and F11, after an accelerated durability test which corresponded to copying of 2,500,000 sheets was carried out. Results of evaluation are shown in Table F24.

Comparative Example F13

Using the RF glow discharge manufacturing apparatus as shown in FIG. 4, an electrophotographic light-receiving member was produced in the same manner as in Example F13 under conditions shown in Table F23, except that in the present Comparative Example no $CO_2$ was used when the photoconductive layer was formed and no oxygen was incorporated in the photoconductive layer.

Characteristics of the electrophotographic light-receiving members produced were evaluated in the same manner as in Example F13. Results of evaluation are shown in Table F24.

As is clear from the results shown in Table 24, the photoconductive layer 12 containing oxygen atoms whose content is preferably varied in the layer thickness direction can contribute improvements in electrophotographic characteristics and durability.

EXAMPLE F14

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table F25. Electrophotographic light-receiving members 10 were thus produced in the same manner as in Example F13.

Characteristics of the electrophotographic light-receiving members 10 produced were evaluated in the same manner as in Example F13.

Comparative Example F14

Using the μW glow discharge manufacturing apparatus as shown in FIG. 5, an electrophotographic light-receiving member was produced in the same manner as in Example F14 under conditions shown in Table F25, except that in the present Comparative Example no $CO_2$ was used when the photoconductive layer was formed, and no oxygen was incorporated in the photoconductive layer.

Characteristics of the electrophotographic light-receiving members produced were evaluated in the same manner as in Example F13. Results of evaluation in Example F14 and Comparative Example F14 were the same as those in Example F13 and Comparative Example F13, respectively.

EXAMPLE F15

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table F26. Electrophotographic light-receiving members 10 were thus produced. In the present Example, the power applied and the flow rate of $CH_4$ fed when the surface layer 13 was formed were varied so that the carbon atom content in the vicinity of the outermost surface of the surface layer 13 was varied in the range of from 63 to 90 atomic % based on the total of silicon atom content and carbon atom content. Here, the carbon atom content in the surface layer 13 at its surface on the side of the photoconductive layer 12 was controlled to be 10 atomic %.

The electrophotographic light-receiving members 10 thus produced were each set in a test-purpose modified electrophotographic apparatus of a copier NP-7550, manufactured by Canon Inc., and electrophotographic characteristics concerning chargeability, sensitivity and residual potential and image characteristics concerning smeared image, white spots, black dots caused by melt-adhesion of toner, and scratches were respectively evaluated. Characteristics of the electrophotographic light-receiving members 10 were again evaluated on the above items after a durability test for continuous paper-feeding image formation on 2,500,000 sheets using reprocessed paper. Evaluation for each item was made in the following manner.

(1) Chargeability, sensitivity and residual potential:
Evaluated in the same manner as in Example A1.

(2) Smeared image:
Evaluated in the same manner as in Example A11.

(3) White spots:
Evaluated in the same manner as in Example A5.

(4) Black dots caused by melt-adhesion of toner:
A whole-area white test chart prepared by Canon Inc. is placed on a copy board to make copies. Black dots of 0.1 mm or more in width and 0.5 mm or more in length, present in the same area of the copied images thus obtained, are counted.

(5) Scratches:
A halftone test chart prepared by Canon Inc. is placed on a copy board to make copies. Scratches of 0.05 mm or more in width and 0.2 mm or more in length are counted, which are present in the area of 340 mm in width (corresponding to one rotation of the electrophotographic light-receiving member 10) and 297 mm in length of the copied images thus obtained, are counted.

Comparative Example F15

Example F15 was repeated except that the carbon atom content in the vicinity of the outermost surface of the surface layer was changed to 20 to 60 atomic % and 93 to 95 atomic % based on the total of silicon atom content and carbon atom content, to give electrophotographic light-receiving members corresponding to such changes. Evaluation was made in the same manner as in Example F15. Results of evaluation in Example F15 and Comparative Example F15 before the durability test are shown in Table F27. Results of evaluation in Example F15 and Comparative Example F15 after the durability test are shown in Table F28. In Tables F27 and F28, with regard to smeared image, "AA" indicates "good"; "A", "lines are broken off in part"; "B", lines are broken off at many portions, but can be read as characters without no problem in practical use", and "C", "problematic in practical use in some cases". With regard to black dots caused by melt-adhesion of toner, and scratches, "AA" indicates "particularly good"; "A", "good"; "B", "no problem in practical use"; and "C", "problematic in practical use in some cases".

As is seen from the results shown in the tables, the electrophotographic light-receiving members 10 according to the present invention in which the carbon atom content in the vicinity of the outermost surface of the surface layer 13 is set within the range of from 63 to 90 atomic % based on the total of silicon atom content and carbon atom content atom content can bring about good electrophotographic characteristics.

EXAMPLE F16

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table F29. Electrophotographic light-receiving members 10 were thus produced in the same manner as in Example F15.

Characteristics of the electrophotographic light-receiving members 10 thus produced were evaluated in the same manner as in Example F15. Results obtained were the same as those in Example F15.

Comparative Example F16

Example F16 was repeated except that the carbon atom content in the vicinity of the outermost surface of the surface layer was changed to 20 to 60 atomic % and 93 to 95 atomic % based on the total of silicon atom content and carbon atom content, to give electrophotographic light-receiving members corresponding to such changes. Their characteristics were evaluated in the same manner as in Example F16. As a result, a deterioration of characteristics was seen.

EXAMPLE F17

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table F30. Electrophotographic light-receiving members 10 were thus produced. In the present Example, the flow rate of $CO_2$ fed when the surface layer 13 was formed was varied so that the oxygen atom content in the surface layer 13 was varied in the range of from $1\times10^{-4}$ to 30 atomic %.

The electrophotographic light-receiving members 10 thus produced were each set in a test-purpose modified electrophotographic apparatus of a copier NP-7550, manufactured by Canon Inc., and electrophotographic characteristics concerning chargeability, sensitivity and residual potential and image characteristics concerning smeared image, white spots, black dots caused by melt-adhesion of toner, and scratches were respectively evaluated in the same manner as in Example F15. Characteristics of the electrophotographic light-receiving members 10 were again evaluated on the above items after a durability test for continuous paper-feeding image formation of 2,500,000 sheets using reprocessed paper.

Comparative Example F17

Example F17 was repeated except that the oxygen atom content in the surface layer was changed to $1\times10^{-5}$ atomic % and 40 to 50 atomic %, to give electrophotographic light-receiving members corresponding to such changes. Evaluation was made in the same manner as in Example F17. Results of evaluation in Example F17 and Comparative Example F17 before the durability test are shown in Table F31. Results of evaluation in Example F17 and Comparative Example F17 after the durability test are shown in Table F32.

As is seen from the results shown in the tables, the electrophotographic light-receiving members 10 according to the present invention in which the oxygen atom content in the surface layer is set within the range of from $1\times10^{-4}$ to 30 atomic % can bring about good electrophotographic characteristics.

EXAMPLE F18

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table F33. Electrophotographic light-receiving members 10 were thus produced in the same manner as in Example F15.

Characteristics of the electrophotographic light-receiving members 10 thus produced were evaluated in the same manner as in Example F17. Results obtained were the same as those in Example F17.

Comparative Example F18

Example F18 was repeated except that the oxygen atom content in the surface layer was changed to $1\times10^{-5}$ atomic % and 40 to 50 atomic %, to give electrophotographic light-receiving members corresponding to such changes. Evaluation was made in the same manner as in Example F18. As a result, a deterioration of characteristics was seen.

EXAMPLE F19

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table F34. Electrophotographic light-receiving members 10 were thus produced. In the present Example, the flow rate of $N_2$ fed when the surface layer 13 was formed was varied so that the nitrogen atom content in the surface layer 13 was varied in the range of from $1\times10^{-4}$ to 30 atomic %.

The electrophotographic light-receiving members 10 thus produced were each set in a test-purpose modified electrophotographic apparatus of a copier NP-7550, manufactured by Canon Inc., and electrophotographic characteristics concerning charge characteristic, sensitivity and residual potential and image characteristics concerning smeared image, white spots, black dots caused by melt-adhesion of toner, and scratches were respectively evaluated in the same manner as in Example F15. Characteristics of the electrophotographic light-receiving members 10 were again evaluated on the above items after a durability test for continuous paper-feeding image formation of 2,500,000 sheets using reprocessed paper.

Comparative Example F19

Example F19 was repeated except that the nitrogen atom content in the surface layer was changed to $1\times10^{-5}$ atomic % and 40 to 50 atomic %, to give electrophotographic light-receiving members corresponding to such changes. Evaluation was made in the same manner as in Example F19. Results of evaluation in Example F19 and Comparative Example F19 before the durability test are shown in Table F35. Results of evaluation in Example F19 and Comparative Example F19 after the durability test are shown in Table F36.

As is seen from the results shown in the tables, the electrophotographic light-receiving members 10 according to the present invention in which the nitrogen atom content in the surface layer 13 is set within the range of from $1\times10^{-4}$ to 30 atomic % can bring about good electrophotographic characteristics.

EXAMPLE F20

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table F37. Electrophotographic light-receiving members 10 were thus produced in the same manner as in Example F19.

Characteristics of the electrophotographic light-receiving members thus produced were evaluated in the same manner as in Example F19. Results obtained were the same as those in Example F19.

Comparative Example F20

Example F20 was repeated except that the nitrogen atom content in the surface layer was changed to $1\times10^{-5}$ atomic % and 40 to 50 atomic %, to give electrophotographic light-receiving members corresponding to such changes. Evaluation was made in the same manner as in Example F20. As a result, a deterioration of characteristics was seen.

EXAMPLE F21

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table F38. Electrophotographic light-receiving members 10 were thus produced. In the present Example, the flow rate of $B_2H_6$ fed when the surface layer 13 was formed was varied so that the content of boron atoms used as Group III element in the surface layer 13 was varied in the range of from $1\times10^{-5}$ to $1\times10^{5}$ atomic ppm.

The electrophotographic light-receiving members 10 thus produced were each set in a test-purpose modified electrophotographic apparatus of a copier NP-7550, manufactured by Canon Inc., and electrophotographic characteristics concerning chargeability, sensitivity and residual potential and image characteristics concerning smeared image, white spots, black dots caused by melt-adhesion of toner, and scratches were respectively evaluated in the same manner as in Example F15. Characteristics of the electrophotographic light-receiving members 10 were again evaluated on the above items after a durability test for continuous paper-feeding image formation of 2,500,000 sheets using reprocessed paper.

Comparative Example F21

Example F21 was repeated except that the boron atom content in the surface layer was changed to $1\times10^{-6}$ atomic ppm and $1\times10^{6}$ atomic ppm, to give electrophotographic light-receiving members corresponding to such changes. Evaluation was made in the same manner as in Example F21. Results of evaluation in Example F21 and Comparative Example F21 before the durability test are shown in Table F39. Results of evaluation in Example F21 and Comparative Example F21 after the durability test are shown in Table F40.

As is seen from the results shown in the tables, the electrophotographic light-receiving members 10 according to the present invention in which the boron atom (Group III element) content in the surface layer 13 is set within the range of from $1\times10^{-5}$ to $1\times10^{5}$ atomic ppm can bring about good electrophotographic characteristics.

EXAMPLE F22

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table F41. Electrophotographic light-receiving members 10 were thus produced in the same manner as in Example F21.

Characteristics of the electrophotographic light-receiving members 10 thus produced were evaluated in the same manner as in Example F21. Results obtained were the same as those in Example F21.

Comparative Example F22

Example F22 was repeated except that the boron atom content in the surface layer was changed to $1\times10^{-6}$ atomic ppm and $1\times10^{6}$ atomic ppm, to give electrophotographic light-receiving members corresponding to such changes. Evaluation was made in the same manner as in Example F22. As a result, a deterioration of characteristics was seen.

EXAMPLE F23

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table F42. Electrophotographic light-receiving members 10 were thus produced. In the present Example, the powder applied and flow rate of $SiF_4$ fed when the surface layer 13 was formed were varied so that the hydrogen atom content and fluorine atom (used as a halogen atom) content in the surface layer 13 were varied to control the total of the hydrogen atom content and fluorine atom content so as to be not more than 80 atomic %.

The electrophotographic light-receiving members 10 thus produced were each set in a test-purpose modified electrophotographic apparatus of a copier NP-7550, manufactured by Canon Inc., and electrophotographic characteristics concerning chargeability, sensitivity and residual potential and image characteristics concerning smeared image, white spots, black dots caused by melt-adhesion of toner, and scratches were respectively evaluated in the same manner as in Example F15. Characteristics of the electrophotographic light-receiving members 10 were again evaluated on the above items after a durability test for continuous paper-feeding image formation of 2,500,000 sheets using reprocessed paper.

Comparative Example F23

Example F23 was repeated except that no $SiF_4$ was fed when the surface layer was formed, to give electrophotographic light-receiving members corresponding to such changes. Evaluation was made in the same manner as in Example F23. Results of evaluation in Example F23 and Comparative Example F23 before the durability test are shown in Table F43. Results of evaluation in Example F23 and Comparative Example F23 after the durability test are shown in Table F44.

In Tables F43 and F44, instances in which fluorine atom content is zero (with asterisks) show results of evaluation in Comparative Example F23; and other instances, results of evaluation in Example F23.

As is seen from the results shown in the tables, the electrophotographic light-receiving members 10 according to the present invention in which the surface layer 13 contains a halogen atom and the total of the hydrogen atom content and fluorine atom (halogen atom) content is set within the range of 80 atomic % or less can bring about good electrophotographic characteristics.

EXAMPLE F24

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table F45. Electrophotographic light-receiving members 10 were thus produced in the same manner as in Example F23.

Characteristics of the electrophotographic light-receiving members 10 thus produced were evaluated in the same manner as in Example F23. Results obtained were the same as those in Example F23.

Comparative Example F24

Example F24 was repeated except that no $SiF_4$ was fed when the surface layer was formed, to give electrophotographic light-receiving members corresponding to such changes. Evaluation was made in the same manner as in Example F24. As a result, a deterioration of characteristics was seen.

EXAMPLE F25

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table F46. Electrophotographic light-receiving members 10 were thus produced. In the present Example, the flow rate of NO fed when the surface layer 13 was formed was varied so that the total of the oxygen atom content and nitrogen atom content in the surface layer 13 was varied in the range of from $1\times10^{-4}$ to 30 atomic %.

The electrophotographic light-receiving members 10 thus produced were each set in a test-purpose modified electrophotographic apparatus of a copier NP-7550, manufactured by Canon Inc., and electrophotographic characteristics concerning chargeability, sensitivity and residual potential and image characteristics concerning smeared image, white spots, black dots caused by melt-adhesion of toner, and scratches were respectively evaluated in the same manner as in Example F15. Characteristics of the electrophotographic light-receiving members 10 were again evaluated on the above items after a durability test for continuous paper-feeding image formation of 2,500,000 sheets using reprocessed paper.

Comparative Example F25

Example F25 was repeated except that the total of the oxygen atom content and nitrogen atom content in the surface layer was changed to $1\times10^{-5}$ and 40 to to 50 atomic %, to give electrophotographic light-receiving members corresponding to such changes. Evaluation was made in the same manner as in Example F25. Results of evaluation in Example F25 and Comparative Example F25 before the durability test are shown in Table F47. Results of evaluation in Example F25 and Comparative Example F25 after the durability test are shown in Table F48.

As is seen from the results shown in the tables, the electrophotographic light-receiving members 10 according to the present invention in which the total of the oxygen atom content and nitrogen atom content in the surface layer 13 is set within the range of from $1\times10^{-4}$ to 30 atomic % can bring about good electrophotographic characteristics.

EXAMPLE F26

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table F49. Electrophotographic light-receiving members 10 were thus produced in the same manner as in Example F25.

Characteristics of the electrophotographic light-receiving members 10 thus produced were evaluated in the same manner as in Example F25. Results obtained were the same as those in Example F25.

Comparative Example F26

Example F26 was repeated except that the total of the oxygen atom content and nitrogen atom content in the surface layer was changed to $1\times10^{-5}$ atomic % and 40 to 50 atomic %, to give electrophotographic light-receiving members corresponding to such changes. Evaluation was made in the same manner as in Example F26. As a result, a deterioration of characteristics was seen.

EXAMPLE F27

Using the RF glow discharge manufacturing apparatus as shown in FIG. 4 and according to the procedure previously described in detail, a light-receiving layer was formed on a mirror-finished aluminum cylinder of 108 mm in diameter under conditions shown in Table F50. Electrophotographic light-receiving members 10 were thus produced. In the present Example, the boron atom content in the photoconductive layer 12 was varied as shown in Table F51. Hydrogen-based diborane (100 ppm $B_2H_6/H_2$) was used as the starting material gas.

The electrophotographic light-receiving members 10 thus produced were each set in a test-purpose modified electrophotographic apparatus of a copier NP-7550, manufactured by Canon Inc., and chargeability, sensitivity and residual potential were respectively evaluated in the same manner as in Example F1. Results obtained are shown in Table F52. In Table F52, for comparison, results are shown as relative values assuming as 100 the values of the chargeability, sensitivity and residual potential obtained in the pattern a of boron atom content of Table F51.

As is seen from the results of evaluation, the photoconductive layer doped with boron atoms can contribute improvements particularly in sensitivity and residual potential.

EXAMPLE F28

Using the μW glow discharge manufacturing apparatus as shown in FIG. 5 and according to the procedure previously described in detail, a light-receiving layer was formed on a mirror-finished aluminum cylinder of 108 mm in diameter under conditions shown in Table F53. Electrophotographic light-receiving members 10 were thus produced in the same manner as in Example F27.

Characteristics of the electrophotographic light-receiving members thus produced were evaluated in the same manner as in Example F27. Results of evaluation were the same as those in Example F27.

EXAMPLE G1

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table G1. An electrophotographic light-receiving member 10 was thus produced. In the present Example, the flow rate of $CH_4$ fed when the first photoconductive layer 1102 shown in FIG. 3 was formed was varied so that the carbon content in the first photoconductive layer 1102 was changed in a pattern of changes as shown in FIG. 8. The carbon content in the first photoconductive layer 1102 at its surface on the side of the substrate 11 was so controlled as to be 30 atomic %. The carbon content was measured by elementary analysis using the Rutherford backward scattering method.

The electrophotographic light-receiving member thus produced was set in a test-purpose modified electrophotographic apparatus, and chargeability, sensitivity and residual potential were evaluated. Evaluation for each item was made in the same manner as in Example A1.

Comparative Example G1

What is called a function-separated electrophotographic light-receiving member having a constant carbon content in its first photoconductive layer 1102 was produced in the same manner as in Example G1 and under conditions shown in Table G2. Characteristics of the electrophotographic light-receiving member thus produced were evaluated in the same manner as in Example G1.

Results of evaluation in Example G1 and Comparative Example G1 are shown together in Table G3. The electrophotographic light-receiving member with the layer structure according to the present invention is improved in chargeability and sensitivity, and also undergoes no changes in residual potential.

EXAMPLE G2

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example G1 except for using μW glow-discharging, under conditions shown in Table G4. An electrophotographic light-receiving member was thus produced. Characteristics of the electrophotographic light-receiving member produced were evaluated in the same manner as in Example G1.

What is called a function-separated electrophoto-graphic light-receiving member having a constant carbon content in its first photoconductive layer was produced in the same manner as in Example G2 and under conditions shown in Table G5. Characteristics of the electrophotographic light-receiving member thus produced were evaluated in the same manner as in Example G2.

Results of evaluation in Example G2 and Comparative Example G2 were entirely the same as the results of evaluation in Example G1 and Comparative Example G1, respectively.

EXAMPLE G3

Comparative Example G3

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table G6. Electrophotographic light-receiving members were thus produced. In the present Example, the layer thickness of the second photoconductive layer 1103 was varied in the range of from 0 to 20 μm. Photosensitivity measured when irradiated with light of 610 nm in a constant amount, with respect to the thickness of the second photoconductive layer 1103, was evaluated assuming the photosensitivity of the second photoconductive layer 1103 with a layer thickness of 0 μm as 100%. Results of evaluation are shown in Table G7. As is seen from the results, providing the second photoconductive layer 1103 brings about an improvement in long-wave sensitivity.

EXAMPLE G4

Comparative Example G4

Using the electrophotographic light-receiving member manufacturing apparatus as shown in FIG. 4 and according to the procedure previously described in detail, a light-receiving layer was formed on a mirror-finished aluminum cylinder of 108 mm in diameter by μW glow-discharging in the same manner as in Example G3 under conditions shown in Table G8. Electrophotographic light-receiving members were thus produced. Photosensitivity measured when irradiated with light of 610 nm in a constant amount, with respect to the thickness of the second photoconductive layer 1103, was evaluated assuming the photosensitivity of the second photoconductive layer 1103 with a layer thickness of 0 μm as 100%. Results of evaluation were the same as those shown in Table G7.

EXAMPLE G5

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table G9. Electrophotographic light-receiving members were thus produced. In the present Example, the flow rate of $CH_4$ fed when the first photoconductive layer 1102 was formed was varied so that the carbon content in the first photoconductive layer 1102 was varied in patterns of changes as shown in FIGS. 8 to 10. In all patterns, the carbon content in the first photoconductive layer 1102 at its surface on the side of the substrate 11 was so controlled as to be 30 atomic %. The carbon content was measured by elementary analysis using the Rutherford backward scattering method.

The electrophotographic light-receiving member thus produced was set in a test-purpose modified elctrophotographic apparatus, and chargeability, sensitivity and residual potential were evaluated. Evaluation for each item was made in the same manner as in Example G1.

Comparative Example G5

Example G3 was repeated except for using patterns of carbon content as shown in FIGS. 11 and 12, to give corresponding electrophotographic light-receiving members. Evaluation was made in the same manner as in Example G4.

Results obtained in Example G5 and Comparative Example G5 are shown together in Table G10. The first photoconductive layer 1102 having the pattern of carbon content according to the present invention, contributes an improvement in chargeability and sensitivity, and also causes no decrease in residual potential.

EXAMPLE G6

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example G5 except for using μW glow-discharging, under conditions shown in Table G11. Electrophotographic light-receiving members were thus produced. In the present Example, the flow rate of $CH_4$ fed when the first photoconductive layer 1102 was formed was varied so that the carbon content in the first photoconductive layer 1102 was varied in patterns of changes as shown in FIGS. 8 to 10. In all patterns, the carbon content in the first photoconductive layer 1102 at its surface on the side of the substrate 11 was so controlled as to be 30 atomic %. The carbon content was measured by elementary analysis using the Rutherford backward scattering method. Characteristics of the electrophotographic light-receiving member thus produced were evaluated in the same manner as in Example G3.

Comparative Example G6

Example G6 was repeated except for using patterns of carbon content as shown in FIGS. 11 and 12, to give corresponding electrophotographic light-receiving members. Characteristics of the electrophotographic light-receiving member thus produced were evaluated in the same manner as in Example G6.

Results obtained in Example G6 and Comparative Example G6 were entirely the same as the results obtained in Example G5 and Comparative Example G5, respectively.

EXAMPLE G7

Comparative Example G7

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table G12. Electrophotographic light-receiving members were thus produced. In the present Example, the pattern shown in FIG. 8 was used as a pattern of changes of carbon content in the first photoconductive layer, and the flow rate of $CH_4$ fed when the first photoconductive layer 1102 was formed was varied so that the carbon content in that layer at its surface on the substrate side was varied. The carbon content in the first photoconductive layer 1102 at its surface on the side of the substrate 11 was measured by elementary analysis using the Rutherford backward scattering method.

The electrophotographic light-receiving members thus produced were each set in a test-purpose modified electrophotographic apparatus, and their electrophotographic characteristics concerning charge characteristic, sensitivity, residual potential, white spots, coarse image and ghost were evaluated. Number of spherical projections on the surfaces of electrophotographic light-receiving members was also examined to make evaluation. Evaluation for each item was made in the following manner.

(1) Chargeability, sensitivity and residual potential:

Evaluated in the same manner as in Example A1.

(2) White spots, coarse image, ghost, and number of spherical projections:

Evaluated in the same manner as in Example A5.

Results thus obtained are shown together in Table G13. As is seen from the results, the first photoconductive layer 1102 with a carbon content of from 0.5 to 50 atomic % at its surface on the side of the substrate 11 can contribute improvements in the characteristics. Very good results are also obtained when the carbon content is 1 to 30 atomic %.

EXAMPLE G8

Comparative Example G8

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example G7 except for using μW glow-discharging, under conditions shown in Table G14. Electrophotographic light-receiving members were thus produced. In the present Example, the pattern shown in FIG. 8 was used as a pattern of changes of carbon content in the first photoconductive layer 1102, and the flow rate of $CH_4$ fed when the first photoconductive layer 1102 was formed was varied so that the carbon content in that layer at its surface on the substrate 11 side was varied. Evaluation was made in the same manner as in Example G7 to obtain the same results as shown in Table G13.

EXAMPLE G9

Comparative Example G9

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table G15. Electrophotographic light-receiving members were thus produced. In the present Example, the flow rate of $SiF_4$ fed when the first photoconductive layer 1102 was formed was varied so that the fluorine content in the photoconductive layer was varied.

The fluorine content in the first photoconductive layer 1102 was measured by elementary analysis using SIMS (CAMECA IMS- 3F).

(I) The electrophotographic light-receiving members thus produced were each set in a test-purpose modified electrophotographic apparatus, and electrophotographic characteristics concerning white spots, coarse image and ghost were evaluated before an accelerated durability test was carried out. Evaluation for each item was made in the same manner as in Examples G1 and G7.

Results obtained are shown together in Table G16.

(II) Next, the electrophotographic light-receiving members thus produced were each set in the test-purpose modified electrophotographic apparatus, and an accelerated durability test which corresponded to copying of 2,500,000 sheets was carried out. Then, electrophotographic characteristics concerning white spots, coarse image and ghost were evaluated similarly to (I).

Results obtained are shown together in Table G17.

As is clear from the results shown in Tables G16 and G17, the photoconductive layer with a fluorine content set within the range of from 1 to 95 atomic ppm is very effective for improving image characteristics and running characteristic.

EXAMPLE G10

Comparative Example G10

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example G9 except for using μW glow-discharging, under conditions shown in Table G18. Electrophotographic light-receiving members were thus produced. Characteristics of the electrophotographic light-receiving members thus produced were evaluated in the same manner as in Example G9. Results obtained were entirely the same as those shown in Tables G16 and G17, respectively.

EXAMPLE G11

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table G19. Electrophotographic light-receiving members were thus produced. In the present Example, the fluorine content in the first photoconductive layer 1102 was controlled to be 30 atomic ppm, and the flow rate of $CO_2$ fed when the first photoconductive layer 1102 was formed was varied so that the oxygen content therein was varied. The oxygen content in the first photoconductive layer 1102 was measured by elementary analysis using SIMS (CAMECA IMS-3F).

The electrophotographic light-receiving members thus produced were each set in a test-purpose modified electrophotographic apparatus, and their electrophotographic characteristics concerning chargeability, sensitivity, residual potential and potential shift were evaluated.

(1) Chargeability, sensitivity and residual potential:

Evaluated in the same manner as in Example A1.

(2) Potential shift:

Evaluated in the same manner as in Example C9.

Results obtained are shown together in Table G20.

EXAMPLE G12

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example G11 except for using μW glow-discharging, under conditions shown in Table G21. Electrophotographic light-receiving members were thus produced. Characteristics of the electrophotographic light-receiving members thus produced were evaluated in the same manner as in Example G11. Results obtained were entirely the same as those shown in Table G20.

EXAMPLE G13

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table G22. Electrophotographic light-receiving members were thus produced. In the present Example, the power applied and the flow rates of $CH_4$, $CO_2$ and $NH_3$ fed when the surface layer was formed were varied so that the total of the carbon atom content, oxygen atom content and nitrogen atom content in the surface layer was varied in the range of from 40 atomic % to 90 atomic %.

The electrophotographic light-receiving members thus produced were each set in a test-purpose modified electrophotographic apparatus, and characteristics concerning chargeability, sensitivity, residual potential, smeared image, images before a durability test, and images after an accelerated durability test which corresponded to copying of 2,500,000 sheets, were evaluated in the following manner.

Chargeability, sensitivity and residual potential:

Evaluated in the same manner as in Example A1.

Smeared image and image evaluation:

Evaluated in the same manner as in Example B9.

Comparative Example G11

Example G13 was repeated except that the total of the carbon atom content, oxygen atom content and nitrogen atom content in the surface layer was changed to less than 40 atomic % and more than 90 atomic %. Electrophotographic light-receiving members corresponding to such changes were thus produced. Evaluation was made in the same manner as in Example G13.

Comparative Example G12

Example G13 was repeated except that no $CH_4$ was used when the surface layer was formed, and the total of the oxygen atom content and nitrogen atom content in the surface layer was changed to 60 atomic %. An electrophotographic light-receiving member was thus produced. Evaluation was made in the same manner as in Example G13.

Comparative Example G13

Example G13 was repeated except that no $CO_2$ was used when the surface layer was formed and the total of the oxygen atom content and nitrogen atom content in the surface layer was changed to 60 atomic %. An electrophotographic light-receiving member was thus produced. Evaluation was made in the same manner as in Example G13.

Comparative Example G14

Example G13 was repeated except that no $NH_3$ was used when the surface layer was formed and the total of the oxygen atom content and nitrogen atom content in the surface layer was changed to 60 atomic %. An electrophotographic light-receiving member was thus produced. Evaluation was made in the same manner as in Example G13.

Results obtained in Example G13 and Comparative Examples G11 to G14 are shown together in Table G23 . The surface layer in which the total of the carbon atom content, oxygen atom content and nitrogen atom content is controlled in the range of from 40 to 90 atomic % contributes remarkable improvements in chargeability and running characteristic, and also the surface layer in which the total of the oxygen atom content and nitrogen atom content is controlled to be not more than 10 atomic % can bring about very good results.

EXAMPLE G14

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example G13 except for using μW glow-discharging, under conditions shown in Table G24. Electrophotographic light-receiving members were thus produced. In the present Example, the power applied and the flow rates of $CH_4$, $CO_2$ and $NH_3$ fed when the surface layer 13 was formed were varied so that the total of the carbon atom content, oxygen atom content and nitrogen atom content in the surface layer 13 was varied in the range of from 40 atomic % to 90 atomic %. Evaluation was made in the same manner as in Example G13.

Comparative Example G15

Example G14 was repeated except that the total of the oxygen atom content and nitrogen atom content in the surface layer 13 was changed to less than 40 atomic % and more than 90 atomic %. Electrophotographic light-receiving members corresponding to such changes were thus produced. Evaluation was made in the same manner as in Example G14.

Comparative Example G16

Example G14 was repeated except that no $CH_4$ was used when the surface layer 13 was formed, and the total of the oxygen atom content and nitrogen atom content in the surface layer 13 was changed to 60 atomic %. Electrophotographic light-receiving members were thus produced. Evaluation was made in the same manner as in Example G14.

Comparative Example G17

Example G14 was repeated except that no $CO_2$ was used when the surface layer 13 was formed and the total of the oxygen atom content and nitrogen atom content in the surface layer 13 was changed to 60 atomic %. Electrophotographic light-receiving members were thus produced. Evaluation was made in the same manner as in Example G14.

Comparative Example G18

Example G14 was repeated except that no $NH_3$ was used when the surface layer 13 was formed and the total of the nitrogen atom content and oxygen atom content in the surface layer 13 was changed to 60 atomic %. Electrophotographic light-receiving members were thus produced. Evaluation was made in the same manner as in Example G23.

Results of evaluation in Example G14 and Comparative Examples G15 to G18 were entirely the same as those shown in Table G23.

EXAMPLE G15

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table G25. Electrophotographic light-receiving members were thus produced. In the present Example, the power applied and the flow rate of $H_2$ and/or flow rate of $SiF_4$ fed when the surface layer 13 was formed were varied so that the fluorine atom content in the surface layer 13 was not more than 20 atomic % and the total of the hydrogen atom content and fluorine atom content was in the range of from 30 to 70 atomic %.

The electrophotographic light-receiving members thus produced were each set in a test-purpose modified electrophotographic apparatus, and characteristics concerning residual potential, sensitivity and smeared images were evaluated in the same manner as in Example G9.

Comparative Example G19

Example G15 was repeated except that the total of the hydrogen atom content and fluorine atom content in the surface layer 13 was changed to less than 30 atomic % and more than 70 atomic %. Electrophotographic light-receiving members corresponding to such changes were thus produced. Evaluation was made in the same manner as in Example G15.

Comparative Example G20

Example G15 was repeated except that the fluorine atom content in the surface layer 13 was changed to more than 20 atomic %. Electrophotographic light-receiving members corresponding to such changes were thus produced. Evaluation was made in the same manner as in Example G15.

Comparative Example G21

Example G15 was repeated except that no $SiF_4$ was used when the surface layer 13 was formed. Electrophotographic light-receiving members corresponding to such changes were thus produced. Evaluation was made in the same manner as in Example G15.

Results of evaluation in Example G15 and Comparative Examples G19 to G21 are shown together in Table G26. As is seen from the results shown in Table G26, the electrophotographic light-receiving members with a surface layer 13 in which the total of the hydrogen atom content and fluorine atom content is set of from 30 to 70 atomic % and the fluorine atom content within the range of not more than 20 atomic % can bring about good results on both the residual potential and the sensitivity, and also can greatly prohibit smeared images from occurring under strong exposure.

EXAMPLE G16

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example G15 except for using μW glow-discharging, under conditions shown in Table G27. Electrophotographic light-receiving members were thus produced. Characteristics of the electrophotographic light-receiving members produced were evaluated in the same manner as in Example G15.

Comparative Example G22

Example G15 was repeated except that the total of the hydrogen atom content and fluorine atom content in the surface layer 13 was changed to less than 30 atomic % and more than 70 atomic %. Electrophotographic light-receiving members corresponding to such changes were thus produced. Evaluation was made in the same manner as in Example G15.

Comparative Example G23

Example G15 was repeated except that the fluorine atom content in the surface layer 13 was changed to more than 20 atomic %. Electrophotographic light-receiving members corresponding to such changes were thus produced. Evaluation was made in the same manner as in Example G15.

Comparative Example G24

Example G15 was repeated except that no $SiF_4$ was used when the surface layer 13 was formed. Electrophotographic light-receiving members corresponding to such changes were thus produced. Evaluation was made in the same manner as in Example G15.

Results of evaluation in Example G16 and Comparative Examples G22 to G24 were the same as those shown in Table G26.

EXAMPLE G17

Using the electrophotographic light-receiving member manufacturing apparatus as shown in FIG. 4 and according to the procedure previously described in detail, a light-receiving layer of an electrophotographic light-receiving member was formed on a mirror-finished aluminum cylinder of 108 mm in diameter by RF glow-discharging under conditions shown in Table G28. In the present Example, the boron atom content in the first and second photoconductive layers was varied as shown in Table G29. Hydrogen-based diborane (100 ppm $B_2H_6/H_2$) was used as the starting material gas.

The electrophotographic light-receiving members thus produced were each set in a test-purpose modified electrophotographic apparatus, and chargeability, sensitivity and residual potential were evaluated. Evaluation for each item was made in the following manner.

(1) Chargeability, sensitivity and residual potential:

Evaluated in the same manner as in Example A1.

Results obtained are shown in Table G30. As is seem therefrom, the photoconductive layer doped with boron atoms can contribute improvements particularly in residual potential and sensitivity.

EXAMPLE G18

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example G17 except for using μW glow-discharging, under conditions shown in Table G31. Electrophotographic light-receiving members were thus produced. The pattern of changes of boron content was the same as shown in Table G29. Characteristics of the electrophotographic light-receiving members thus produced were evaluated in the same manner as in Example G17. Results obtained were entirely the same as those shown in Table G30.

EXAMPLE H1

Using the RF glow discharge manufacturing apparatus for the electrophotographic light-receiving member, as shown in FIG. 4, and according to the procedure previously described in detail, a light-receiving layer was formed on a mirror-finished aluminum cylinder of 108 mm in diameter under conditions shown in Table H1. An electrophotographic light-receiving member was thus produced. In the present Example, the flow rate of $CH_4$ fed when the first photoconductive, layer 1102 was formed was varied so that the carbon content in the first photoconductive layer 1102 was changed in a pattern of changes as shown in FIG. 8. The carbon content in the first photoconductive layer 1102 at its surface on the side of the substrate 11 was controlled to be 30 atomic %. The carbon content was measured by elementary analysis using the Rutherford backward scattering method.

The electrophotographic light-receiving member thus produced was set in a test-purpose modified electrophotographic apparatus, and chargeability, sensitivity and residual potential were respectively evaluated. Evaluation for each item was made in the same manner as in Example A1.

Comparative Example H1

The same electrophotographic light-receiving member as in Example H1 except that the carbon content in the first photoconductive layer was made constant was produced in the same manner as in Example H1 and under conditions shown in Table H2. Characteristics of the electrophotographic light-receiving member thus produced were evaluated in the same manner as in Example H1.

Results obtained in Example H1 and Comparative Example H1 are shown together in Table H3. The electrophotographic light-receiving member with the layer structure according to the present invention brings about an improvement in chargeability and sensitivity, and also undergoes no decrease in residual potential.

EXAMPLE H2

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example H1 except for using μW glow-discharging, under conditions shown in Table H4. An electrophotographic light-receiving member was thus produced. Characteristics of the electrophoto-graphic light-receiving member produced were evaluated in the same manner as in Example H1.

Results obtained in Example H2 were entirely the same as in Example H1, which were good results.

Comparative Example H2

What is called a function-separated electrophotographic light-receiving member having a constant carbon content in its first photoconductive layer was produced in the same manner as in Example H2 and under conditions shown in Table H5. Characteristics of the electrophotographic light-receiving member thus-produced were evaluated in the same manner as in Example H1.

Results obtained in Comparative Example H2 were entirely the same as those in Comparative Example H1, showing characteristics inferior to those in the electrophotographic light-receiving member of Example H2 according to the present invention.

EXAMPLE H3

Example H1 was repeated except that a light-receiving layer was formed under conditions shown in Table H6 and the layer thickness of the second photoconductive layer 1103 was varied in the range of from 0.5 to 15 μm, to give corresponding electrophotographic light-receiving members. On the electrophotographic light-receiving members each thus obtained, photosensitivity was measured when irradiated with light of 610 nm in a constant amount, with respect to the thickness of the second photoconductive layer 1103, and its relative evaluation was made assuming the photosensitivity of the second photoconductive layer 1103 with a layer thickness of 0 μm as 100%.

Comparative Example H3

An electrophotographic light-receiving member with entirely the same structure as in Example H3 except that no second photoconductive layer 1103 was provided was produced in the same manner as in Example H1 and under conditions shown in Table H6. Evaluation of the electrophotographic light-receiving member thus produced were evaluated in the same manner as in Example H3.

Results obtained in Example H3 and Comparative Example H3 are shown together in Table H7.

As is clear from Table H7, the electrophotographic light-receiving member provided with the second photoconductive layer 1103 according to the present invention brings about an improvement in long-wave sensitivity.

EXAMPLE H4

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example H3 except for using μW glow-discharging, under conditions shown in Table H8. Electrophotographic light-receiving members were thus produced. In the present Example, the layer thickness of the second photoconductive layer 1103 was varied in the range of from 0.5 to 10 μm. Evaluation on the electrophotographic light-receiving members thus produced were evaluated in the same manner as in Example H3. Results obtained in Example H4 were similar to those in Example H3.

Comparative Example H4

Using the electrophotographic light-receiving member manufacturing apparatus as shown in FIG. 5 and according to the procedure previously described in detail, a light-receiving layer was formed on a mirror-finished aluminum cylinder of 108 mm in diameter using μW glow-discharging under conditions shown in Table H8. An electrophotographic light-receiving member with entirely the same structure as in Example H4 except that no second photoconductive layer 1103 was provided was produced. Characteristics of the electrophotographic light-receiving member 10 thus produced were evaluated in the same manner as in Example H4.

Results obtained in Comparative Example H3 were the same as those in Comparative Example H3, showing a long-wave sensitivity inferior to that of the electrophotographic light-receiving member of Example H4 provided with the second photoconductive layer 1103 according to the present invention.

EXAMPLE H5

Using the RF glow discharge manufacturing apparatus for an electrophotographic light-receiving member as shown in FIG. 4 and according to the procedure previously described in detail, a light-receiving layer was formed on a mirror-finished aluminum cylinder of 108 mm in diameter under conditions shown in Table H9. Electrophotographic light-receiving members were thus produced. In the present Example, the flow rate of $CH_4$ fed when the first photoconductive layer 1102 was formed was varied so that the carbon content in the first photoconductive layer 1102 was changed in patterns of changes as shown in FIGS. 8 to 10. In all patterns, the carbon content in the first photoconductive layer 1102 at its surface on the side of the substrate 11 was so controlled as to be 30 atomic %. The carbon content was measured by elementary analysis using the Rutherford backward scattering method.

The electrophotographic light-receiving members 10 thus produced were each set in a test-purpose modified electrophotographic apparatus, and chargeability, sensitivity and residual potential were respectively evaluated. Evaluation for the items, chargeability, sensitivity and residual potential, was made in the same manner as in Example H1.

Comparative Example H5

Example H5 was repeated except for using patterns of changes in carbon content as shown in FIGS. 11 and 12, to give electrophotographic light-receiving members. Characteristics of the electrophoto-graphic light-receiving members 10 thus produced were evaluated in the same manner as in Example H5.

Results obtained in Example H5 and Comparative Example H5 are shown together in Table H10. As is clear from Table H10, the electrophotographic light-receiving member 10 in which the first photoconductive layer 1102 has the pattern of carbon content according to the present invention bring about improvements in chargeability and sensitivity, and also causes no changes in residual potential.

EXAMPLE H6

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example H1 except for using μW glow-discharging, under conditions shown in Table H11. Electrophotographic light-receiving members 10 were thus produced. In the present Example, the flow rate of $CH_4$ fed when the first photoconductive layer 1102 was formed was varied so that the carbon content in the first photoconductive layer 1102 was varied in patterns of changes as shown in FIGS. 8 to 10. In all patterns, the carbon content in the first photoconductive layer 1102 at its surface on the side of the substrate 11 was so controlled as to be 30 atomic %. The carbon content was measured by elementary analysis using the Rutherford backward scattering method.

The electrophotographic light-receiving members 10 thus produced were each set in a test-purpose modified electrophotographic apparatus, and chargeability, sensitivity and residual potential were respectively evaluated in the same manner as in Example H1.

Results obtained in Example H6 were entirely the same as in Example H5, which were good results.

Comparative Example H6

Example H6 was repeated except for using patterns of changes in carbon content as shown in FIGS. 11 and 12, to give electrophotographic light-receiving members. Characteristics of the electrophotographic light-receiving member thus produced were evaluated in the same manner as in Example H6.

Results obtained in Comparative Example H6 were entirely the same as those in Comparative Example H5, showing characteristics inferior to those of the electrophotographic light-receiving members 10 of Example H6 according to the present invention.

EXAMPLE H7

Using the RF glow discharge manufacturing apparatus for the electrophotographic light-receiving member, as shown in FIG. 4, and according to the procedure previously described in detail, a light-receiving layer was formed on a mirror-finished aluminum cylinder of 108 mm in diameter under conditions shown in Table H12. Electrophotographic light-receiving members were thus produced. In the present Example, the pattern shown in FIG. 8 was used as a pattern of changes of carbon content in the first photoconductive layer, and the flow rate of $CH_4$ fed when the first photoconductive layer 1102 was formed was varied so that the carbon content in that layer at its surface on the substrate 11 side was varied in the range of from 0.5 to 50 atomic %. The carbon content in the first photoconductive layer 1102 at its surface on the side of the substrate 11 was measured by elementary analysis using the Rutherford backward scattering method.

The electrophotographic light-receiving members 10 thus produced were each set in a test-purpose modified electrophotographic apparatus, and their electrophotographic characteristics concerning chargeability, sensitivity, residual potential, white spots, coarse image and Ghost were evaluated. Number of spherical projections occurred on the surfaces of electrophotographic light-receiving members was also examined to make evaluation. Evaluation for items, chargeability, sensitivity and residual potential, was made in the same manner as in Example H1, and for other items, in the following manner. White spots, coarse image, Ghost, and number of spherical projections were evaluated in the manner as described in Example A5.

Comparative Example H7

Example H7 was repeated except that the carbon content on the side of the first photoconductive layer was changed to 0.3 atomic %, 60 atomic % and 70 atomic %, to Give corresponding electrophotographic light-receiving members. Characteristics of the electrophoto-graphic light-receiving members thus produced were evaluated in the same manner as in Example H7.

Results obtained in Example H7 and Comparative Example H7 are shown in Table H13. As is clear from the results shown in Table H13, the first photoconductive layer 1102 with a carbon content in the range of from 0.5 to 50 atomic % at its surface on the side of the substrate, as so defined in the present invention, can contribute improvements in the characteristics required for electrophotographic light-receiving members. Very good results are also obtained when the carbon content is 1 to 30 atomic %.

EXAMPLE H8

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example H1 except for using μW glow-discharging, under conditions shown in Table H14. Electrophotographic light-receiving members 10 were thus produced. In the present Example, the pattern shown in FIG. 8 was used as a pattern of changes of carbon content in the first photoconductive layer 1102, and the flow rate of CH4 fed when the first photoconductive layer 1102 was formed was varied so that the carbon content in that layer at its surface on the substrate 11 side was varied in the range of from 0.5 to 50 atomic %. The carbon content was measured by elementary analysis using the Rutherford backward scattering method.

Characteristics of the electrophotographic light-receiving members 10 thus produced were evaluated in the same manner as in Example H7.

The results obtained in Example H8 were entirely the same as those in Example H7, which were good results.

Comparative Example H8

Example H8 was repeated except that the carbon content in the first photoconductive layer at its surface on the substrate side was changed to 0.3 atomic %, 60 atomic % and 70 atomic %, to give corresponding electrophotographic light-receiving members. Characteristics of the electrophotographic light-receiving members thus produced were evaluated in the same manner as in Example H8.

Results obtained in Comparative Example H8 showed characteristics inferior to those of the electrophotographic light-receiving members of Example H8 according to the present invention.

EXAMPLE H9

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table H15. Electrophotographic light-receiving members were thus produced. In the present Example, the flow rate of $SiF_4$ fed when the first photoconductive layer 1102 was formed was varied so that the fluorine content in the first photoconductive layer 1102 was varied in the range of from 1 to 95 atomic ppm. The fluorine content in the first photoconductive layer 1102 was measured by elementary analysis using SIMS.

The electrophotographic light-receiving members 10 thus produced were each set in a test-purpose modified electrophotographic apparatus of a copier NP-7550, manufactured by Canon Inc., and electrophotographic characteristics concerning white spots, coarse image and ghost were evaluated. A durability test for continuous paper-feeding image formation of 2,500,000 sheets was also carried out, and thereafter the electrophotographic characteristics concerning white spots, coarse image and ghost were again evaluated.

Comparative Example H9

Example H9 was repeated except that the fluorine content in the first photoconductive layer was changed to 0.5 atomic ppm, 150 atomic ppm and 300 atomic ppm, to give corresponding electrophotographic light-receiving members. Characteristics of the electrophotographic light-receiving members thus produced were evaluated in the same manner as in Example H9.

Results obtained before the durability tests and after the durability tests in Example H9 and Comparative Example H9 are shown in Tables H16 and H17, respectively.

As is clear from the results shown in Tables H16 and H17, the electrophotographic light-receiving members 10 according to the present invention in which the fluorine atom content in the first photoconductive layer was varied in the range of not more than 95 atomic ppm bring about great improvements in image characteristics and running characteristic.

EXAMPLE H10

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example H9 except for using μW glow-discharging, under conditions shown in Table H18. Electrophotographic light-receiving members 10 were thus produced. Characteristics of the electrophotographic light-receiving members 10 thus produced were evaluated in the same manner as in Example H9.

Results obtained in Example H10 were entirely the same as the results obtained in Example H9, which were good results.

EXAMPLE H11

Electrophotographic light-receiving members were produced in the same manner as in Example H1 under conditions shown in Table H19. In the present Example, the fluorine atom content in the first photoconductive layer 1102 was controlled to be 50 atomic ppm, and the flow rate of $CO_2$ fed when the first photoconductive layer 1102 was formed was varied so that the oxygen content therein was varied in the range of from 10 to 5,000 atomic ppm. The oxygen content in the first photoconductive layer 1102 was measured by elementary analysis using SIMS.

The electrophotographic light-receiving members 10 thus produced were each set in a test-purpose modified electrophotographic apparatus, and their electrophotographic characteristics concerning chargeability, sensitivity, residual potential and potential shift were evaluated. With regard to the items for chargeability, sensitivity and residual potential, evaluation was made in the same manner as in Example A1. With regard to the potential shift, evaluation was made in the manner as described in Example C9.

Comparative Example H11

Electrophotographic light-receiving members with entirely the same structure as in Example 11 except that the oxygen content in the first photoconductive layer was changed to 5 atomic ppm, 8,000 atomic ppm and 10,000 atom were produced in the same manner as in Example H11 under conditions shown in Table H19. Characteristics of the electrophotographic light-receiving members thus produced were evaluated in the same manner as in Example H11.

Results obtained in Example H11 and Comparative Example H11 are shown in Table H20. As is clear from the results shown in Table H20, the electrophotographic light-receiving members 10 of the present invention in which the oxygen content in the first photoconductive layer 1102 is controlled in the range of from 10 to 5,0000 atomic ppm can bring about good results.

EXAMPLE H12

Using the RF glow discharge manufacturing apparatus for the electrophotographic light-receiving member 10, as shown in FIG. 4, and according to the procedure previously described in detail, a light-receiving layer 1105 was formed on a mirror-finished aluminum cylinder of 108 mm in diameter under conditions shown in Table H21. Electrophotographic light-receiving members 10 were thus produced. In the present Example, the power applied and the flow rate of $CH_4$ fed when the surface layer 13 was formed were varied so that the carbon atom content in the vicinity of the outermost surface of the surface layer 13 was varied in the range of from 63 to 90 atomic % based on the total of silicon atom content and carbon atom content. Here, the carbon atom content in the surface layer 13 at its surface on the side of the second photoconductive layer 1103 was controlled to be 10 atomic %.

The electrophotographic light-receiving members 10 thus produced were each set in a test-purpose modified electrophotographic apparatus, and electrophotographic characteristics concerning chargeability, sensitivity and residual potential and image characteristics concerning smeared image, white spots, black dots caused by melt-adhesion of toner, and scratches were respectively evaluated. Characteristics of the electrophotographic light-receiving members 10 were again evaluated on the above items after a durability test for continuous paper-feeding image formation of 2,500,000 sheets using reprocessed paper. Evaluation for the items, chargeability, sensitivity and residual potential was made in the same manner as in Example A1, and for the items, smeared image, white spots, black dots caused by melt-adhesion of toner and scratches, as in Example F15.

Comparative Example H12

Example H12 was repeated except that the carbon atom content in the vicinity of the outermost surface of the surface layer was changed to 20 to 60 atomic % and 93 to 95 atomic % or more based on the total of silicon atom content and carbon atom content, to give corresponding electrophotographic light-receiving members. Evaluation on them thus produced was made in the same manner as in Example H12.

Results obtained in Example H12 and Comparative Example H12 before the durability test are shown in Table H22, and results obtained therein after the durability test are shown in Table H23.

As is clear from the results shown in Tables H22 and H23, the electrophotographic light-receiving members 10 according to the present invention in which the carbon atom content in the vicinity of the outermost surface of the surface layer 13 is set within the range of from 63 to 90 atomic % based on the total of silicon atom content and atom content can bring about good electrophotographic characteristics.

EXAMPLE H13

Using the manufacturing apparatus for the electrophotographic light-receiving member 10, as shown in FIG. 5, and according to the procedure previously described in detail, a light-receiving layer was formed on a mirror-finished aluminum cylinder of 108 mm in diameter in the same manner as in Example H12 except for using μW glow-discharging, under conditions shown in Table H24. Thus, electrophotographic light-receiving members 10 were produced. Characteristics of the electrophotographic light-receiving members thus produced were evaluated in the same manner as in Example H12.

Results obtained in Example H13 were entirely the same as those in Example H12.

Comparative Example H13

Example H13 was repeated except that the carbon atom content in the vicinity of the outermost surface of the surface layer was changed to 20 to 60 atomic % and 93 to 95 atomic % or more, to give corresponding electrophotographic light-receiving members. Their characteristics were evaluated in the same manner as in Example H12.

Results obtained in Comparative Example H13 showed characteristics inferior to those of the electrophotographic light-receiving member 10 of Example H13 according to the present invention.

EXAMPLE H14

Using the RF glow discharge manufacturing apparatus for the electrophotographic light-receiving member 10, as shown in FIG. 4, and according to the procedure previously described in detail, a light-receiving layer 1105 was formed on a mirror-finished aluminum cylinder of 108 mm in diameter under conditions shown in Table H25. Electrophotographic light-receiving members 10 were thus produced. In the present Example, the flow rate of $CO_2$ fed when the surface layer 13 was formed was varied so that the oxygen atom content in the surface layer 13 was varied in the range of from $1\times10^{-4}$ to 30 atomic %.

The electrophotographic light-receiving members 10 thus produced were each set in a test-purpose modified electrophotographic apparatus, and electrophotographic characteristics concerning chargeability, sensitivity and residual potential and image characteristics concerning smeared image, white spots, black dots caused by melt-adhesion of toner, and scratches were respectively evaluated in the same manner as in Example H4. Characteristics of the electrophotographic light-receiving members were again evaluated on the above items after a durability test for continuous paper-feeding image formation of 2,500,000 sheets using reprocessed paper.

Comparative Example H14

Example H14 was repeated except that the oxygen atom content in the surface layer was changed to 1×10 atomic % and 40 to 50 atomic %, to give corresponding electrophotographic light-receiving members 10. Evaluation was made in the same manner as in Example H14.

Results obtained in Example H14 and Comparative Example H14 before the durability test are shown in Table H26. Results obtained therein after the durability test are shown in Table H27.

As is clear from the results shown in Tables 267 and 27, the electrophotographic light-receiving members 10 according to the present invention in which the oxygen atom content in the surface layer is set within the range of from $1\times10^{-4}$ to 30 atomic % can bring about good electrophotographic characteristics.

EXAMPLE H15

Using the manufacturing apparatus for the electrophotographic light-receiving member 10, as shown in FIG. 5, and according to the procedure previously described in detail, a light-receiving layer was formed on a mirror-finished aluminum cylinder of 108 mm in diameter in the same manner as in Example H14 except for using μW glow-discharging, under conditions shown in Table H28. Thus, electrophotographic light-receiving members 10 were produced. Characteristics of the electrophotographic light-receiving members 10 thus produced were evaluated in the same manner as in Example H14.

Results obtained in Example H15 were entirely the same as those in Example H14.

Comparative Example H15

Example H15 was repeated except that the oxygen atom content in the surface layer was changed to 40 to 50 atomic %, to give corresponding electrophotographic light-receiving members. Characteristics of the electrophotographic light-receiving members thus produced were evaluated in the same manner as in Example H14.

Results obtained in Comparative Example H15 showed electrophotographic characteristics inferior to those of the electrophotographic light-receiving member 10 of Example H15 according to the present invention.

EXAMPLE H16

Using the RF glow discharge manufacturing apparatus for the electrophotographic light-receiving member 10, as shown in FIG. 4, and according to the procedure previously described in detail, a light-receiving layer 1105 was formed on a mirror-finished aluminum cylinder of 108 mm in diameter under conditions shown in Table H29. Electrophotographic light-receiving members were thus produced. In the present Example, the flow rate of $N_2$ fed when the surface layer 13 was formed was varied so that the nitrogen atom content in the surface layer 13 was varied in the range of from $1\times10^{-4}$ to 30 atomic %.

The electrophotographic light-receiving members 10 thus produced were each set in a test-purpose modified electrophotographic apparatus, and electrophotographic characteristics concerning chargeability, sensitivity and residual potential and image characteristics concerning smeared image, white spots, black dots caused by melt-adhesion of toner, and scratches were respectively evaluated in the same manner as in Example H4. Characteristics of the electrophotographic light-receiving members 10 were again evaluated on the above items after a durability test for continuous paper-feeding image formation on 2,500,000 sheets using reprocessed paper.

Comparative Example H16

Example H16 was repeated except that the nitrogen atom content in the surface layer was changed to $1\times10^{-5}$ atomic % and 40 to 50 atomic %, to give corresponding electrophotographic light-receiving members. Evaluation was made in the same manner as in Example H16.

Results obtained in Example H16 and Comparative Example H16 before the durability test are shown in Table H30. Results obtained therein after the durability test are shown in Table H31.

As is clear from the results shown in Tables H30 and H31, the electrophotographic light-receiving members 10 according to the present invention in which the nitrogen atom content in the surface layer is set within the range of from $1\times10^{-4}$ to 30 atomic % can bring about good electrophotographic characteristics.

EXAMPLE H17

Using the manufacturing apparatus for the electrophotographic light-receiving member 10, as shown in FIG. 5, and according to the procedure previously described in detail, a light-receiving layer was formed on a mirror-finished aluminum cylinder of 108 mm in diameter in the same manner as in Example H16 except for using μW glow-discharging, under conditions shown in Table H32. Electrophotographic light-receiving members 10 were thus produced. Characteristics of the electrophotographic light-receiving members 10 thus produced were evaluated in the same manner as in Example H16.

Results obtained in Example H17 were entirely the same as those in Example H16.

Comparative Example H17

Example H16 was repeated except that the oxygen atom content in the surface layer was changed to 40 to 50 atomic %, to give corresponding electrophotographic light-receiving members. Characteristics of the electrophotographic light-receiving members thus produced were evaluated in the same manner as in Example H16.

Results obtained in Comparative Example H17 showed electrophotographic characteristics inferior to those of the electrophotographic light-receiving member of Example H16 according to the present invention.

EXAMPLE H18

Using the RF glow discharge manufacturing apparatus for the electrophotographic light-receiving member 10, as shown in FIG. 4, and according to the procedure previously described in detail, a light-receiving layer 1105 was formed on a mirror-finished aluminum cylinder of 108 mm in diameter under conditions shown in Table H33. Electrophotographic light-receiving members 10 were thus produced. In the present Example, the flow rate of $B_2H_6$ fed when the surface layer 13 was formed was varied so that the content of boron atoms used as Group III element in the surface layer 13 was varied in the range of from $1\times10^{-5}$ to $1\times10^{5}$ atomic ppm.

The electrophotographic light-receiving members 10 thus produced were each set in a test-purpose modified electrophotographic apparatus, and electrophotographic characteristics concerning chargeability, sensitivity and residual potential and image characteristics concerning smeared image, white spots, black dots caused by melt-adhesion of toner, and scratches were respectively evaluated in the same manner as in Example H4. Characteristics of the electrophotographic light-receiving members 10 were again evaluated on the above items after a durability test for continuous paper-feeding image formation on 2,500,000 sheets using reprocessed paper.

Comparative Example H18

Example H18 was repeated except that the boron atom content in the surface layer was changed to $1\times10^{-6}$ atomic ppm and $1\times10^{6}$ atomic ppm, to give corresponding electrophotographic light-receiving members. Evaluation was made in the same manner as in Example H18.

Results obtained in Example H18 and Comparative Example H18 before the durability test are shown in Table H34. Results obtained therein after the durability test are shown in Table H35.

As is clear from the results shown in Tables H34 and H35, the electrophotographic light-receiving members 10 according to the present invention in which the Group III element content in the surface layer 13 is set within the range of from $1\times10^{-5}$ to $1\times10^{5}$ atomic ppm can bring about good electrophotographic characteristics.

EXAMPLE H19

Using the manufacturing apparatus for the electrophotographic light-receiving member 10, as shown in FIG. 5, and according to the procedure previously described in detail, a light-receiving layer was formed on a mirror-finished aluminum cylinder of 108 mm in diameter in the same manner as in Example H18 except for using μW glow-discharging, under conditions shown in Table H36. Electrophotographic light-receiving members were thus produced. Characteristics of the electrophotographic light-receiving members 10 thus produced were evaluated in the same manner as in Example H17.

Results obtained in Example H19 were entirely the same as those in Example H18.

Comparative Example H19

Example H19 was repeated except that the nitrogen atom content in the surface layer was changed to 40 to 50 atomic %, to give corresponding electrophotographic light-receiving members. Characteristics of the electrophotographic light-receiving members thus produce were evaluated in the same manner as in Example H18.

Results obtained in Comparative Example H19 showed electrophotographic characteristics inferior to 10 those of the electrophotographic light-receiving member 10 of Example H19 according to the present invention.

EXAMPLE H20

Using the RF glow discharge manufacturing apparatus for the electrophotographic light-receiving member 10, as shown in FIG. 4, and according to the procedure previously described in detail, a light-receiving layer 1105 was formed on a mirror-finished aluminum cylinder of 108 mm in diameter under conditions shown in Table H37. Electrophotographic light-receiving members 10 were thus produced. In the present Example, the powder applied and flow rate of $SiF_4$ fed when the surface layer 13 was formed were varied so that the hydrogen atom content and fluorine atom (used as a halogen atom) content in the surface layer 13 were varied to control the total of the hydrogen atom content and fluorine atom content so as to be not more than 80 atomic %.

The electrophotographic light-receiving members 10 thus produced were each set in a test-purpose modified electrophotographic apparatus, and electrophotographic characteristics concerning chargeability, sensitivity and residual potential and image characteristics concerning smeared image, white spots, black dots caused by melt-adhesion of toner, and scratches were respectively evaluated in the same manner as in Example H4. Characteristics of the electrophotographic light-receiving members 10 were again evaluated on the above items after a durability test for continuous paper-feeding image formation on 2,500,000 sheets using reprocessed paper.

Comparative Example H20

Example H20 was repeated except that no $SiF_4$ was fed when the surface layer was formed, to give corresponding electrophotographic light-receiving members. Characteristics of the electrophotographic light-receiving members thus produced were evaluated in the same manner as in Example H20.

Results of evaluation in Example H20 and Comparative Example H20 before the durability test are shown in Table H38. Results obtained therein after the durability test are shown in Table H39.

In Tables H38 and H39, instances in which fluorine atom content is zero (with asterisks) show results obtained in Comparative Example H20; and other instances, results obtained in Example H20.

As is clear from the results shown in Tables H38 and H39, the electrophotographic light-receiving members 10 according to the present invention in which the surface layer 13 contains a halogen atom and the total of the hydrogen atom content and halogen atom content is set within the range of 80 atomic % or less can bring about good electrophotographic characteristics.

EXAMPLE H21

Using the manufacturing apparatus for the electrophotographic light-receiving member 10, as shown in FIG. 5, and according to the procedure previously described in detail, a light-receiving layer was formed on a mirror-finished aluminum cylinder of 108 mm in diameter in the same manner as in Example H20 except for using μW glow-discharging, under conditions shown in Table H40. Electrophotographic light-receiving members 10 were thus produced. Characteristics of the electrophotographic light-receiving members thus produced were evaluated in the same manner as in Example H20.

Results obtained in Example H21 were entirely the same as those in Example H20.

Comparative Example H21

Example H21 was repeated except that no $SiF_4$ was fed when the surface layer was formed, to give corresponding electrophotographic light-receiving members. Characteristics of the electrophotographic light-receiving members thus produced were evaluated in the same manner as in Example H20.

Results obtained in Comparative Example H21 showed electrophotographic characteristics inferior to those of the electrophotographic light-receiving member 10 of Example H21 according to the present invention.

EXAMPLE H22

Using the RF glow discharge manufacturing apparatus for the electrophotographic light-receiving member 10, as shown in FIG. 4, and according to the procedure previously described in detail, a light-receiving layer 1105 was formed on a mirror-finished aluminum cylinder of 108 mm in diameter under conditions shown in Table H41. Electrophotographic light-receiving members 10 were thus produced. In the present Example, the flow rate of NO fed when the surface layer 13 was formed was varied so that the total of the oxygen atom content and nitrogen atom content in the surface layer 13 was varied in the range of from $1\times10^{-4}$ to 30 atomic %.

The electrophotographic light-receiving members 10 thus produced were each set in a test-purpose modified electrophotographic apparatus, and electrophotographic characteristics concerning chargeability, sensitivity and residual potential and image characteristics concerning smeared image, white spots, black dots caused by melt-adhesion of toner, and scratches were respectively evaluated in the same manner as in Example H4. Characteristics of the electrophotographic light-receiving members 10 were again evaluated on the above items after a durability test for continuous paper-feeding image formation on 2,500,000 sheets using reprocessed paper.

Comparative Example H22

Example H22 was repeated except that the nitrogen atom content in the surface layer was changed to 40 to 50 atomic %, to give corresponding electrophotographic light-receiving members. Characteristics of the electrophotographic light-receiving members thus produced were evaluated in the same manner as in Example H22.

Results obtained in Example H22 and Comparative Example H22 before the durability test are shown in Table H42. Results obtained therein after the durability test are shown in Table H43.

As is clear from the results shown in Tables H42 and H43, the electrophotographic light-receiving members 10 according to the present invention in which the total of the oxygen atom content and nitrogen atom content in the surface layer 13 set within the range of from $1\times10^{-4}$ to 30 atomic % can bring about good electrophotographic characteristics.

EXAMPLE H23

Using the manufacturing apparatus for the electrophotographic light-receiving member 10, as shown in FIG. 5, and according to the procedure previously described in detail, a light-receiving layer was formed on a mirror-finished aluminum cylinder of 108 mm in diameter in the same manner as in Example H21 except for using μW glow-discharging, under conditions shown in Table H44. Electrophotographic light-receiving members 10 were thus produced. Characteristics of the electrophoto-graphic light-receiving members 10 thus produced were evaluated in the same manner as in Example H22.

Results obtained were good, as being similar to those in Example H22.

Comparative Example H23

Example H23 was repeated except that the total of the oxygen atom content and nitrogen atom content in the surface layer 13 was changed to 40 to 50 atomic %, to give corresponding electrophotographic light-receiving members. Characteristics of the electrophotographic light-receiving members 10 thus produced were evaluated in the same manner as in Example H22.

Results obtained in Comparative Example H23 showed electrophotographic characteristics inferior to those of the electrophotographic light-receiving member 10 of Example H23 according to the present invention.

EXAMPLE I1

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table I1. An electrophotographic light-receiving member 10 was thus produced. In the present Example, the flow rate of $CH_4$ fed when the first photoconductive layer was formed was varied so that the carbon content in the first photoconductive layer was changed in a pattern of changes as shown in FIG. 8. The carbon content in the first photoconductive layer at its surface on the side of the substrate was so controlled as to be 30 atomic %. The carbon content was measured by elementary analysis using the Rutherford backward scattering method.

The electrophotographic light-receiving member thus produced was set in a test-purpose modified electrophotographic apparatus of a copier NP-7550, manufactured by Canon Inc., and chargeability, sensitivity and residual potential were evaluated. Evaluation for each item was made in the manner as described in Example A1.

Comparative Example I1

What is called a function-separated electrophotographic light-receiving member having a constant carbon content in its first photoconductive layer was produced in the same manner as in Example I1 and under conditions shown in Table I2. Characteristics of the electrophotographic light-receiving member thus produced were evaluated in the same manner as in Example I1.

Results of evaluation in Example I1 and Comparative Example I1 are shown together in Table I3. The electrophotographic light-receiving member with the layer structure according to the present invention is improved in chargeability and sensitivity, and also undergoes no changes in residual potential.

EXAMPLE I2

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I1 except for using μW glow-discharging, under conditions shown in Table I4. An electrophotographic light-receiving member was thus produced. Characteristics of the electrophotographic light-receiving member produced were evaluated in the same manner as in Example I1.

Comparative Example I2

What is called a function-separated electrophotographic light-receiving member having a constant carbon content in its first photoconductive layer was produced in the same manner as in Example I2 and under conditions shown in Table I5. Characteristics of the electrophotographic light-receiving member thus produced were evaluated in the same manner as in Example I2.

Results of evaluation in Example I2 and Comparative Example I2 were entirely the same as the results obtained in Example I1 and Comparative Example I1, respectively.

EXAMPLE I3

Comparative Example I3

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table I6. Electrophotographic light-receiving members were thus produced. In the present Example, the layer thickness of the second photoconductive layer was varied in the range of from 0.5 to 20 μm to give electrophotographic light-receiving members (Example I3). An electrophotographic light-receiving member having a second photoconductive layer with a thickness of 0 μm (no second photoconductive layer was provided) was also produced (Comparative Example I3). Photosensitivity was measured when irradiated with light of 610 nm in a constant amount, with respect to the thickness of the second photoconductive layer, and its relative evaluation was made on each member, assuming the photosensitivity of the second photoconductive layer with a layer thickness of 0 μm as 100. Results of evaluation are shown in Table I7.

As is clear from Table I7, providing the second photoconductive layer brings about an improvement in long-wave sensitivity.

EXAMPLE I4

Comparative Example I4

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I3 and Comparative Example I3 except for using by pW glow-discharging, under conditions shown in Table I8. Electrophotographic light-receiving members were thus produced. Evaluation was made in the same manner as in Example I3 and Comparative Example I3 on the electrophotographic light-receiving members thus produced.

Results of evaluation were entirely the same as those shown in Table I7.

EXAMPLE I5

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table I9. Electrophotographic light-receiving members were thus produced. In the present Example, the flow rate of $CH_4$ fed when the first photoconductive layer was formed was varied so that the carbon content in the first photoconductive layer was varied in patterns of changes as shown in FIGS. 8 to 10. In all patterns, the carbon content in the first photoconductive layer at its surface on the side of the substrate was so controlled as to be 30 atomic %. The carbon content was measured by elementary analysis using the Rutherford backward scattering method.

The electrophotographic light-receiving member thus produced was set in a test-purpose modified electrophotographic apparatus of a copier NP-7550, manufactured by Canon Inc., and chargeability, sensitivity and residual potential were evaluated. Evaluation for each item was made in the same manner as in Example I1.

Comparative Example I5

Example I5 was repeated except for using patterns of carbon content as shown in FIGS. 11 and 12, to give corresponding electrophotographic light-receiving members. Evaluation was made in the same manner as in Example I5.

Results obtained in Example I5 and Comparative Example I5 are shown together in Table 10. The first photoconductive layer having the pattern of carbon content according to the present invention, contributes an improvement in chargeability and sensitivity, and also causes no decrease in residual potential.

EXAMPLE I6

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I5 except for using μW glow-discharging, under conditions shown in Table I11. Electrophotographic light-receiving members were thus produced. In the present Example, the flow rate of $CH_4$ fed when the first photoconductive layer was formed was varied so that the carbon content in the first photoconductive layer was varied in patterns of changes as shown in FIGS. 8 to 10. In all patterns, the carbon content in the first photoconductive layer at its surface on the side of the substrate was so controlled as to be 30 atomic %. The carbon content was measured by elementary analysis using the Rutherford backward scattering method. Characteristics of the electrophotographic light-receiving member thus produced were evaluated in the same manner as in Example I5.

Comparative Example I6

Example I6 was repeated except for using patterns of carbon content as shown in FIGS. 11 and 12, to give corresponding electrophotographic light-receiving members. Characteristics of the electrophotographic light-receiving member thus produced were evaluated in the same manner as in Example I6.

Results of evaluation in Example I6 and Comparative Example I6 were entirely the same as the results obtained in Example I5 and Comparative Example I5, respectively.

EXAMPLE I7

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table I12. Electrophotographic light-receiving members were thus produced. In the present Example, the pattern shown in FIG. 8 was used as a pattern of changes of carbon content in the first photoconductive layer, and the flow rate of $CH_4$ fed when the first photoconductive layer was formed was varied so that the carbon content in that layer at its surface on the substrate side was varied from 0.5 atomic % to 50 atomic %. Thus, electrophotographic light-receiving members corresponding to such variations were produced. The carbon content in the first photoconductive layer at its surface on the side of the substrate was measured by elementary analysis using the Rutherford backward scattering method.

The electrophotographic light-receiving members thus produced were each set in a test-purpose modified electrophotographic apparatus of a copier NP-7550, manufactured by Canon Inc., and their electrophotographic characteristics concerning chargeability, sensitivity, residual potential, white spots, coarse image and ghost were evaluated. Number of spherical projections on the surfaces of electrophotographic light-receiving members was also examined to make evaluation. Evaluation for each item was made in the following manner.

(1) Chargeability, sensitivity and residual potential:
Evaluated in the same manner as in Example A1.
(2) White spots, coarse image and ghost:
Evaluated in the same manner as in Example A5.
(3) Number of spherical projections:
Evaluated in the same manner as in Example A5.

Comparative Example I7

Example I7 was repeated except that the carbon content at the surface on the substrate side was changed to 0.3 atomic %, 60 atomic % and 70 atomic %. Electrophotographic light-receiving members corresponding to such changes were thus produced. Evaluation was made in the same manner as in Example I7.

Results of evaluation in Example I7 and Comparative Example I7 are shown together in Table I13. As is seen from the results, the first photoconductive layer with a carbon content of from 0.5 to 50 atomic % at its surface on the side of the substrate, which is in accordance with the present invention, can contribute improvements in the characteristics of the electrophotographic light-receiving member, and also bring about a decrease in spherical projections. Very good results are obtained when the carbon content is 1 to 30 atomic %.

EXAMPLE I8

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I7 except for using μW glow-discharging, under conditions shown in Table I14. Electrophotographic light-receiving members were thus produced. In the present Example, the pattern shown in FIG. 8 was used as a pattern of changes of carbon content in the first photoconductive layer, and the flow rate of $CH_4$ fed when the first photoconductive layer was formed was varied so that the carbon content in that layer at its surface on the substrate side was varied from 0.5 atomic % to 50 atomic %. Thus, electrophotographic light-receiving members corresponding to such variations were produced. Evaluation was made in the same manner as in Example I7.

Comparative Example I8

Example I8 was repeated except that the carbon content at the surface on the substrate side was changed to 0.3 atomic %, 60 atomic % and 70 atomic %. Electrophotographic light-receiving members corresponding to such changes were thus produced. Evaluation was made in the same manner as in Example I8.

Results of evaluation in Example I8 and Comparative Example I8 were the same as the results of evaluation in Example I7 and Comparative Example I7, respectively.

EXAMPLE I9

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table I15. Electrophotographic light-receiving members were thus produced. In the present Example, the flow rate of $siF_4$ fed when the first photoconductive layer was formed was varied so that the fluorine content in the first photoconductive layer was varied as shown in FIGS. 13 to 20. Thus, electrophotographic light-receiving members corresponding to such variations were produced. The fluorine content in the first photoconductive layer was measured by elementary analysis using SIMS (CAMECA IMS-3F).

(I) The electrophotographic light-receiving members thus produced were each set in a test-purpose modified electrophotographic apparatus of a copier NP-7550, manufactured by Canon Inc., and electrophotographic characteristics concerning white spots, coarse image and ghost were evaluated in the same manner as in Example I6 before an accelerated durability test was carried out.

(II) Next, the electrophotographic light-receiving members thus produced were each set in the test-purpose modified electrophotographic apparatus of a copier NP-7550, manufactured by Canon Inc., and an accelerated durability test which corresponded to copying on 2,500,000 sheets was carried out. Then, electrophotographic characteristics concerning white spots, coarse image and ghost were evaluated similarly to (I).

Comparative Example I9

Example I9 was repeated except that the fluorine content in the first photoconductive layer was varied as shown in FIGS. 21 and 22, to give electrophotographic light-receiving members corresponding to such variations. Evaluation was made in the same manner as in Example I9.

Results of evaluation in Example I9 and Comparative Example I9 are shown together in Tables I16 and I17, respectively. As is seen from the results, the first photoconductive layer with a fluorine content set within the range of from 1 to 95 atomic ppm in the first photoconductive layer, which is in accordance with the present invention, can contribute improvements in image characteristics and durability. Very good results are obtained when the fluorine content is 5 to 50 atomic ppm.

EXAMPLE I10

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I9 except for using μW glow-discharging, under conditions shown in Table I18. Electrophotographic light-receiving members were thus produced. In the present example, the flow rate of $SiF_4$ fed when the first photoconductive layer was formed was varied so that the fluorine content in the first photoconductive layer was varied as shown in FIGS. 13 to 20. Thus, electrophotographic light-receiving members corresponding to such variations were produced. Characteristics of the electrophotographic light-receiving members thus produced were evaluated in the same manner as in Example I9.

Comparative Example I10

Example I10 was repeated except that the fluorine content in the first photoconductive layer was varied as shown in FIGS. 21 and 22, to give electrophotographic light-receiving members corresponding to such variations. Evaluation was made in the same manner as in Example I10.

Results of evaluation in Example I10 and Comparative Example I10 were the same as the results of evaluation in Example I9 and Comparative Example I9, respectively.

EXAMPLE I11

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table I19. Electrophotographic light-receiving members were thus produced. In the present Example, the flow rate of $SiF_4$ fed when the first photoconductive layer was formed was varied so that the fluorine content in the first photoconductive layer was varied as shown in FIGS. 23 to 26. Here, the fluorine content in the first photoconductive layer was varied in the range of from 1 atomic ppm to 95 atomic ppm. The fluorine content in the first photoconductive layer was measured by elementary analysis using SIMS (CAMECA IMS-3F).

(I) The electrophotographic light-receiving members thus produced were each set in a test-purpose modified electrophotographic apparatus of a copier NP-7550, manufactured by Canon Inc., and electrophotographic characteristics concerning temperature characteristics, chargeability, uneven images, white spots, coarse image and ghost were evaluated in the following manner.

(1) Temperature characteristics:

Evaluated in the same manner as in Example E9.

(2) Chargeability:

Evaluated in the same manner as in Example A1.

(3) Uneven image:

Evaluated in the same manner as in Example E9.

(4) White spots, coarse image and ghost:

Evaluated in the same manner as in Example A5.

(II) Next, the electrophotographic light-receiving members thus produced were each set in the test-purpose modified electrophotographic apparatus of a copier NP-7550, manufactured by Canon Inc., and an accelerated durability test which corresponded to copying on 2,500,000 sheets was carried out. Then, electrophotographic characteristics concerning temperature characteristics, chargeability, uneven images, white spots, coarse image and ghost were evaluated similarly to (I).

Comparative Example I11

Example I11 was repeated except that fluorine content in the first photoconductive layer was made constant in a pattern as shown in FIG. 27, to give an electrophotographic light-receiving member. Its characteristics were evaluated in the same manner as in Example I11. Here, the fluorine content in the first photoconductive layer was measured by elementary analysis using SIMS (CAMECA IMS-3F) to reveal that it was constant at 25 atomic ppm.

Results of evaluation in Example I11 and Comparative Example I11 are shown together in Tables I20 and I21, respectively. As is clear from the results shown in Tables I20 and I21, the first photoconductive layer with a fluorine content varied in the layer thickness direction is very effective for improving image characteristics and durability.

EXAMPLE I12

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I11 except for using μW glow-discharging, under conditions shown in Table I22. Electrophotographic light-receiving members were thus produced. Characteristics of the electrophotographic light-receiving members thus produced was evaluated in the same manner as in Example I11.

Comparative Example I12

Example I12 was repeated except that fluorine content in the first photoconductive layer was made constant in a pattern as shown in FIG. 27, to give an electrophotographic light-receiving member. Its characteristics were evaluated in the same manner as in Example I12. Here, the fluorine content in the first photoconductive layer was measured by elementary analysis using SIMS (CAMECA IMS-3F) to reveal that it was constant at 25 atomic ppm.

Results of evaluation in Example I12 and Comparative Example I12 were the same as those in Example I11 and Comparative Example I11, respectively.

EXAMPLE I13

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table I23. Electrophotographic light-receiving members were thus produced. In the present Example, the oxygen content in the first photoconductive layer in its layer thickness direction was made constant in a pattern as shown in FIG. 28, and the flow rate of $CO_2$ fed when the first photoconductive layer was formed was varied so that the oxygen content in the first photoconductive layer was varied in the range of from 10 atomic ppm to 5,000 atomic ppm. Thus, electrophotographic light-receiving members corresponding to such variations were produced. The oxygen content in the first photoconductive layer was measured by elementary analysis using SIMS (CAMECA IMS-3F).

The electrophotographic light-receiving members thus produced were each set in a test-purpose modified electrophotographic apparatus of a copier NP-7550, manufactured by Canon Inc., and electrophotographic characteristics concerning chargeability, sensitivity, residual potential and potential shift were evaluated.

(1) Chargeability, sensitivity and residual potential:
Evaluated in the same manner as in Example A1.

(2) Potential shift:
Evaluated in the same manner as in Example C9.

Comparative Example I13

Example I13 was repeated except that the oxygen content in the first photoconductive layer was changed to 5 atomic ppm, 7 atomic ppm and 5,500 to 8,000 atomic ppm, to give electrophotographic light-receiving members corresponding to such changes. Their characteristics were evaluated in the same manner as in Example I13.

Results obtained in Example I13 and Comparative Example I13 are shown together in Table I24. As is clear from the results, the first photoconductive layer with an oxygen content set within the range of from 10 to 5,000 ppm is very effective for an improvement in potential shift.

EXAMPLE I14

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I13 except for using μW glow-discharging, under conditions shown in Table I25. Electrophotographic light-receiving members were thus produced. In the present Example, the oxygen content in the first photoconductive layer in its layer thickness direction was made constant in a pattern as shown in FIG. 28, and the flow rate of $CO_2$ fed when the first photoconductive layer was formed was varied so that the oxygen content in the first photoconductive layer was varied in the range of from 10 atomic ppm to 5,000 atomic ppm. Thus, electrophotographic light-receiving members corresponding to such variations were produced. Characteristics of the electrophotographic light-receiving members produced were evaluated in the same manner as in Example I13.

Comparative Example I14

Example I14 was repeated except that the oxygen content in the first photoconductive layer was changed to 5 atomic ppm, 7 atomic ppm and 5,500 to 8,000 atomic ppm, to give electrophotographic light-receiving members corresponding to such changes. Their characteristics were evaluated in the same manner as in Example I14.

Results of evaluation in Example I14 and Comparative Example I14 were the same as the results obtained in Example I13 and Comparative Example I13, respectively.

EXAMPLE I15

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table I26. Electrophotographic light-receiving members were thus produced. In the present Example, the flow rate of $CO_2$ fed when the first photoconductive layer was formed was varied so that the oxygen content in the first photoconductive layer was varied as shown in FIGS. 28 to 32. Here, the oxygen content in the first photoconductive layer was varied in the range of from 10 atomic ppm to 500 atomic ppm. The oxygen content in the first photoconductive layer was measured by elementary analysis using SIMS (CAMECA IMS-3F).

The electrophotographic light-receiving members thus produced were each set in a test-purpose modified electrophotographic apparatus of a copier NP- 7550, manufactured by Canon Inc., and electrophotographic characteristics concerning chargeability, sensitivity, residual potential and potential shift were evaluated in the same manner as in Examples I1 and I13, after an accelerated durability test which corresponded to copying on 2,500,000 sheets was carried out.

Comparative Example I15

Using the electrophotographic light-receiving member manufacturing apparatus as shown in FIG. 4, an electrophotographic light-receiving member was produced in the same manner as in Example I15, under conditions shown in Table I26, except that in the present Comparative Example no $CO_2$ was used when the photoconductive layers were formed and no oxygen was incorporated in the photoconductive layers. Characteristics of the electrophotographic light-receiving members produced were evaluated in the same manner as in Example I15.

Results of evaluation in Example I15 and Comparative Example I15 are shown together in Table I27. As is clear from the results shown in Table I27, the photoconductive layer containing oxygen atoms whose content is preferably varied in the layer thickness direction can contribute improvements in electrophotographic characteristics and durability.

EXAMPLE I16

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I15 except for using μW glow-discharging, under conditions shown in Table I28. Electrophotographic light-receiving members were thus produced. Characteristics of the electrophotographic light-receiving members produced were evaluated in the same manner as in Example I15.

Comparative Example I16

Using the electrophotographic light-receiving member manufacturing apparatus as shown in FIG. 5, an electrophotographic light-receiving member was produced in the same manner as in Example I16 under conditions shown in Table I28, except that in the present Comparative Example no $CO_2$ was used when the photoconductive layers were formed, and no oxygen was incorporated in the photoconductive layers. Characteristics of the electrophotographic light-receiving members produced were evaluated in the same manner as in Example I16.

Results of evaluation in Example I16 and Comparative Example I16 were the same as those in Example I15 and Comparative Example I15, respectively.

EXAMPLE I17

Using the RF glow discharge manufacturing apparatus for the electrophotographic light-receiving member, as shown in FIG. 4, and according to the procedure previously described in detail, a light-receiving layer was formed on a mirror-finished aluminum cylinder of 108 mm in diameter under conditions shown in Table I29. Electrophotographic light-receiving members were thus produced. In the present Example, the power applied and the flow rate of $CH_4$ fed when the surface layer was formed were varied so that the carbon content in the vicinity of the outermost surface of the surface layer was varied in the range of from 63 to 90 atomic % based on the total of silicon atom content and carbon atom content. Here, the carbon content in the surface layer at its surface on the side of the photoconductive layer was controlled to be 10 atomic %.

The electrophotographic light-receiving members thus produced were each set in a test-purpose modified electrophotographic apparatus of a copier NP-7550, manufactured by Canon Inc., and electrophotographic characteristics concerning charge characteristic, sensitivity and residual potential and image characteristics concerning smeared image, white spots, black dots caused by melt-adhesion of toner, and scratches were respectively evaluated. Characteristics of the electrophotographic light-receiving members were again evaluated on the above items after a durability test for continuous paper-feeding image formation on 2,500,000 sheets using reprocessed paper. Evaluation for each item was made in the same manner as in Example H14.

Comparative Example I17

Example I17 was repeated except that the carbon content in the vicinity of the outermost surface of the surface layer was changed to 20 to 60 atomic % and 93 to 95 atomic % or more based on the total of silicon atom content and carbon atom content, to give corresponding electrophotographic light-receiving members. Evaluation was made in the same manner as in Example I17.

Results obtained in Example I17 and Comparative Example I17 before the durability test are shown in Table, and results obtained therein after the durability test are shown in Table I31.

As is clear from the results shown in Tables I30 and I31, the electrophotographic light-receiving members according to the present invention in which the carbon content in the vicinity of the outermost surface of the surface layer is set within the range of from 63 to 90 atomic % based on the total of silicon atom content and carbon atom content can bring about good electrophotographic characteristics.

EXAMPLE I18

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I17 except for using μW glow-discharging, under conditions shown in Table I32. Thus, electrophotographic light-receiving members were produced. Characteristics of the electrophotographic light-receiving members thus produced were evaluated in the same manner as in Example I17.

Results obtained in Example I18 were entirely the same as those in Example I17.

Comparative Example I18

Example I18 was repeated except that the carbon content in the vicinity of the outermost surface of the surface layer was changed to 20 to 60 atomic % and 93 to 95 atomic % or more, to give corresponding electrophotographic light-receiving members. Their characteristics were evaluated in the same manner as in Example I18.

Results obtained in Comparative Example I18 showed characteristics inferior to those of the electrophotographic light-receiving member of Example I18 according to the present invention.

EXAMPLE I19

Using the RF glow discharge manufacturing apparatus for the electrophotographic light-receiving member, as shown in FIG. 4, and according to the procedure previously described in detail, a light-receiving layer was formed on a mirror-finished aluminum cylinder of 108 mm in diameter under conditions shown in Table I33. Electrophotographic light-receiving members were thus produced. In the present Example, the flow rate of $CO_2$ fed when the surface layer was formed was varied so that the oxygen content in the surface layer was varied in the range of from $1\times10^{-4}$ to 30 atomic %.

The electrophotographic light-receiving members thus produced were each set in a test-purpose modified electrophotographic apparatus of a copier NP-7550, manufactured by Canon Inc., and electrophotographic characteristics concerning chargeability, sensitivity and residual potential and image characteristics concerning smeared image, white spots, black dots caused by melt-adhesion of toner, and scratches were respectively evaluated in the same manner as in Example I17. Characteristics of the electrophotographic light-receiving members were again evaluated on the above items after a durability test for continuous paper-feeding image formation on 2,500,000 sheets using reprocessed paper.

Comparative Example I19

Example I19 was repeated except that the oxygen content in the surface layer was changed to $1\times10^{-5}$ atomic % and 40 to 50 atomic %, to give corresponding electrophotographic light-receiving members. Evaluation was made in the same manner as in Example I19.

Results obtained in Example I19 and Comparative Example I19 before the durability test are shown in Table I34. Results obtained therein after the durability test are shown in Table I35.

As is clear from the results shown in Tables I34 and I35, the electrophotographic light-receiving members according to the present invention in which the oxygen content in the surface layer is set within the range of from $1\times10^{-4}$ to 30 atomic % can bring about good electrophotographic characteristics.

EXAMPLE I20

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I19 except for using μW glow-discharging, under conditions shown in Table I36. Thus, electrophotographic light-receiving members were produced. Characteristics of the electrophotographic light-receiving members thus produced were evaluated in the same manner as in Example I19

Results obtained in Example I20 were entirely the same as those in Example I19.

Comparative Example I20

Example I20 was repeated except that the oxygen content in the surface layer was changed to $1\times10^{-5}$ atomic % and 40 to 50 atomic %, to give corresponding electrophotographic light-receiving members. Characteristics of the electrophotographic light-receiving members thus produced were evaluated in the same manner as in Example I20.

Results obtained in Comparative Example I20 showed electrophotographic characteristics inferior to those of the electrophotographic light-receiving member of Example I20 according to the present invention.

EXAMPLE I21

Using the RF glow discharge manufacturing apparatus for the electrophotographic light-receiving member, as shown in FIG. 4, and according to the procedure previously described in detail, a light-receiving layer was formed on a mirror-finished aluminum cylinder of 108 mm in diameter under conditions shown in Table I37. Electrophotographic light-receiving members were thus produced. In the present Example, the flow rate of $N_2$ fed when the surface layer was formed was varied so that the nitrogen content in the surface layer was varied in the range of from $1\times10^{-4}$ to 30 atomic %.

The electrophotographic light-receiving members thus produced were each set in a test-purpose modified electrophotographic apparatus of a copier NP-7550, manufactured by Canon Inc., and electrophotographic characteristics concerning chargeability, sensitivity and residual potential and image characteristics concerning smeared image, white spots, black dots caused by melt-adhesion of toner, and scratches were respectively evaluated in the same manner as in Example I17. Characteristics of the electrophotographic light-receiving members were again evaluated on the above items after a durability test for continuous paper-feeding image formation on 2,500,000 sheets using reprocessed paper.

Comparative Example I21

Example I21 was repeated except that the nitrogen content in the surface layer was changed to $1\times10^{-5}$ atomic % and 40 to 50 atomic %, to give corresponding electrophotographic light-receiving members. Evaluation was made in the same manner as in Example I21.

Results obtained in Example I21 and Comparative Example I21 before the durability test are shown in Table I38. Results obtained therein after the durability test are shown in Table I39.

As is clear from the results shown in Tables I38 and I39, the electrophotographic light-receiving members according to the present invention in which the nitrogen content in the surface layer is set within the range of from $1\times10^{-4}$ to 30 atomic % can bring about good electrophotographic characteristics.

EXAMPLE I22

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I21 except for using μW glow-discharging, under conditions shown in Table I40. Electrophotographic light-receiving members were thus produced. Characteristics of the electrophotographic light-receiving members thus produced were evaluated in the same manner as in Example I21.

Results obtained were entirely the same as those in Example I21.

Comparative Example I22

Example I22 was repeated except that the oxygen content in the surface layer was changed to $1\times10^{-5}$ atomic % and 40 to 50 atomic %, to give corresponding electrophotographic light-receiving members. Characteristics of the electrophotographic light-receiving members thus produced were evaluated in the same manner as in Example I22.

Results obtained in Comparative Example I22 showed electrophotographic characteristics inferior to those of the electrophotographic light-receiving member of Example I22 according to the present invention.

EXAMPLE I23

Using the RF glow discharge manufacturing apparatus for the electrophotographic light-receiving member, as shown in FIG. 4, and according to the procedure previously described in detail, a light-receiving layer was formed on a mirror-finished aluminum cylinder of 108 mm in diameter under conditions shown in Table I41. Electrophotographic light-receiving members were thus produced. In the present Example, the flow rate of $B_2H_6$ fed when the surface layer was formed was varied so that the content of boron atoms used as Group III element in the surface layer was varied in the range of from $1\times10^{-5}$ to $1\times10^{5}$ atomic ppm.

The electrophotographic light-receiving members thus produced were each set in a test-purpose modified electrophotographic apparatus of a copier NP-7550, manufactured by Canon Inc., and electrophotographic characteristics concerning chargeability, sensitivity and residual potential and image characteristics concerning smeared image, white spots, black dots caused by melt-adhesion of toner, and scratches were respectively evaluated in the same manner as in Example I17. Characteristics of the electrophotographic light-receiving members were again evaluated on the above items after a durability test for continuous paper-feeding image formation on 2,500,000 sheets using reprocessed paper.

Comparative Example I23

Example I23 was repeated except that the boron atom content in the surface layer was changed to $1\times10^{-6}$ atomic ppm and $1\times10^{6}$ atomic ppm, to give corresponding electrophotographic light-receiving members. Evaluation was made in the same manner as in Example I23.

Results obtained in Example I23 and Comparative Example I23 before the durability test are shown in Table I42. Results obtained therein after the durability test are shown in Table I43.

As is clear from the results shown in Tables I42 and I43, the electrophotographic light-receiving members according to the present invention in which the Group III element content in the surface layer is set within the range of from $1\times10^{-5}$ to $1\times10^{5}$ atomic ppm can bring about good electrophotographic characteristics.

EXAMPLE I24

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I23 except for using μW glow-discharging, under conditions shown in Table I44. Electrophotographic light-receiving members were thus produced. Characteristics of the electrophotographic light-receiving members thus produced were evaluated in the same manner as in Example I23.

Results obtained in Example I24 were entirely the same as those in Example I23.

Comparative Example I24

Example I24 was repeated except that the boron atom content in the surface layer was changed to $1\times10^{-6}$ atomic ppm and $1\times10^{6}$ atomic ppm, to give corresponding electrophotographic light-receiving members. Characteristics of the electrophotographic light-receiving members thus produce were evaluated in the same manner as in Example I24.

Results obtained in Comparative Example I24 showed electrophotographic characteristics inferior to those of the electrophotographic light-receiving member of Example I24 according to the present invention.

EXAMPLE I25

Using the RF glow discharge manufacturing apparatus for the electrophotographic light-receiving member, as shown in FIG. 4, and according to the procedure previously described in detail, a light-receiving layer was formed on a mirror-finished aluminum cylinder of 108 mm in diameter under conditions shown in Table I45. Electrophotographic light-receiving members were thus produced. In the present Example, the powder applied and flow rate of $SiF_4$ fed when the surface layer was formed were varied so that the hydrogen atom content and fluorine atom (used as a halogen atom) content in the surface layer were varied to control the total of the hydrogen atom content and fluorine atom content so as to be not more than 80 atomic %.

The electrophotographic light-receiving members thus produced were each set in a test-purpose modified electrophotographic apparatus of a copier NP-7550, manufactured by Canon Inc., and electrophotographic characteristics concerning chargeability, sensitivity and residual potential and image characteristics concerning smeared image, white spots, black dots caused by melt-adhesion of toner, and scratches were respectively evaluated in the same manner as in Example I7. Characteristics of the electrophotographic light-receiving members were again evaluated on the above items after a durability test for continuous paper-feeding image formation on 2,500,000 sheets using reprocessed paper.

Comparative Example I25

Example I25 was repeated except that no $SiF_4$ was fed when the surface layer was formed, to give corresponding electrophotographic light-receiving members. Characteristics of the electrophotographic light-receiving members thus produced were evaluated in the same manner as in Example I25.

Results obtained in the above before the durability test and after the durability test are shown in Table I46 and Table I47, respectively.

In Tables I46 and I47, instances in which fluorine atom content is zero (with asterisks) show results obtained in Comparative Example I25; and other instances, results obtained in Example I25.

As is clear from the results shown in Tables I46 and I47, the electrophotographic light-receiving members according to the present invention in which the surface layer contains a halogen atom and the total of the hydrogen atom content and halogen atom content is set within the range of 80 atomic % or less can bring about good electrophotographic characteristics.

EXAMPLE I26

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I25 except for using μW glow-discharging, under conditions shown in Table I48. Electrophotographic light-receiving members were thus produced. Characteristics of the electrophotographic light-receiving members thus produced were evaluated in the same manner as in Example I25.

Results obtained in Example I25 were entirely the same as those in Example I24.

Comparative Example I26

Example I26 was repeated except that no $SiF_4$ was fed when the surface layer was formed, to give corresponding electrophotographic light-receiving members. Characteristics of the electrophotographic light-receiving members thus produced were evaluated in the same manner as in Example I26.

Results obtained in Comparative Example I26 showed electrophotographic characteristics inferior to those of the electrophotographic light-receiving member of Example I26 according to the present invention.

EXAMPLE I27

Using the RF glow discharge manufacturing apparatus for the electrophotographic light-receiving member, as shown in FIG. 4, and according to the procedure previously described in detail, a light-receiving layer was formed on a mirror-finished aluminum cylinder of 108 mm in diameter under conditions shown in Table I49. Electrophotographic light-receiving members were thus produced. In the present Example, the flow rate of NO fed when the surface layer was formed was varied so that the total of the oxygen atom content and nitrogen atom content in the surface layer was varied in the range of from $1\times10^{-4}$ to 30 atomic %.

The electrophotographic light-receiving members thus produced were each set in a test-purpose modified electrophotographic apparatus of a copier NP-7550, manufactured by Canon Inc., and electrophotographic characteristics concerning chargeability, sensitivity and residual potential and image characteristics concerning smeared image, white spots, black dots caused by melt-adhesion of toner, and scratches were respectively evaluated in the same manner as in Example I17. Characteristics of the electrophotographic light-receiving members were again evaluated on the above items after a durability test for continuous paper-feeding image formation on 2,500,000 sheets using reprocessed paper.

Comparative Example I27

Example I27 was repeated except that the total of the oxygen atom content and nitrogen atom content in the surface layer was changed to $1\times10^{-5}$ atomic % and 40 to 50 atomic %, to give corresponding electrophotographic light-receiving members. Characteristics of the electrophotographic light-receiving members thus produced were evaluated in the same manner as in Example I27.

Results obtained in Example I27 and Comparative Example I27 before the durability test are shown in Table I50. Results obtained therein after the durability test are shown in Table I51.

As is clear from the results shown in Tables I50 and I51, the electrophotographic light-receiving members according to the present invention in which the total of the oxygen atom content and nitrogen atom content in the surface layer set within the range of from $1\times10^{-4}$ to 30 atomic % can bring about good electrophotographic characteristics.

EXAMPLE I28

Using the manufacturing apparatus for the electrophotographic light-receiving member, as shown in FIG. 5, and according to the procedure previously described in detail, a light-receiving layer was formed on a mirror-finished aluminum cylinder of 108 mm in diameter in the same manner as in Example I27 except for using μW glow-discharging, under conditions shown in Table I52. Electrophotographic light-receiving members were thus produced. Characteristics of the electrophotographic light-receiving members thus produced were evaluated in the same manner as in Example I27.

Results obtained were entirely the same as those in Example I27.

Comparative Example I28

Example I28 was repeated except that the total of the oxygen atom content and nitrogen atom content in the surface layer was changed to $1\times10^{-5}$ atomic % and 40 to 50 atomic %, to give corresponding electrophotographic light-receiving members. Characteristics of the electrophotographic light-receiving members thus produced were evaluated in the same manner as in Example I28.

Results obtained in Comparative Example I28 showed electrophotographic characteristics inferior to those of the electrophotographic light-receiving member of Example I28 according to the present invention.

EXAMPLE E29

Using the RF glow-discharging manufacturing apparatus for the electrophotographic light-receiving member, as shown in FIG. 4, and according to the procedure previously described in detail, a light-receiving layer of an electrophotographic light-receiving member was formed on a mirror-finished aluminum cylinder of 108 mm in diameter under conditions shown in Table I53. In the present Example, the boron atom content in the first and second photoconductive layers each was varied as shown in Table I54. Hydrogen-based diborane (10 ppm $B_2H_6/H_2$) was used as the starting material gas.

The electrophotographic light-receiving members thus produced were each set in a test-purpose modified electrophotographic apparatus of a copier NP-7550, manufactured by Canon Inc., and chargeability, sensitivity and residual potential were evaluated. Evaluation for each item was made in the following manner.

(1) Chargeability, sensitivity and residual potential:

Evaluated in the same manner as in Example A1.

Results obtained are shown in Table I55. In Table I55, for comparison, results are shown as relative values assuming as 100 the values of the chargeability, sensitivity and residual potential obtained in the pattern a of boron atom content.

As is clear from Table 55, the photoconductive layer doped with boron atoms can contribute improvements particularly in residual potential and sensitivity.

EXAMPLE I30

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I29 except for using μW glow-discharging, under conditions shown in Table I56. Electrophotographic light-receiving members were thus produced. The pattern of changes of boron content was the same as shown in Table 54. Characteristics of the electrophotographic light-receiving members thus produced were evaluated in the same manner as in Example I29. Results thus obtained were the same as those in Example I55.

EXAMPLE I31

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table I57. An electrophotographic light-receiving member 10 was thus produced. In the present Example, the flow rate of $CH_4$ fed when the first photoconductive layer was formed was varied so that the carbon content in the photoconductive layer was changed in a pattern of changes as shown in FIG. 8. The carbon content in the first photoconductive layer at its surface on the side of the substrate was so controlled as to be 30 atomic %. The carbon content was measured by elementary analysis using the Rutherford backward scattering method.

The electrophotographic light-receiving member thus produced was set in a test-purpose modified electrophotographic apparatus of a copier NP-7550, manufactured by Canon Inc., and chargeability, sensitivity and residual potential were evaluated. Evaluation for each item was made in the manner as described in Example A1.

Comparative Example I29

What is called a function-separated electrophotographic light-receiving member having a constant carbon content and boron content in its first photoconductive layer was produced in the same manner as in Example I31 and under conditions shown in Table I58. Characteristics of the electrophotographic light-receiving member thus produced were evaluated in the same manner as in Example I31.

Results of evaluation in Example I31 and Comparative Example I29 are shown together in Table I59. The electrophotographic light-receiving member with the layer structure according to the present invention is improved in chargeability and sensitivity, and also undergoes no changes in residual potential.

EXAMPLE I32

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I31 except for using μW glow-discharging, under conditions shown in Table I60. An electrophotographic light-receiving member was thus produced. Characteristics of the electrophotographic light-receiving member produced were evaluated in the same manner as in Example I31.

Comparative Example I30

What is called a function-separated electrophotographic light-receiving member having a constant carbon content and boron content in its first photoconductive layer was produced in the same manner as in Example I32 and under conditions shown in Table I61. Characteristics of the electrophotographic light-receiving member thus produced were evaluated in the same manner as in Example I32.

Results of evaluation in Example I32 and Comparative Example I30 were entirely the same as the results obtained in Example I31 and Comparative Example I29, respectively.

EXAMPLE I33

Comparative Example I31

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table I62. Electrophotographic light-receiving members were thus produced. In the present Example, the layer thickness of the second photoconductive layer was varied in the range of from 0.5 to 15 μm to give electrophotographic light-receiving members (Example I33). Electrophotographic light-receiving members having a second photoconductive layer with a thickness of 0 μm and 20 μm each were also produced (Comparative Example I31). Photosensitivity was measured when irradiated with light of 610 nm in a constant amount, with respect to the thickness of the second photoconductive layer, and its relative evaluation was made on each member, assuming the photosensitivity of the second photoconductive layer with a layer thickness of 0 μm as 100. Results of evaluation are shown in Table I63.

As is clear from Table I63, providing the second photoconductive layer brings about an improvement in long-wave sensitivity.

EXAMPLE I34

Comparative Example I32

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I33 and Comparative Example I31 except for using by μW glow-discharging, under conditions shown in Table I64. Thus, electrophotographic light-receiving members were produced. Evaluation was made in the same manner as in Example I33 and Comparative Example I31 on the electrophotographic light-receiving members thus produced.

Results of evaluation were entirely the same as those in Example I33 and Comparative Example I31.

EXAMPLE I35

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table I65. Electrophotographic light-receiving members were thus produced. In the present Example, the flow rate of $CH_4$ fed when the first photoconductive layer was formed was varied so that the carbon content in the first photoconductive layer was varied in patterns of changes as shown in FIGS. 8 to 10. In all patterns, the carbon content in the first photoconductive layer at its surface on the side of the substrate was so controlled as to be 30 atomic %. The carbon content was measured by elementary analysis using the Rutherford backward scattering method.

The electrophotographic light-receiving member thus produced was set in a test-purpose modified electrophotographic apparatus of a copier NP-7550, manufactured by Canon Inc., and chargeability, sensitivity and residual potential were evaluated. Evaluation for each item was made in the same manner as in Example I1.

Comparative Example I33

Example I35 was repeated except for using a pattern of carbon content as shown in FIGS. 11 and 12 each, to give corresponding electrophotographic light-receiving members. Evaluation was made in the same manner as in Example I35.

Results obtained in Example I35 and Comparative Example I33 are shown together in Table I66. The first photoconductive layer having the pattern of carbon content according to the present invention, contributes an improvement in chargeability and sensitivity, and also causes no decrease in residual potential.

EXAMPLE I36

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I35 except for using μW glow-discharging, under conditions shown in Table I67. Electrophotographic light-receiving members were thus produced. In the present Example, the flow rate of $CH_4$ fed when the first photoconductive layer was formed was varied so that the carbon content in the first photoconductive layer was varied in patterns of changes as shown in FIGS. 8 to 10. In all patterns, the carbon content in the photoconductive layer at its surface on the side of the substrate was so controlled as to be 30 atomic %. The carbon content was measured by elementary analysis using the Rutherford backward scattering method. Characteristics of the electrophotographic light-receiving member thus produced were evaluated in the same manner as in Example I35.

Comparative Example I34

Example I36 was repeated except for using a pattern of carbon content as shown in FIGS. 11 and 12 each, to give corresponding electrophotographic light-receiving members. Characteristics of the electrophotographic light-receiving member thus produced were evaluated in the same manner as in Example I36.

Results of evaluation in Example I36 and Comparative Example I34 were entirely the same as the results obtained in Example I35 and Comparative Example I33, respectively.

EXAMPLE I37

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table I68. Electrophotographic light-receiving members were thus produced. In the present Example, the pattern shown in FIG. 8 was used as a pattern of changes of carbon content in the first photoconductive layer, and the flow rate of $CH_4$ fed when the first photoconductive layer was formed was varied so that the carbon content in that layer at its surface on the substrate side was varied from 0.5 atomic % to 50 atomic %. Thus, electrophotographic light-receiving members corresponding to such variations were produced. The carbon content in the first photoconductive layer at its surface on the side of the substrate was measured by elementary analysis using the Rutherford backward scattering method.

The electrophotographic light-receiving members thus produced were each set in a test-purpose modified electrophotographic apparatus of a copier NP-7550, manufactured by Canon Inc., and their electrophotographic characteristics concerning chargeability, sensitivity, residual potential, white spots, coarse image and ghost were evaluated. Number of spherical projections on the surfaces of electrophotographic light-receiving members was also examined to make evaluation. Evaluation for each item was made in the same manner as in Examples A1 and A5.

Comparative Example I35

Example I37 was repeated except that the carbon content at the surface on the substrate side was changed to 0.3 atomic %, 60 atomic % and 70 atomic % Electrophotographic light-receiving members corresponding to such changes were thus produced. Evaluation was made in the same manner as in Example I37.

Results of evaluation in Example I37 and Comparative Example I35 are shown together in Table I69. As is seen from the results, the first photoconductive layer with a carbon content of from 0.5 to 50 atomic % at its surface on the side of the substrate, which is in accordance with the present invention, can contribute improvements in the characteristics of the electrophotographic light-receiving member, and also bring about a decrease in spherical projections. Very good results are obtained when the carbon content is 1 to 30 atomic %,

EXAMPLE I38

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I37 except for using μW glow-discharging, under conditions shown in Table I70. Electrophotographic light-receiving members were thus produced. In the present Example, the pattern shown in FIG. 8 was used as a pattern of changes of carbon content in the first photoconductive layer, and the flow rate of $CH_4$ fed when the first photoconductive layer was formed was varied so that the carbon content in that layer at its surface on the substrate side was varied from 0.5 atomic % to 50 atomic %. Thus, electrophotographic light-receiving members corresponding to such variations were produced. Evaluation was made in the same manner as in Example I37.

Comparative Example I36

Example I38 was repeated except that the carbon content at the surface on the substrate side was changed to 0.3 atomic %, 60 atomic % and 70 atomic %. Electrophotographic light-receiving members corresponding to such changes were thus produced. Evaluation was made in the same manner as in Example I38.

Results of evaluation in Example I38 and Comparative Example I36 were the same as the results obtained in Example I37 and Comparative Example I35, respectively.

EXAMPLE I39

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table I71. Electrophotographic light-receiving members were thus produced. In the present Example, the flow rate of $SiF_4$ fed when the first photoconductive layer was formed was varied so that the fluorine content in the first photoconductive layer was varied as shown in FIGS. 13 to 20. Thus, electrophotographic light-receiving members corresponding to such variations were produced. The fluorine content in the first photoconductive layer was measured by elementary analysis using SIMS (CAMECA IMS-3F).

(I) The electrophotographic light-receiving members thus produced were each set in a test-purpose modified electrophotographic apparatus of a copier NP-7550, manufactured by Canon Inc., and electrophotographic characteristics concerning white spots, coarse image and ghost were evaluated in the same manner as in Example I36 before an accelerated durability test was carried out.

(II) Next, the electrophotographic light-receiving members thus produced were each set in the test-purpose modified electrophotographic apparatus of a copier NP-7550, manufactured by Canon Inc., and an accelerated durability test which corresponded to copying on 2,500,000 sheets was carried out. Then, electrophotographic characteristics concerning white spots, coarse image and ghost were evaluated similarly to (I).

Comparative Example I37

Example I39 was repeated except that the fluorine content in the first photoconductive layer was varied as shown in FIGS. 21 and 22, to give electrophotographic light-receiving members corresponding to such variations. Evaluation was made in the same manner as in Example I39.

Results of evaluation in Example I39 and Comparative Example I37 are shown together in Tables I72 and I73, respectively. As is seen from the results, the first photoconductive layer with a fluorine content set within the range of from 1 to 95 atomic ppm in the first photoconductive layer, which is in accordance with the present invention, can contribute improvements in image characteristics and durability. Very good results are also obtained when the fluorine content is 5 to 50 atomic ppm.

EXAMPLE I40

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I39 except for using μW glow-discharging, under conditions shown in Table I74. Electrophotographic light-receiving members were thus produced. In the present Example, the flow rate of $siF_4$ fed when the first photoconductive layer was formed was varied so that the fluorine content in the first photoconductive layer was varied as shown in FIGS. 13 to 20. Thus, electrophotographic light-receiving members corresponding to such variations were produced. Characteristics of the electrophotographic light-receiving members thus produced were evaluated in the same manner as in Example I39.

Comparative Example I38

Example I40 was repeated except that the fluorine content in the first photoconductive layer was varied as shown in FIGS. 21 and 22, to give electrophotographic light-receiving members corresponding to such variations. Evaluation was made in the same manner as in Example I40.

Results of evaluation in Example I40 and Comparative Example I38 were the same as the results of evaluation in Example I39 and Comparative Example I37, respectively.

EXAMPLE I41

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table I75. Electrophotographic light-receiving members were thus produced. In the present Example, the flow rate of $SiF_4$ fed when the first photoconductive layer was formed was varied so that the fluorine content in the first photoconductive layer was varied as shown in FIGS. 23 to 26. Here, the fluorine content in the first photoconductive layer was varied in the range of from 1 atomic ppm to 95 atomic ppm. The fluorine content in the first photoconductive layer was measured by elementary analysis using SIMS (CAMECA IMS-3F).

(I) The electrophotographic light-receiving members thus produced were each set in a test-purpose modified electrophotographic apparatus of a copier NP-7550, manufactured by Canon Inc., and electrophotographic characteristics concerning temperature characteristics, chargeability, uneven images, white spots, coarse image and ghost were evaluated in the same manner as in Example E9.

(II) Next, the electrophotographic light-receiving members thus produced were each set in the test-purpose modified electrophotographic apparatus of a copier NP-7550, manufactured by Canon Inc., and an accelerated durability test which corresponded to copying on 2,500,000 sheets was carried out. Then, electrophotographic characteristics concerning temperature characteristics, chargeability, uneven images, white spots, coarse image and ghost were evaluated similarly to (I).

Comparative Example I39

EXAMPLE I41 was repeated except that fluorine content in the first photoconductive layer was made constant in a pattern as shown in FIG. 27, to give an electrophotographic light-receiving member. Its characteristics were evaluated in the same manner as in Example I41. Here, the fluorine content in the first photoconductive layer was measured by elementary analysis using SIMS (CAMECA IMS-3F) to reveal that it was constant at 25 atomic ppm.

Results of evaluation in Example I41 and Comparative Example I39 are shown together in Tables I76 and I77, respectively. As is clear from the results shown in Tables I76 and I77, the first photoconductive layer with a fluorine content varied in the layer thickness direction is very effective for improving image characteristics and durability.

EXAMPLE I42

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I41 except for using μW glow-discharging, under conditions shown in Table I78. Electrophotographic light-receiving members were thus produced. Characteristics of the electrophotographic light-receiving members thus produced was evaluated in the same manner as in Example I41.

Comparative Example I40

Example I42 was repeated except that fluorine content in the first photoconductive layer was made constant in a pattern as shown in FIG. 27, to give an electrophotographic light-receiving member. Its characteristics were evaluated in the same manner as in Example I42. Here, the fluorine content in the first photoconductive layer was measured by elementary analysis using SIMS (CAMECA IMS-3F) to reveal that it was constant at 25 atomic ppm.

Results of evaluation in Example I42 and Comparative Example I40 were the same as those in Example I41 and Comparative Example I39, respectively.

EXAMPLE I43

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table I79. Electrophotographic light-receiving members were thus produced. In the present Example, the oxygen content in the first photoconductive layer in its layer thickness direction was made constant in a pattern as shown in FIG. 28, and the flow rate of $CO_2$ fed when the first photoconductive layer was formed was varied so that the oxygen content in the first photoconductive layer was varied in the range of from 10 atomic ppm to 5,000 atomic ppm. Thus, electrophotographic light-receiving members corresponding to such variations were produced. The oxygen content in the first photoconductive layer was measured by elementary analysis using SIMS (CAMECA IMS-3F).

The electrophotographic light-receiving members thus produced were each set in a test-purpose modified electrophotographic apparatus of a copier NP-7550, manufactured by Canon Inc., and electrophotographic characteristics concerning chargeability, sensitivity, residual potential and potential shift were evaluated.

Comparative Example I41

Example I43 was repeated except that the oxygen content in the first photoconductive layer was changed to 5 atomic ppm, 7 atomic ppm and 5,500 to 8,000 atomic ppm, to give electrophotographic light-receiving members corresponding to such changes. Their characteristics were evaluated in the same manner as in Example I43.

Results obtained in Example I43 and Comparative Example I41 are shown together in Table I80. As is clear from the results, the first photoconductive layer with an oxygen content set within the range of from 10 to 5,000 ppm is very effective in regard to an improvement in potential shift.

EXAMPLE I44

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I43 except for using μW glow-discharging, under conditions shown in Table I81. Electrophotographic light-receiving members were thus produced. In the present Example, the oxygen content in the first photoconductive layer in its layer thickness direction was made constant in a pattern as shown in FIG. 28, and the flow rate of $CO_2$ fed when the first photoconductive layer was formed was varied so that the oxygen content in the first photoconductive layer was varied in the range of from 10 atomic ppm to 5,000 atomic ppm. Thus, electrophotographic light-receiving members corresponding to such variations were produced. Characteristics of the electrophotographic light-receiving members produced were evaluated in the same manner as in Example I43.

Comparative Example I42

Example I44 was repeated except that the oxygen content in the first photoconductive layer was changed to 5 atomic ppm, 7 atomic ppm and 5,500 to 8,000 atomic ppm, to give electrophotographic light-receiving members corresponding to such changes. Their characteristics were evaluated in the same manner as in Example I44.

Results of evaluation in Example I44 and Comparative Example I42 were the same as the results obtained in Example I43 and Comparative Example I41, respectively.

EXAMPLE I45

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table I82. Electrophotographic light-receiving members were thus produced. In the present Example, the flow rate of $CO_2$ fed when the first photoconductive layer was formed was varied so that the oxygen content in the first photoconductive layer was varied as shown in FIGS. 28 to 32. Here, the oxygen content in the first photoconductive layer was varied in the range of from 10 atomic ppm to 500 atomic ppm. The oxygen content in the first photoconductive layer was measured by elementary analysis using SIMS (CAMECA IMS-3F).

The electrophotographic light-receiving members thus produced were each set in a test-purpose modified electrophotographic apparatus of a copier NP-7550, manufactured by Canon Inc., and electrophotographic characteristics concerning chargeability, sensitivity, residual potential and potential shift were evaluated in the same manner as in Examples I1 and I13, after an accelerated durability test which corresponded to copying on 2,500,000 sheets was carried out.

Comparative Example I43

Using the electrophotographic light-receiving member manufacturing apparatus as shown in FIG. 4, an electrophotographic light-receiving member was produced in the same manner as in Example I45 by RF glow discharging, under conditions shown in Table I82, except that in the present Comparative Example no oxygen was incorporated in the first photoconductive layer. Characteristics of the electrophotographic light-receiving members produced were evaluated in the same manner as in Example I45.

Results of evaluation in Example I45 and Comparative Example I43 are shown together in Table I83. As is clear from the results shown in Table I83, the first photoconductive layer containing oxygen atoms whose content is preferably varied in the layer thickness direction can contribute improvements in electrophotographic characteristics and durability.

EXAMPLE I46

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I45 except for using μW glow-discharging, under conditions shown in Table I84. Electrophotographic light-receiving members were thus produced. Characteristics of the electrophotographic light-receiving members produced were evaluated in the same manner as in Example I45.

Comparative Example I44

Using the electrophotographic light-receiving member manufacturing apparatus as shown in FIG. 5, an electrophotographic light-receiving member was produced in the same manner as in Example I46 under conditions shown in Table I84, except that in the present Comparative Example no oxygen was incorporated in the first photoconductive layer. Characteristics of the electrophotographic light-receiving members produced were evaluated in the same manner as in Example I46.

Results of evaluation in Example I46 and Comparative Example I44 were entirely the same as those shown in Table I83.

EXAMPLE 47

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table I85. Electrophotographic light-receiving members were thus produced. In the present Example, the power applied and the flow rates of $CH_4$, $CO_2$ and $NH_3$ fed when the surface layer was formed were varied so that the total of the carbon atom content, oxygen atom content and nitrogen atom content in the surface layer was varied in the range of from 40 atomic % to 90 atomic %.

The electrophotographic light-receiving members thus produced were each set in a test-purpose modified electrophotographic apparatus of a copier NP-6650, manufactured by Canon Inc. and characteristics concerning chargeability, sensitivity, residual potential, smeared image, images before a durability test, and images after an accelerated durability test which corresponded to copying on 2,500,000 sheets, were evaluated in the same manner as in Example I17.

Comparative Example I45

Example I47 was repeated except that the total of the carbon atom content, oxygen atom content and nitrogen atom content in the surface layer was changed to less than 40 atomic % and more than 90 atomic %. Electrophotographic light-receiving members corresponding to such changes were thus produced. Evaluation was made in the same manner as in Example I47.

Comparative Example I46

Example I47 was repeated except that no $CH_4$ was used when the surface layer was formed, and the total of the oxygen atom content and nitrogen atom content in the surface layer was changed to 60 atomic %. An electrophotographic light-receiving members were thus produced. Evaluation was made in the same manner as in Example I47.

Comparative Example I47

Example I47 was repeated except that no $CO_2$ was used when the surface layer was formed and the total of the carbon atom content and nitrogen atom content in the surface layer was changed to 60 atomic %. An electrophotographic light-receiving member was thus produced. Evaluation was made in the same manner as in Example I47.

Comparative Example I48

Example I47 was repeated except that no $NH_3$ was used when the surface layer was formed and the total of the carbon atom content and oxygen atom content in the surface layer was changed to 60 atomic %. An electrophotographic light-receiving member was thus produced. Evaluation was made in the same manner as in Example I47.

Results obtained in Example I47 and Comparative Examples I45 to I48 are shown together in Table I86. The surface layer in which the carbon atom content is controlled in the range of from 40 to 90 atomic % contributes remarkable improvements in chargeability and durability, and also the surface layer in which the total of the carbon atom content, oxygen atom content and nitrogen atom content is controlled to be not more than 10 atomic % can bring about very good results.

EXAMPLE I48

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I47 except for using μW glow-discharging, under conditions shown in Table I87. Electrophotographic light-receiving members were thus produced. In the present Example, the power applied and the flow rates of $CH_4$, $CO_2$ and $NH_3$ fed when the surface layer was formed were varied so that the total of the carbon atom content, oxygen atom content and nitrogen atom content in the surface layer was varied in the range of from 40 atomic % to 90 atomic %. Evaluation was made in the same manner as in Example I47.

Comparative Example I49

Example I48 was repeated except that the total of the carbon atom content, oxygen atom content and nitrogen atom content in the surface layer was changed to less than 40 atomic % and more than 90 atomic %. Electrophotographic light-receiving members corresponding to such changes were thus produced. Evaluation was made in the same manner as in Example I48.

Comparative Example I50

Example I48 was repeated except that no $CH_4$ was used when the surface layer was formed, and the total of the carbon atom content and nitrogen atom content in the surface layer was changed to 60 atomic %. Electrophotographic light-receiving members were thus produced. Evaluation was made in the same manner as in Example I48.

Comparative Example I51

Example I48 was repeated except that no $CO_2$ was used when the surface layer was formed and the total of the carbon atom content and nitrogen atom content in the surface layer was changed to 60 atomic %. Electrophotographic light-receiving members were thus produced. Evaluation was made in the same manner as in Example I48.

Comparative Example I52

Example I48 was repeated except that no $NH_3$ was used when the surface layer was formed and the total of the carbon atom content and oxygen atom content in the surface layer was changed to 60 atomic %. Electrophotographic light-receiving members were thus produced. Evaluation was made in the same manner as in Example I48.

Results of evaluation in Example I48 and Comparative Examples I49 to I52 were entirely the same as those in Example I47 and Comparative Examples I45 to I48, respectively.

EXAMPLE I49

Using the electrophotographic light-receiving member manufacturing apparatus as shown in FIG. 4 and according to the procedure previously described in detail, a light-receiving layer was formed on a mirror-finished aluminum cylinder of 108 mm in diameter by RF glow discharging under conditions shown in Table I88. Electrophotographic light-receiving members were thus produced. In the present Example, the power applied and the flow rate of $H_2$ and/or flow rate of $SiF_4$ fed when the surface layer was formed were varied so that the fluorine atom content in the surface layer was not more than 20 atomic % and the total of the hydrogen atom content and fluorine atom content was in the range of from 30 to 70 atomic %.

The electrophotographic light-receiving members thus produced were each set in a test-purpose modified electrophotographic apparatus of a copier NP-8550, manufactured by Canon Inc., and characteristics concerning residual potential, sensitivity and smeared images were evaluated in the same manner as in Example I39.

Comparative Example I53

Example I49 was repeated except that the total of the hydrogen atom content and fluorine atom content in the surface layer was changed to less than 30 atomic % and more than 70 atomic %. Electrophotographic light-receiving members corresponding to such changes were thus produced. Evaluation was made in the same manner as in Example I49.

Comparative Example I54

Example I49 was repeated except that the fluorine atom content in the surface layer was changed to more than 20 atomic %. Electrophotographic light-receiving members corresponding to such changes were thus produced. Evaluation was made in the same manner as in Example I49.

Comparative Example I55

Example I49 was repeated except that no $SiF_4$ was used when the surface layer was formed. Electrophotographic light-receiving members corresponding to such changes were thus produced. Evaluation was made in the same manner as in Example I49.

Results of evaluation in Example I49 and Comparative Examples I53 to I55 are shown together in Table I89. As is seen from the results shown in Table I89, the electrophotographic light-receiving members with a surface layer in which the total of the hydrogen atom content and fluorine atom content is set within the range of from 30 to 70 atomic % and the fluorine atom content within the range of not more than 20 atomic % can bring about good results on both the residual potential and the sensitivity, and also can greatly prohibit smeared images from occurring under strong exposure.

EXAMPLE I50

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I49 except for using μW glow-discharging, under conditions shown in Table I90. Electrophotographic light-receiving members were thus produced. Characteristics of the electrophotographic light-receiving members produced were evaluated in the same manner as in Example I49.

Comparative Example I56

Example I50 was repeated except that the total of the hydrogen atom content and fluorine atom content in the surface layer was changed to less than 30 atomic % and more than 70 atomic %. Electrophotographic light-receiving members corresponding to such changes were thus produced. Evaluation was made in the same manner as in Example I50.

Comparative Example I57

Example I50 was repeated except that the fluorine atom content in the surface layer was changed to more than 20 atomic %. Electrophotographic light-receiving members corresponding to such changes were thus produced. Evaluation was made in the same manner as in Example I50.

Comparative Example I58

Example I50 was repeated except that no $SiF_4$ was used when the surface layer was formed. Electrophotographic light-receiving members corresponding to such changes were thus produced. Evaluation was made in the same manner as in Example I50.

Results of evaluation in Example I50 and Comparative Examples I56 to I58 were the same as those in Example I49 and Comparative Examples I53 to I55, respectively.

EXAMPLE I51

Using electrophotographic light-receiving member manufacturing apparatus as shown in FIG. 4 and according to the procedure previously described in detail, a light-receiving layer of an electrophotographic light-receiving member was formed on a mirror-finished aluminum cylinder of 108 mm in diameter by RF glow discharging under conditions shown in Table I91. In the present Example, the boron atom content in the first and second photoconductive layers was varied as shown in Table I92. Hydrogen-based diborane (10 ppm $B_2H_6/H_2$) was used as the starting material gas.

The electrophotographic light-receiving members thus produced were each set in a test-purpose modified electrophotographic apparatus of a copier NP-6650, manufactured by Canon Inc., and chargeability, sensitivity and residual potential were evaluated. Evaluation for each item was made in the same manner as in Example A1.

Results obtained are shown in Table I93. As is seem therefrom, the photoconductive layer doped with boron atoms can contribute improvements particularly in residual potential and sensitivity.

EXAMPLE I52

Using the electrophotographic light-receiving member manufacturing apparatus as shown in FIG. 5 and according to the procedure previously described in detail, a light-receiving layer was formed on a mirror-finished aluminum cylinder of 108 mm in diameter in the same manner as in Example I51 except for using μW glow-discharging, under conditions shown in Table I94. Electrophotographic light-receiving members were thus produced. The pattern of changes of boron content was the same as shown in Table I92. Characteristics of the electrophotographic light-receiving members thus produced were evaluated in the same manner as in Example I51. Results obtained were the same as those shown in Table I93.

As having been described above, the present invention is effective on the following:

(1) Since the electrophotographic light-receiving member of the present invention has the specific layer structure as described above, various problems involved in the conventional electrophotographic light-receiving members comprised of a-Si can be settled. In particular, vary good electrical characteristics, optical characteristics, photoconductive characteristics, image characteristics, durability and service-environment compatibility can be achieved.

(2) In particular, in the present invention, the carbon atom content in the photoconductive layer is made to continuously decrease from the conductive substrate side toward the surface layer side. This makes it possible to smoothly connect the functions of generating charges (or photocarriers) and transporting the generated charges that are important to electrophotographic light-receiving members, so that those having a superior photosensitivity can be provided. Moreover, since the photoconductive layer contains carbon, the electrophotographic light-receiving layer can be made to have a smaller dielectric constant, and hence the electrostatic capacity per layer thickness can be decreased. This brings about a high chargeability and a remarkable improvement in photosensitivity, and also brings about an improvement in breakdown voltage against a high voltage and an improvement in durability.

Since also the photoconductive layer containing a small amount of oxygen atoms together with carbon atoms is disposed on the side of the conductive substrate, the adhesion between the conductive substrate and the photoconductive layer can be improved, peel-off of film generation of fine defect can be suppressed, and the yield in the manufacture can be improved.

(3) In addition, in the present invention, at least the nc-Si photoconductive layer contains a small amount (95 atomic ppm or less) of fluorine atoms (F). This enables effective release of the strain produced in the deposited films, so that it becomes possible to control occurrence of structural defects in films, and also to decrease occurrence of abnormal growth. Thus, image characteristics concerning, for example, "coarse image", "ghost" and "spots" can be remarkably improved, and also the durability can be retained throughout electrophotographic processes while superior characteristics are also retained.

(4) The surface layer of the electrophotographic light-receiving member according to the present invention has a rich water repellency, and hence moisture resistance can be improved. Mechanical strength and electrical characteristics against breakdown voltage can also be improved. Charges can be effectively blocked from being injected from the surface when subjected to charging, and the chargeability, service-environment compatibility, durability and electrical breakdown voltage can be improved. Furthermore, since the absorption of light in the surface layer can be decreased, an improvement in sensitivity can be achieved, and also since the carrier accumulation at the interface between the photoconductive layer and surface layer can be decreased, smeared images can be prevented even when the chargeability is maintained in a high state.

(5) The surface layer of the electrophotographic light-receiving member according to the present invention simultaneously contains at least a silicon atom, a hydrogen atom, a carbon atom, a halogen atom, an element belonging to Group III of the periodic table, and/or a nitrogen atom. These cooperatively act to decrease faulty image such as "spots", in particular, to decrease "leak spots" that may occur during long-term use. They also prevent "scratches" during reproduction and "melt-adhesion of toner" and "smeared images" during long-term use, bringing about very good image characteristics, durability and service-environment compatibility.

(6) The photoconductive layer contains fluorine atoms nonuniformly in the layer thickness direction. This brings about an improvement in what is called temperature characteristics, which concern a change in characteristics of light-receiving members with a change in temperature in an environment in which light-receiving members are used. Hence, a remarkable improvement can be seen in preventing image densities of copied images from becoming uneven, and the durability can be retained throughout electrophotographic processes while superior characteristics are also retained.

(7) In the embodiment in which the light-receiving layer is comprised of the first and second photoconductive layers in the present invention, the carbon atom content in the first photoconductive layer comprising amorphous silicon is made to continuously decrease from the conductive substrate side toward the second photoconductive layer side. This makes it possible to smoothly connect the functions of generating charges (or photocarriers) and transporting the generated charges that are important to electrophotographic light-receiving members, so that those having a superior photosensitivity can be provided. Moreover, since the first photoconductive layer contains carbon, the light-receiving layer can be made to have a smaller dielectric constant, and hence the electrostatic capacity per layer thickness can be decreased. This brings about a high chargeability and a remarkable improvement in photosensitivity, and also brings about an improvement in breakdown voltage against a high voltage and an improvement in durability.

(8) The first photoconductive layer comprising amorphous silicon is provided in a thickness of from 0.5 to 15 μm. This enables improvement in sensitivity to longer wave light and more effectively prevents ghost because of an improved travelling of carriers having a polarity opposite to the static charge polarity.

(9) Furthermore, in the present invention, the first photoconductive layer contains a small amount (95 atomic ppm or less) of fluorine atoms (F). Hence, image characteristics concerning, for example, "coarse image" and "ghost" as stated above can be remarkably improved, and also the durability can be retained throughout electrophotographic processes while superior characteristics are also retained.

(10) In another embodiment, the electrophotographic light-receiving member of the present invention has the layer structure as described above and, the carbon atom content in the first photoconductive layer is made to continuously decrease from the conductive substrate side toward the second photoconductive layer side. The first photoconductive layer contains a fluorine atom, and also the surface layer simultaneously contains at least a silicon atom, a hydrogen atom, a carbon atom, an oxygen atom, a halogen atom, and an element belonging to Group III of the periodic table. These cooperatively act to make chargeability higher than that of conventional electrophotographic light-receiving members, bring about a great improvement in photosensitivity, and at the same time decrease faulty image such as "white spots", in particular, to decrease "leak spots" that may occur during long-term use. They also prevent scratches during and reproduction and "melt-adhesion of toner" and "smeared images" during long-term use, to bring about very good image characteristics, durability and service-environment compatibility.

TABLE A1

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 350 → 0 (FIG. 6 pattern) | | | | |
| | $SiF_4$ | 30 ppm (based on $SiH_4$) | | | | |
| Surface layer | $SiH_4$ | 30 | 300 | 0.3 | 250 | 0.5 |
| | $CH_4$ | 500 | | | | |
| | $SiF_4$ | 10 | | | | |
| | $H_2$ | 100 | | | | |

TABLE A2

| Layer | Gas used, & flow rate (sccm) | | RF power (W) | Inner pressure (Torr) | Substrate temp. (°C.) | Layer thickness (μm) |
|---|---|---|---|---|---|---|
| First photoconductive layer | $SiH_4$ | 500 | 500 | 0.5 | 250 | 17 |
| | $CH_4$ | 350 | | | | |
| | $SiF_4$ | 30 ppm (based on $SiH_4$) | | | | |
| Second photoconductive layer | $SiH_4$ | 500 | 500 | 0.5 | 250 | 3 |
| Surface layer | $SiH_4$ | 30 | 300 | 0.3 | 250 | 0.5 |
| | $CH_4$ | 500 | | | | |
| | $SiF_4$ | 10 | | | | |
| | $H_2$ | 100 | | | | |

TABLE A3

| | Chargeability | Sensitivity | Residual potential |
|---|---|---|---|
| Example A1: | AA | AA | AA |
| Comparative Example A1: | A | B | B |

TABLE A4

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 250 → 0 (FIG. 6 pattern) | | | | |
| | $SiF_4$ | 30 ppm (based on $SiH_4$) | | | | |
| Surface layer | $SiH_4$ | 30 | 1,000 | 10 | 250 | 0.5 |
| | $CH_4$ | 500 | | | | |
| | $SiF_4$ | 10 | | | | |
| | $H_2$ | 100 | | | | |

TABLE A5

| Layer | Gas used, & flow rate (sccm) | | μW power (W) | Inner pressure (mTorr) | Substrate temp. (°C.) | Layer thickness (μm) |
|---|---|---|---|---|---|---|
| First Photoconductive layer | $SiH_4$ | 500 | 1,000 | 10 | 250 | 17 |
| | $CH_4$ | 250 | | | | |
| | $SiF_4$ | 30 ppm (based on $SiH_4$) | | | | |
| Second photoconductive layer | $SiH_4$ | 500 | 1,000 | 10 | 250 | 3 |
| Surface layer | $SiH_4$ | 30 | 1,000 | 10 | 250 | 0.5 |
| | $CH_4$ | 500 | | | | |
| | $SiF_4$ | 10 | | | | |
| | $H_2$ | 100 | | | | |

TABLE A6

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | (Varied) | | | | |
| | $SiF_4$ | 30 ppm (based on $SiH_4$) | | | | |
| Surface layer | $SiH_4$ | 30 | 300 | 0.3 | 250 | 0.5 |
| | $CH_4$ | 500 | | | | |
| | $SiF_4$ | 10 | | | | |

TABLE A7

| | Pattern of carbon atom content | Chargeability | Sensitivity | Residual potential |
|---|---|---|---|---|
| Example: A3 | FIG. 8 | AA | AA | AA |
| | FIG. 9 | AA | AA | AA |
| | FIG. 10 | AA | AA | AA |
| Comparative Example: A3 | FIG. 11 | A | B | B |
| | FIG. 12 | AA | B | B |

TABLE A8

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | (Varied) | | | | |
| | $SiF_4$ | 30 ppm (based on $SiH_4$) | | | | |
| Surface layer | $SiH_4$ | 30 | 1,000 | 10 | 250 | 0.5 |
| | $CH_4$ | 500 | | | | |
| | $SiF_4$ | 10 | | | | |

TABLE A9

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | Varied → 0 (FIG. 8 pattern) | | | | |
| | $SiF_4$ | 30 ppm (based on $SiH_4$) | | | | |
| Surface layer | $SiH_4$ | 30 | 300 | 0.3 | 250 | 0.5 |
| | $CH_4$ | 500 | | | | |
| | $SiF_4$ | 10 | | | | |

TABLE A10

| | Carbon atom content (at. %) | Chargeability | Senitivity | Residual potential | White spots | (1) | (2) | (3) | (4) |
|---|---|---|---|---|---|---|---|---|---|
| Comparative Example A5: | 70 | AA | B | A | AA | AA | B | AA | B |
| | 60 | AA | B | A | AA | AA | A | AA | B |
| | 50 | AA | A | A | AA | AA | AA | AA | A |
| | 40 | AA | AA | A | AA | AA | AA | AA | A |
| | 30 | AA | AA | AA | AA | AA | AA | AA | AA |
| | 20 | AA | AA | AA | AA | AA | AA | AA | AA |
| | 10 | AA | AA | AA | AA | AA | AA | AA | AA |
| | 5 | AA | AA | AA | AA | AA | AA | AA | AA |
| | 1 | AA | AA | AA | AA | AA | AA | AA | AA |
| | 0.5 | A | A | AA | AA | AA | AA | A | A |
| Comparative Example A5: | 0.3 | B | AA | AA | B | A | AA | B | B |

(1): Coarse image
(2): Ghost
(3): Spherical protuberances
(4): Overall evaluation

TABLE A11

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | Varied | → 0 (FIG. 6 pattern) | | | |
| | $SiF_4$ | 30 | ppm (based on $SiH_4$) | | | |
| Surface layer | $SiH_4$ | 30 | 1,000 | 10 | 250 | 0.5 |
| | $CH_4$ | 500 | | | | |
| | $SiF_4$ | 10 | | | | |

TABLE A12

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 | → 0 (FIG. 8 pattern) | | | |
| | $SiF_4$ | (Varied) | | | | |
| Surface layer | $SiH_4$ | 30 | 300 | 0.3 | 250 | 0.5 |
| | $CH_4$ | 500 | | | | |
| | $SiF_4$ | 10 | | | | |

TABLE A13

(before running)

| | Fluorine content (atomic ppm) | White spots | Coarse image | Ghost | Overall evaluation |
|---|---|---|---|---|---|
| Example A7: | 1 | AA | A | A | A |
| | 5 | AA | AA | AA | AA |
| | 10 | AA | AA | AA | AA |
| | 20 | AA | AA | AA | AA |
| | 30 | AA | AA | AA | AA |
| | 50 | AA | AA | AA | AA |
| | 95 | AA | AA | A | AA |
| Comparative Example A7: | 100 | AA | A | B | B |
| | 200 | AA | B | B | B |
| | 500 | AA | B | B | B |

TABLE A14

(after running)

| | Fluorine content (atomic ppm) | White spots | Coarse images | Ghost | Overall evaluation |
|---|---|---|---|---|---|
| Example A7: | 1 | A | A | A | A |
| | 5 | AA | AA | A | AA |
| | 10 | AA | AA | AA | AA |
| | 20 | AA | AA | AA | AA |
| | 30 | AA | AA | AA | AA |
| | 50 | AA | AA | AA | AA |
| | 95 | AA | AA | AA | AA |
| Comparative Example A7: | 100 | AA | A | B | B |
| | 200 | AA | B | B | B |
| | 500 | AA | B | C | C |

TABLE A15

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 150 | → 0 (FIG. 8 pattern) | | | |
| | $SiF_4$ | (Varied) | | | | |
| Surface layer | $SiH_4$ | 30 | 1,000 | 10 | 250 | 0.5 |
| | $CH_4$ | 500 | | | | |
| | $SiF_4$ | 10 | | | | |

TABLE A16

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 | → 0 (FIG. 8 pattern) | | | |
| | $SiF_4$ | 30 | ppm (based on $SiH_4$) | | | |
| Surface layer | $SiH_4$ | 30 | Varied | 0.3 | 250 | 0.5 |
| | $CH_4$ | (Varied) | | | | |
| | $SiF_4$ | 10 | | | | |
| | $H_2$ | 100 | | | | |

TABLE A17

| | Comptv. Example A9 | Example A9 | | | | | | | Comptv. Example A9 |
|---|---|---|---|---|---|---|---|---|---|
| Carbon atom content: (at. %) | 20 | 30 | 40 | 50 | 60 | 70 | 80 | 90 | 95 |
| Chargeability: | B | A | AA | AA | AA | AA | AA | AA | AA |
| Residual potential: | AA | AA | AA | AA | AA | AA | AA | A | B |
| Image evaluation before running: | B | B | A | A | A | A | A | A | A |
| Image evaluation after running: | C | B | A | A | A | A | A | A | A |
| Overall evaluation: | C | C | A | AA | AA | AA | AA | A | B |

TABLE A18

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 150 | → 0 (FIG. 8 pattern) | | | |
| | $SiF_4$ | 30 | ppm (based on $SiH_4$) | | | |
| Surface layer | $SiH_4$ | 30 | Varied | 10 | 250 | 0.5 |
| | $CH_4$ | (Varied) | | | | |
| | $SiF_4$ | 10 | | | | |
| | $H_2$ | 100 | | | | |

TABLE A19

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 | → 0 (FIG. 8 pattern) | | | |
| | $SiF_4$ | 30 | ppm (based on $SiH_4$) | | | |
| Surface layer | $SiH_4$ | 30 | Varied | 0.3 | 250 | 0.5 |
| | $CH_4$ | 500 | | | | |
| | $SiF_4$ | (Varied) | | | | |
| | $H_2$ | (Varied) | | | | |

TABLE A20

| | Example A11 | | | | | | | | Cp.* A11 | | | | | Cp.* A11 | | | | | Cp* A12 | | | | | Cp* A13 | | | |
|---|---|---|---|---|---|---|---|---|---|---|---|---|---|---|---|---|---|---|---|---|---|---|---|---|---|---|---|
| a) Hydrogen content: (at. %) | 21 | 30 | 30 | 30 | 48 | 48 | 61 | 61 | 11 | 53 | 61 | 70 | 11 | 21 | 30 | 48 | 30 | 48 | 70 | 76 |
| b) Fluorine content: (at. %) | 15 | 3 | 9 | 18 | 3 | 19 | 3 | 8 | 18 | 18 | 12 | 4 | 24 | 23 | 23 | 21 | 0 | 0 | 0 | 0 |
| Total of a) & b): (at. %) | 36 | 33 | 39 | 48 | 51 | 67 | 64 | 69 | 29 | 71 | 73 | 74 | 35 | 44 | 53 | 69 | 30 | 48 | 70 | 76 |
| Sensitivity: | AA | AA | AA | AA | AA | AA | AA | AA | A | A | A | A | AA | AA | AA | AA | A | A | A | A |
| Residual potential: | AA | AA | AA | AA | AA | AA | AA | AA | A | A | A | A | A | A | A | A | A | A | A | A |
| Smeared image: | AA | AA | AA | AA | AA | AA | AA | AA | AA | AA | AA | AA | AA | AA | AA | AA | A | A | A | A |
| Overall evaluation: | AA | AA | AA | AA | AA | AA | AA | AA | A | A | A | A | A | A | A | A | A | A | A | A |

*Comparative Example

TABLE A21

| Layer | Gas used, & flow rate (sccm) | | μW power (W) | Inner pressure (mTorr) | Substrate temp. (°C.) | Layer thickness (μm) |
|---|---|---|---|---|---|---|
| Photoconduc- | $SiH_4$ | 500 | 1,000 | 10 | 250 | 20 |
| | $CH_4$ | 150 | → 0 (FIG. 8 pattern) | | | |

TABLE A21-continued

| Layer | Gas used, & flow rate (sccm) | | μW power (W) | Inner pressure (mTorr) | Substrate temp. (°C.) | Layer thickness (μm) |
|---|---|---|---|---|---|---|
| tive layer | $SiF_4$ | 30 ppm (based on $SiH_4$) | | | | |
| Surface layer | $SiH_4$ | 30 | Varied | 10 | 250 | 0.5 |
| | $CH_4$ | 500 | | | | |
| | $SiF_4$ | (Varied) | | | | |
| | $H_2$ | (Varied) | | | | |

TABLE A22

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 (FIG. 8 pattern) | | | | |
| | $B_2H_6$ | (Table 23) | | | | |
| | $SiF_4$ | 30 ppm (based on $SiH_4$) | | | | |
| Surface layer | $SiH_4$ | 30 | 300 | 0.3 | 250 | 0.5 |
| | $CH_4$ | 500 | | | | |
| | $SiF_4$ | 10 | | | | |
| | $H_2$ | 100 | | | | |

TABLE A23

| | Pattern of Boron Atom Content | |
|---|---|---|
| | Pattern | $B_2H_6$ content in photoconductive layer (ppm) |
| Comparative A17 | a | 0 |
| Example A13 | b | 10 |
| | c | 20 → 1 (Linearly changed) |
| | d | 20 → 0.5 (Linearly changed) |

TABLE A24

| | Pattern | Chargeability | Sensitivity | Residual potential | Overall evaluation |
|---|---|---|---|---|---|
| Comparative Example A17 | a | AA | A | AA | A |
| Example A13 | b | AA | AA | AA | AA |
| | c | AA | AA | AA | AA |
| | d | AA | AA | AA | AA |

TABLE A25

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 150 → 0 (FIG. 6 pattern) | | | | |
| | $B_2H_6$ | (Table A23) | | | | |
| | $SiF_4$ | 30 ppm (based on $SiH_4$) | | | | |
| Surface layer | $SiH_4$ | 30 | 1,000 | 10 | 250 | 0.5 |
| | $CH_4$ | 500 | | | | |
| | $SiF_4$ | 10 | | | | |
| | $H_2$ | 100 | | | | |

TABLE B1

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 350 → 0 (FIG. 6 pattern) | | | | |
| | $SiF_4$ | 30 ppm (based on $SiH_4$) | | | | |
| Surface layer | $SiH_4$ | 30 | 300 | 0.3 | 250 | 0.5 |
| | $CH_4$ | 500 | | | | |
| | $CO_2$ | 100 | | | | |
| | $NH_3$ | 100 | | | | |
| | $SiF_4$ | 10 | | | | |
| | $H_2$ | 100 | | | | |

TABLE B2

| Layer | Gas used, & flow rate (sccm) | | RF power (W) | Inner pressure (Torr) | Substrate temp. (°C.) | Layer thickness (μm) |
|---|---|---|---|---|---|---|
| First Photoconductive layer | $SiH_4$ | 500 | 500 | 0.5 | 250 | 17 |
| | $CH_4$ | 350 | | | | |
| | $SiF_4$ | 30 ppm (based on $SiH_4$) | | | | |
| Second photoconductive layer | $SiH_4$ | 500 | 500 | 0.5 | 250 | 3 |
| Surface layer | $SiH_4$ | 30 | 300 | 0.3 | 250 | 0.5 |
| | $CH_4$ | 500 | | | | |
| | $CO_2$ | 100 | | | | |
| | $NH_3$ | 100 | | | | |
| | $SiF_4$ | 10 | | | | |
| | $H_2$ | 100 | | | | |

TABLE B3

| | Chargeability | Sensitivity | Residual potential |
|---|---|---|---|
| Example B1: | AA | AA | AA |
| Comparative Example B1: | A | B | B |

TABLE B4

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 250 → 0 (FIG. 6 pattern) | | | | |
| | $SiF_4$ | 30 ppm (based on $SiH_4$) | | | | |
| Surface layer | $SiH_4$ | 30 | 1,000 | 10 | 250 | 0.5 |
| | $CH_4$ | 500 | | | | |
| | $CO_2$ | 100 | | | | |
| | $NH_3$ | 100 | | | | |
| | $SiF_4$ | 10 | | | | |
| | $H_2$ | 100 | | | | |

TABLE B5

| Layer | Gas used, & flow rate (sccm) | | μW power (W) | Inner pressure (mTorr) | Substrate temp. (°C.) | Layer thickness (μm) |
|---|---|---|---|---|---|---|
| First Photoconductive layer | $SiH_4$ | 500 | 1,000 | 10 | 250 | 17 |
| | $CH_4$ | 90 | | | | |
| | $SiF_4$ | 30 ppm (based on $SiH_4$) | | | | |
| Second photoconductive layer | $SiH_4$ | 500 | 1,000 | 10 | 250 | 3 |
| Surface layer | $SiH_4$ | 30 | 1,000 | 10 | 250 | 0.5 |
| | $CH_4$ | 500 | | | | |
| | $CO_2$ | 100 | | | | |
| | $NH_3$ | 100 | | | | |
| | $SiF_4$ | 10 | | | | |
| | $H_2$ | 100 | | | | |

TABLE B6

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | (Varied) | | | | |
| | $SiF_4$ | 30 ppm (based on $SiH_4$) | | | | |
| Surface layer | $SiH_4$ | 30 | 300 | 0.3 | 250 | 0.5 |
| | $CH_4$ | 500 | | | | |
| | $CO_2$ | 100 | | | | |
| | $NH_3$ | 100 | | | | |
| | $SiF_4$ | 10 | | | | |

TABLE B7

| Pattern of carbon atom content | Chargeability | Sensitivity | Residual potential |
|---|---|---|---|
| Example B3: | | | |
| FIG. 8 | AA | AA | AA |
| FIG. 9 | AA | AA | AA |
| FIG. 10 | AA | AA | AA |
| Comparative Example B3: | | | |
| FIG. 11 | A | B | B |
| FIG. 12 | AA | B | B |

TABLE B8

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | (Varied) | | | | |
| | $SiF_4$ | 30 ppm (based on $SiH_4$) | | | | |
| Surface layer | $SiH_4$ | 30 | 1,000 | 10 | 250 | 0.5 |
| | $CH_4$ | 500 | | | | |
| | $CO_2$ | 100 | | | | |
| | $NH_3$ | 100 | | | | |
| | $SiF_4$ | 10 | | | | |

TABLE B9

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | Varied → 0 (FIG. 8 pattern) | | | | |
| | $SiF_4$ | 30 ppm (based on $SiH_4$) | | | | |
| Surface layer | $SiH_4$ | 30 | 300 | 0.3 | 250 | 0.5 |
| | $CH_4$ | 500 | | | | |
| | $CO_2$ | 100 ppm | | | | |
| | $NH_3$ | 10 ppm (based on $SiH_4$) | | | | |
| | $SiF_4$ | 10 | | | | |

TABLE B10

| Carbon atom content (at. %) | Chargeability | Sensitivity | Residual potential | White spots | (1) | (2) | (3) | (4) |
|---|---|---|---|---|---|---|---|---|
| Comparative Example B5: | | | | | | | | |
| 70 | AA | B | A | AA | AA | B | AA | B |
| 60 | AA | B | A | AA | AA | A | AA | B |
| Example B5: | | | | | | | | |
| 50 | AA | A | A | AA | AA | AA | AA | A |
| 40 | AA | AA | A | AA | AA | AA | AA | A |

TABLE B10-continued

| Carbon atom content (at. %) | Chargeability | Sensitivity | Residual potential | White spots | (1) | (2) | (3) | (4) |
|---|---|---|---|---|---|---|---|---|
| 30 | AA | AA | AA | AA | AA | AA | AA | AA |
| 20 | AA | AA | AA | AA | AA | AA | AA | AA |
| 10 | AA | AA | AA | AA | AA | AA | AA | AA |
| 5 | AA | AA | AA | AA | AA | AA | AA | AA |
| 1 | AA | AA | AA | AA | AA | AA | AA | AA |
| 0.5 | A | AA | AA | AA | AA | AA | A | A |
| Comparative Example B5: | | | | | | | | |
| 0.3 | B | AA | AA | B | A | AA | B | B |

(1): Coarse image
(2): Ghost
(3): Spherical protuberances
(4): Overall evaluation

TABLE B11

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | Varied → 0 (FIG. 8 pattern) | | | | |
| | $SiF_4$ | 30 ppm (based on $SiH_4$) | | | | |
| Surface layer | $SiH_4$ | 30 | 1,000 | 10 | 250 | 0.5 |
| | $CH_4$ | 500 | | | | |
| | $CO_2$ | 100 ppm | | | | |
| | $NH_3$ | 10 ppm (based on $SiH_4$) | | | | |
| | $SiF_4$ | 10 | | | | |

TABLE B12

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 (FIG. 8 pattern) | | | | |
| | $SiF_4$ | (Varied) | | | | |
| Surface layer | $SiH_4$ | 30 | 300 | 0.3 | 250 | 0.5 |
| | $CH_4$ | 500 | | | | |
| | $CO_2$ | 100 | | | | |
| | $NH_3$ | 10 | | | | |
| | $SiF_4$ | 10 | | | | |

TABLE B13

| Fluorine atom content (atomic ppm) | White spots | Coarse image | Ghost | Overall evaluation |
|---|---|---|---|---|
| Example B7: | | | | |
| 1 | AA | A | A | A |
| 5 | AA | AA | AA | AA |
| 10 | AA | AA | AA | AA |
| 20 | AA | AA | AA | AA |
| 30 | AA | AA | AA | AA |
| 50 | AA | AA | AA | AA |
| 95 | AA | AA | A | AA |

TABLE B13-continued

| Fluorine atom content (atomic ppm) | White spots | Coarse image | Ghost | Overall evaluation |
|---|---|---|---|---|
| Comparative Example B7: | | | | |
| 100 | AA | A | B | B |
| 200 | AA | B | B | B |
| 500 | AA | B | B | B |

TABLE B14

| Fluorine atom content (atomic ppm) | White spots | Coarse image | Ghost | Overall evaluation |
|---|---|---|---|---|
| Example B7: | | | | |
| 1 | A | A | A | A |
| 5 | AA | AA | A | AA |
| 10 | AA | AA | AA | AA |
| 20 | AA | AA | AA | AA |
| 30 | AA | AA | AA | AA |
| 50 | AA | AA | AA | AA |
| 95 | AA | AA | A | AA |
| Comparative Example B7: | | | | |
| 100 | AA | A | B | B |
| 200 | AA | B | B | B |
| 500 | AA | B | B | B |

TABLE B15

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 150 → 0 (FIG. 8 pattern) | | | | |
| | $SiF_4$ | (Varied) | | | | |

TABLE B15-continued

| Layer | Gas used, & flow rate (sccm) | μW power (W) | Inner pressure (mTorr) | Substrate temp. (°C.) | Layer thickness (μm) |
|---|---|---|---|---|---|
| Surface layer | $SiH_4$ 30<br>$CH_4$ 500<br>$CO_2$ 100<br>$NH_3$ 100<br>$SiF_4$ 10 | 1,000 | 10 | 250 | 0.5 |

TABLE B16

| Layer | Gas used, & flow rate (sccm) | RF power (W) | Inner pressure (Torr) | Substrate temp. (°C.) | Layer thickness (μm) |
|---|---|---|---|---|---|
| Photoconductive layer | $SiH_4$ 500<br>$CH_4$ 150 → 0 (FIG. 8 pattern)<br>$SiF_4$ 30 ppm (based on $SiH_4$) | 500 | 0.5 | 250 | 20 |
| Surface layer | $SiH_4$ 30<br>$CH_4$ (Varied)<br>$CO_2$ (Varied)<br>$NH_3$ (Varied)<br>$SiF_4$ 10<br>$H_2$ 100 | Varied | 0.3 | 250 | 0.5 |

TABLE B17

| | Example B9 | | | | | |
|---|---|---|---|---|---|---|
| a) Carbon content: (at. %) | 10 | 30 | 60 | 60 | 60 | 70 |
| b) Oxygen content: (at. %) | 20 | 5 | 3 | 8 | $5 \times 10^{-3}$ | 4 |
| c) Nitrogen content: (at. %) | 20 | 8 | 5 | 15 | $2 \times 10^{-4}$ | 5 |
| Total of b) & c): (at. %) | 40 | 13 | 8 | 23 | about $5 \times 10^{-3}$ | 9 |
| Total of a), b) & c): (at. %) | 50 | 43 | 68 | 83 | about 60 | 79 |
| Chargeability: | A | A | AA | A | AA | AA |
| Sensitivity: | AA | AA | AA | AA | AA | AA |
| Residual potential: | AA | AA | AA | AA | AA | AA |
| Smeared image: | A | AA | AA | A | AA | AA |
| Image evaluation before running: | A | A | AA | A | AA | AA |
| Image evaluation after running: | A | A | AA | A | AA | AA |
| Overall evaluation: | A | A | AA | A | AA | AA |

| | Example B9 | | | | |
|---|---|---|---|---|---|
| a) Carbon content: (at. %) | 70 | 70 | 70 | 70 | 80 |
| b) Oxygen content: (at. %) | 6 | $1 \times 10^{-3}$ | 12 | $5 \times 10^{-3}$ | 3 |
| c) Nitrogen content: (at. %) | 9 | 3 | $1 \times 10^{-3}$ | $2 \times 10^{-4}$ | 5 |

TABLE B17-continued

| | | | | | |
|---|---|---|---|---|---|
| Total of b) & c): (at. %) | 15 | about 3 | about 12 | about $5 \times 10^{-3}$ | 8 |
| Total of a), b) & c): (at. %) | 85 | about 73 | about 82 | about 70 | 88 |
| Chargeability: | A | AA | A | AA | AA |
| Sensitivity: | AA | AA | AA | AA | AA |
| Residual potential: | AA | AA | AA | AA | AA |
| Smeared image: | AA | AA | AA | AA | AA |
| Image evaluation before running: | A | AA | A | AA | AA |
| Image evaluation after running: | A | AA | A | AA | AA |
| Overall evaluation: | A | AA | A | AA | AA |

| | Comparative Example | | | | | | | |
|---|---|---|---|---|---|---|---|---|
| | | | B9 | | | B10 | B11 | B12 |
| a) Carbon content: (at. %) | 10 | 10 | 30 | 30 | 60 | 0 | 50 | 50 |
| b) Oxygen content: (at. %) | 12 | 40 | 2 | 35 | 18 | 40 | 0 | 10 |
| c) Nitrogen content: (at. %) | 10 | 45 | 3 | 30 | 15 | 20 | 10 | 0 |
| Total of b) & c): (at. %) | 22 | 85 | 5 | 65 | 33 | 60 | 60 | 60 |
| Total of a), b) & c): (at. %) | 32 | 95 | 35 | 95 | 93 | 60 | 60 | 60 |
| Chargeability: | B | A | A | A | A | A | A | A |
| Sensitivity: | A | AA | AA | AA | AA | A | AA | AA |
| Residual potential: | AA | AA | AA | AA | AA | B | B | B |
| Smeared image: | A | A | AA | A | A | A | A | A |
| Image evaluation before running: | B | A | B | A | A | A | A | A |
| Image evaluation after running: | B | B | B | B | B | B | B | B |
| Overall evaluation: | B | B | B | B | B | B | B | B |

TABLE B18

| Layer | Gas used, & flow rate (sccm) | μW power (W) | Inner pressure (mTorr) | Substrate temp. (°C.) | Layer thickness (μm) |
|---|---|---|---|---|---|
| Photoconductive layer | $SiH_4$ 500<br>$CH_4$ 150 → 0 (FIG. 8 pattern)<br>$SiF_4$ 30 ppm (based on $SiH_4$) | 1,000 | 10 | 250 | 20 |
| Surface layer | $SiH_4$ 30<br>$CH_4$ (Varied)<br>$CO_2$ (Varied)<br>$NH_3$ (Varied)<br>$SiF_4$ 10<br>$H_2$ 100 | Varied | 10 | 250 | 0.5 |

TABLE B19

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 (FIG. 8 pattern) | | | | |
| | $SiF_4$ | 50 ppm (based on $SiH_4$) | | | | |
| Surface layer | $SiH_4$ | 30 | Varied | 0.3 | 250 | 0.5 |
| | $CH_4$ | 500 | | | | |
| | $CO_2$ | 100 | | | | |
| | $NH_3$ | 100 | | | | |
| | $SiF_4$ | (Varied) | | | | |
| | $H_2$ | (Varied) | | | | |

TABLE B20

| | Example B11 | | | | | | | | Cp.* B17 | |
|---|---|---|---|---|---|---|---|---|---|---|
| a) Hydrogen content: (at. %) | 21 | 30 | 30 | 30 | 48 | 48 | 61 | 61 | 11 | 53 |
| b) Fluorine content: (at. %) | 15 | 3 | 9 | 18 | 3 | 19 | 3 | 8 | 18 | 18 |
| Total of a) & b): (at. %) | 36 | 33 | 39 | 48 | 51 | 67 | 64 | 69 | 29 | 71 |
| Sensitivity: | AA | AA | AA | AA | AA | AA | AA | AA | A | A |
| Residual potential: | AA | AA | AA | AA | AA | AA | AA | AA | A | A |
| Smeared image: | AA | AA | AA | AA | AA | AA | AA | AA | AA | AA |
| Overall evaluation: | AA | AA | AA | AA | AA | AA | AA | AA | A | A |
| | Cp.* B17 | | | Cp* B18 | | | Cp* B19 | | | |
| a) Hydrogen content: (at. %) | 61 | 70 | 11 | 21 | 30 | 48 | 30 | 48 | 70 | 76 |
| b) Fluorine content: (at. %) | 12 | 4 | 24 | 23 | 23 | 21 | 0 | 0 | 0 | 0 |
| Total of a) & b): (at. %) | 73 | 74 | 35 | 44 | 53 | 69 | 30 | 48 | 70 | 76 |
| Sensitivity: | A | A | AA | AA | AA | AA | A | A | A | A |
| Residual potential: | A | A | A | A | A | A | A | A | A | A |
| Smeared image: | AA | AA | AA | AA | AA | AA | A | A | A | A |
| Overall evaluation: | A | A | A | A | A | A | A | A | A | A |

*Comparative Example

TABLE B21

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 150 → 0 (FIG. 8 pattern) | | | | |
| | $SiF_4$ | 50 ppm (based on $SiH_4$) | | | | |
| Surface layer | $SiH_4$ | 30 | Varied | 10 | 250 | 0.5 |
| | $CH_4$ | 500 | | | | |
| | $CO_2$ | 100 | | | | |

TABLE B21-continued

| Layer | Gas used, & flow rate (sccm) | | μW power (W) | Inner pressure (mTorr) | Substrate temp. (°C.) | Layer thickness (μm) |
|---|---|---|---|---|---|---|
| | $NH_3$ | 100 | | | | |
| | $SiF_4$ | (Varied) | | | | |
| | $H_2$ | (Varied) | | | | |

TABLE B22

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 (FIG. 8 pattern) | | | | |
| | $B_2H_6$ | (Table B23) | | | | |
| | $SiF_4$ | 30 ppm (based on $SiH_4$) | | | | |
| Surface layer | $SiH_4$ | 30 | 300 | 0.3 | 250 | 0.5 |
| | $CH_4$ | 500 | | | | |
| | $CO_2$ | 50 ppm | | | | |

TABLE B22-continued

| Layer | Gas used, & flow rate (sccm) | RF power (W) | Inner pressure (Torr) | Substrate temp. (°C.) | Layer thickness (μm) |
|---|---|---|---|---|---|
| | $NH_3$ 3 ppm (based on $SiH_4$)<br>$SiF_4$ 10<br>$H_2$ 100 | | | | |

TABLE B23

| | Pattern of Boron Atom Content | |
|---|---|---|
| | Pattern | $B_2H_6$ content in photoconductive layer (ppm) |
| Comparative Example B23: | a | 0 |
| Example B13: | b | 10 |
| | c | 20 → 1 (Linearly changed) |
| | d | 20 → 0.5 (Linearly changed) |

TABLE B24

| | Pattern | Chargeability | Sensitivity | Residual potential | Overall evaluation |
|---|---|---|---|---|---|
| Comparative Example B23: | a | AA | A | AA | A |
| Example B13: | b | AA | AA | AA | AA |
| | c | AA | AA | AA | AA |
| | d | AA | AA | AA | AA |

TABLE B25

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 150 → 0 (FIG. 8 pattern) | | | | |
| | $B_2H_6$ | (Table B23) | | | | |
| | $SiF_4$ | 30 ppm (based on $SiH_4$) | | | | |
| Surface layer | $SiH_4$ | 30 | 1,000 | 10 | 250 | 0.5 |
| | $CH_4$ | 500 | | | | |
| | $CO_2$ | 50 ppm | | | | |
| | $NH_3$ | 3 ppm (based on $SiH_4$) | | | | |
| | $SiF_4$ | 10 | | | | |
| | $H_2$ | 100 | | | | |

TABLE C1

| Layer | Gas used, & flow rate (sccm) | | RF power (W) | Inner pressure (mTorr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 350 → 0 (FIG. 8 pattern) | | | | |
| | $SiF_4$ | 50 ppm (based on $SiH_4$) | | | | |
| Surface layer | $SiH_4$ | 10 | 150 | 0.4 | 250 | 0.5 |
| | $CH_4$ | 750 | | | | |
| | $O_2$ | 60 ppm (based on $SiH_4$) | | | | |
| | $B_2H_6$ | 3 ppm (based on $SiH_4$) | | | | |
| | $SiF_4$ | 10 | | | | |

TABLE C2

| Layer | Gas used, & flow rate (sccm) | | RF power (W) | Inner pressure (mTorr) | Substrate temp. (°C.) | Layer thickness (μm) |
|---|---|---|---|---|---|---|
| First Photo-conductive layer | $SiH_4$ | 500 | 500 | 0.5 | 250 | 17 |
| | $CH_4$ | 350 | | | | |
| | $SiF_4$ | 50 ppm (based on $SiH_4$) | | | | |
| Second photo-conductive layer | $SiH_4$ | 500 | 500 | 0.5 | 250 | 3 |
| Surface layer | $SiH_4$ | 10 | 300 | 0.4 | 250 | 0.5 |
| | $CH_4$ | 750 | | | | |
| | $O_2$ | 60 ppm (based on $SiH_4$) | | | | |
| | $B_2H_6$ | 3 ppm (based on $SiH_4$) | | | | |
| | $SiF_4$ | 10 | | | | |

TABLE C3

| | Charge-ability | Sensitivity | Residual potential |
|---|---|---|---|
| Example C1: | AA | AA | AA |
| Comparative Example C1: | A | B | B |

TABLE C4

| Layer | Gas used, & flow rate (sccm) | | μW power (W) | Inner pressure (mTorr) | Substrate temp. (°C.) | Layer thickness (μm) |
|---|---|---|---|---|---|---|
| Photo-conductive layer | $SiH_4$ | 500 | 1,000 | 10 | 250 | 20 |
| | $CH_4$ | 250 → 0 (FIG. 8 pattern) | | | | |
| | $SiF_4$ | 50 ppm (based on $SiH_4$) | | | | |
| Surface layer | $SiH_4$ | 100 | 1,000 | 10 | 250 | 0.5 |
| | $CH_4$ | 700 | | | | |
| | $O_2$ | 40 ppm (based on $SiH_4$) | | | | |
| | $B_2H_6$ | 1 ppm (based on $SiH_4$) | | | | |
| | $SiF_4$ | 50 | | | | |

TABLE C5

| Layer | Gas used, & flow rate (sccm) | | μW power (W) | Inner pressure (mTorr) | Substrate temp. (°C.) | Layer thickness (μm) |
|---|---|---|---|---|---|---|
| First Photo-conductive layer | $SiH_4$ | 500 | 1,000 | 10 | 250 | 17 |
| | $CH_4$ | 250 | | | | |
| | $SiF_4$ | 50 ppm (based on $SiH_4$) | | | | |
| Second photo-conductive layer | $SiH_4$ | 500 | 1,000 | 10 | 250 | 3 |
| Surface layer | $SiH_4$ | 100 | 1,000 | 10 | 250 | 0.5 |
| | $CH_4$ | 700 | | | | |
| | $O_2$ | 40 ppm (based on $SiH_4$) | | | | |
| | $B_2H_6$ | 1 ppm (based on $SiH_4$) | | | | |
| | $SiF_4$ | 50 | | | | |

TABLE C6

| Layer | Gas used, & flow rate (sccm) | | RF power (W) | Inner pressure (mTorr) | Substrate temp. (°C.) | Layer thickness (μm) |
|---|---|---|---|---|---|---|
| Photo-conductive layer | $SiH_4$ | 500 | 500 | 0.5 | 250 | 20 |
| | $CH_4$ | (Varied) | | | | |
| | $SiF_4$ | 50 ppm (based on $SiH_4$) | | | | |
| Surface layer | $SiH_4$ | 10 | 150 | 0.4 | 250 | 0.5 |
| | $CH_4$ | 750 | | | | |
| | $O_2$ | 60 ppm (based on $SiH_4$) | | | | |
| | $B_2H_6$ | 3 ppm (based on $SiH_4$) | | | | |
| | $SiF_4$ | 10 | | | | |

TABLE C7

| | Pattern of carbon atom content | Charge-ability | Sensi-tivity | Residual potential |
|---|---|---|---|---|
| Example C3: | FIG. 8 | AA | AA | AA |
| | FIG. 9 | AA | AA | AA |
| | FIG. 10 | AA | AA | AA |
| Comparative Example C3: | FIG. 11 | A | B | B |
| | FIG. 12 | AA | B | B |

TABLE C8

| Layer | Gas used, & flow rate (sccm) | | μW power (W) | Inner pressure (mTorr) | Substrate temp. (°C.) | Layer thickness (μm) |
|---|---|---|---|---|---|---|
| Photo-conductive layer | $SiH_4$ | 500 | 1,000 | 10 | 250 | 20 |
| | $CH_4$ | (Varied) | | | | |
| | $SiF_4$ | 50 ppm (based on $SiH_4$) | | | | |
| Surface layer | $SiH_4$ | 100 | 1,000 | 10 | 250 | 0.5 |
| | $CH_4$ | 700 | | | | |
| | $O_2$ | 40 ppm (based on $SiH_4$) | | | | |
| | $B_2H_6$ | 1 ppm (based on $SiH_4$) | | | | |
| | $SiF_4$ | 50 | | | | |

TABLE C9

| Layer | Gas used, & flow rate (sccm) | | RF power (W) | Inner pressure (mTorr) | Substrate temp. (°C.) | Layer thickness (μm) |
|---|---|---|---|---|---|---|
| Photo-conductive layer | $SiH_4$ | 500 | 500 | 0.5 | 250 | 20 |
| | $CH_4$ | Varied → 0 (FIG. 8 pattern) | | | | |
| | $SiF_4$ | 50 ppm (based on $SiH_4$) | | | | |
| Surface layer | $SiH_4$ | 10 | 150 | 0.4 | 250 | 0.5 |
| | $CH_4$ | 750 | | | | |
| | $O_2$ | 60 ppm (based on $SiH_4$) | | | | |
| | $B_2H_6$ | 3.5 ppm (based on $SiH_4$) | | | | |
| | $SiF_4$ | 20 | | | | |

TABLE C10

| Carbon atom content (at. %) | Charge-ability | Sensi-tivity | Residual potential | White spots | (1) | (2) | (3) | (4) |
|---|---|---|---|---|---|---|---|---|
| Comparative Example A5: | | | | | | | | |
| 70 | AA | B | A | AA | AA | B | AA | B |
| 60 | AA | B | A | AA | AA | A | AA | B |

TABLE C10-continued

| Carbon atom content (at. %) | Charge-ability | Sensi-tivity | Residual potential | White spots | (1) | (2) | (3) | (4) |
|---|---|---|---|---|---|---|---|---|
| Example A5: | | | | | | | | |
| 50 | AA | A | A | AA | AA | AA | AA | A |
| 40 | AA | AA | A | AA | AA | AA | AA | A |
| 30 | AA | AA | AA | AA | AA | AA | AA | AA |
| 20 | AA | AA | AA | AA | AA | AA | AA | AA |
| 10 | AA | AA | AA | AA | AA | AA | AA | AA |
| 5 | AA | AA | AA | AA | AA | AA | AA | AA |
| 1 | AA | AA | AA | AA | AA | AA | AA | AA |
| 0.5 | A | AA | AA | AA | AA | AA | A | A |

TABLE C10-continued

| Carbon atom content (at. %) | Chargeability | Sensitivity | Residual potential | White spots | (1) | (2) | (3) | (4) |
|---|---|---|---|---|---|---|---|---|
| Comparative Example A5: | | | | | | | | |
| 0.3 | B | AA | AA | B | A | AA | B | B |

(1): Coarse image
(2): Ghost
(3): Spherical protuberances
(4): Overall evaluation

TABLE C11

| Layer | Gas used, & flow rate (sccm) | | μW power (W) | Inner pressure (mTorr) | Substrate temp. (°C.) | Layer thickness (μm) |
|---|---|---|---|---|---|---|
| Photo-conductive layer | $SiH_4$ | 300 | 1,000 | 10 | 250 | 20 |
| | $CH_4$ | Varied → 0 (FIG. 8 pattern) | | | | |
| | $SiF_4$ | 50 ppm (based on $SiH_4$) | | | | |
| Surface layer | $SiH_4$ | 100 | 1,000 | 10 | 250 | 0.5 |
| | $CH_4$ | 700 | | | | |
| | $O_2$ | 40 ppm (based on $SiH_4$) | | | | |
| | $B_2H_6$ | 1 ppm (based on $SiH_4$) | | | | |
| | $SiF_4$ | 10 | | | | |

TABLE C12

| Layer | Gas used, & flow rate (sccm) | | RF power (W) | Inner pressure (mTorr) | Substrate temp. (°C.) | Layer thickness (μm) |
|---|---|---|---|---|---|---|
| Photo-conductive layer | $SiH_4$ | 500 | 500 | 0.5 | 250 | 20 |
| | $CH_4$ | 150 → 0 (FIG. 8 pattern) | | | | |
| | $SiF_4$ | (Varied) | | | | |
| | $B_2H_6$ | 30 → 2 ppm (based on $SiH_4$) | | | | |
| Surface layer | $SiH_4$ | 10 | 150 | 0.4 | 250 | 0.5 |
| | $CH_4$ | 750 | | | | |
| | $O_2$ | 60 ppm (based on $SiH_4$) | | | | |
| | $B_2H_6$ | 3 ppm (based on $SiH_4$) | | | | |
| | $SiF_4$ | 10 | | | | |

TABLE C13

(before running)

| | Fluorine atom content (atomic ppm) | White spots | Coarse image | Ghost | Overall evaluation |
|---|---|---|---|---|---|
| Comparative Example C7: | 0.5 | AA | B | B | B |
| Example C7: | 1 | AA | A | A | A |
| | 5 | AA | AA | AA | AA |
| | 10 | AA | AA | AA | AA |
| | 50 | AA | AA | AA | AA |
| | 70 | AA | AA | AA | AA |
| | 80 | AA | AA | AA | AA |
| | 95 | AA | AA | A | AA |
| Comparative Example C7: | 100 | AA | A | B | B |
| | 150 | AA | A | B | B |
| | 300 | AA | A | B | B |

TABLE C14

(after running)

| | Fluorine atom content (atomic ppm) | White spots | Coarse image | Ghost | Overall evaluation |
|---|---|---|---|---|---|
| Comparative Example C7: | 0.5 | B | B | B | B |
| Example C7: | 1 | A | A | A | A |
| | 5 | AA | AA | A | AA |
| | 10 | AA | AA | AA | AA |
| | 50 | AA | AA | AA | AA |
| | 70 | AA | AA | AA | AA |

TABLE C14-continued (after running)

| | Fluorine atom content (atomic ppm) | White spots | Coarse image | Ghost | Overall evaluation |
|---|---|---|---|---|---|
| | 80 | AA | AA | AA | AA |
| | 95 | AA | AA | A | AA |
| Comparative Example C7: | 100 | AA | A | B | B |
| | 150 | AA | A | B | B |
| | 300 | AA | B | B | B |

TABLE C15

| Layer | Gas used, & flow rate (sccm) | | μW power (W) | Inner pressure (mTorr) | Substrate temp. (°C.) | Layer thickness (μm) |
|---|---|---|---|---|---|---|
| Photo-conductive layer | $SiH_4$ | 500 | 1,000 | 10 | 250 | 20 |
| | $CH_4$ | 150 → 0 (FIG. 8 pattern) | | | | |
| | $SiF_4$ | (Varied) | | | | |
| | $B_2H_6$ | 30 → 2 ppm (based on $SiH_4$) | | | | |
| Surface layer | $SiH_4$ | 100 | 1,000 | 10 | 250 | 0.5 |
| | $CH_4$ | 700 | | | | |
| | $O_2$ | 40 ppm (based on $SiH_4$) | | | | |
| | $B_2H_6$ | 1 ppm (based on $SiH_4$) | | | | |
| | $SiF_4$ | 50 | | | | |

TABLE C16

| Layer | Gas used, & flow rate (sccm) | | RF power (W) | Inner pressure (mTorr) | Substrate temp. (°C.) | Layer thickness (μm) |
|---|---|---|---|---|---|---|
| Photo-conductive layer | $SiH_4$ | 500 | 500 | 0.5 | 250 | 20 |
| | $CH_4$ | 150 → 0 (FIG. 8 pattern) | | | | |
| | $CO_2$ | (Varied) (based on $SiH_4$) | | | | |
| | $B_2H_6$ | 30 → 2 ppm (based on $SiH_4$) | | | | |
| Surface layer | $SiH_4$ | 10 | 150 | 0.4 | 250 | 0.5 |
| | $CH_4$ | 750 | | | | |
| | $O_2$ | 60 ppm (based on $SiH_4$) | | | | |
| | $B_2H_6$ | 3 ppm (based on $SiH_4$) | | | | |
| | $SiF_4$ | 10 | | | | |

TABLE C17

| Oxygen atom content | Charge-ability | Sensi-tivity | Residual potential | Potential shift | Overall evalua-tion |
|---|---|---|---|---|---|
| Comparative Example C9: | | | | | |
| 5 | AA | AA | AA | A | A |
| 7 | AA | AA | AA | A | A |
| Example C9: | | | | | |
| 10 | AA | AA | AA | AA | AA |
| 50 | AA | AA | AA | AA | AA |
| 100 | AA | AA | AA | AA | AA |
| 250 | AA | AA | AA | AA | AA |
| 500 | AA | AA | AA | AA | AA |

TABLE C17-continued

| Oxygen atom content | Charge-ability | Sensi-tivity | Residual potential | Potential shift | Overall evalua-tion |
|---|---|---|---|---|---|
| 1,000 | AA | AA | AA | AA | AA |
| 3,000 | AA | AA | AA | AA | AA |
| 5,000 | AA | AA | AA | AA | AA |
| Comparative Example C9: | | | | | |
| 5,500 | AA | A | B | AA | B |
| 6,000 | AA | B | B | AA | B |
| 8,000 | AA | B | B | AA | B |

TABLE C18

| Layer | Gas used, & flow rate (sccm) | | μW power (W) | Inner pressure (mTorr) | Substrate temp. (°C.) | Layer thickness (μm) |
|---|---|---|---|---|---|---|
| Photo-conductive layer | $SiH_4$ | 500 | 1,000 | 10 | 250 | 20 |
| | $CH_4$ | 150 → 0 (FIG. 8 pattern) | | | | |
| | $SiF_4$ | 50 ppm | | | | |
| | $CO_2$ | (Varied) | | | | |
| | $B_2H_6$ | 40 → 3 ppm (based on $SiH_4$) | | | | |
| Surface layer | $SiH_4$ | 15 | 1,000 | 10 | 250 | 0.5 |
| | $CH_4$ | 800 | | | | |
| | $CO_2$ | 100 ppm (based on $SiH_4$) | | | | |
| | $B_2H_6$ | 2 ppm (based on $SiH_4$) | | | | |
| | $SiF_4$ | 20 | | | | |

TABLE C19

| Layer | Gas used, & flow rate (sccm) | | RF power (W) | Inner pressure (mTorr) | Substrate temp. (°C.) | Layer thickness (μm) |
|---|---|---|---|---|---|---|
| Photo-conductive layer | $SiH_4$ | 500 | 500 | 0.5 | 250 | 20 |
| | $CH_4$ | 150 → 0 (FIG. 8 pattern) | | | | |
| | $SiF_4$ | 50 ppm (based on $SiH_4$) | | | | |
| | $CO_2$ | 500 ppm (based on $SiH_4$) | | | | |
| | $B_2H_6$ | 30 → 2 ppm (based on $SiH_4$) | | | | |
| Surface layer | $SiH_4$ | 15 | Varied | 0.5 | 250 | 0.5 |
| | $CH_4$ | (Varied) | | | | |
| | $CO_2$ | 1,000 ppm (based on $SiH_4$) | | | | |
| | $B_2H_6$ | 3.5 ppm (based on $SiH_4$) | | | | |
| | $SiF_4$ | 20 | | | | |

TABLE C20

| | Comptv. Example C11 | | | Example C11 | | | | | | Comptv. Example C11 | |
|---|---|---|---|---|---|---|---|---|---|---|---|
| | Carbon atom content: (at. %) | | | | | | | | | | |
| | 20 | 40 | 60 | 63 | 70 | 75 | 83 | 86 | 90 | 93 | 95 |
| Chargeability: | B | B | A | AA | AA | AA | AA | AA | AA | AA | AA |
| Sensitivity: | B | A | A | AA | AA | AA | AA | A | A | B | B |
| Residual potential: | AA | AA | AA | AA | AA | AA | AA | AA | AA | A | B |
| Smeared image: | AA | AA | AA | AA | AA | AA | AA | AA | AA | A | B |
| White spots: | B | A | AA | AA | AA | AA | AA | AA | AA | AA | AA |
| Black dots caused by melt-adhesion of toner: | A | AA | AA | AA | AA | AA | AA | AA | AA | AA | AA |
| Scratches: | A | AA | AA | AA | AA | AA | AA | AA | AA | AA | AA |

TABLE C21

| | Comptv. Example C11 | | | Example C11 | | | | | | Comptv. Example C11 | |
|---|---|---|---|---|---|---|---|---|---|---|---|
| | Carbon atom content: (at. %) | | | | | | | | | | |
| | 20 | 40 | 60 | 63 | 70 | 75 | 83 | 86 | 90 | 93 | 95 |
| Chargeability: | B | B | A | AA | AA | AA | AA | AA | AA | AA | AA |
| Sensitivity: | B | B | A | AA | AA | AA | AA | A | A | B | B |
| Residual potential: | AA | AA | AA | AA | AA | AA | AA | AA | AA | A | B |
| Smeared image: | B | B | A | AA | AA | AA | AA | AA | A | B | B |
| White spots: | B | B | A | AA | AA | AA | AA | AA | AA | AA | AA |
| Black dots caused by melt-adhesion of toner: | B | B | A | AA | AA | AA | AA | AA | AA | AA | AA |
| Scratches: | B | B | A | AA | AA | AA | AA | AA | AA | AA | AA |

TABLE C22

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 300 | 1,000 | 10 | 250 | 20 |
| | $CH_4$ | 150 → 0 | | | | |
| | $SiF_4$ | 50 ppm (based on $SiH_4$) | | | | |
| | $CO_2$ | 1,000 ppm (based on $SiH_4$) | | | | |
| | $B_2H_6$ | 40 → 3 ppm (based on $SiH_4$) | | | | |
| Surface layer | $SiH_4$ | 75 | Varied | 10 | 250 | 0.5 |
| | $CH_4$ | (Varied) | | | | |
| | $O_2$ | 60 ppm (based on $SiH_4$) | | | | |
| | $B_2H_6$ | 5 ppm (based on $SiH_4$) | | | | |
| | $SiF_4$ | 35 | | | | |

TABLE C23

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 | | | | |
| | $SiF_4$ | 50 ppm (based on $SiH_4$) | | | | |
| | $CO_2$ | 500 ppm (based on $SiH_4$) | | | | |
| | $B_2H_6$ | 30 → 2 ppm (based on $SiH_4$) | | | | |
| Surface layer | $SiH_4$ | 15 | 300 | 0.5 | 250 | 0.5 |
| | $CH_4$ | 800 | | | | |
| | $CO_2$ | (Varied) (based on $SiH_4$) | | | | |
| | $B_2H_6$ | 3.5 ppm (based on $SiH_4$) | | | | |
| | $SiF_4$ | 20 | | | | |

TABLE C24

| | (before running) | | | | | | | | | | |
|---|---|---|---|---|---|---|---|---|---|---|---|
| | Cp* C13 | Example C13 | | | | | | | | | Cp* C13 |
| | Oxygen atom content: (at. %) | | | | | | | | | | |
| | $1\times10^{-5}$ | $1\times10^{-4}$ | $3\times10^{-4}$ | $1\times10^{-3}$ | $5\times10^{-3}$ | 1 | 20 | 25 | 30 | 40 | 50 |
| Chargeability: | B | A | AA | AA | AA | AA | AA | AA | AA | AA | AA |
| Sensitivity: | B | A | A | AA | AA | AA | AA | AA | A | B | B |
| Residual potential: | A | AA | AA | AA | AA | AA | AA | A | A | B | B |
| Smeared image: | A | A | AA | AA | AA | AA | AA | AA | AA | AA | AA |
| White spots: | A | AA | AA | AA | AA | AA | AA | AA | AA | AA | AA |
| Black dots caused by melt-adhesion of toner: | B | A | AA | AA | AA | AA | AA | AA | AA | AA | AA |
| Scratches: | A | A | AA | AA | AA | AA | AA | AA | AA | AA | AA |

*Comparative Example

TABLE C25

| Cp* C13 | (after running) Example C13 | | | | | | | | | Cp* C13 |
|---|---|---|---|---|---|---|---|---|---|---|
| Oxygen atom content: (at. %) | $1\times10^{-5}$ | $1\times10^{-4}$ | $3\times10^{-4}$ | $1\times10^{-3}$ | $5\times10^{-3}$ | 1 | 20 | 25 | 30 | 40 | 50 |
| Chargeability: | B | A | AA | AA | AA | AA | AA | AA | AA | AA | AA |
| Sensitivity: | B | A | AA | AA | AA | AA | AA | AA | A | B | B |
| Residual potential: | A | AA | AA | AA | AA | AA | AA | A | A | B | B |
| Smeared image: | B | A | AA | AA | AA | AA | AA | AA | AA | AA | AA |
| White spots: | A | AA | AA | AA | AA | AA | AA | AA | AA | AA | AA |
| Black dots caused by melt-adhesion of toner: | B | A | AA | AA | AA | AA | AA | AA | AA | AA | AA |
| Scratches: | A | A | AA | AA | AA | AA | AA | AA | AA | AA | AA |

*Comparative Example

TABLE C26

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 300 | 1,000 | 10 | 250 | 20 |
| | $CH_4$ | 150 → 0 (FIG. 8 pattern) | | | | |
| | $SiF_4$ | 500 ppm (based on $SiH_4$) | | | | |
| | $CO_2$ | 1,000 ppm (based on $SiH_4$) | | | | |
| | $SiF_4$ | 50 ppm (based on $SiH_4$) | | | | |
| | $B_2H_6$ | 30 → 2 ppm (based on $SiH_4$) | | | | |
| Surface layer | $SiH_4$ | 75 | 1,000 | 10 | 250 | 0.5 |
| | $CH_4$ | 800 | | | | |
| | $CO_2$ | (Varied) (based on $SiH_4$) | | | | |
| | $B_2H_6$ | 5 ppm (based on $SiH_4$) | | | | |
| | $SiF_4$ | 35 | | | | |

TABLE C27

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 300 | 500 | 0.5 | 250 | 20 |
| | $CH_4$ | 150 → 0 (FIG. 8 pattern) | | | | |
| | $SiF_4$ | 50 ppm (based on $SiH_4$) | | | | |
| | $CO_2$ | 500 ppm (based on $SiH_4$) | | | | |
| | $B_2H_6$ | 30 → 2 ppm (based on $SiH_4$) | | | | |
| Surface layer | $SiH_4$ | 15 | 300 | 0.5 | 250 | 0.5 |
| | $CH_4$ | 800 | | | | |
| | $N_2$ | (Varied) (based on $SiH_4$) | | | | |
| | $B_2H_6$ | 3.5 ppm (based on $SiH_4$) | | | | |
| | $SiF_4$ | 20 | | | | |

TABLE C28

| Cp* C15 | (before running) Example C15 | | | | | | | | | Cp* C15 |
|---|---|---|---|---|---|---|---|---|---|---|
| Nitrogen atom content: (at. %) | $1\times10^{-5}$ | $1\times10^{-4}$ | $3\times10^{-4}$ | $1\times10^{-3}$ | $5\times10^{-3}$ | 1 | 20 | 25 | 30 | 40 | 50 |
| Chargeability: | B | A | AA | AA | AA | AA | AA | AA | AA | AA | AA |
| Sensitivity: | B | A | AA | AA | AA | AA | AA | AA | A | B | B |
| Residual potential: | A | AA | AA | AA | AA | AA | AA | A | A | B | B |
| Smeared image: | A | A | AA | AA | AA | AA | AA | AA | AA | AA | AA |
| White spots: | A | AA | AA | AA | AA | AA | AA | AA | AA | AA | AA |

TABLE C28-continued

| | (before running) | | | | | | | | | |
|---|---|---|---|---|---|---|---|---|---|---|
| Cp* C15 | Example C15 | | | | | | | | | Cp* C15 |
| Black dots caused by melt-adhesion of toner: | | | | | | | | | | |
| B | A | AA | AA | AA | AA | AA | AA | AA | AA | AA |
| Scratches: | | | | | | | | | | |
| A | A | AA | AA | AA | AA | AA | AA | AA | AA | AA |

*Comparative Example

TABLE C29

| | (after running) | | | | | | | | | |
|---|---|---|---|---|---|---|---|---|---|---|
| Cp* C15 | Example C15 | | | | | | | | | Cp* C15 |
| Nitrogen atom content: (at. %) | | | | | | | | | | |
| $1 \times 10^{-5}$ | $1 \times 10^{-4}$ | $3 \times 10^{-4}$ | $1 \times 10^{-3}$ | $5 \times 10^{-3}$ | 1 | 20 | 25 | 30 | 40 | 50 |
| Chargeability: | | | | | | | | | | |
| B | A | AA | AA | AA | AA | AA | AA | AA | AA | AA |
| Sensitivity: | | | | | | | | | | |
| B | A | AA | AA | AA | AA | AA | AA | A | B | B |
| Residual potential: | | | | | | | | | | |
| A | AA | AA | AA | AA | AA | AA | A | A | B | B |
| Smeared image: | | | | | | | | | | |
| B | A | AA | AA | AA | AA | AA | AA | AA | AA | AA |
| White spots: | | | | | | | | | | |
| B | A | AA | AA | AA | AA | AA | AA | AA | AA | AA |
| Black spots caused by melt-adhesion of toner: | | | | | | | | | | |
| B | A | AA | AA | AA | AA | AA | AA | AA | AA | AA |
| Scratches: | | | | | | | | | | |
| A | A | AA | AA | AA | AA | AA | AA | AA | AA | AA |

*Comparative Example

TABLE C30

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 300 | 1,000 | 10 | 250 | 20 |
| | $CH_4$ | 150 → 0 | | | | |
| | $CO_2$ | 1,000 ppm (based on $SiH_4$) | | | | |
| | $SiF_4$ | 50 ppm (based on $SiH_4$) | | | | |
| Surface layer | $SiH_4$ | 75 | 1,000 | 10 | 250 | 0.5 |
| | $CH_4$ | 800 | | | | |
| | $N_2$ | (Varied) (based on $SiH_4$) | | | | |
| | $B_2H_6$ | 5 ppm (based on $SiH_4$) | | | | |
| | $SiF_4$ | 35 | | | | |

TABLE C31

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 300 | 500 | 0.5 | 250 | 20 |
| | $CH_4$ | 200 → 0 | | | | |
| | $SiF_4$ | 50 ppm (based on $SiH_4$) | | | | |

TABLE C31-continued

| Layer | Gas used, & flow rate (sccm) | | RF power (W) | Inner pressure (Torr) | Substrate temp. (°C.) | Layer thickness (μm) |
|---|---|---|---|---|---|---|
| layer | $CO_2$ | 500 ppm (based on $SiH_4$) | | | | |
| | $B_2H_6$ | 30 → 2 ppm (based on $SiH_4$) | | | | |
| Surface layer | $SiH_4$ | 15 | 300 | 0.5 | 250 | 0.5 |
| | $CH_4$ | 850 | | | | |
| | $CO_2$ | 100 ppm (based on $SiH_4$) | | | | |
| | $B_2H_6$ | (Varied) (based on $SiH_4$) | | | | |
| | $SiF_4$ | 20 | | | | |

TABLE C32

(before running)

| | Cp* C17 | Example C17 | | | | |
|---|---|---|---|---|---|---|
| Boron atom content: (at. %) | $1 \times 10^{-6}$ | $1 \times 10^{-5}$ | $5 \times 10^{-4}$ | $1 \times 10^{-4}$ | $1 \times 10^{-2}$ | 1 |
| Chargeability: | AA | AA | AA | AA | AA | AA |
| Sensitivity: | A | A | AA | AA | AA | AA |
| Residual potential: | B | A | AA | AA | AA | AA |
| Smeared image: | A | AA | AA | AA | AA | AA |
| White spots: | A | AA | AA | AA | AA | AA |
| Scratches: | AA | AA | AA | AA | AA | AA |
| Black dots caused by melt-adhesion of toner: | A | AA | AA | AA | AA | AA |

| | Example C17 (cont'd) | | | | Cp* C17 |
|---|---|---|---|---|---|
| Boron atom content: (at. %) | $1 \times 10^{2}$ | $3 \times 10^{4}$ | $5 \times 10^{4}$ | $1 \times 10^{5}$ | $1 \times 10^{6}$ |
| Chargeability: | AA | AA | AA | A | A |
| Sensitivity: | AA | AA | AA | A | A |
| Residual potential: | AA | AA | AA | AA | AA |
| Smeared image: | AA | AA | AA | AA | AA |
| White spots: | AA | AA | AA | AA | AA |
| Scratches: | AA | AA | AA | AA | AA |
| Black dots caused by melt-adhesion of toner: | AA | AA | AA | AA | AA |

*Comparative Example

TABLE C33

(after running)

| | Cp* C17 | Example C17 | | | | |
|---|---|---|---|---|---|---|
| Boron atom content: (at. %) | $1 \times 10^{-6}$ | $1 \times 10^{-5}$ | $5 \times 10^{-4}$ | $1 \times 10^{-4}$ | $1 \times 10^{-2}$ | 1 |
| Chargeability: | AA | AA | AA | AA | AA | AA |
| Sensitivity: | B | A | AA | AA | AA | AA |
| Residual potential: | B | A | AA | AA | AA | AA |
| Smeared image: | B | B | A | AA | AA | AA |
| White spots: | B | A | AA | AA | AA | AA |
| Scratches: | AA | AA | AA | AA | AA | AA |
| Black dots caused by melt-adhesion of toner: | B | A | A | AA | AA | AA |

| | Example C17 (cont'd) | | | | Cp* C17 |
|---|---|---|---|---|---|
| Boron atom content: (at. %) | $1 \times 10^{2}$ | $3 \times 10^{4}$ | $5 \times 10^{4}$ | $1 \times 10^{5}$ | $1 \times 10^{6}$ |
| Chargeability: | AA | AA | AA | A | A |
| Sensitivity: | AA | AA | AA | A | A |
| Residual potential: | AA | AA | AA | AA | AA |
| Smeared image: | AA | AA | AA | AA | AA |
| White spots: | AA | AA | AA | AA | AA |
| Scratches: | AA | AA | AA | AA | AA |
| Black dots caused by melt-adhesion of toner: | AA | AA | AA | AA | AA |

*Comparative Example

TABLE C34

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 300 | 1,000 | 10 | 250 | 20 |
| | $CH_4$ | 150 → 0 (FIG. 8 pattern) | | | | |
| | $SiF_4$ | 50 ppm (based on $SiH_4$) | | | | |
| | $CO_2$ | 1,000 ppm (based on $SiH_4$) | | | | |
| | $B_2H_6$ | 40 → 3 ppm (based on $SiH_4$) | | | | |
| Surface layer | $SiH_4$ | 75 | 1,000 | 10 | 250 | 0.5 |
| | $CH_4$ | 800 | | | | |
| | $CO_2$ | 100 ppm (based on $SiH_4$) | | | | |
| | $B_2H_6$ | (Varied) (based on $SiH_4$) | | | | |
| | $SiF_4$ | 35 | | | | |

TABLE C35

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 300 | 500 | 0.5 | 250 | 20 |
| | $CH_4$ | 120 → 0 | | | | |
| | $SiF_4$ | 100 ppm (based on $SiH_4$) | | | | |
| | $CO_2$ | 800 ppm (based on $SiH_4$) | | | | |
| | $B_2H_6$ | 30 → 2 ppm (based on $SiH_4$) | | | | |
| Surface layer | $SiH_4$ | 15 | Varied | 0.5 | 300 | 0.5 |
| | $CH_4$ | 850 | | | | |
| | $CO_2$ | 500 ppm (based on $SiH_4$) | | | | |
| | $B_2H_6$ | 30 ppm (based on $SiH_4$) | | | | |
| | $SiF_4$ | (Varied) | | | | |

TABLE C36

| (before running) | | | | | | | | | | |
|---|---|---|---|---|---|---|---|---|---|---|
| a) Hydrogen content: (at. %) | | 11 | | | 21 | | | 30 | | |
| b) Fluorine content: (at. %) | 0* | 18 | 24 | 0* | 15 | 23 | 0* | 9 | 18 | 23 |
| | — | — | — | — | — | — | — | — | — | — |
| Total of a) & b): (at. %) | 11 | 29 | 35 | 21 | 36 | 44 | 30 | 39 | 48 | 53 |
| Chargeability: | A | AA | AA | A | AA | AA | A | AA | AA | AA |
| Sensitivity: | A | A | AA | A | AA | AA | AA | AA | AA | AA |
| Residual potential: | A | A | A | A | AA | A | AA | AA | AA | A |
| Smeared image: | A | AA | AA | A | AA | AA | A | AA | AA | AA |
| White spots: | A | AA | AA | A | AA | AA | A | AA | AA | AA |
| Scratches: | AA | AA | AA | AA | AA | AA | AA | AA | AA | AA |
| Black dots caused by melt-adhesion of toner: | A | AA | AA | A | AA | AA | A | AA | AA | AA |
| Overall evaluation: | A | A | A | A | AA | A | A | AA | AA | A |
| a) Nydrogen content: (at. %) | | 48 | | | | 61 | | 70 | | 76 |
| b) Fluorine content: (at. %) | 0* | 11 | 19 | 23 | 0* | 8 | 12 | 0* | 4 | 0* |
| | — | — | — | — | — | — | — | — | — | — |
| Total of a) & b): (at. %) | 48 | 59 | 67 | 71 | 61 | 69 | 73 | 70 | 74 | 76 |
| Chargeability: | A | AA | AA | AA | A | AA | AA | A | AA | A |
| Sensitivity: | AA | AA | AA | A | AA | AA | A | AA | A | A |
| Residual potential: | AA | AA | AA | A | AA | AA | A | AA | AA | A |
| Smeared image: | A | AA | AA | AA | A | AA | AA | A | AA | A |
| White spots: | A | AA | AA | AA | A | AA | AA | A | AA | A |
| Scratches: | AA | AA | AA | AA | AA | AA | AA | AA | AA | AA |
| Black dots caused by melt-adhesion of toner: | A | AA | AA | AA | A | AA | AA | A | AA | A |
| Overall evaluation: | A | AA | AA | A | A | AA | A | A | A | A |

Remarks: *Data in which fluorine atom content is 0 at. % are results of evaluation of Comparative Example C19. Other data are those of Example C19.

TABLE C37

| (after running) | | | | | | | | | | |
|---|---|---|---|---|---|---|---|---|---|---|
| a) Hydrogen content: (at. %) | | 11 | | | 21 | | | 30 | | |
| b) Fluorine content: (at. %) | 0* | 18 | 24 | 0* | 15 | 23 | 0* | 9 | 18 | 23 |
| | — | — | — | — | — | — | — | — | — | — |
| Total of a) & b): (at. %) | 11 | 29 | 35 | 21 | 36 | 44 | 30 | 39 | 48 | 53 |
| Charge-ability: | A | AA | AA | A | AA | AA | A | AA | AA | AA |
| Sensitivity: | A | A | AA | A | AA | AA | AA | AA | AA | AA |
| Residual potential: | A | A | A | A | AA | A | AA | AA | AA | A |
| Smeared image: | A | AA | AA | A | AA | AA | A | AA | AA | AA |
| White spots: | A | AA | AA | A | AA | AA | A | AA | AA | AA |
| Scratches: | AA | AA | AA | AA | AA | AA | AA | AA | AA | AA |
| Black dots caused by melt-adhesion of toner: | B | AA | AA | B | AA | AA | B | AA | AA | AA |
| Overall evaluation: | B | A | A | B | AA | A | B | AA | AA | A |
| a) Hydrogen content: (at. %) | | 48 | | | | 61 | | 70 | | 76 |
| b) Fluorine content: (at. %) | 0* | 11 | 19 | 23 | 0* | 8 | 12 | 0* | 4 | 0* |
| | — | — | — | — | — | — | — | — | — | — |
| Total of a) & b): (at. %) | 48 | 59 | 67 | 71 | 61 | 69 | 73 | 70 | 74 | 76 |
| Charge-ability: | A | AA | AA | AA | A | AA | AA | A | AA | A |
| Sensitivity: | AA | AA | AA | A | AA | AA | A | AA | A | A |
| Residual potential: | AA | AA | AA | A | AA | AA | A | AA | AA | A |
| Smeared image: | A | AA | AA | AA | A | AA | AA | A | AA | A |
| White spots: | A | AA | AA | AA | A | AA | AA | A | AA | A |
| Scratches: | AA | AA | AA | AA | AA | AA | AA | AA | AA | AA |
| Black dots caused by melt-adhesion of toner: | B | AA | AA | AA | B | AA | AA | B | AA | B |
| Overall evaluation: | B | AA | AA | A | B | AA | A | B | A | B |

Remarks: *Data in which fluorine atom content is 0 at. % are results of evaluation of Comparative Example C19. Other data are those of Example C19.

TABLE C38

| (before running) | | | | | | |
|---|---|---|---|---|---|---|
| Layer | Gas used, & flow rate (sccm) | | μW power (W) | Inner pres-sure (mTorr) | Sub-strate temp. (°C.) | Layer thick-ness (μm) |
| Photo-conduc-tive layer | $SiH_4$ | 300 | 1,000 | 10 | 250 | 20 |
| | $CH_4$ | 150 → 0 (FIG. 8 pattern) | | | | |
| | $SiF_4$ | 50 ppm (based on $SiH_4$) | | | | |
| | $CO_2$ | 1,000 ppm (based on $SiH_4$) | | | | |
| | $B_2H_6$ | 40 → 3 ppm (based on $SiH_4$) | | | | |
| Surface layer | $SiH_4$ | 75 | Varied | 10 | 250 | 0.5 |
| | $CH_4$ | 800 | | | | |
| | $CO_2$ | 100 ppm (based on $SiH_4$) | | | | |
| | $B_2H_6$ | 30 ppm (based on $SiH_4$) | | | | |
| | $SiF_4$ | (Varied) | | | | |

TABLE C39

| Layer | Gas used, & flow rate (sccm) | | RF power (W) | Inner pres-sure (Torr) | Sub-Strate temp. (°C.) | Layer thick-ness (μm) |
|---|---|---|---|---|---|---|
| Photo-conduc-tive layer | $SiH_4$ | 300 | 500 | 0.5 | 300 | 25 |
| | $CH_4$ | 120 → 0 (FIG. 8 pattern) | | | | |
| | $SiF_4$ | 100 ppm (based on $SiH_4$) | | | | |
| | $CO_2$ | 800 ppm (based on $SiH_4$) | | | | |
| | $B_2H_6$ | 40 → 3 ppm (based on $SiH_4$) | | | | |
| Surface layer | $SiH_4$ | 15 | 300 | 0.5 | 300 | 0.5 |
| | $CH_4$ | 850 | | | | |
| | NO | (Varied) (based on $SiH_4$) | | | | |
| | $B_2H_6$ | 300 ppm (based on $SiH_4$) | | | | |
| | $SiF_4$ | 30 | | | | |

TABLE C40

(before running)

| Cp* C21 | Example C21 | | | | | | | | | Cp* C21 |
|---|---|---|---|---|---|---|---|---|---|---|
| Total of oxygen atom content and nitrogen atom content: (at. %) | | | | | | | | | | |
| $1 \times 10^{-5}$ | $1 \times 10^{-4}$ | $3 \times 10^{-4}$ | $1 \times 10^{-3}$ | $5 \times 10^{-3}$ | 1 | 20 | 25 | 30 | 40 | 50 |
| Chargeability: | | | | | | | | | | |
| B | A | AA | AA | AA | AA | AA | AA | AA | AA | AA |
| Sensitivity: | | | | | | | | | | |
| B | A | AA | AA | AA | AA | AA | AA | A | B | B |
| Residual potential: | | | | | | | | | | |
| A | AA | AA | AA | AA | AA | AA | A | A | B | B |
| Smeared image: | | | | | | | | | | |
| A | A | AA | AA | AA | AA | AA | AA | AA | AA | AA |
| White spots: | | | | | | | | | | |
| A | AA | AA | AA | AA | AA | AA | AA | AA | AA | AA |
| Black dots caused by melt-adhesion of toner: | | | | | | | | | | |
| B | A | AA | AA | AA | AA | AA | AA | AA | AA | AA |
| Scratches: | | | | | | | | | | |
| A | A | AA | AA | AA | AA | AA | AA | AA | AA | AA |

*Comparative Example

TABLE C41

(after running)

| Cp* C21 | Example C21 | | | | | | | | | Cp* C21 |
|---|---|---|---|---|---|---|---|---|---|---|
| Total of oxygen atom content and nitrogen atom content: (at. %) | | | | | | | | | | |
| $1 \times 10^{-5}$ | $1 \times 10^{-4}$ | $3 \times 10^{-4}$ | $1 \times 10^{-3}$ | $5 \times 10^{-3}$ | 1 | 20 | 25 | 30 | 40 | 50 |
| Chargeability: | | | | | | | | | | |
| B | A | AA | AA | AA | AA | AA | AA | AA | AA | AA |
| Sensitivity: | | | | | | | | | | |
| B | A | AA | AA | AA | AA | AA | AA | A | B | B |
| Residual potential: | | | | | | | | | | |
| A | AA | AA | AA | AA | AA | AA | A | A | B | B |
| Smeared image: | | | | | | | | | | |
| B | A | AA | AA | AA | AA | AA | AA | AA | AA | AA |
| White spots: | | | | | | | | | | |
| B | A | AA | AA | AA | AA | AA | AA | AA | AA | AA |
| Black dots caused by melt-adhesion of toner: | | | | | | | | | | |
| B | A | AA | AA | AA | AA | AA | AA | AA | AA | AA |
| Scratches: | | | | | | | | | | |
| A | A | AA | AA | AA | AA | AA | AA | AA | AA | AA |

*Comparative Example

TABLE C42

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 300 | 1,000 | 10 | 250 | 20 |
| | $CH_4$ | 150 → 0 | | | | |
| | $SiF_4$ | 50 ppm (based on $SiH_4$) | | | | |
| | $CO_2$ | 1,000 ppm (based on $SiH_4$) | | | | |
| | $B_2H_6$ | 40 → 3 ppm (based on $SiH_4$) | | | | |
| Surface layer | $SiH_4$ | 75 | 1,000 | 10 | 250 | 0.5 |
| | $CH_4$ | 800 | | | | |
| | NO | (Varied) (based on $SiH_4$) | | | | |
| | $B_2H_6$ | 30 ppm (based on $SiH_4$) | | | | |
| | $SiF_4$ | 35 | | | | |

TABLE D1

| Layer | Gas used, & flow rate (sccm) | | RF power (W) | Inner pressure (torr) | Sub-Strate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 350 → 0 (FIG. 8 pattern) | | | | |
| | $SiF_4$ | 30 ppm | | | | |
| | $CO_2$ | 800 ppm (based on $SiH_4$) | | | | |
| Surface layer | $SiH_4$ | 30 | 300 | 0.3 | 250 | 0.5 |
| | $CH_4$ | 500 | | | | |
| | $CO_2$ | 100 | | | | |
| | $NH_3$ | 100 | | | | |
| | $SiF_4$ | 10 | | | | |
| | $H_2$ | 100 | | | | |

TABLE D2

| Layer | Gas used, & flow rate (sccm) | | RF power (W) | Inner pressure (Torr) | Sub-Strate temp. (°C.) | Layer thickness (μm) |
|---|---|---|---|---|---|---|
| First Photoconductive layer | $SiH_4$ | 500 | 500 | 0.5 | 250 | 17 |
| | $CH_4$ | 350 | | | | |
| | $SiF_4$ | 30 ppm | | | | |
| | $CO_2$ | 800 ppm (based on $SiH_4$) | | | | |
| Second photoconductive layer | $SiH_4$ | 500 | 500 | 0.5 | 250 | 3 |
| Surface layer | $SiH_4$ | 30 | 300 | 0.3 | 250 | 0.5 |
| | $CH_4$ | 500 | | | | |
| | $CO_2$ | 100 | | | | |
| | $NH_3$ | 100 | | | | |
| | $SiF_4$ | 10 | | | | |
| | $H_2$ | 100 | | | | |

TABLE D3

| Chargeability | Sensitivity | Residual potential | Potential shift |
|---|---|---|---|
| Example D1: | | | |
| AA | AA | AA | AA |
| Comparative Example D1: | | | |
| A | B | B | A |

TABLE D4

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 250 → 0 (FIG. 8 pattern) | | | | |
| | $SiF_4$ | 30 ppm | | | | |
| | $CO_2$ | 800 ppm (based on $SiH_4$) | | | | |
| Surface layer | $SiH_4$ | 30 | 1,000 | 10 | 250 | 0.5 |
| | $CH_4$ | 500 | | | | |
| | $CO_2$ | 100 | | | | |
| | $NH_3$ | 100 | | | | |
| | $SiF_4$ | 10 | | | | |
| | $H_2$ | 100 | | | | |

TABLE D5

| Layer | Gas used, & flow rate (sccm) | | μW power (W) | Inner pressure (mtorr) | Substrate temp. (°C.) | Layer thickness (μm) |
|---|---|---|---|---|---|---|
| First Photoconductive layer | $SiH_4$ | 500 | 1,000 | 10 | 250 | 17 |
| | $CH_4$ | 250 | | | | |
| | $SiF_4$ | 30 ppm | | | | |
| | $CO_2$ | 800 ppm (based on $SiH_4$) | | | | |
| Second photoconductive layer | $SiH_4$ | 500 | 1,000 | 10 | 250 | 3 |
| Surface layer | $SiH_4$ | 30 | 1,000 | 10 | 250 | 0.5 |
| | $CH_4$ | 500 | | | | |
| | $CO_2$ | 100 | | | | |
| | $NH_3$ | 100 | | | | |
| | $SiF_4$ | 10 | | | | |
| | $H_2$ | 100 | | | | |

TABLE D6

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | (Varied) | | | | |
| | $SiF_4$ | 30 ppm | | | | |
| | $CO_2$ | 800 ppm (based on $SiH_4$) | | | | |
| Surface layer | $SiH_4$ | 30 | 300 | 0.3 | 250 | 0.5 |
| | $CH_4$ | 500 | | | | |
| | $CO_2$ | 100 | | | | |
| | $NH_3$ | 100 | | | | |
| | $SiF_4$ | 10 | | | | |

TABLE D7

| Pattern of carbon atom content | Chargeability | Sensitivity | Residual potential | Potential shift |
|---|---|---|---|---|
| Example D3: | | | | |
| FIG. 8 | AA | AA | AA | AA |
| FIG. 9 | AA | AA | AA | AA |
| FIG. 10 | AA | AA | AA | AA |
| Comparative Example D3: | | | | |
| FIG. 11 | A | B | B | B |
| FIG. 12 | AA | B | B | B |

TABLE D8

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | (Varied) | | | | |
| | $SiF_4$ | 30 ppm | | | | |
| | $CO_2$ | 800 ppm (based on $SiH_4$) | | | | |
| Surface layer | $SiH_4$ | 30 | 1,000 | 10 | 250 | 0.5 |
| | $CH_4$ | 500 | | | | |
| | $CO_2$ | 100 | | | | |
| | $NH_3$ | 100 | | | | |
| | $SiF_4$ | 10 | | | | |

TABLE D9

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | Varied → 0 (FIG. 8 pattern) | | | | |
| | $SiF_4$ | 30 ppm | | | | |
| | $CO_2$ | 800 ppm (based on $SiH_4$) | | | | |
| Surface layer | $SiH_4$ | 30 | 300 | 0.3 | 250 | 0.5 |
| | $CH_4$ | 500 | | | | |
| | $CO_2$ | 100 ppm | | | | |
| | $NH_3$ | 10 ppm (based on $SiH_4$) | | | | |
| | $SiF_4$ | 10 | | | | |

TABLE D10

| Carbon atom content (at. %) | Chargeability | Sensitivity | Residual potential | White spots | (1) | (2) | (3) | (4) |
|---|---|---|---|---|---|---|---|---|
| Comparative Example D5: | | | | | | | | |
| 70 | AA | B | B | AA | AA | B | AA | B |
| 60 | AA | B | A | AA | AA | A | AA | B |
| Example D5: | | | | | | | | |
| 50 | AA | A | A | AA | AA | AA | AA | A |
| 40 | AA | AA | A | AA | AA | AA | AA | A |
| 30 | AA | AA | AA | AA | AA | AA | AA | AA |
| 20 | AA | AA | AA | AA | AA | AA | AA | AA |
| 10 | AA | AA | AA | AA | AA | AA | AA | AA |
| 5 | AA | AA | AA | AA | AA | AA | AA | AA |
| 1 | AA | AA. | AA | AA | AA | AA | AA | AA |
| 0.5 | A | AA | AA | AA | AA | AA | A | A |
| Comparative Example D5: | | | | | | | | |
| 0.3 | B | AA | AA | B | A | AA | B | B |

(1): Coarse image
(2): Ghost
(3): Spherical protuberances
(4): Overall evaluation

TABLE D11

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive | $SiH_4$ | 500 | 1,000 | 10 | 250 | 20 |
| | $CH_4$ | (Varied) → 0 (FIG. 8 pattern) | | | | |
| | $SiF_4$ | 30 ppm | | | | |

TABLE D11-continued

| Layer | Gas used, & flow rate (sccm) | | μW power (W) | Inner pressure (mTorr) | Substrate temp. (°C.) | Layer thickness (μm) |
|---|---|---|---|---|---|---|
| layer | $CO_2$ | 800 ppm (based on $SiH_4$) | | | | |
| Surface layer | $SiH_4$ | 30 | 1,000 | 10 | 250 | 0.5 |
| | $CH_4$ | 500 | | | | |
| | $CO_2$ | 100 ppm | | | | |
| | $NH_3$ | 10 ppm (based on $SiH_4$) | | | | |
| | $SiF_4$ | 10 | | | | |

TABLE D12

| Layer | Gas used, & flow rate (sccm) | | RF power (W) | Inner pressure (torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 (FIG. 6 pattern) | | | | |
| | $SiF_4$ | (Varied) | | | | |
| | $CO_2$ | (Varied) | | | | |
| Surface layer | $SiH_4$ | 30 | 300 | 0.3 | 250 | 0.5 |
| | $CH_4$ | 500 | | | | |
| | $CO_2$ | 100 | | | | |
| | $NH_3$ | 100 | | | | |
| | $SiF_4$ | 10 | | | | |

TABLE D13

(White Spots)

| Oxygen atom content | Fluorine atom content (atomic ppm) | | | | | | | | | |
|---|---|---|---|---|---|---|---|---|---|---|
| | Example D7 | | | | | | | Comparative Example D7 | | |
| (atomic ppm) | 1 | 5 | 10 | 20 | 30 | 50 | 95 | 100 | 200 | 500 |
| Example D7: | | | | | | | | | | |
| 5 | B | B | B | B | B | B | B | B | B | B |
| 10 | A | A | A | A | A | A | A | A | A | A |
| 50 | A | A | A | A | A | A | A | A | A | A |
| 100 | AA | AA | AA | AA | AA | AA | AA | AA | AA | AA |
| 1,000 | AA | AA | AA | AA | AA | AA | AA | AA | AA | AA |
| 2,000 | AA | AA | AA | AA | AA | AA | AA | AA | AA | AA |
| 5,000 | AA | AA | AA | AA | AA | AA | AA | AA | AA | AA |
| Comparative Example D7: | | | | | | | | | | |
| 6,000 | AA | AA | AA | AA | AA | AA | AA | AA | AA | AA |
| 8,000 | AA | AA | AA | AA | AA | AA | AA | AA | AA | AA |
| 10,000 | AA | AA | AA | AA | AA | AA | AA | AA | AA | AA |

TABLE D14

(Coarse image)

| Oxygen atom content | Fluorine atom content (atomic ppm) | | | | | | | | | |
|---|---|---|---|---|---|---|---|---|---|---|
| | Example D7 | | | | | | | Comparative Example D7 | | |
| (atomic ppm) | 1 | 5 | 10 | 20 | 30 | 50 | 95 | 100 | 200 | 500 |
| Example D7: | | | | | | | | | | |
| 5 | A | A | AA | AA | AA | AA | AA | AA | A | B |
| 10 | AA | A | AA | AA | AA | AA | AA | AA | A | B |
| 50 | AA | A | AA | AA | AA | AA | AA | AA | A | B |
| 100 | AA | A | AA | AA | AA | AA | AA | AA | A | B |
| 1,000 | AA | A | AA | AA | AA | AA | AA | AA | A | B |
| 2,000 | AA | A | AA | AA | AA | AA | AA | AA | A | B |
| 5,000 | AA | A | AA | AA | AA | AA | AA | AA | A | B |
| Comparative Example D7: | | | | | | | | | | |
| 6,000 | A | AA | AA | AA | AA | AA | AA | A | A | B |
| 8,000 | B | AA | AA | AA | AA | A | A | A | A | B |
| 10,000 | B | A | A | A | A | A | A | A | B | B |

TABLE D15

(Ghost)

| Oxygen atom content | Fluorine atom content (atomic ppm) | | | | | | | | | |
|---|---|---|---|---|---|---|---|---|---|---|
| | Example D7 | | | | | | | Comparative Example D7 | | |
| (atomic ppm) | 1 | 5 | 10 | 20 | 30 | 50 | 95 | 100 | 200 | 500 |
| Example D7: | | | | | | | | | | |
| 5 | A | A | AA | AA | AA | AA | A | B | B | B |
| 10 | A | AA | AA | AA | AA | AA | A | B | B | B |
| 50 | A | AA | AA | AA | AA | AA | A | B | B | B |
| 100 | A | AA | AA | AA | AA | AA | A | B | B | B |
| 1,000 | A | AA | AA | AA | AA | AA | A | B | B | B |
| 2,000 | A | AA | AA | AA | AA | AA | A | B | B | B |

TABLE D15-continued (Ghost)

| Oxygen atom content | Fluorine atom content (atomic ppm) | | | | | | | | | |
|---|---|---|---|---|---|---|---|---|---|---|
| | Example D7 | | | | | | | Comparative Example D7 | | |
| (atomic ppm) | 1 | 5 | 10 | 20 | 30 | 50 | 95 | 100 | 200 | 500 |
| 5,000 | A | AA | AA | AA | AA | A | B | B | B | B |
| Comparative Example D7: | | | | | | | | | | |
| 6,000 | A | A | A | A | A | A | B | B | B | B |
| 8,000 | B | A | A | A | A | B | B | B | B | B |
| 10,000 | B | B | B | B | B | B | B | B | B | B |

TABLE D16

(Sensitivity)

| Oxygen atom content | Fluorine atom content (atomic ppm) | | | | | | | | | |
|---|---|---|---|---|---|---|---|---|---|---|
| | Example D7 | | | | | | | Comparative Example D7 | | |
| (atomic ppm) | 1 | 5 | 10 | 20 | 30 | 50 | 95 | 100 | 200 | 500 |
| Example D7: | | | | | | | | | | |
| 5 | AA | AA | AA | AA | AA | AA | AA | A | A | A |
| 10 | AA | AA | AA | AA | AA | AA | AA | A | A | A |
| 50 | AA | AA | AA | AA | AA | AA | AA | A | A | A |
| 100 | AA | AA | AA | AA | AA | AA | AA | A | A | A |
| 1,000 | AA | AA | AA | AA | AA | AA | AA | A | A | B |
| 2,000 | AA | AA | AA | AA | AA | AA | AA | A | B | B |
| 5,000 | AA | AA | AA | AA | AA | AA | A | A | B | B |
| Comparative Example D7: | | | | | | | | | | |
| 6,000 | B | B | B | B | B | B | B | B | B | B |
| 8,000 | B | B | B | B | B | B | B | B | B | B |
| 10,000 | C | C | C | C | C | C | C | C | C | C |

TABLE D17

(Potential shift)

| Oxygen atom content | Fluorine atom content (atomic ppm) | | | | | | | | | |
|---|---|---|---|---|---|---|---|---|---|---|
| | Example D7 | | | | | | | Comparative Example D7 | | |
| (atomic ppm) | 1 | 5 | 10 | 20 | 30 | 50 | 95 | 100 | 200 | 500 |
| Example D7: | | | | | | | | | | |
| 5 | B | B | B | B | B | B | B | B | B | B |
| 10 | A | A | A | A | A | A | A | A | A | A |
| 50 | A | AA | AA | AA | AA | AA | AA | AA | A | A |
| 100 | A | AA | AA | AA | AA | AA | AA | AA | A | A |
| 1,000 | A | AA | AA | AA | AA | AA | AA | AA | A | A |
| 2,000 | A | AA | AA | AA | AA | AA | AA | A | A | A |
| 5,000 | A | AA | AA | AA | AA | A | A | A | A | A |
| Comparative Example D7: | | | | | | | | | | |
| 6,000 | A | A | A | A | A | A | A | A | A | B |
| 8,000 | A | A | A | A | A | A | A | A | B | B |
| 10,000 | A | B | B | B | B | B | B | B | B | B |

TABLE D18

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 150 → 0 (FIG. 8 pattern) | | | | |
| | $SiF_4$ | (Varied) | | | | |
| | $CO_2$ | (Varied) | | | | |
| Surface layer | $SiH_4$ | 30 | 1,000 | 10 | 250 | 0.5 |
| | $CH_4$ | 500 | | | | |
| | $CO_2$ | 100 | | | | |
| | $NH_3$ | 100 | | | | |
| | $SiF_4$ | 10 | | | | |

TABLE D19

| Layer | Gas used, & flow rate (sccm) | | RF power (W) | Inner pressure (torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 (FIG. 8 pattern) | | | | |
| | $SiF_4$ | 30 ppm | | | | |
| | $CO_2$ | 800 ppm (based on $SiH_4$) | | | | |
| Surface layer | $SiH_4$ | 30 | Varied | 0.3 | 250 | 0.5 |
| | $CH_4$ | (Varied) | | | | |
| | $CO_2$ | (Varied) | | | | |
| | $NH_3$ | (Varied) | | | | |
| | $SiF_4$ | 10 | | | | |
| | $H_2$ | 100 | | | | |

TABLE D20

| | Example D9 | | | | | |
|---|---|---|---|---|---|---|
| a) Carbon content: (at. %) | 10 | 30 | 60 | 60 | 60 | 70 |
| b) Oxygen content: (at. %) | 20 | 5 | 3 | 8 | $5 \times 10^{-3}$ | 4 |
| c) Nitrogen content: (at. %) | 20 | 8 | 5 | 15 | $2 \times 10^{-4}$ | 5 |
| Total of b) & c): (at. %) | 40 | 13 | 8 | 23 | about $5 \times 10^{-3}$ | 9 |
| Total of a), b) & c): (at. %) | 50 | 43 | 68 | 83 | about 60 | 79 |
| Chargeability: | A | A | A | A | A | A |
| Sensitivity: | A | A | A | A | A | A |
| Residual potential: | A | A | A | A | A | A |
| Smeared image: | A | AA | AA | A | AA | AA |
| Image evaluation before running: | A | A | AA | A | AA | AA |
| Image evaluation after running: | A | A | AA | A | AA | AA |
| Overall evaluation: | A | A | AA | A | AA | AA |

| | Example D9 (cont'd) | | | | |
|---|---|---|---|---|---|
| a) Carbon content: | 70 | 70 | 70 | 70 | 80 |
| b) Oxygen content: (at. %) | 6 | $1 \times 10^{-3}$ | 12 | $5 \times 10^{-3}$ | 3 |

TABLE D20-continued

| | | | | | |
|---|---|---|---|---|---|
| c) Nitrogen content: (at. %) | 9 | 3 | $1 \times 10^{-3}$ | $2 \times 10^{-4}$ | 5 |
| Total of b) & c): (at. %) | 15 | about 3 | about 12 | about $5 \times 10^{-3}$ | 8 |
| Total of a), b) & c): (at. %) | 85 | about 73 | about 82 | about 70 | 88 |
| Chargeability: | A | A | A | A | A |
| Sensitivity: | A | A | A | A | A |
| Residual potential: | A | A | A | A | A |
| Smeared image: | AA | AA | AA | AA | AA |
| Image evaluation before running: | A | AA | A | AA | AA |
| Image evaluation after running: | A | AA | A | AA | AA |
| Overall evaluation: | A | AA | A | AA | AA |

| | Comparative Example | | | | | | | |
|---|---|---|---|---|---|---|---|---|
| | | | D9 | | | D10 | D11 | D12 |
| a) Carbon content: (at. %) | 10 | 10 | 30 | 30 | 60 | 0 | 50 | 50 |
| b) Oxygen content: (at. %) | 12 | 40 | 2 | 35 | 18 | 40 | 0 | 10 |
| c) Nitrogen content: (at. %) | 10 | 45 | 3 | 30 | 15 | 20 | 10 | 0 |
| Total of b) & c): (at. %) | 22 | 85 | | 65 | 33 | 60 | 60 | 60 |
| Total of a), b) & c): (at. %) | 32 | 95 | 35 | 95 | 93 | 60 | 60 | 60 |
| Chargeability: | B | A | A | A | A | A | A | A |
| Sensitivity: | B | A | A | A | A | B | A | A |
| Residual potential: | A | A | A | A | A | B | B | B |
| Smeared image: | A | A | AA | A | A | A | A | A |
| Image evaluation before running: | B | A | B | A | A | A | A | A |
| Image evaluation after running: | B | B | B | B | B | B | B | B |
| Overall evaluation: | B | B | B | B | B | B | B | B |

TABLE D21

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 150 → 0 (FIG. 8 pattern) | | | | |
| | $SiF_4$ | 30 ppm (based on $SiH_4$) | | | | |
| | $CO_2$ | 800 ppm (based on $SiH_4$) | | | | |
| Surface | $SiH_4$ | 30 | Varied | 10 | 250 | 0.5 |
| | $CH_4$ | (Varied) | | | | |
| | $CO_2$ | (Varied) | | | | |
| | $NH_3$ | (Varied) | | | | |
| | $SiF_4$ | 10 | | | | |
| | $H_2$ | 100 | | | | |

TABLE D22

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 (FIG. 8 pattern) | | | | |
| | $SiF_4$ | 30 ppm (based on $SiH_4$) | | | | |
| | $CO_2$ | 800 ppm (based on $SiH_4$) | | | | |
| Surface layer | $SiH_4$ | 30 | Varied | 0.3 | 250 | 0.5 |
| | $CH_4$ | 500 | | | | |
| | $CO_2$ | 100 | | | | |
| | $NH_3$ | 100 | | | | |
| | $SiF_4$ | (Varied) | | | | |
| | $H_2$ | (Varied) | | | | |

TABLE D23

| | Example D11 | | | | | | | | Cp.* D17 | |
|---|---|---|---|---|---|---|---|---|---|---|
| a) Hydrogen content: (at. %) | 21 | 30 | 30 | 30 | 48 | 48 | 61 | 61 | 11 | 53 |
| b) Fluorine content: (at. %) | 15 | 3 | 9 | 18 | 3 | 19 | 3 | 8 | 18 | 18 |
| Total of a) & b): (at. %) | 36 | 33 | 39 | 48 | 51 | 67 | 64 | 69 | 29 | 71 |
| Sensitivity: | A | A | A | A | A | A | A | A | B | B |
| Residual potential: | A | A | A | A | A | A | A | A | B | B |
| Smeared image: | AA | AA | AA | AA | AA | AA | AA | AA | AA | AA |
| Overall evaluation: | AA | AA | AA | AA | AA | AA | AA | AA | B | B |

| | Cp.* D17 | | Cp* D18 | | | | Cp* D19 | | | |
|---|---|---|---|---|---|---|---|---|---|---|
| a) Hydrogen content: (at. %) | 61 | 70 | 11 | 21 | 30 | 48 | 30 | 48 | 70 | 76 |
| b) Fluorine content: (at. %) | 12 | 4 | 24 | 23 | 23 | 21 | 0 | 0 | 0 | 0 |
| Total of a) & b): (at. %) | 73 | 74 | 35 | 44 | 53 | 69 | 30 | 48 | 70 | 76 |
| Sensitivity: | B | B | A | A | A | A | A | A | A | B |
| Residual potential: | B | A | B | B | B | B | A | A | A | B |
| Smeared image: | AA | AA | AA | AA | AA | AA | A | A | A | A |
| Overall evaluation: | B | B | B | B | B | B | A | A | A | B |

*Comparative Example

TABLE D24

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 150 → 0 (FIG. 8 pattern) | | | | |
| | $SiF_4$ | 30 ppm | | | | |
| | $CO_2$ | 800 ppm (based on $SiH_4$) | | | | |
| Surface layer | $SiH_4$ | 30 | Varied | 10 | 250 | 0.5 |
| | $CH_4$ | 500 | | | | |
| | $CO_2$ | 100 | | | | |
| | $NH_3$ | 100 | | | | |

TABLE D24-continued

| Layer | Gas used, & flow rate (sccm) | | μW power (W) | Inner pressure (mTorr) | Substrate temp. (°C.) | Layer thickness (μm) |
|---|---|---|---|---|---|---|
| | $SiF_4$ | (Varied) | | | | |
| | $H_2$ | (Varied) | | | | |

TABLE D25

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 (FIG. 8 pattern) | | | | |
| | $B_2H_6$ | (Table D26) | | | | |
| | $SiF_4$ | 30 ppm | | | | |
| | $CO_2$ | 800 ppm (based on $SiH_4$) | | | | |
| Surface layer | $SiH_4$ | 30 | 300 | 0.3 | 250 | 0.5 |
| | $CH_4$ | 500 | | | | |
| | $CO_2$ | 50 ppm | | | | |
| | $NH_3$ | 3 ppm (based on $SiH_4$) | | | | |

TABLE D25-continued

| Layer | Gas used, & flow rate (sccm) | RF power (W) | Inner pressure (Torr) | Substrate temp. (°C.) | Layer thickness (μm) |
|---|---|---|---|---|---|
| | $SiF_4$ 10<br>$H_2$ 100 | | | | |

TABLE D26

| Pattern of Boron Atom Content | |
|---|---|
| Pattern | $B_2H_6$ content in photoconductive layer |
| Comparative Example D23: | |
| a | 0 |
| Example D13: | |
| b | 10 |
| c | 20 → 1 (Linearly changed) |
| d | 20 → 0.5 (Linearly changed) |

TABLE D27

| Pattern | Chargeability | Sensitivity | Residual potential | Overall evaluation |
|---|---|---|---|---|
| Comparative Example D23: | | | | |
| a | AA | A | AA | A |
| Example D13: | | | | |
| b | AA | AA | AA | AA |
| c | AA | AA | AA | AA |
| d | AA | AA | AA | AA |

TABLE D28

| Layer | Gas used, & flow rate (sccm) | μW power (W) | Inner pressure (mTorr) | Substrate temp. (°C.) | Layer thickness (μm) |
|---|---|---|---|---|---|
| Photoconductive layer | $SiH_4$ 500<br>$CH_4$ 150 → 0 (FIG. 8 pattern)<br>$B_2H_6$ (Table D26)<br>$SiF_4$ 30 ppm<br>$CO_2$ 800 ppm (based on $SiH_4$) | 1,000 | 10 | 250 | 17 |
| Surface layer | $SiH_4$ 30<br>$CH_4$ 500<br>$CO_2$ 50 ppm<br>$NH_3$ 3 ppm (based on $SiH_4$)<br>$SiF_4$ 10<br>$H_2$ 100 | 1,000 | 10 | 250 | 0.5 |

TABLE E1

| Layer | Gas used, & flow rate (sccm) | RF power (W) | Inner pressure (Torr) | Substrate temp. (°C.) | Layer thickness (μm) |
|---|---|---|---|---|---|
| Photoconductive layer | $SiH_4$ 500<br>$CH_4$ 350 → 0 (FIG. 8 pattern)<br>$SiF_4$ 50 → 80 ppm (based on $SiH_4$) | 500 | 0.5 | 250 | 20 |
| Surface layer | $SiH_4$ 30<br>$CH_4$ 500 | 300 | 0.3 | 250 | 0.5 |

TABLE E1-continued

| Layer | Gas used, & flow rate (sccm) | RF power (W) | Inner pressure (Torr) | Substrate temp. (°C.) | Layer thickness (μm) |
|---|---|---|---|---|---|
| | NO 100<br>$NH_3$ 100<br>$SiF_4$ 10<br>$H_2$ 100 | | | | |

TABLE E2

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 350<br>$SiF_4$ 50 → 80 ppm (based on $SiH_4$) | 500 | 0.5 | 250 | 17 |
| Second photoconductive layer | $SiH_4$ 500 | 500 | 0.5 | 250 | 3 |
| Surface layer | $SiH_4$ 30<br>$CH_4$ 500<br>NO 100<br>$NH_3$ 100<br>$SiF_4$ 10<br>$H_2$ 100 | 300 | 0.3 250 | 0.5 | |

TABLE E3

| Chargeability | Sensitivity | Residual potential |
|---|---|---|
| Example E1: | | |
| AA | AA | AA |
| Comparative Example E1: | | |
| A | B | B |

TABLE E4

| Layer | Gas used, & flow rate (sccm) | RF power (W) | Inner pressure (Torr) | Substrate temp. (°C.) | Layer thickness (μm) |
|---|---|---|---|---|---|
| Photoconductive layer | $SiH_4$ 500<br>$CH_4$ 250 → 0 (FIG. 8 pattern)<br>$SiF_4$ 50 → 80 ppm (based on $SiH_4$) | 1,000 | 10 | 250 | 20 |
| Surface layer | $SiH_4$ 30<br>$CH_4$ 500<br>NO 100<br>$NH_3$ 100<br>$SiF_4$ 10<br>$H_2$ 100 | 1,000 | 10 | 250 | 0.5 |

TABLE E5

| Layer | Gas used, & flow rate (sccm) | μW power (W) | Inner pressure (mtorr) | Substrate temp. (°C.) | Layer thickness (μm) |
|---|---|---|---|---|---|
| First Photo- | $SiH_4$ 500<br>$CH_4$ 250 | 1,000 | 10 | 250 | 17 |

TABLE E5-continued

| Layer | Gas used, & flow rate (sccm) | | μW power (W) | Inner pressure (mtorr) | Substrate temp. (°C.) | Layer thickness (μm) |
|---|---|---|---|---|---|---|
| conductive layer | $SiF_4$ | 50 → 80 ppm (based on $SiH_4$) | | | | |
| Second photoconductive layer | $SiH_4$ | 500 | 1,000 | 10 | 250 | 3 |
| Surface layer | $SiH_4$ | 30 | 1,000 | 10 | 250 | 0.5 |
| | $CH_4$ | 500 | | | | |
| | NO | 100 | | | | |
| | $NH_3$ | 100 | | | | |
| | $SiF_4$ | 10 | | | | |
| | $H_2$ | 100 | | | | |

TABLE E6

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | (Varied) | | | | |
| | $SiF_4$ | 50 → 80 ppm (based on $SiH_4$) | | | | |
| Surface layer | $SiH_4$ | 30 | 300 | 0.3 | 250 | 0.5 |
| | $CH_4$ | 500 | | | | |
| | NO | 100 | | | | |
| | $NH_3$ | 100 | | | | |
| | $SiF_4$ | 10 | | | | |
| | $H_2$ | 100 | | | | |

TABLE E7

| Pattern of carbon atom content | Chargeability | Sensitivity | Residual potential |
|---|---|---|---|
| Example E3: | | | |
| FIG. 8 | AA | AA | AA |
| FIG. 9 | AA | AA | AA |
| FIG. 10 | AA | AA | AA |
| Comparative Example E3: | | | |
| FIG. 11 | A | B | B |
| FIG. 12 | AA | B | B |

TABLE E8

| Layer | Gas used, & flow rate (sccm) | | μW power (W) | Inner pressure (Torr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | (Varied) | | | | |
| | $SiF_4$ | 50 → 80 ppm (based on $SiH_4$) | | | | |
| Surface layer | $SiH_4$ | 30 | 1,000 | 10 | 250 | 0.5 |
| | $CH_4$ | 500 | | | | |
| | NO | 100 | | | | |
| | $NH_3$ | 100 | | | | |
| | $SiF_4$ | 10 | | | | |
| | $H_2$ | 100 | | | | |

TABLE E9

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | Varied → 0 (FIG. 8 pattern) | | | | |
| | $SiF_4$ | 50 → 80 ppm (based on $SiH_4$) | | | | |
| Surface layer | $SiH_4$ | 30 | 300 | 0.3 | 250 | 0.5 |
| | $CH_4$ | 500 | | | | |
| | NO | 100 | | | | |
| | $NH_3$ | 100 | | | | |
| | $SiF_4$ | 10 | | | | |
| | $H_2$ | 100 | | | | |

TABLE E10

| Carbon atom content | Chargeability | Sensitivity | Residual potential | White spots | (1) | (2) | (3) | (4) |
|---|---|---|---|---|---|---|---|---|
| Comparative Example E5: | | | | | | | | |
| 70 | AA | B | A | AA | AA | B | AA | B |
| 60 | AA | B | A | AA | AA | A | AA | B |
| Example E5: | | | | | | | | |
| 50 | AA | A | A | AA | AA | AA | AA | A |
| 40 | AA | AA | A | AA | AA | AA | AA | A |

TABLE E10-continued

| Carbon atom content | Charge-ability | Sensitivity | Residual potential | White spots | (1) | (2) | (3) | (4) |
|---|---|---|---|---|---|---|---|---|
| 30 | AA | AA | AA | AA | AA | AA | AA | AA |
| 20 | AA | AA | AA | AA | AA | AA | AA | AA |
| 10 | AA | AA | AA | AA | AA | AA | AA | AA |
| 5 | AA | AA | AA | AA | AA | AA | AA | AA |
| 1 | AA | AA | AA | AA | AA | AA | AA | AA |
| 0.5 | A | AA | AA | AA | AA | AA | A | A |
| Comparative Example E5: | | | | | | | | |
| 0.3 | B | AA | AA | B | A | AA | B | B |

(1): Coarse image
(2): Ghost
(3): Spherical protuberances
(4): Overall evaluation

TABLE E11

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | Varied → 0 (FIG. 8 pattern) | | | | |
| | $SiF_4$ | 50 → 80 ppm (based on $SiH_4$) | | | | |
| Surface layer | $SiH_4$ | 30 | 1,000 | 10 | 250 | 0.5 |
| | $CH_4$ | 500 | | | | |
| | NO | 100 | | | | |
| | $NH_3$ | 100 | | | | |
| | $SiF_4$ | 10 | | | | |
| | $H_2$ | 100 | | | | |

TABLE E12

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 (FIG. 8 pattern) | | | | |
| | $SiF_4$ | (Varied) | | | | |
| | $B_2H_6$ | 30 → 2 ppm (based on $SiH_4$) | | | | |
| Surface layer | $SiH_4$ | 30 | 300 | 0.3 | 250 | 0.5 |
| | $CH_4$ | 500 | | | | |
| | NO | 100 | | | | |
| | $NH_3$ | 100 | | | | |
| | $SiF_4$ | 10 | | | | |
| | $H_2$ | 100 | | | | |

TABLE E13

Figure 13:
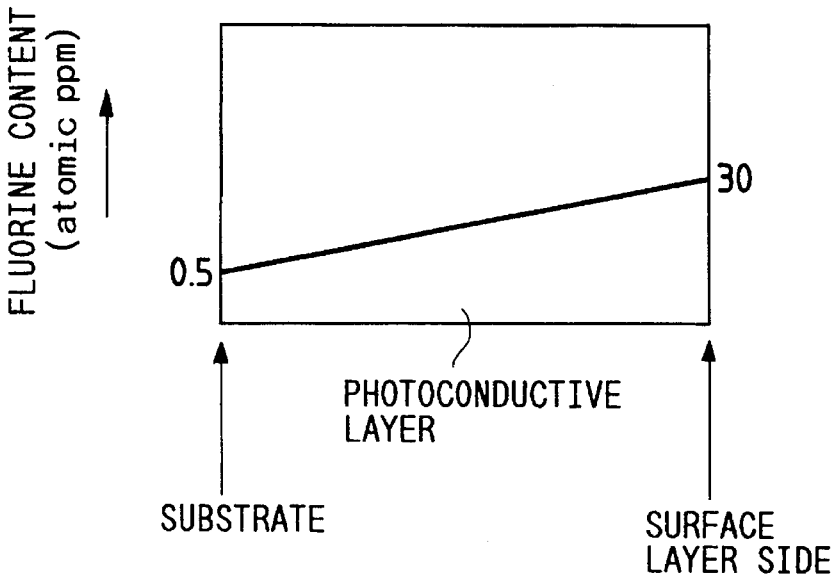
FIGS. 13 to 27 are respectively schematic distribution diagrams for illustrating fluorine distribution in a layer thickness direction in a photoconductive layer (or a first photoconductive layer) of a light-receiving member.
Figure 14:
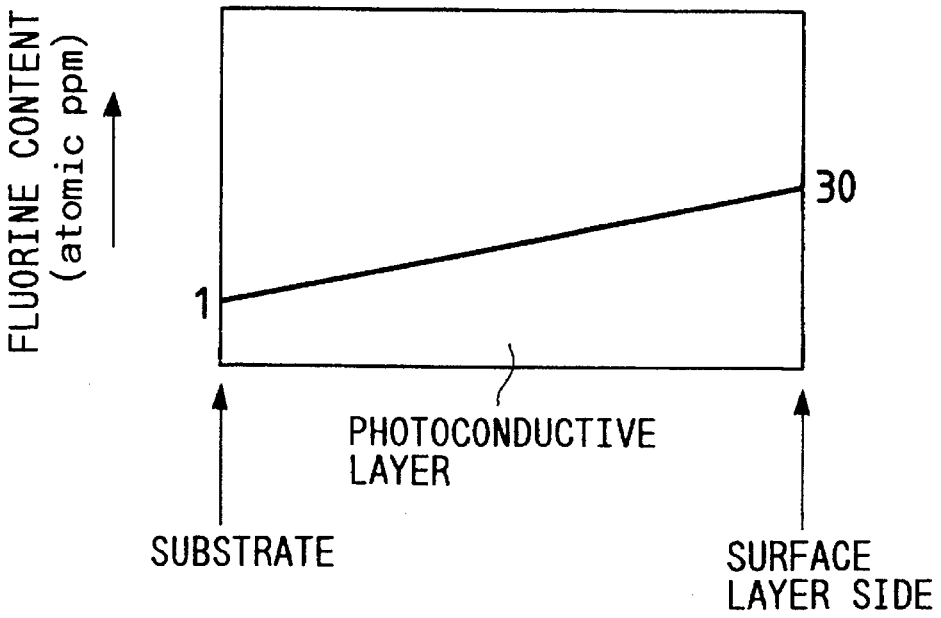
Figure 15:
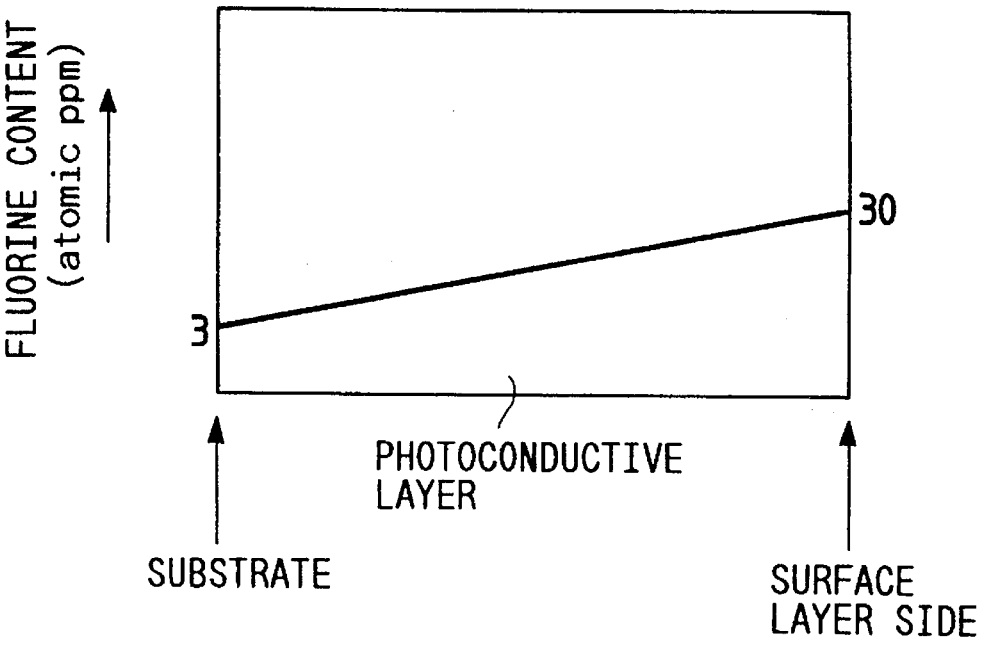
Figure 16:
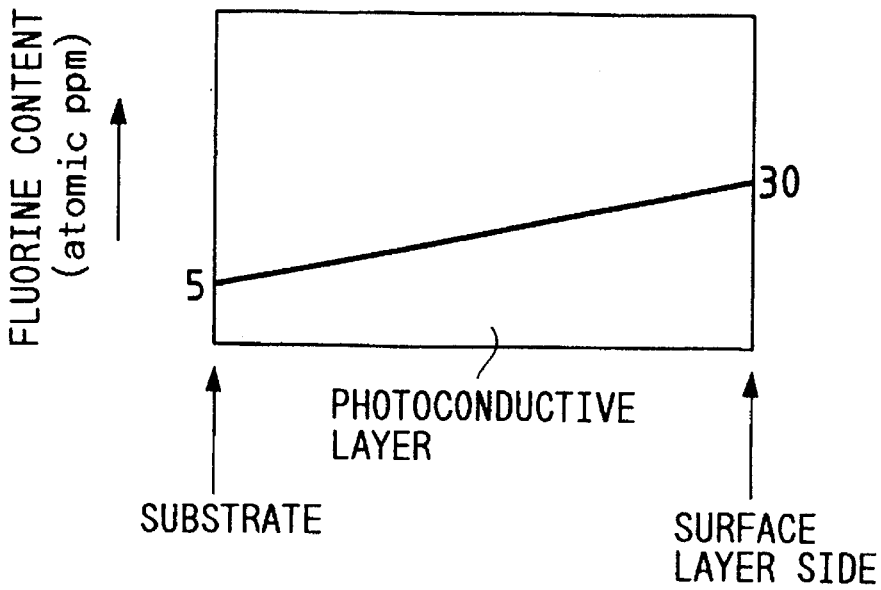
Figure 17:
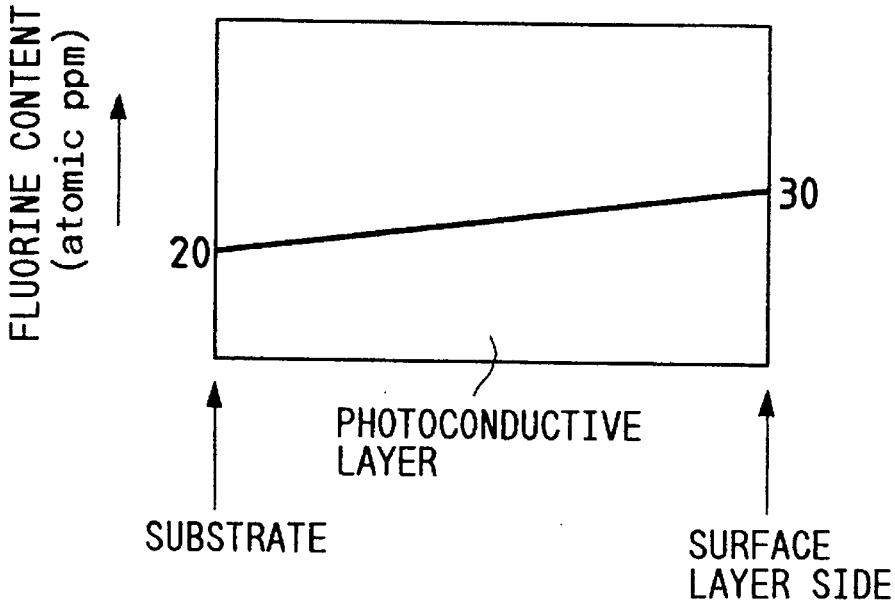
Figure 18:
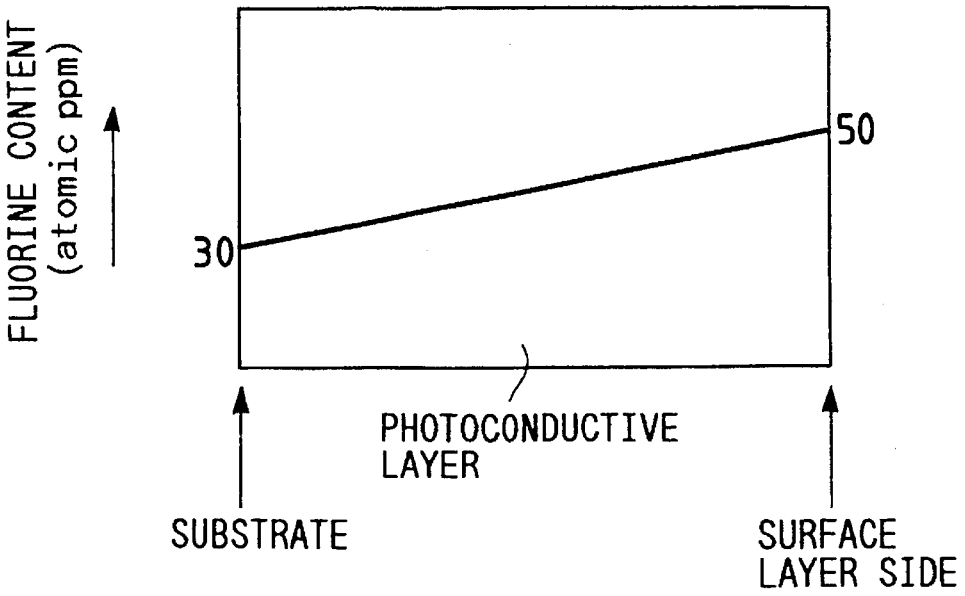
Figure 19:
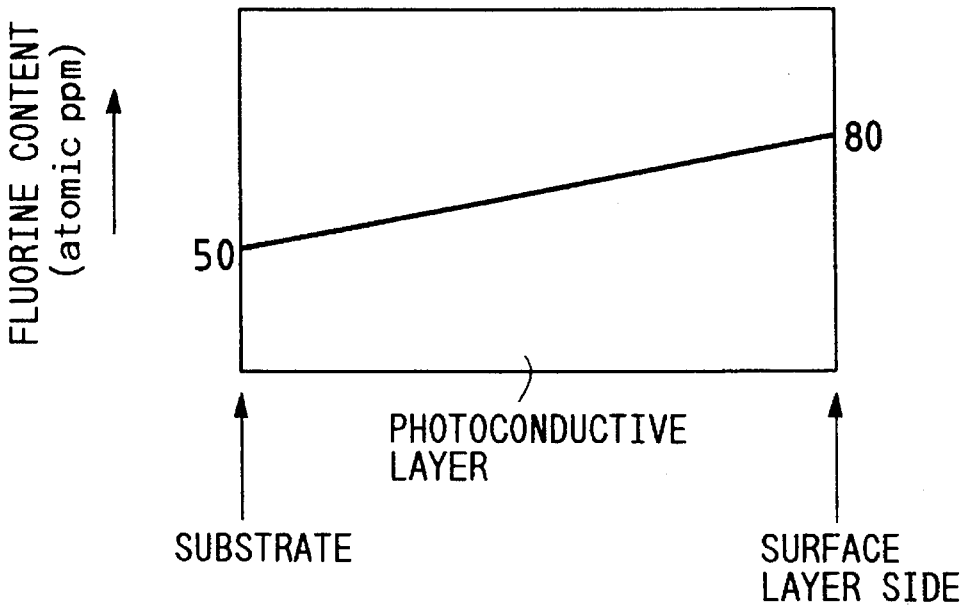
Figure 20:
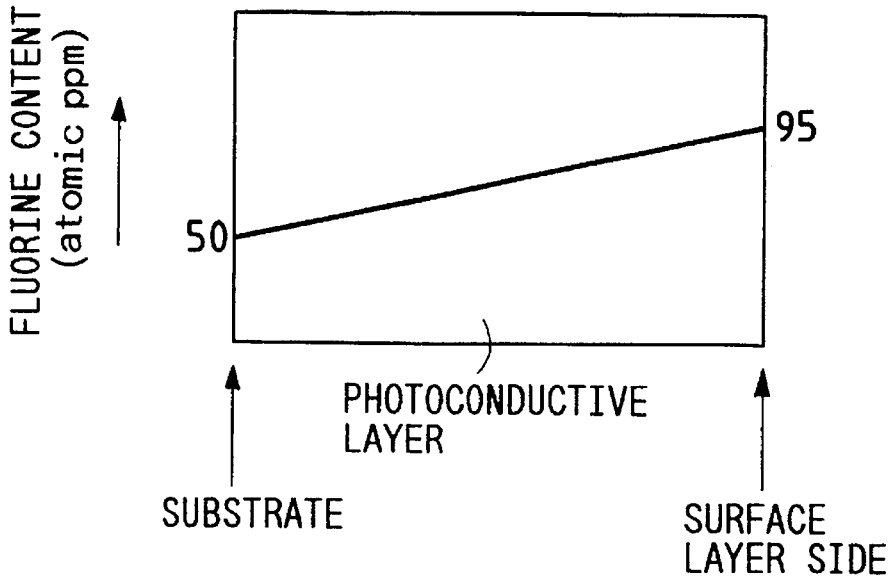

| Fluorine atom content | (before running) White spots | Coarse image | Ghost | Overall evaluation |
|---|---|---|---|---|
| Example E7: | | | | |
| FIG. 13 | AA | AA | AA | AA |
| FIG. 14 | AA | AA | AA | AA |
| FIG. 15 | AA | AA | AA | AA |
| FIG. 16 | AA | AA | AA | AA |
| FIG. 17 | AA | AA | AA | AA |
| FIG. 18 | AA | AA | AA | AA |
| FIG. 19 | AA | AA | AA | AA |
| FIG. 20 | AA | AA | AA | AA |

TABLE E13-continued

| Fluorine atom content | (before running) White spots | Coarse image | Ghost | Overall evaluation |
|---|---|---|---|---|
| Comparative Example E7: | | | | |
| FIG. 21 | AA | AA | B | B |
| FIG. 22 | AA | AA | B | B |

TABLE E14

| Fluorine atom content | (before running) White spots | Coarse image | Ghost | Overall evaluation |
|---|---|---|---|---|
| Example E7: | | | | |
| FIG. 13 | AA | AA | AA | AA |
| FIG. 14 | AA | AA | AA | AA |
| FIG. 15 | AA | AA | AA | AA |
| FIG. 16 | AA | AA | AA | AA |
| FIG. 17 | AA | AA | AA | AA |
| FIG. 18 | AA | AA | AA | AA |
| FIG. 19 | AA | AA | AA | AA |
| FIG. 20 | AA | AA | AA | AA |
| Comparative Example E7: | | | | |
| FIG. 21 | AA | A | B | B |
| FIG. 22 | AA | B | B | B |

TABLE E15

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 150 → 0 (FIG. 8 pattern) | | | | |
| | $SiF_4$ | (Varied) | | | | |
| | $B_2H_6$ | 30 → 2 ppm (based on $SiH_4$) | | | | |
| Surface | $SiH_4$ | 30 | 1,000 | 10 | 250 | 0.5 |

TABLE E15-continued

| Layer | Gas used, & flow rate (sccm) | | μW power (W) | Inner pressure (mTorr) | Substrate temp. (°C.) | Layer thickness (μm) |
|---|---|---|---|---|---|---|
| layer | $CH_4$ | 500 | | | | |
| | NO | 100 | | | | |
| | $NH_3$ | 100 | | | | |
| | $SiF_4$ | 10 | | | | |
| | $H_2$ | 100 | | | | |

TABLE E16

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 (FIG. 8 pattern) | | | | |
| | $SiF_4$ | (Varied) | | | | |
| | $B_2H_6$ | 30 → 2 ppm (based on $SiH_4$) | | | | |
| Surface layer | $SiH_4$ | 30 | 300 | 0.3 | 250 | 0.5 |
| | $CH_4$ | 500 | | | | |
| | NO | 100 | | | | |
| | $NH_3$ | 100 | | | | |
| | $SiF_4$ | 10 | | | | |
| | $H_2$ | 100 | | | | |

TABLE E17

Figure 23:
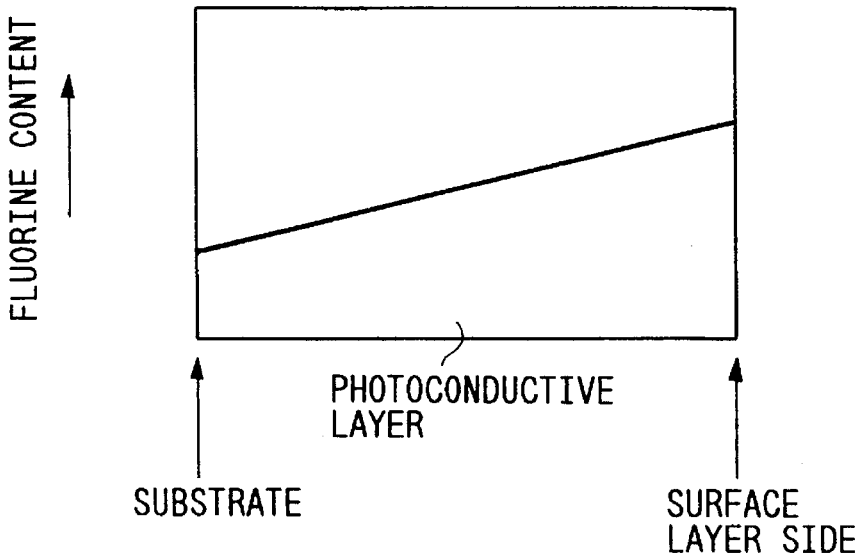
Figure 24:
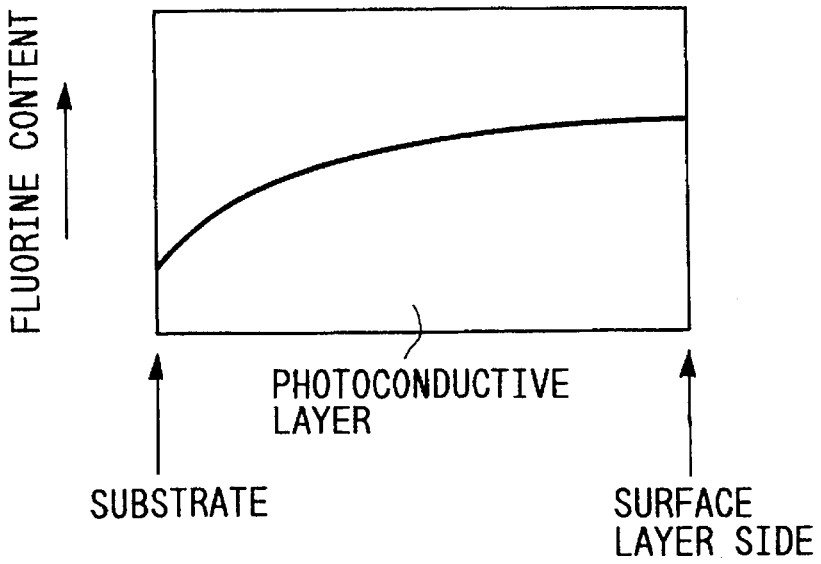
Figure 25:
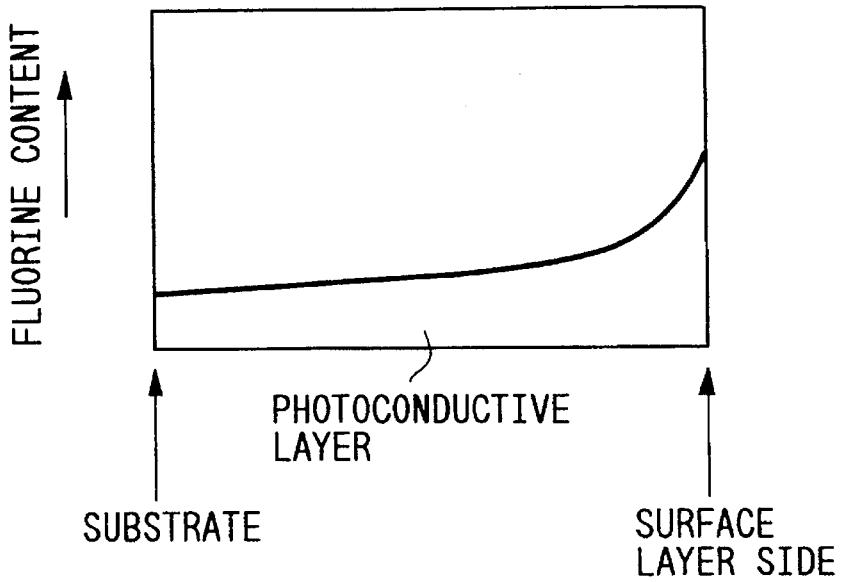
Figure 26:
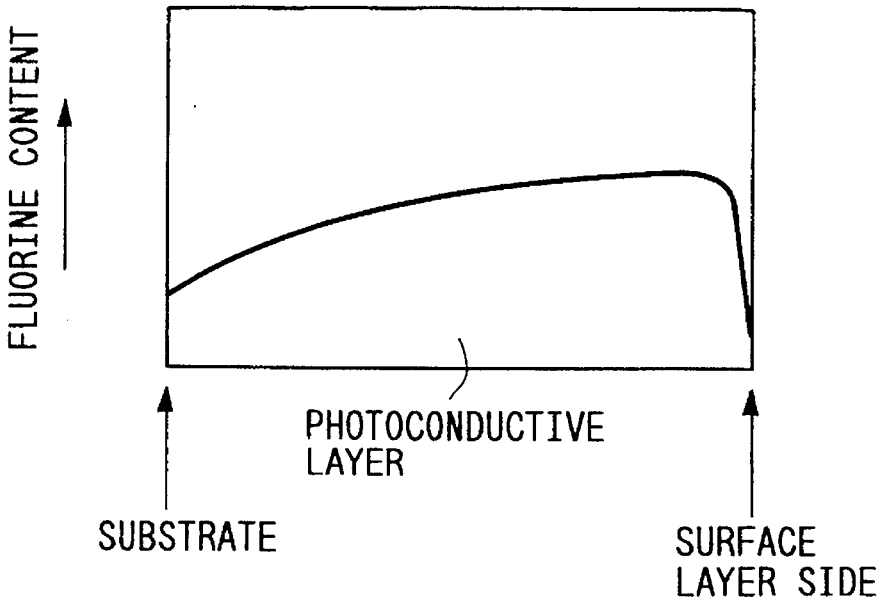

| Pattern of Fluorine atom content | (before running) White spots | Coarse image | Ghost | (1) | (2) | (3) | (4) |
|---|---|---|---|---|---|---|---|
| Example E9: | | | | | | | |
| FIG. 23 | AA | AA | AA | AA | AA | AA | AA |
| FIG. 24 | AA | AA | AA | AA | AA | AA | AA |
| FIG. 25 | AA | AA | AA | AA | AA | AA | AA |
| FIG. 26 | AA | AA | AA | AA | AA | AA | AA |
| Comparative Example E9: | | | | | | | |
| FIG. 27 | AA | AA | AA | A | AA | A | A |

(1): Temperature characteristics
(2): Chargeability
(3): Uneven image density
(4): Overall evaluation

TABLE E18

| Pattern of Fluorine atom content | (after running) White spots | Coarse image | Ghost | (1) | (2) | (3) | (4) |
|---|---|---|---|---|---|---|---|
| Example E9: | | | | | | | |
| FIG. 23 | AA | AA | AA | AA | AA | AA | AA |
| FIG. 24 | AA | AA | AA | AA | AA | AA | AA |
| FIG. 25 | AA | AA | AA | AA | AA | AA | AA |
| FIG. 26 | AA | AA | AA | AA | AA | AA | AA |
| Comparative Example E9: | | | | | | | |
| FIG. 27 | AA | AA | AA | B | AA | B | B |

(1): Temperature characteristics

TABLE E18-continued

| Pattern of Fluorine atom content | (after running) White spots | Coarse image | Ghost | (1) | (2) | (3) | (4) |
|---|---|---|---|---|---|---|---|

(2): Chargeability
(3): Uneven image density
(4): Overall evaluation

TABLE E19

| Layer | Gas used, & flow rate (sccm) | | μW power (W) | Inner pressure (mTorr) | Substrate temp. (°C.) | Layer thickness (μm) |
|---|---|---|---|---|---|---|
| First conductive layer | $SiH_4$ | 500 | 1,000 | 10 | 250 | 20 |
| | $CH_4$ | 150 → 0 (FIG. 8 pattern) | | | | |
| | $B_2H_6$ | 30 → 2 ppm (based on $SiH_4$) | | | | |
| Surface layer | $SiH_4$ | 30 | 1,000 | 10 | 250 | 0.5 |
| | $CH_4$ | 500 | | | | |
| | NO | 100 | | | | |
| | $NH_3$ | 100 | | | | |
| | $SiF_4$ | 10 | | | | |
| | $H_2$ | 100 | | | | |

TABLE E20

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 (FIG. 8 pattern) | | | | |
| | $SiF_4$ | 50 → 80 ppm (based on $SiH_4$) | | | | |
| | $CO_2$ | (Varied) | | | | |
| | $B_2H_6$ | 40 → 3 ppm (based on $SiH_4$) | | | | |
| Surface layer | $SiH_4$ | 30 | 300 | 0.3 | 250 | 0.5 |
| | $CH_4$ | 500 | | | | |
| | NO | 100 | | | | |
| | $NH_3$ | 100 | | | | |
| | $SiF_4$ | 10 | | | | |
| | $H_2$ | 100 | | | | |

TABLE E21

| Oxygen content (at. ppm) | Chargeability | Sensitivity | Residual potential | Potential shift | Overall evaluation |
|---|---|---|---|---|---|
| Comparative Example E11: | | | | | |
| 5 | AA | AA | AA | A | A |
| 7 | AA | AA | AA | A | A |
| Example E11: | | | | | |
| 10 | AA | AA | AA | AA | AA |
| 50 | AA | AA | AA | AA | AA |
| 100 | AA | AA | AA | AA | AA |
| 250 | AA | AA | AA | AA | AA |
| 500 | AA | AA | AA | AA | AA |
| 1,000 | AA | AA | AA | AA | AA |
| 3,000 | AA | AA | AA | AA | AA |
| 5,000 | AA | AA | AA | AA | AA |
| Comparative Example E11: | | | | | |
| 5,550 | AA | A | B | AA | B |
| 6,000 | AA | B | B | AA | B |

TABLE E21-continued

| Oxygen content (at. ppm) | Chargeability | Sensitivity | Residual potential | Potential shift | Overall evaluation |
|---|---|---|---|---|---|
| 8,000 | AA | B | B | AA | B |

TABLE E22

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 150 → 0 (FIG. 8 pattern) | | | | |
| | $SiF_4$ | 50 → 2 ppm (based on $SiH_4$) | | | | |
| | $CO_2$ | (Varied) | | | | |
| | $B_2H_6$ | 40 → 3 ppm (based on $SiH_4$) | | | | |
| Surface layer | $SiH_4$ | 30 | 1,000 | 10 | 250 | 0.5 |
| | $CH_4$ | 500 | | | | |
| | NO | 100 | | | | |
| | $NH_3$ | 100 | | | | |
| | $SiF_4$ | 10 | | | | |
| | $H_2$ | 100 | | | | |

TABLE E23

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 (FIG. 8 pattern) | | | | |
| | $SiF_4$ | 50 → 80 ppm (based on $SiH_4$) | | | | |
| | $CO_2$ | (Varied) | | | | |
| | $B_2H_6$ | 40 → 3 ppm (based on $SiH_4$) | | | | |
| Surface layer | $SiH_4$ | 35 | 300 | 0.3 | 250 | 0.5 |
| | $CH_4$ | 500 | | | | |
| | NO | 100 | | | | |
| | $NH_3$ | 100 | | | | |
| | $SiF_4$ | 10 | | | | |
| | $H_2$ | 100 | | | | |

TABLE E24

Figure 29:
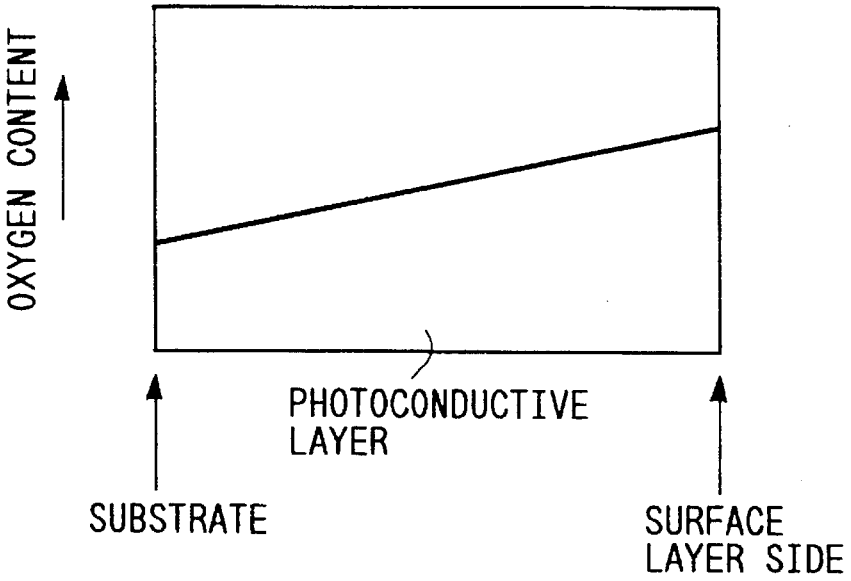
Figure 30:
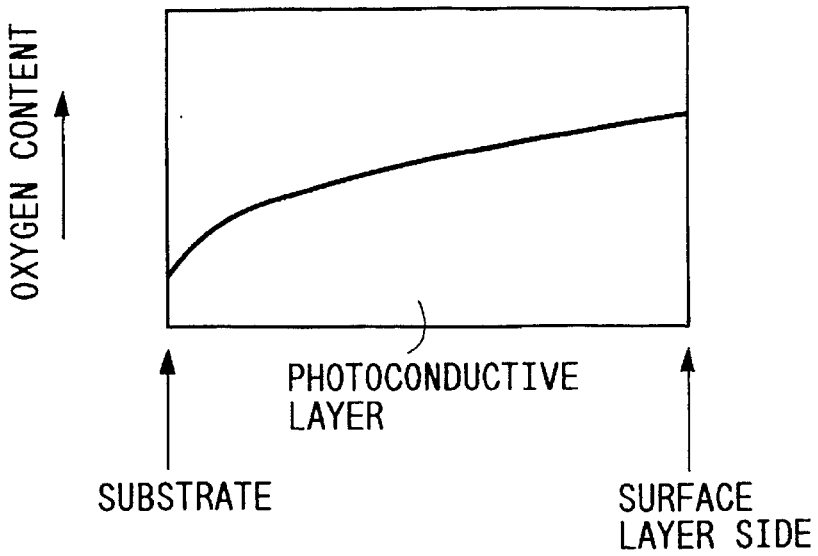
Figure 31:
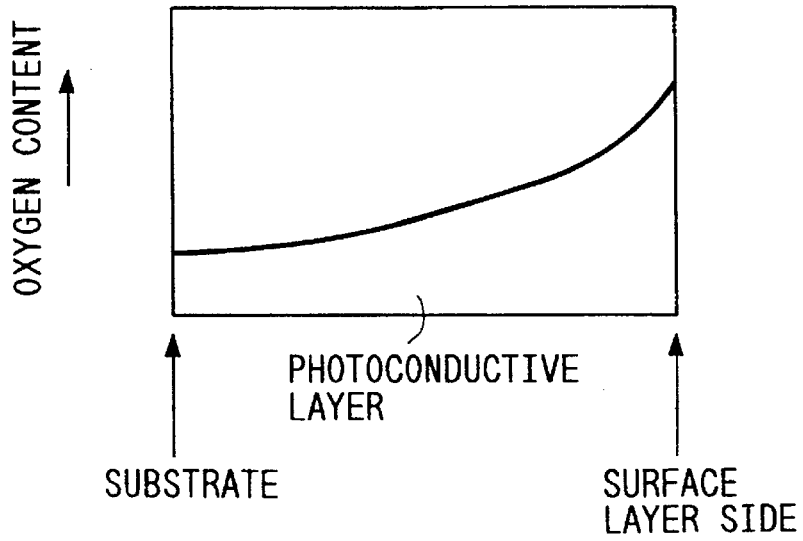
Figure 32:
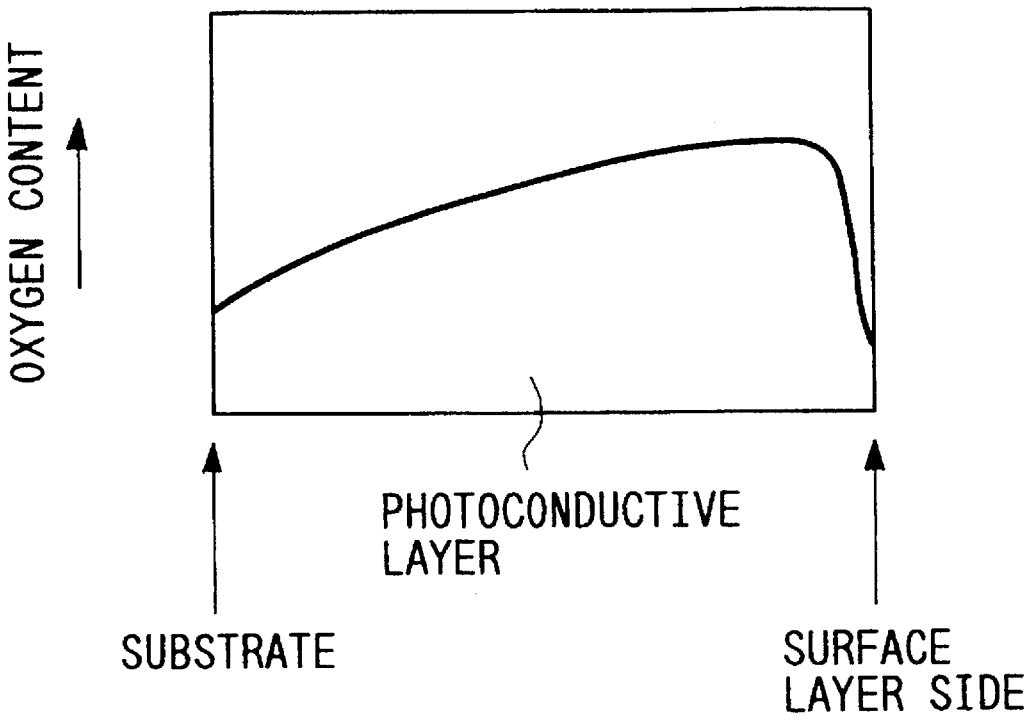

| Pattern of Oxygen content | Chargeability | Sensitivity | Residual potential | Potential shift | Overall evaluation |
|---|---|---|---|---|---|
| Example E13: | | | | | |
| FIG. 28 | AA | AA | AA | A | A |
| FIG. 29 | AA | AA | AA | AA | AA |
| FIG. 30 | AA | AA | AA | AA | AA |
| FIG. 31 | AA | AA | AA | AA | AA |
| FIG. 32 | AA | AA | AA | AA | AA |
| Comparative Example E13: | | | | | |
| — | AA | AA | AA | B | B |

TABLE E25

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 150 → 0 (FIG. 8 pattern) | | | | |
| | $SiF_4$ | 50 → 80 ppm (based on $SiH_4$) | | | | |
| | $CO_2$ | (Varied) | | | | |
| | $B_2H_6$ | 40 → 3 ppm (based on $SiH_4$) | | | | |
| Surface layer | $SiH_4$ | 30 | 1,000 | 10 | 250 | 0.5 |
| | $CH_4$ | 500 | | | | |
| | NO | 100 | | | | |
| | $NH_3$ | 100 | | | | |
| | $SiF_4$ | 10 | | | | |
| | $H_2$ | 100 | | | | |

TABLE E26

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 (FIG. 8 pattern) | | | | |
| | $SiF_4$ | 50 → 80 ppm (based on $SiH_4$) | | | | |
| Surface layer | $SiH_4$ | 30 | Varied | 0.3 | 250 | 0.5 |
| | $CH_4$ | (Varied) | | | | |
| | $CO_2$ | (Varied) | | | | |
| | $NH_3$ | (Varied) | | | | |
| | $SiF_4$ | 10 | | | | |
| | $H_2$ | 100 | | | | |

TABLE E27

| | Example E15 | | | | | |
|---|---|---|---|---|---|---|
| a) Carbon content: (at. %) | 10 | 30 | 60 | 60 | 60 | 70 |
| b) Oxygen content: (at. %) | 20 | 5 | 3 | 8 | $5 \times 10^{-3}$ | 4 |
| c) Nitrogen content: (at. %) | 20 | 8 | 5 | 15 | $2 \times 10^{-4}$ | 5 |
| Total of b) & c): (at. %) | 40 | 13 | 8 | 23 | about $5 \times 10^{-3}$ | 9 |
| Total of a), b) & c): (at. %) | 50 | 43 | 68 | 83 | about 60 | 79 |
| Chargeability: | A | A | AA | A | AA | AA |
| Sensitivity: | AA | AA | AA | AA | AA | AA |
| Residual potential: | AA | AA | AA | AA | AA | AA |
| Smeared image: | A | AA | AA | A | AA | AA |
| Image evaluation before running: | A | A | AA | A | AA | AA |
| Image evaluation after running: | A | A | AA | A | AA | AA |
| Overall evaluation: | A | A | AA | A | AA | AA |

| | Example E15 | | | | |
|---|---|---|---|---|---|
| a) Carbon content: (at. %) | 70 | 70 | 70 | 70 | 80 |
| b) Oxygen content: (at. %) | 6 | $1 \times 10^{-3}$ | 12 | $5 \times 10^{-3}$ | 3 |
| c) Nitrogen | 9 | 3 | $1 \times 10^{-3}$ | $2 \times 10^{-4}$ | 5 |

TABLE E27-continued

| | | | | | |
|---|---|---|---|---|---|
| content: (at. %) | | | | | |
| Total of b) & c): (at. %) | 15 | about 3 | about 12 | about $5 \times 10^{-3}$ | 8 |
| Total of a), b) & c) (at. %) | 85 | about 73 | about 82 | about 70 | 88 |
| Chargeability: | A | AA | A | AA | AA |
| Sensitivity: | AA | AA | AA | AA | AA |
| Residual potential: | AA | AA | AA | AA | AA |
| Smeared image: | AA | AA | AA | AA | AA |
| Image evaluation before running: | A | AA | A | AA | AA |
| Image evaluation after running: | A | AA | A | AA | AA |
| Overall evaluation: | A | AA | A | AA | AA |

| | Comparative Example | | | | | | | |
|---|---|---|---|---|---|---|---|---|
| | | | E15 | | | E16 | E17 | E18 |
| a) Carbon content: (at. %) | 10 | 10 | 30 | 30 | 60 | 0 | 50 | 50 |
| b) Oxygen content: (at. %) | 12 | 40 | 2 | 35 | 18 | 20 | 0 | 10 |
| c) Nitrogen content: (at. %) | 10 | 45 | 3 | 30 | 15 | 40 | 10 | 0 |
| Total of b) & c): (at. %) | 22 | 85 | 5 | 65 | 33 | 60 | 10 | 10 |
| Total of a), b) & c): (at. %) | 32 | 95 | 35 | 95 | 93 | 60 | 60 | 60 |
| Charge-ability: | B | A | A | A | A | A | A | A |
| Sensitivity: | A | AA | AA | AA | AA | A | AA | AA |
| Residual potential: | AA | AA | AA | AA | AA | B | B | B |
| Smeared image: | A | A | AA | A | A | A | A | A |
| Image eval-uation before running: | B | A | B | A | A | A | A | A |
| Image eval-uation after running: | B | B | B | B | B | B | B | B |
| Overall evaluation: | B | B | B | B | B | B | B | B |

TABLE E28

| Layer | Gas used, & flow rate | (sccm) | μW power (W) | Inner pres-sure (mTorr) | Sub-strate temp. (°C.) | Layer thick-ness (μm) |
|---|---|---|---|---|---|---|
| Photo-conduc-tive layer | $SiH_4$ | 500 | 1,000 | 10 | 250 | 20 |
| | $CH_4$ | 150 → 0 (FIG. 8 pattern) | | | | |
| | $SiF_4$ | 50 → 80 ppm (based on $SiH_4$) | | | | |
| Surface layer | $SiH_4$ | 30 | Varied | 10 | 250 | 0.5 |
| | $CH_4$ | (Varied) | | | | |
| | $CO_2$ | (Varied) | | | | |
| | $NH_3$ | (Varied) | | | | |
| | $SiF_4$ | 10 | | | | |
| | $H_2$ | 100 | | | | |

TABLE E29

| Layer | Gas used, & flow rate | (sccm) | RF power (W) | Inner pres-sure (Torr) | Sub-strate temp. (°C.) | Layer thick-ness (μm) |
|---|---|---|---|---|---|---|
| Photo-conduc-tive layer | $SiH_4$ | 500 | 500 | 0.5 | 250 | 20 |
| | $CH_4$ | 150 → 0 (FIG. 8 pattern) | | | | |
| | $SiF_4$ | 50 → 80 ppm (based on $SiH_4$) | | | | |
| Surface layer | $SiH_4$ | 30 | Varied | 0.3 | 250 | 0.5 |
| | $CH_4$ | 500 | | | | |
| | NO | 100 | | | | |
| | $NH_3$ | 100 | | | | |
| | $SiF_4$ | (Varied) | | | | |
| | $H_2$ | (Varied) | | | | |

TABLE E30

| | Example E17 | | | | | | | | Cp.* E22 | | Cp.* E22 | | Cp* E23 | | | | Cp* E24 | | | |
|---|---|---|---|---|---|---|---|---|---|---|---|---|---|---|---|---|---|---|---|---|
| a) Hydrogen content: (at. %) | 21 | 30 | 30 | 30 | 48 | 48 | 61 | 61 | 11 | 53 | 61 | 70 | 11 | 21 | 30 | 48 | 30 | 48 | 70 | 76 |
| b) Fluorine content: (at. %) | 15 | 3 | 9 | 18 | 3 | 19 | 3 | 8 | 18 | 18 | 12 | 4 | 24 | 23 | 23 | 21 | 0 | 0 | 0 | 0 |
| Total of a) & b): (at. %) | 36 | 33 | 39 | 48 | 51 | 67 | 64 | 69 | 29 | 71 | 73 | 74 | 35 | 44 | 53 | 69 | 30 | 48 | 70 | 76 |
| Sensitivity: | AA | AA | AA | AA | AA | AA | AA | AA | A | A | A | A | AA | AA | AA | AA | A | A | A | A |
| Residual potential: | AA | AA | AA | AA | AA | AA | AA | AA | A | A | A | A | A | A | A | A | A | A | A | A |
| Smeared image: | AA | AA | AA | AA | AA | AA | AA | AA | AA | AA | AA | AA | AA | AA | AA | AA | A | A | A | A |

TABLE E30-continued

| | Example E17 | | | | | | | | Cp.* E22 | | Cp.* E22 | | | Cp* E23 | | | Cp* E24 | | | |
|---|---|---|---|---|---|---|---|---|---|---|---|---|---|---|---|---|---|---|---|---|
| Overall evaluation: | AA | AA | AA | AA | AA | AA | AA | AA | A | A | A | A | A | A | A | A | A | A | A | A |

*Comparative Example

TABLE E31

| Layer | Gas used, & flow rate | (sccm) | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 150 → 0 (FIG. 8 pattern) | | | | |
| | $SiF_4$ | 50 → 80 ppm (based on $SiH_4$) | | | | |
| Surface layer | $SiH_4$ | 30 | Varied | 10 | 250 | 0.5 |
| | $CH_4$ | 500 | | | | |
| | NO | 100 | | | | |
| | $NH_3$ | 100 | | | | |
| | $SiF_4$ | (Varied) | | | | |
| | $H_2$ | (Varied) | | | | |

TABLE E32

| Layer | Gas used, & flow rate | (sccm) | RF power (W) | Inner pressure (Torr) | Substrate temp. (°C.) | Layer thickness (μm) |
|---|---|---|---|---|---|---|
| Photoconductive layer | $SiH_4$ | 500 | 1,000 | 10 | 250 | 17 |
| | $CH_4$ | 150 → 0 (FIG. 8 pattern) | | | | |
| | $SiF_4$ | 50 → 80 ppm (based on $SiH_4$) | | | | |
| | $B_2H_6$ | (Table E33) | | | | |
| | $CO_2$ | 500 → 600 ppm (based on $SiH_4$) | | | | |
| Surface layer | $SiH_4$ | 15 | 300 | 0.5 | 250 | 0.5 |
| | $CH_4$ | 850 | | | | |
| | $CO_2$ | 60 ppm (based on $SiH_4$) | | | | |
| | $B_2H_6$ | 3.5 ppm (based on $SiH_4$) | | | | |
| | $SiF_4$ | 20 | | | | |

TABLE E33

| Pattern | Pattern of Boron Atom Content: $B_2H_6$ content in photoconductive layer |
|---|---|
| a | 0 |
| b | 10 |
| c | 25 → 2 (Linearly changed) |
| d | 25 → 1.8 (Linearly changed) |

TABLE E34

| Pattern | Chargeability | Sensitivity | Residual potential |
|---|---|---|---|
| a | 100 | 100 | 100 |
| b | 100 | 95 | 91 |
| c | 99 | 94 | 91 |
| d | 99 | 94 | 90 |

TABLE E35

| Layer | Gas used, & flow rate | (sccm) | μW power (W) | Inner pressure (mTorr) | Substrate temp. (°C.) | Layer thickness (μm) |
|---|---|---|---|---|---|---|
| Photoconductive layer | $SiH_4$ | 300 | 1,000 | 10 | 250 | 20 |
| | $CH_4$ | 120 → 0 (FIG. 8 pattern) | | | | |
| | $SiF_4$ | 70 → 90 ppm (based on $SiH_4$) | | | | |
| | $B_2H_6$ | (Table E33) | | | | |
| | $CO_2$ | 500 → 600 ppm (based on $SiH_4$) | | | | |
| Surface layer | $SiH_4$ | 75 | 1,000 | 10 | 250 | 0.5 |
| | $CH_4$ | 800 | | | | |
| | $CO_2$ | 500 ppm (based on $SiH_4$) | | | | |
| | $B_2H_6$ | 30 ppm (based on $SiH_4$) | | | | |
| | $SiF_4$ | 35 | | | | |

TABLE F1

| Layer | Gas used, & flow rate | (sccm) | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 350 → 0 (FIG. 8 pattern) | | | | |
| | $SiF_4$ | 50 → 80 ppm (based on $SiH_4$) | | | | |
| Surface layer | $SiH_4$ | 30 | 150 | 0.4 | 250 | 0.5 |
| | $CH_4$ | 750 | | | | |
| | $O_2$ | 60 ppm (based on $SiH_4$) | | | | |
| | $B_2H_6$ | 3 ppm (based on $SiH_4$) | | | | |
| | $SiF_4$ | 10 | | | | |

TABLE F2

| Layer | Gas used, & flow rate | (sccm) | RF power (W) | Inner pressure (Torr) | Substrate temp. (°C.) | Layer thickness (μm) |
|---|---|---|---|---|---|---|
| First Photoconductive layer | $SiH_4$ | 500 | 500 | 0.5 | 250 | 17 |
| | $CH_4$ | 350 | | | | |
| | $SiF_4$ | 50 → 80 ppm (based on $SiH_4$) | | | | |
| Second photoconductive layer | $SiH_4$ | 500 | 500 | 0.5 | 250 | 3 |
| Surface layer | $SiH_4$ | 10 | 150 | 0.4 | 250 | 0.5 |
| | $CH_4$ | 750 | | | | |
| | $O_2$ | 60 ppm (based on $SiH_4$) | | | | |
| | $B_2H_6$ | 3 ppm (based on $SiH_4$) | | | | |
| | $SiF_4$ | 10 | | | | |

TABLE F3

| | Chargeability | Sensitivity | Residual potential |
|---|---|---|---|
| Example F1: | AA | AA | AA |
| Comparative Example F1: | A | B | B |

TABLE F4

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 250 → 0 (FIG. 8 pattern) | | | | |
| | $SiF_4$ | 50 → 80 ppm (based on $SiH_4$) | | | | |
| Surface layer | $SiH_4$ | 100 | 1,000 | 10 | 250 | 0.5 |
| | $CH_4$ | 700 | | | | |
| | $O_2$ | 40 ppm (based on $SiH_4$) | | | | |
| | $B_2H_6$ | 1 ppm (based on $SiH_4$) | | | | |
| | $SiF_4$ | 50 | | | | |

TABLE F5

| Layer | Gas used, & flow rate (sccm) | | μW power (W) | Inner pressure (mTorr) | Substrate temp. (°C.) | Layer thickness (μm) |
|---|---|---|---|---|---|---|
| First Photoconductive layer | $SiH_4$ | 500 | 1,000 | 10 | 250 | 17 |
| | $CH_4$ | 250 | | | | |
| | $SiF_4$ | 50 → 80 ppm (based on $SiH_4$) | | | | |
| Second photoconductive layer | $SiH_4$ | 500 | 1,000 | 10 | 250 | 3 |
| Surface layer | $SiH_4$ | 100 | 1,000 | 10 | 250 | 0.5 |
| | $CH_4$ | 700 | | | | |
| | $O_2$ | 40 ppm (based on $SiH_4$) | | | | |
| | $B_2H_6$ | 1 ppm (based on $SiH_4$) | | | | |
| | $SiF_4$ | 50 | | | | |

TABLE F6

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | (Varied) | | | | |
| | $SiF_4$ | 50 → 80 ppm (based on $SiH_4$) | | | | |
| Surface | $SiH_4$ | 10 | 150 | 0.4 | 250 | 0.5 |
| | $CH_4$ | 750 | | | | |
| | $O_2$ | 60 ppm (based on $SiH_4$) | | | | |
| | $B_2H_6$ | 3 ppm (based on $SiH_4$) | | | | |
| | $SiF_4$ | 10 | | | | |

TABLE F7

| Pattern of carbon atom content | Chargeability | Sensitivity | Residual potential |
|---|---|---|---|
| Example F3: | | | |
| FIG. 8 | AA | AA | AA |
| FIG. 9 | AA | AA | AA |
| FIG. 10 | AA | AA | AA |
| Comparative Example F3: | | | |
| FIG. 11 | A | B | B |
| FIG. 12 | AA | B | B |

TABLE F8

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | (Varied) | | | | |
| | $SiF_4$ | 50 → 80 ppm (based on $SiH_4$) | | | | |
| Surface layer | $SiH_4$ | 100 | 1,000 | 10 | 250 | 0.5 |
| | $CH_4$ | 700 | | | | |
| | $O_2$ | 40 ppm (based on $SiH_4$) | | | | |
| | $B_2H_6$ | 1 ppm (based on $SiH_4$) | | | | |
| | $SiF_4$ | 50 | | | | |

TABLE F9

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | Varied → 0 (FIG. 8 pattern) | | | | |
| | $SiF_4$ | 50 → 80 ppm (based on $SiH_4$) | | | | |
| Surface layer | $SiH_4$ | 10 | 150 | 0.4 | 250 | 0.5 |
| | $CH_4$ | 750 | | | | |
| | $O_2$ | 60 ppm (based on $SiH_4$) | | | | |
| | $B_2H_6$ | 3 ppm (based on $SiH_4$) | | | | |
| | $SiF_4$ | 10 | | | | |

TABLE F10

| Carbon atom content (at. %) | Chargeability | Sensitivity | Residual potential | White spots | (1) | (2) | (3) | (4) |
|---|---|---|---|---|---|---|---|---|
| Comparative Example F5: | | | | | | | | |
| 70 | AA | B | A | AA | AA | B | AA | B |
| 60 | AA | B | A | AA | AA | A | AA | B |
| Example F5: | | | | | | | | |
| 50 | AA | A | A | AA | AA | AA | AA | A |
| 40 | AA | AA | A | AA | AA | AA | AA | A |
| 30 | AA | AA | AA | AA | AA | AA | AA | AA |
| 20 | AA | AA | AA | AA | AA | AA | AA | AA |
| 10 | AA | AA | AA | AA | AA | AA | AA | AA |
| 5 | AA | AA | AA | AA | AA | AA | AA | AA |
| 1 | AA | AA | AA | AA | AA | AA | AA | AA |
| 0.5 | A | AA | AA | AA | AA | AA | A | A |
| Comparative Example F5: | | | | | | | | |
| 0.3 | B | AA | AA | B | A | AA | B | B |

(1): Coarse image
(2): Ghost
(3): Spherical protuberances
(4): Overall evaluation

TABLE F11

| Layer | Gas used, & flow rate | (sccm) | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | Varied → 0 (FIG. 8 pattern) | | | | |
| | $SiF_4$ | 50 → 80 ppm (based on $SiH_4$) | | | | |
| Surface layer | $SiH_4$ | 100 | 1,000 | 10 | 250 | 0.5 |
| | $CH_4$ | 700 | | | | |
| | $O_2$ | 40 ppm (based on $SiH_4$) | | | | |
| | $B_2H_6$ | 1 ppm (based on $SiH_4$) | | | | |
| | $SiF_4$ | 50 | | | | |

TABLE F12

| Layer | Gas used, & flow rate | (sccm) | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 (FIG. 8 pattern) | | | | |
| | $SiF_4$ | (Varied) | | | | |
| | $B_2H_6$ | 30 → 2 ppm (based on $SiH_4$) | | | | |
| Surface layer | $SiH_4$ | 10 | 150 | 0.4 | 250 | 0.5 |
| | $CH_4$ | 750 | | | | |
| | $O_2$ | 60 ppm (based on $SiH_4$) | | | | |
| | $B_2H_6$ | 3 ppm (based on $SiH_4$) | | | | |
| | $SiF_4$ | 10 | | | | |

TABLE F13

(before running)

| Fluorine atom content | White spots | Coarse image | Ghost | Overall evaluation |
|---|---|---|---|---|
| Example F7: | | | | |
| FIG. 13 | AA | AA | AA | AA |
| FIG. 14 | AA | AA | AA | AA |
| FIG. 15 | AA | AA | AA | AA |
| FIG. 16 | AA | AA | AA | AA |
| FIG. 17 | AA | AA | AA | AA |
| FIG. 18 | AA | AA | AA | AA |
| FIG. 19 | AA | AA | AA | AA |
| FIG. 20 | AA | AA | AA | AA |
| Comparative Example F7: | | | | |
| FIG. 21 | AA | AA | B | B |
| FIG. 22 | AA | AA | B | B |

TABLE F14

(after running)

| Fluorine atom content | White spots | Coarse image | Ghost | Overall evaluation |
|---|---|---|---|---|
| Example F7: | | | | |
| FIG. 13 | AA | A | B | B |
| FIG. 14 | AA | A | A | A |
| FIG. 15 | AA | AA | A | A |
| FIG. 16 | AA | AA | AA | AA |
| FIG. 17 | AA | AA | AA | AA |
| FIG. 18 | AA | AA | AA | AA |
| FIG. 19 | AA | A | AA | A |
| FIG. 20 | AA | A | A | A |

TABLE F14-continued

| Fluorine atom content | White spots | Coarse image | Ghost | Overall evaluation |
|---|---|---|---|---|
| | (after running) | | | |
| Comparative Example F7: | | | | |
| FIG. 21 | AA | B | B | B |
| FIG. 22 | AA | B | B | B |

TABLE F15

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 150 → 0 (FIG. 8 pattern) | | | | |
| | $SiF_4$ | (Varied) | | | | |
| | $B_2H_6$ | 30 → 2 ppm (based on $SiH_4$) | | | | |
| Surface layer | $SiH_4$ | 100 | 1,000 | 10 | 250 | 0.5 |
| | $CH_4$ | 700 | | | | |
| | $O_2$ | 40 ppm (based on $SiH_4$) | | | | |
| | $B_2H_6$ | 1 ppm (based on $SiH_4$) | | | | |
| | $SiF_4$ | 50 | | | | |

TABLE F16

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive | $SiH_4$ | 500 | 500 | 0.5 | 250 | 20 |
| | $CH_4$ | 150 → 0 (FIG. 8 pattern) | | | | |
| | $SiF_4$ | (Varied) | | | | |
| | $B_2H_6$ | 30 → 2 ppm (based on $SiH_4$) | | | | |
| Surface layer | $SiH_4$ | 100 | 150 | 0.4 | 250 | 0.5 |
| | $CH_4$ | 750 | | | | |
| | $O_2$ | 60 ppm (based on $SiH_4$) | | | | |
| | $B_2H_6$ | 3 ppm (based on $SiH_4$) | | | | |
| | $SiF_4$ | 10 | | | | |

TABLE F17

| Fluorine atom content | White spots | Coarse image | Ghost | (1) | (2) | (3) | (4) |
|---|---|---|---|---|---|---|---|
| | (before running) | | | | | | |
| Example F9: | | | | | | | |
| FIG. 23 | AA | AA | AA | AA | AA | AA | AA |
| FIG. 24 | AA | AA | AA | AA | AA | AA | AA |
| FIG. 25 | AA | AA | AA | AA | AA | AA | AA |
| FIG. 26 | AA | AA | AA | AA | AA | AA | AA |
| Comparative Example F9: | | | | | | | |
| FIG. 27 | AA | AA | AA | A | AA | A | A |

(1): Temperature characteristics
(2): Chargeability
(3): Uneven image density
(4): Overall evaluation

TABLE F18

| Fluorine atom content | White spots | Coarse image | Ghost | (1) | (2) | (3) | (4) |
|---|---|---|---|---|---|---|---|
| | (after running) | | | | | | |
| Example F9: | | | | | | | |
| FIG. 23 | AA | AA | AA | AA | AA | AA | AA |
| FIG. 24 | AA | AA | AA | AA | AA | AA | AA |
| FIG. 25 | AA | AA | AA | AA | AA | AA | AA |
| FIG. 26 | AA | AA | AA | AA | AA | AA | AA |
| Comparative Example F9: | | | | | | | |
| FIG. 27 | AA | AA | AA | B | A | B | B |

(1): Temperature characteristics
(2): Chargeability
(3): Uneven image density
(4): Overall evaluation

TABLE F19

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 150 → 0 (FIG. 8 pattern) | | | | |
| | $SiF_4$ | (Varied) | | | | |
| | $B_2H_6$ | 30 → 2 ppm (based on $SiH_4$) | | | | |
| Surface layer | $SiH_4$ | 100 | 1,000 | 10 | 250 | 0.5 |
| | $CH_4$ | 700 | | | | |
| | $O_2$ | 40 ppm (based on $SiH_4$) | | | | |
| | $B_2H_6$ | 1 ppm (based on $SiH_4$) | | | | |
| | $SiF_4$ | 50 | | | | |

TABLE F20

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 | | | | |
| | $SiF_4$ | 50 → 80 ppm (based on $SiH_4$) | | | | |
| | $B_2H_6$ | 40 → 3 ppm (based on $SiH_4$) | | | | |
| | $CO_2$ | (Varied) | | | | |
| Surface layer | $SiH_4$ | 10 | 150 | 0.4 | 250 | 0.5 |
| | $CH_4$ | 750 | | | | |
| | $O_2$ | 60 ppm (based on $SiH_4$) | | | | |
| | $B_2H_6$ | 3 ppm (based on $SiH_4$) | | | | |
| | $SiF_4$ | 10 | | | | |

TABLE F21

| Oxygen atom content (at · ppm) | Chargeability | Sensitivity | Residual potential | Potential shift | Overall evaluation |
|---|---|---|---|---|---|
| Comparative Example F11: | | | | | |
| 5 | AA | AA | AA | A | A |
| 7 | AA | AA | AA | A | A |
| Example F11: | | | | | |
| 10 | AA | AA | AA | AA | AA |
| 50 | AA | AA | AA | AA | AA |
| 100 | AA | AA | AA | AA | AA |
| 250 | AA | AA | AA | AA | AA |

TABLE F21-continued

| Oxygen atom content (at · ppm) | Chargeability | Sensitivity | Residual potential | Potential shift | Overall evaluation |
|---|---|---|---|---|---|
| 500 | AA | AA | AA | AA | AA |
| 1,000 | AA | AA | AA | AA | AA |
| 3,000 | AA | AA | AA | AA | AA |
| 5,000 | AA | AA | AA | AA | AA |
| Comparative Example F11; | | | | | |
| 5,550 | AA | A | B | AA | B |
| 6,000 | AA | B | B | AA | B |
| 8,000 | AA | B | B | AA | B |

TABLE F22

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 150 → 0 | | | | |
| | $SiF_4$ | 50 → 80 ppm (based on $SiH_4$) | | | | |
| | $B_2H_6$ | 40 → 3 ppm (based on $SiH_4$) | | | | |
| | $CO_2$ | (Varied) | | | | |
| Surface layer | $SiH_4$ | 100 | 1,000 | 10 | 250 | 0.5 |
| | $CH_4$ | 700 | | | | |
| | $O_2$ | 40 ppm (based on $SiH_4$) | | | | |
| | $B_2H_6$ | 1 ppm (based on $SiH_4$) | | | | |
| | $SiF_4$ | 50 | | | | |

TABLE F23

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 | | | | |
| | $SiF_4$ | 50 → 80 ppm (based on $SiH_4$) | | | | |
| | $B_2H_6$ | 40 → 3 ppm (based on $SiH_4$) | | | | |
| | $CO_2$ | (Varied) | | | | |
| Surface layer | $SiH_4$ | 10 | 150 | 0.4 | 250 | 0.5 |
| | $CH_4$ | 750 | | | | |
| | $O_2$ | 60 ppm (based on $SiH_4$) | | | | |
| | $B_2H_6$ | 3 ppm (based on $SiH_4$) | | | | |
| | $SiF_4$ | 10 | | | | |

TABLE F24

| Oxygen atom content | Chargeability | Sensitivity | Residual potential | Potential shift | Overall evaluation |
|---|---|---|---|---|---|
| Example F13: | | | | | |
| FIG. 28 | AA | AA | AA | A | A |
| FIG. 29 | AA | AA | AA | AA | AA |
| FIG. 30 | AA | AA | AA | AA | AA |
| FIG. 31 | AA | AA | AA | AA | AA |
| FIG. 32 | AA | AA | AA | AA | AA |
| Comparative Example F13: | | | | | |
| None | AA | AA | AA | B | B |

TABLE F25

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 500 | 1,000 | 10 | 250 | 20 |
| | $CH_4$ | 150 → 0 | | | | |
| | $SiF_4$ | 50 → 80 ppm (FIG. 8 pattern) | | | | |
| | $B_2H_6$ | 40 → 3 ppm (based on $SiH_4$) | | | | |
| | $CO_2$ | (Varied) | | | | |
| Surface layer | $SiH_4$ | 100 | 1,000 | 10 | 250 | 0.5 |
| | $CH_4$ | 700 | | | | |
| | $O_2$ | 40 ppm (based on $SiH_4$) | | | | |
| | $B_2H_6$ | 1 ppm (based on $SiH_4$) | | | | |
| | $SiF_4$ | 50 | | | | |

TABLE F26

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 | | | | |
| | $SiF_4$ | 50 → 80 ppm (based on $SiH_4$) | | | | |
| | $B_2H_6$ | 30 → 2 ppm (based on $SiH_4$) | | | | |
| Surface layer | $SiH_4$ | 15 | Varied | 0.5 | 250 | 0.5 |
| | $CH_4$ | (Varied) | | | | |
| | $CO_2$ | 1,000 ppm (based on $SiH_4$) | | | | |
| | $B_2H_6$ | 3.5 ppm (based on $SiH_4$) | | | | |
| | $SiF_4$ | 20 | | | | |

TABLE F27

(before running)

| Carbon atom content: | Comptv. Example F15 | | | Example F15 | | | | | Comptv. Example F15 | | |
|---|---|---|---|---|---|---|---|---|---|---|---|
| (at · %) | 20 | 40 | 60 | 63 | 70 | 75 | 83 | 86 | 90 | 93 | 95 |
| Chargeability: | B | B | A | AA | AA | AA | AA | AA | AA | AA | AA |
| Sensitivity: | B | A | A | AA | AA | AA | AA | A | A | B | B |
| Residual potential: | AA | AA | AA | AA | AA | AA | AA | AA | AA | A | B |
| Smeared image: | AA | AA | AA | AA | AA | AA | AA | AA | AA | A | B |
| White spots: | B | A | AA | AA | AA | AA | AA | AA | AA | AA | AA |
| Black dots caused by melt-adhesion of toner: | A | AA | AA | AA | AA | AA | AA | AA | AA | AA | AA |
| Scratches: | A | AA | AA | AA | AA | AA | AA | AA | AA | AA | AA |

TABLE F28

(after running)

| Carbon atom content: | Comptv. Example F15 | | | Example F15 | | | | | | Comptv. Example F15 | |
|---|---|---|---|---|---|---|---|---|---|---|---|
| (at · %) | 20 | 40 | 60 | 63 | 70 | 75 | 83 | 86 | 90 | 93 | 95 |
| Chargeability: | B | B | A | AA | AA | AA | AA | AA | AA | AA | AA |
| Sensitivity: | B | B | A | AA | AA | AA | AA | A | A | B | B |
| Residual potential: | AA | AA | AA | AA | AA | AA | AA | AA | AA | A | B |
| Smeared image: | B | B | A | AA | AA | AA | AA | AA | A | B | B |
| White spots: | B | B | A | AA | AA | AA | AA | AA | AA | AA | AA |
| Black dots caused by melt-adhesion of toner: | B | B | A | AA | AA | AA | AA | AA | AA | AA | AA |
| Scratches: | B | B | A | AA | AA | AA | AA | AA | AA | AA | AA |

TABLE F29

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 300 | 1,000 | 10 | 250 | 20 |
| | $CH_4$ | 150 → 0 | | | | |
| | $SiF_4$ | 50 → 80 ppm (based on $SiH_4$) | | | | |
| | $B_2H_6$ | 40 → 3 ppm (based on $SiH_4$) | | | | |
| | $CO_2$ | 200 → 400 ppm (based on $SiH_4$) | | | | |
| Surface layer | $SiH_4$ | 75 | Varied | 10 | 250 | 0.5 |
| | $CH_4$ | (Varied) | | | | |
| | $O_2$ | 60 ppm (based on $SiH_4$) | | | | |
| | $B_2H_6$ | 5 ppm (based on $SiH_4$) | | | | |
| | $SiF_4$ | 35 | | | | |

TABLE F30

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 | | | | |
| | $SiF_4$ | 50 → 80 ppm (based on $SiH_4$) | | | | |
| | $B_2H_6$ | 30 → 2 ppm (based on $SiH_4$) | | | | |

TABLE F30-continued

| Layer | Gas used, & flow rate (sccm) | | RF power (W) | Inner pressure (Torr) | Substrate temp. (°C.) | Layer thickness (μm) |
|---|---|---|---|---|---|---|
| | $CO_2$ | 200 → 400 ppm (based on $SiH_4$) | | | | |
| Surface layer | $SiH_4$ | 15 | 300 | 0.5 | 250 | 0.5 |
| | $CH_4$ | 800 | | | | |
| | $CO_2$ | (Varied) (based on $SiH_4$) | | | | |
| | $B_2H_6$ | 3.5 ppm (based on $SiH_4$) | | | | |
| | $SiF_4$ | 20 | | | | |

TABLE F31

(before running)

| Oxygen atom content: | Cp* F17 | Example F17 | | | | | | | | Cp* F17 | |
|---|---|---|---|---|---|---|---|---|---|---|---|
| (at · %) | $1 \times 10^{-5}$ | $1 \times 10^{-4}$ | $3 \times 10^{-4}$ | $1 \times 10^{-3}$ | $5 \times 10^{-3}$ | 1 | 20 | 25 | 30 | 40 | 50 |
| Chargeability: | B | A | AA | AA | AA | AA | AA | AA | AA | AA | AA |
| Sensitivity: | B | A | AA | AA | AA | AA | AA | AA | A | B | B |
| Residual potential: | A | AA | AA | AA | AA | AA | AA | A | A | B | B |
| Smeared image: | A | A | AA | AA | AA | AA | AA | AA | AA | AA | AA |
| White spots: | A | AA | AA | AA | AA | AA | AA | AA | AA | AA | AA |
| Black dots caused by melt-adhesion of toner: | B | A | AA | AA | AA | AA | AA | AA | AA | AA | AA |
| Scratches: | A | A | AA | AA | AA | AA | AA | AA | AA | AA | AA |

*Comparative Example

TABLE F32

(after running)

| Oxygen atom content: | Cp* F17 | Example F17 | | | | | | | | Cp* F17 | |
|---|---|---|---|---|---|---|---|---|---|---|---|
| (at · %) | $1 \times 10^{-5}$ | $1 \times 10^{-4}$ | $3 \times 10^{-4}$ | $1 \times 10^{-3}$ | $5 \times 10^{-3}$ | 1 | 20 | 25 | 30 | 40 | 50 |
| Chargeability: | B | A | AA | AA | AA | AA | AA | AA | AA | AA | AA |
| Sensitivity: | B | A | AA | AA | AA | AA | AA | AA | A | B | B |
| Residual potential: | A | AA | AA | AA | AA | AA | AA | A | A | B | B |
| Smeared image: | B | A | AA | AA | AA | AA | AA | AA | AA | AA | AA |
| White spots: | B | A | AA | AA | AA | AA | AA | AA | AA | AA | AA |
| Black dots caused by melt-adhesion of toner: | B | A | AA | AA | AA | AA | AA | AA | AA | AA | AA |
| Scratches: | A | A | AA | AA | AA | AA | AA | AA | AA | AA | AA |

*Comparative Example

TABLE F33

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 300 | 1,000 | 10 | 250 | 20 |
| | $CH_4$ | 150 → 0 | | | | |
| | $SiF_4$ | 50 → 80 ppm (based on $SiH_4$) | | | | |
| | $B_2H_6$ | 40 → 3 ppm (based on $SiH_4$) | | | | |
| | $CO_2$ | 200 → 400 ppm (based on $SiH_4$) | | | | |
| Surface layer | $SiH_4$ | 75 | 1,000 | 10 | 250 | 0.5 |
| | $CH_4$ | 800 | | | | |
| | $CO_2$ | (Varied) (based on $SiH_4$) | | | | |
| | $B_2H_6$ | 5 ppm (based on $SiH_4$) | | | | |
| | $SiF_4$ | 35 | | | | |

TABLE F34

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 | | | | |
| | $SiF_4$ | 50 → 80 ppm (based on $SiH_4$) | | | | |
| | $B_2H_6$ | 30 → 2 ppm (based on $SiH_4$) | | | | |
| | $CO_2$ | 200 → 400 ppm (based on $SiH_4$) | | | | |
| Surface layer | $SiH_4$ | 15 | 300 | 0.5 | 250 | 0.5 |
| | $CH_4$ | 750 | | | | |

TABLE F34-continued

| Layer | Gas used, & flow rate (sccm) | | RF power (W) | Inner pressure (Torr) | Substrate temp. (°C.) | Layer thickness (μm) |
|---|---|---|---|---|---|---|
| | $N_2$ | (Varied) (based on $SiH_4$) | | | | |
| | $B_2H_6$ | 3.5 ppm (based on $SiH_4$) | | | | |
| | $SiF_4$ | 20 | | | | |

TABLE F35

(before running)

| Nitrogen atom content: | Cp* F19 | Example F19 | | | | | | | | Cp* F19 | |
|---|---|---|---|---|---|---|---|---|---|---|---|
| (at · %) | $1 \times 10^{-5}$ | $1 \times 10^{-4}$ | $3 \times 10^{-4}$ | $1 \times 10^{-3}$ | $5 \times 10^{-3}$ | 1 | 20 | 25 | 30 | 40 | 50 |
| Chargeability: | B | A | AA | AA | AA | AA | AA | AA | AA | AA | AA |
| Sensitivity: | B | A | AA | AA | AA | AA | AA | AA | A | B | B |
| Residual potential: | A | AA | AA | AA | AA | AA | AA | A | A | B | B |
| Smeared image: | A | A | AA | AA | AA | AA | AA | AA | AA | AA | AA |
| White spots: | A | AA | AA | AA | AA | AA | AA | AA | AA | AA | AA |
| Black dots caused by melt-adhesion of toner: | B | A | AA | AA | AA | AA | AA | AA | AA | AA | AA |
| Scratches: | A | A | AA | AA | AA | AA | AA | AA | AA | AA | AA |

*Comparative Example

TABLE F36

(after running)

| Nitrogen atom content: | Cp* F17 | Example F17 | | | | | | | | Cp* F17 | |
|---|---|---|---|---|---|---|---|---|---|---|---|
| (at · %) | $1 \times 10^{-5}$ | $1 \times 10^{-4}$ | $3 \times 10^{-4}$ | $1 \times 10^{-3}$ | $5 \times 10^{-3}$ | 1 | 20 | 25 | 30 | 40 | 50 |
| Chargeability: | B | A | AA | AA | AA | AA | AA | AA | AA | AA | AA |
| Sensitivity: | B | A | AA | AA | AA | AA | AA | AA | A | B | B |
| Residual potential: | A | AA | AA | AA | AA | AA | AA | A | A | B | B |
| Smeared image: | B | A | AA | AA | AA | AA | AA | AA | AA | AA | AA |
| White spots: | B | A | AA | AA | AA | AA | AA | AA | AA | AA | AA |
| Black dots caused by melt-adhesion of toner: | B | A | AA | AA | AA | AA | AA | AA | AA | AA | AA |
| Scratches: | A | A | AA | AA | AA | AA | AA | AA | AA | AA | AA |

*Comparative Example

TABLE F37

| Layer | Gas used, & flow rate (sccm) | | μW power (W) | Inner pressure (mTorr) | Sub-strate temp. (°C.) | Layer thickness (μm) |
|---|---|---|---|---|---|---|
| Photo-conduc-tive layer | $SiH_4$ | 300 | 1,000 | 10 | 250 | 20 |
| | $CH_4$ | 150 → 0 | | | | |
| | $SiF_4$ | 50 → 80 ppm (based on $SiH_4$) | | | | |
| | $B_2H_6$ | 40 → 3 ppm (based on $SiH_4$) | | | | |
| | $CO_2$ | 200 → 400 ppm (based on $SiH_4$) | | | | |
| Surface layer | $SiH_4$ | 75 | 1,000 | 10 | 250 | 0.5 |
| | $CH_4$ | 700 | | | | |
| | $N_2$ | (Varied) (based on $SiH_4$) | | | | |
| | $B_2H_6$ | 10 ppm (based on $SiH_4$) | | | | |
| | $SiF_4$ | 35 | | | | |

TABLE F38

| Layer | Gas used, & flow rate (sccm) | | RF power (W) | Inner pressure (Torr) | Sub-strate temp. (°C.) | Layer thickness (μm) |
|---|---|---|---|---|---|---|
| Photo-con-duc-tive layer | $SiH_4$ | 300 | 500 | 0.5 | 250 | 20 |
| | $CH_4$ | 200 → 0 | | | | |
| | $SiF_4$ | 50 → 80 ppm (based on $SiH_4$) | | | | |
| | $B_2H_6$ | 30 → 2 ppm (based on $SiH_4$) | | | | |
| | $CO_2$ | 200 → 400 ppm (based on $SiH_4$) | | | | |
| Sur-face layer | $SiH_4$ | 15 | 300 | 0.5 | 250 | 0.5 |
| | $CH_4$ | 850 | | | | |

TABLE F38-continued

| Layer | Gas used, & flow rate (sccm) | | RF power (W) | Inner pressure (Torr) | Sub-strate temp. (°C.) | Layer thickness (μm) |
|---|---|---|---|---|---|---|
| layer | $CON_2$ | 1,000 ppm (based on $SiH_4$) | | | | |
| | $B_2H_6$ | (Varied) (based on $SiH_4$) | | | | |
| | $SiF_4$ | 20 | | | | |

TABLE F39

(before running)

| Boron atom content: | Cp* F21 | Example F21 | | | | |
|---|---|---|---|---|---|---|
| (at · %) | $1 \times 10^{-6}$ | $1 \times 10^{-5}$ | $5 \times 10^{-4}$ | $1 \times 10^{-4}$ | $1 \times 10^{-2}$ | $7 \times 10^{-2}$ |
| Chargeability: | AA | AA | AA | AA | AA | AA |
| Sensitivity: | A | A | AA | AA | AA | AA |
| Residual potential: | B | A | AA | AA | AA | AA |
| Smeared image: | A | AA | AA | AA | AA | AA |
| White spots: | A | AA | AA | AA | AA | AA |
| Scratches: | AA | AA | AA | AA | AA | AA |
| Black dots caused by melt-adhesion of toner: | A | AA | AA | AA | AA | AA |

| Boron atom content: | Example F21 | | | | | Cp*F21 |
|---|---|---|---|---|---|---|
| (at · %) | 1 | $1 \times 10^{2}$ | $3 \times 10^{4}$ | $5 \times 10^{4}$ | $1 \times 10^{5}$ | $1 \times 10^{6}$ |
| Chargeability: | AA | AA | AA | AA | A | A |
| Sensitivity: | AA | AA | AA | AA | A | A |
| Residual potential: | AA | AA | AA | AA | AA | AA |
| Smeared image: | AA | AA | AA | AA | AA | AA |
| White spots: | AA | AA | AA | AA | AA | AA |
| Scratches: | AA | AA | AA | AA | AA | AA |
| Black dots caused by melt-adhesion of toner: | AA | AA | AA | AA | AA | AA |

*Comparative Example

TABLE F40

(after running)

| Boron atom content: | Cp* F21 | Example F21 | | | | | | | | | | Cp* F21 |
|---|---|---|---|---|---|---|---|---|---|---|---|---|
| (at. %) | $1 \times 10^{-6}$ | $1 \times 10^{-5}$ | $5 \times 10^{-4}$ | $1 \times 10^{-4}$ | $1 \times 10^{-2}$ | $7 \times 10^{-2}$ | 1 | $1 \times 10^{2}$ | $3 \times 10^{4}$ | $5 \times 10^{4}$ | $1 \times 10^{5}$ | $1 \times 10^{6}$ |
| Chargeability: | AA | AA | AA | AA | AA | AA | AA | AA | AA | AA | A | A |
| Sensitivity: | B | A | AA | AA | AA | AA | AA | AA | AA | AA | A | A |
| Residual potential: | B | A | AA | AA | AA | AA | AA | AA | AA | AA | AA | AA |
| Smeared image: | B | B | A | AA | AA | AA | AA | AA | AA | AA | AA | AA |
| White spots: | B | A | AA | AA | AA | AA | AA | AA | AA | AA | AA | AA |
| Scratches: | AA | AA | AA | AA | AA | AA | AA | AA | AA | AA | AA | AA |
| Black dots caused by melt-adhesion of toner: | B | A | A | AA | AA | AA | AA | AA | AA | AA | AA | AA |

*Comparative Example

TABLE F41

| Layer | Gas used, & flow rate (sccm) | μW power (W) | Inner pressure (mTorr) | Substrate temp. (°C.) | Layer thickness (μm) |
|---|---|---|---|---|---|
| Photoconductive layer | $SiH_4$ 300<br>$CH_4$ 150 → 0<br>$SiF_4$ 50 → 80 ppm (based on $SiH_4$)<br>$B_2H_6$ 40 → 3 ppm (based on $SiH_4$) | 1,000 | 10 | 250 | 20 |

TABLE F41-continued

| Layer | Gas used, & flow rate (sccm) | | μW power (W) | Inner pressure (mTorr) | Substrate temp. (°C.) | Layer thickness (μm) |
|---|---|---|---|---|---|---|
| | $CO_2$ | 500 → 600 ppm (based on $SiH_4$) | | | | |
| Surface layer | $SiH_4$ | 75 | 1,000 | 10 | 250 | 0.5 |
| | $CH_4$ | 800 | | | | |
| | $O_2$ | 2,000 ppm (based on $SiH_4$) | | | | |
| | $B_2H_6$ | (Varied) (based on $SiH_4$) | | | | |
| | $SiF_4$ | 35 | | | | |

TABLE F42

| Layer | Gas used, & flow rate (sccm) | | RF power (W) | Inner pressure (Torr) | Substrate temp. (°C.) | Layer thickness (μm) |
|---|---|---|---|---|---|---|
| Photo-conductive layer | $SiH_4$ | 300 | 500 | 0.5 | 250 | 20 |
| | $CH_4$ | 120 → 0 | | | | |
| | $SiF_4$ | 50 → 80 ppm (based on $SiH_4$) | | | | |
| | $B_2H_6$ | 30 → 2 ppm (based on $SiH_4$) | | | | |
| | $CO_2$ | 500 → 900 ppm (based on $SiH_4$) | | | | |
| Surface layer | $SiH_4$ | 15 | Varied | 0.5 | 250 | 0.5 |
| | $CH_4$ | 850 | | | | |
| | $CO_2$ | 1,000 ppm (based on $SiH_4$) | | | | |
| | $B_2H_6$ | 30 ppm (based on $SiH_4$) | | | | |
| | $SiF_4$ | (Varied) | | | | |

TABLE F43

| (before running) | | | | | | | | | | |
|---|---|---|---|---|---|---|---|---|---|---|
| a) Hydrogen content: (at. %) | | 11 | | | 21 | | | 30 | | |
| b) Fluorine content: (at. %) | 0* | 18 | 24 | 0* | 15 | 23 | 0* | 9 | 18 | 23 |
| Total of a) & b): (at. %) | 11 | 29 | 35 | 21 | 36 | 44 | 30 | 39 | 48 | 53 |
| Chargeability: | A | AA | AA | A | AA | AA | A | AA | AA | AA |
| Sensitivity: | A | A | AA | A | AA | AA | AA | AA | AA | AA |
| Residual potential: | A | A | A | A | AA | A | AA | AA | AA | A |
| Smeared image: | A | AA | AA | A | AA | AA | A | AA | AA | AA |
| White spots: | A | AA | AA | A | AA | AA | A | AA | AA | AA |
| Scratches: | AA | AA | AA | AA | AA | AA | AA | AA | AA | AA |
| Black dots caused by melt-adhesion of toner: | A | AA | AA | A | AA | AA | A | AA | AA | AA |
| Overall evaluation: | A | A | A | A | AA | A | A | AA | AA | A |
| a) Hydrogen content: (at. %) | | 48 | | | | 61 | | 70 | | 76 |
| b) Fluorine content: (at. %) | 0* | 11 | 19 | 23 | 0* | 8 | 12 | 0* | 4 | 0* |
| Total of a) & b): (at. %) | 48 | 59 | 67 | 71 | 61 | 69 | 73 | 70 | 74 | 76 |
| Chargeability: | A | AA | AA | AA | A | AA | AA | A | AA | A |
| Sensitivity: | AA | AA | AA | A | AA | AA | A | AA | A | A |
| Residual potential: | AA | AA | AA | A | AA | AA | A | AA | AA | A |
| Smeared image: | A | AA | AA | AA | A | AA | AA | A | AA | A |
| White spots: | A | AA | AA | AA | A | AA | AA | A | AA | A |
| Scratches: | AA | AA | AA | AA | AA | AA | AA | AA | AA | AA |
| Black dots caused by melt-adhesion of toner: | A | AA | AA | AA | A | AA | AA | A | AA | A |
| Overall evaluation: | A | AA | AA | A | A | AA | A | A | A | A |

Remarks: Data in which fluorine atom content is 0 at. % are results of evaluation of Comparative Example F23. Other data are those of Example F23.

TABLE F44

| (after running) | | | | | | | | | | |
|---|---|---|---|---|---|---|---|---|---|---|
| a) Hydrogen content: (at. %) | | 11 | | | 21 | | | 30 | | |
| b) Fluorine content: (at. %) | 0* | 18 | 24 | 0* | 15 | 23 | 0* | 9 | 18 | 23 |
| Total of a) & b): (at. %) | 11 | 29 | 35 | 21 | 36 | 44 | 30 | 39 | 48 | 53 |
| Chargeability: | A | AA | AA | A | AA | AA | A | AA | AA | AA |
| Sensitivity: | A | A | AA | A | AA | AA | AA | AA | AA | AA |
| Residual potential: | A | A | A | A | AA | A | AA | AA | AA | A |
| Smeared image: | A | AA | AA | A | AA | AA | A | AA | AA | AA |
| White spots: | A | AA | AA | A | AA | AA | A | AA | AA | AA |
| Scratches: | AA | AA | AA | AA | AA | AA | AA | AA | AA | AA |
| Black dots caused by melt-adhesion of toner: | B | AA | AA | B | AA | AA | B | AA | AA | AA |
| Overall evaluation: | B | A | A | B | AA | A | B | AA | AA | A |
| a) Hydrogen content: (at. %) | | 48 | | | | 61 | | 70 | | 76 |
| b) Fluorine content: (at. %) | 0* | 11 | 19 | 23 | 0* | 8 | 12 | 0* | 4 | 0* |
| Total of a) & b): (at. %) | 48 | 59 | 67 | 71 | 61 | 69 | 73 | 70 | 74 | 76 |
| Chargeability: | A | AA | AA | AA | A | AA | AA | A | AA | A |
| Sensitivity: | AA | AA | AA | A | AA | AA | A | AA | A | A |
| Residual potential: | AA | AA | AA | A | AA | AA | A | AA | AA | A |
| Smeared image: | A | AA | AA | AA | A | AA | AA | A | AA | A |

TABLE F44-continued

| | (after running) | | | | | | | | | |
|---|---|---|---|---|---|---|---|---|---|---|
| White spots: | A | AA | AA | AA | A | AA | AA | A | AA | A |
| Scratches: | AA | AA | AA | AA | AA | AA | AA | AA | AA | AA |
| Black dots caused by melt-adhesion of toner: | B | AA | AA | AA | B | AA | AA | B | AA | B |
| Overall evaluation: | B | AA | AA | A | B | AA | A | B | A | B |

Remarks: Data in which fluorine atom content is 0 at. % are results of evaluation of Comparative Example F23. Other data are those of Example F23.

TABLE F45

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 300 | 1,000 | 10 | 250 | 20 |
| | $CH_4$ | 150 → 0 | | | | |
| | $SiF_4$ | 50 → 80 ppm (based on $SiH_4$) | | | | |
| | $B_2H_6$ | 40 → 3 ppm (based on $SiH_4$) | | | | |
| | $CO_2$ | 500 → 600 ppm (based on $SiH_4$) | | | | |
| Surface layer | $SiH_4$ | 75 | Varied | 10 | 250 | 0.5 |
| | $CH_4$ | 800 | | | | |
| | NO | 2,000 ppm (based on $SiH_4$) | | | | |
| | $B_2H_6$ | 30 ppm (based on $SiH_4$) | | | | |
| | $SiF_4$ | (Varied) | | | | |

TABLE F46

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 300 | 500 | 0.5 | 250 | 20 |
| | $CH_4$ | 120 → 0 | | | | |
| | $SiF_4$ | 50 → 80 ppm (based on $SiH_4$) | | | | |
| | $B_2H_6$ | 50 → 4 ppm (based on $SiH_4$) | | | | |
| | $CO_2$ | 500 → 900 ppm (based on $SiH_4$) | | | | |
| Surface layer | $SiH_4$ | 15 | 300 | 0.5 | 250 | 0.5 |
| | $CH_4$ | 850 | | | | |
| | NO | (Varied) (based on $SiH_4$) | | | | |
| | $B_2H_6$ | 300 ppm (based on $SiH_4$) | | | | |
| | $SiF_4$ | 30 | | | | |

TABLE F47

| Cp* F25 Oxygen and Nitrogen content: atom (at. %) | (before running) Example F25 | | | | | | | | Cp* F25 | |
|---|---|---|---|---|---|---|---|---|---|---|
| $1 \times 10^{-5}$ | $1 \times 10^{-4}$ | $3 \times 10^{-4}$ | $1 \times 10^{-3}$ | $5 \times 10^{-3}$ | 1 | 20 | 25 | 30 | 40 | 50 |
| Chargeability: | | | | | | | | | | |
| B | A | AA | AA | AA | AA | AA | AA | AA | AA | AA |
| Sensitivity: | | | | | | | | | | |
| B | A | AA | AA | AA | AA | AA | AA | A | B | B |
| Residual potential: | | | | | | | | | | |
| A | AA | AA | AA | AA | AA | AA | A | A | B | B |
| Smeared image: | | | | | | | | | | |
| A | A | AA | AA | AA | AA | AA | AA | AA | AA | AA |
| White spots: | | | | | | | | | | |
| A | AA | AA | AA | AA | AA | AA | AA | AA | AA | AA |
| Black dots caused by melt-adhesion of toner: | | | | | | | | | | |
| B | A | AA | AA | AA | AA | AA | AA | AA | AA | AA |
| Scratches: | | | | | | | | | | |
| A | A | AA | AA | AA | AA | AA | AA | AA | AA | AA |

*Comparative Example

TABLE F48

| Cp* F25 Oxygen and Nitrogen atom content: (at. %) | Example F25 (after running) | | | | | | | | Cp* F25 | |
|---|---|---|---|---|---|---|---|---|---|---|
| $1 \times 10^{-5}$ | $1 \times 10^{-4}$ | $3 \times 10^{-4}$ | $1 \times 10^{-3}$ | $5 \times 10^{-3}$ | 1 | 20 | 25 | 30 | 40 | 50 |
| Chargeability: | | | | | | | | | | |
| B | A | AA | AA | AA | AA | AA | AA | AA | AA | AA |
| Sensitivity: | | | | | | | | | | |
| B | A | AA | AA | AA | AA | AA | AA | A | B | B |
| Residual potential: | | | | | | | | | | |
| A | AA | AA | AA | AA | AA | AA | A | A | B | B |
| Smeared image: | | | | | | | | | | |
| B | A | AA | AA | AA | AA | AA | AA | AA | AA | AA |
| White spots: | | | | | | | | | | |
| B | A | AA | AA | AA | AA | AA | AA | AA | AA | AA |
| Black dots caused by melt-adhesion of toner: | | | | | | | | | | |
| B | A | AA | AA | AA | AA | AA | AA | AA | AA | AA |
| Scratches: | | | | | | | | | | |
| A | A | AA | AA | AA | AA | AA | AA | AA | AA | AA |

*Comparative Example

TABLE F49

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 300 | 1,000 | 10 | 250 | 20 |
| | $CH_4$ | 150 → 0 | | | | |
| | $SiF_4$ | 50 → 80 ppm (based on $SiH_4$) | | | | |
| | $B_2H_6$ | 40 → 3 ppm (based on $SiH_4$) | | | | |
| | $CO_2$ | 500 → 600 ppm (based on $SiH_4$) | | | | |
| Surface layer | $SiH_4$ | 75 | 1,000 | 10 | 250 | 0.5 |
| | $CH_4$ | 800 | | | | |
| | NO | Varied (based on $SiH_4$) | | | | |
| | $B_2H_6$ | 30 ppm (based on $SiH_4$) | | | | |
| | $SiF_4$ | 35 | | | | |

TABLE F50

| Layer | Gas used, & flow rate (sccm) | | RF power (W) | Inner pressure (Torr) | Substrate temp. (°C.) | Layer thickness (μm) |
|---|---|---|---|---|---|---|
| Photoconductive layer | $SiH_4$ | 500 | 500 | 0.5 | 250 | 20 |
| | $CH_4$ | 150 → 0 (FIG. 8 pattern) | | | | |
| | $SiF_4$ | 50 → 80 ppm (based on $SiH_4$) | | | | |
| | $B_2H_6$ | (FIG. F51) | | | | |
| | $CO_2$ | 500 → 600 ppm (based on $SiH_4$) | | | | |
| Surface layer | $SiH_4$ | 15 | 300 | 0.5 | 250 | 0.5 |
| | $CH_4$ | 850 | | | | |
| | $CO_2$ | 60 ppm (based on $SiH_4$) | | | | |
| | $B_2H_6$ | 3.5 ppm (based on $SiH_4$) | | | | |
| | $SiF_4$ | 20 | | | | |

TABLE F51

| Pattern | Pattern of Boron Atom Content: $B_2H_6$ content in photoconductive layer (ppm) |
|---|---|
| a | 0 |
| b | 10 |
| c | 25 → 2 (Linearly changed) |
| d | 25 → 1.8 (Linearly changed) |

TABLE F52

| Pattern | Chargeability | Sensitivity | Residual potential |
|---|---|---|---|
| a | 100 | 100 | 100 |
| b | 100 | 95 | 91 |
| c | 99 | 94 | 91 |
| d | 99 | 94 | 90 |

TABLE F53

| Layer | Gas used, & flow rate (sccm) | | μW power (W) | Inner pressure (mTorr) | Substrate temp. (°C.) | Layer thickness (μm) |
|---|---|---|---|---|---|---|
| Photoconductive layer | $SiH_4$ | 300 | 1,000 | 10 | 250 | 20 |
| | $CH_4$ | 120 → 0 (FIG. 8 pattern) | | | | |
| | $SiF_4$ | 70 → 90 ppm (based on $SiH_4$) | | | | |
| | $B_2H_6$ | (Table F51) (based on $SiH_4$) | | | | |
| | $CO_2$ | 500 → 600 ppm (based on $SiH_4$) | | | | |
| Surface layer | $SiH_4$ | 75 | 1,000 | 10 | 250 | 0.5 |
| | $CH_4$ | 800 | | | | |
| | NO | 500 ppm (based on $SiH_4$) | | | | |
| | $B_2H_6$ | 30 ppm (based on $SiH_4$) | | | | |
| | $SiF_4$ | 35 | | | | |

TABLE G1

| Layer | Gas used, & flow rate (sccm) | | RF power (W) | Inner pressure (Torr) | Substrate temp. (°C.) | Layer thickness (μm) |
|---|---|---|---|---|---|---|
| First Photoconductive layer | $SiH_4$ | 500 | 500 | 0.5 | 250 | 17 |
| | $CH_4$ | 350 → 0 (FIG. 8 pattern) | | | | |
| | $SiF_4$ | 30 ppm (based on $SiH_4$) | | | | |
| Second photoconductive layer | $SiH_4$ | 500 | 500 | 0.5 | 250 | 3 |
| Surface layer | $SiH_4$ | 30 | 300 | 0.3 | 250 | 0.5 |
| | $CH_4$ | 500 | | | | |
| | $CO_2$ | 100 | | | | |
| | $NH_3$ | 100 | | | | |

TABLE G1-continued

| Layer | Gas used, & flow rate (sccm) | RF power (W) | Inner pressure (Torr) | Sub-strate temp. (°C.) | Layer thickness (μm) |
|---|---|---|---|---|---|
| | $SiF_4$ 10<br>$H_2$ 100 | | | | |

TABLE G2

| Layer | Gas used, & flow rate (sccm) | RF power (W) | Inner pressure (Torr) | Sub-strate temp. (°C.) | Layer thickness (μm) |
|---|---|---|---|---|---|
| First Photo-conduc-tive layer | $SiH_4$ 500<br>$CH_4$ 350<br>$SiF_4$ 30 ppm (based on $SiH_4$) | 500 | 0.5 | 250 | 17 |
| Second photo-conduc-tive layer | $SiH_4$ 500 | 500 | 0.5 | 250 | 3 |
| Surface layer | $SiH_4$ 30<br>$CH_4$ 500<br>$CO_2$ 100<br>$NH_3$ 100<br>$SiF_4$ 10<br>$H_2$ 100 | 300 | 0.3 | 250 | 0.5 |

TABLE G3

| | Chargeability | Sensitivity | Residual potential |
|---|---|---|---|
| Example G1: | AA | AA | AA |
| Comparative Example G1: | A | B | B |

TABLE G4

| Layer | Gas used, & flow rate (sccm) | μW power (W) | Inner pressure (mTorr) | Sub-strate temp. (°C.) | Layer thickness (μm) |
|---|---|---|---|---|---|
| First Photo-conduc-tive layer | $SiH_4$ 500<br>$CH_4$ 250 → 0 (FIG. 8 pattern)<br>$SiF_4$ 30 ppm (based on $SiH_4$) | 1,000 | 10 | 250 | 17 |
| Second photo-conduc-tive layer | $SiH_4$ 500 | 1,000 | 10 | 250 | 3 |
| Surface layer | $SiH_4$ 30<br>$CH_4$ 500<br>$CO_2$ 100<br>$NH_3$ 100<br>$SiF_4$ 10<br>$H_2$ 100 | 1,000 | 10 | 250 | 0.5 |

TABLE G5

| Layer | Gas used, & flow rate (sccm) | μW power (W) | Inner pressure (mTorr) | Sub-strate temp. (°C.) | Layer thickness (μm) |
|---|---|---|---|---|---|
| First Photo-conduc-tive layer | $SiH_4$ 500<br>$CH_4$ 250<br>$SiF_4$ 30 ppm (based on $SiH_4$) | 1,000 | 10 | 250 | 17 |
| Second photo-conduc-tive layer | $SiH_4$ 500 | 1,000 | 10 | 250 | 3 |
| Surface layer | $SiH_4$ 30<br>$CH_4$ 500<br>$CO_2$ 100<br>$NH_3$ 100<br>$SiF_4$ 10<br>$H_2$ 100 | 1,000 | 10 | 250 | 0.5 |

TABLE G5-continued

| Layer | Gas used, & flow rate (sccm) | μW power (W) | Inner pressure (mTorr) | Sub-strate temp. (°C.) | Layer thickness (μm) |
|---|---|---|---|---|---|
| conduc-tive layer | $SiF_4$ 30 ppm (based on $SiH_4$) | | | | |
| Second photo-conduc-tive layer | $SiH_4$ 500 | 1,000 | 10 | 250 | 3 |
| Surface layer | $SiH_4$ 30<br>$CH_4$ 500<br>$CO_2$ 100<br>$NH_3$ 100<br>$SiF_4$ 10<br>$H_2$ 100 | 1,000 | 10 | 250 | 0.5 |

TABLE G6

| Layer | Gas used, & flow rate (sccm) | RF power (W) | Inner pressure (Torr) | Sub-strate temp. (°C.) | Layer thickness (μm) |
|---|---|---|---|---|---|
| First Photo-conduc-tive layer | $SiH_4$ 500<br>$CH_4$ 150 → 0 (FIG. 8 pattern)<br>$SiF_4$ 30 ppm (based on $SiH_4$) | 500 | 0.5 | 250 | 17 |
| Second photo-conduc-tive layer | $SiH_4$ 500 | 500 | 0.5 | 250 | 0–20 |
| Surface layer | $SiH_4$ 30<br>$CH_4$ 500<br>$CO_2$ 100<br>$NH_3$ 100<br>$SiF_4$ 10<br>$H_2$ 100 | 500 | 0.3 | 250 | 0.5 |

TABLE G7

| | Layer thickness of Second conductive layer (μm) | Sensitivity (%) |
|---|---|---|
| Comparative Example G3: | 0 | 100 |
| Example G3: | 0.5 | 110 |
| | 1.0 | 115 |
| | 2.0 | 112 |
| | 5.0 | 110 |
| | 7.0 | 110 |
| | 10.0 | 105 |
| | 15.0 | 105 |
| | 20.0 | 102 |

TABLE G8

| Layer | Gas used, & flow rate (sccm) | μW power (W) | Inner pressure (mTorr) | Sub-strate temp. (°C.) | Layer thickness (μm) |
|---|---|---|---|---|---|
| First Photo-conduc-tive layer | $SiH_4$ 500<br>$CH_4$ 150 → 0 (FIG. 8 pattern)<br>$SiF_4$ 30 ppm (based on $SiH_4$) | 1,000 | 10 | 250 | 17 |
| Second | $SiH_4$ 500 | 1,000 | 10 | 250 | 0–10 |

TABLE G8-continued

| Layer | Gas used, & flow rate (sccm) | | μW power (W) | Inner pressure (mTorr) | Substrate temp. (°C.) | Layer thickness (μm) |
|---|---|---|---|---|---|---|
| photo-conductive layer | | | | | | |
| Surface layer | $SiH_4$ | 30 | 1,000 | 10 | 250 | 0.5 |
| | $CH_4$ | 500 | | | | |
| | $CO_2$ | 100 | | | | |
| | $NH_3$ | 100 | | | | |
| | $SiF_4$ | 10 | | | | |
| | $H_2$ | 100 | | | | |

TABLE G9

| Layer | Gas used, & flow rate (sccm) | | RF power (W) | Inner pressure (Torr) | Substrate temp. (°C.) | Layer thickness (μm) |
|---|---|---|---|---|---|---|
| First Photo-conductive layer | $SiH_4$ | 500 | 500 | 0.5 | 250 | 17 |
| | $CH_4$ | (Varied) | | | | |
| | $SiF_4$ | 30 ppm (based on $SiH_4$) | | | | |
| Second photo-conductive layer | $SiH_4$ | 500 | 500 | 0.5 | 250 | 3 |
| Surface layer | $SiH_4$ | 30 | 300 | 0.3 | 250 | 0.5 |
| | $CH_4$ | 500 | | | | |
| | $CO_2$ | 100 | | | | |
| | $NH_3$ | 100 | | | | |
| | $SiF_4$ | 10 | | | | |

TABLE G10

| | Pattern of carbon atom content | Chargeability | Sensitivity | Residual potential |
|---|---|---|---|---|
| Example G5: | FIG. 8 | AA | AA | AA |
| | FIG. 9 | AA | AA | AA |
| | FIG. 10 | AA | AA | AA |
| Comparative Example G5: | FIG. 11 | A | B | B |
| | FIG. 12 | AA | B | B |

TABLE G11

| Layer | Gas used, & flow rate (sccm) | | μW power (W) | Inner pressure (mTorr) | Substrate temp. (°C.) | Layer thickness (μm) |
|---|---|---|---|---|---|---|
| First Photo-conductive layer | $SiH_4$ | 500 | 1,000 | 10 | 250 | 17 |
| | $CH_4$ | (Varied) | | | | |
| | $SiF_4$ | 30 ppm (based on $SiH_4$) | | | | |
| Second photo-conductive layer | $SiH_4$ | 500 | 1,000 | 10 | 250 | 3 |
| Surface layer | $SiH_4$ | 30 | 1,000 | 10 | 250 | 0.5 |
| | $CH_4$ | 500 | | | | |
| | $CO_2$ | 100 | | | | |
| | $NH_3$ | 100 | | | | |
| | $SiF_4$ | 10 | | | | |

TABLE G12

| Layer | Gas used, & flow rate (sccm) | | RF power (W) | Inner pressure (Torr) | Substrate temp. (°C.) | Layer thickness (μm) |
|---|---|---|---|---|---|---|
| First Photo-conductive layer | $SiH_4$ | 500 | 500 | 0.5 | 250 | 17 |
| | $CH_4$ | (Varied)→0 (FIG. 8 pattern) | | | | |
| | $SiF_4$ | 30 ppm (based on $SiH_4$) | | | | |
| Second photo-conductive layer | $SiH_4$ | 500 | 500 | 0.5 | 250 | 3 |
| Surface layer | $SiH_4$ | 30 | 300 | 0.3 | 250 | 0.5 |
| | $CH_4$ | 500 | | | | |
| | $CO_2$ | 100 | | | | |
| | $NH_3$ | 100 | | | | |
| | $SiF_4$ | 10 | | | | |

TABLE G13

| Carbon atom content (at. %) | Chargeability | Sensitivity | Residual potential | White spots | (1) | (2) | (3) | (4) |
|---|---|---|---|---|---|---|---|---|
| Comparative Example G7: | | | | | | | | |
| 70 | AA | B | A | AA | AA | B | AA | B |
| 60 | AA | B | A | AA | AA | A | AA | B |
| Example G7: | | | | | | | | |
| 50 | AA | A | A | AA | AA | AA | AA | A |
| 40 | AA | AA | A | AA | AA | AA | AA | A |
| 30 | AA | AA | AA | AA | AA | AA | AA | AA |
| 20 | AA | AA | AA | AA | AA | AA | AA | AA |
| 10 | AA | AA | AA | AA | AA | AA | AA | AA |
| 5 | AA | AA | AA | AA | AA | AA | AA | AA |
| 1 | AA | AA | AA | AA | AA | AA | AA | AA |
| 0.5 | A | AA | AA | AA | AA | AA | A | A |
| Comparative Example G7: | | | | | | | | |
| 0.3 | B | AA | AA | B | A | AA | B | B |

(1): Coarse image
(2): Ghost
(3): Spherical protuberances
(4): Overall evaluation

TABLE G14

| Layer | Gas used, & flow rate (sccm) | | μW power (W) | Inner pressure (mTorr) | Substrate temp. (°C.) | Layer thickness (μm) |
|---|---|---|---|---|---|---|
| First Photo-conductive layer | $SiH_4$ | 500 | 1,000 | 10 | 250 | 17 |
| | $CH_4$ | (Varied)→0 (FIG. 8 pattern) | | | | |
| | $SiF_4$ | 30 ppm (based on $SiH_4$) | | | | |
| Second photo-conductive layer | $SiH_4$ | 500 | 1,000 | 10 | 250 | 3 |
| Surface layer | $SiH_4$ | 30 | 1,000 | 10 | 250 | 0.5 |
| | $CH_4$ | 500 | | | | |

TABLE G14-continued

| Layer | Gas used, & flow rate (sccm) | μW power (W) | Inner pressure (mTorr) | Substrate temp. (°C.) | Layer thickness (μm) |
|---|---|---|---|---|---|
| | $CO_2$ 100<br>$NH_3$ 100<br>$SiF_4$ 10 | | | | |

TABLE G15

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 150→0 (FIG. 8 pattern)<br>$SiF_4$ (Varied) | 500 | 0.5 | 250 | 17 |
| Second photoconductive layer | $SiH_4$ 500 | 500 | 0.5 | 250 | 3 |
| Surface layer | $SiH_4$ 30<br>$CH_4$ 500<br>$CO_2$ 100<br>$NH_3$ 100<br>$SiF_4$ 10 | 300 | 0.3 | 250 | 0.5 |

TABLE G16

(before running)

| | Fluorine atom content (at. ppm) | White spots | Coarse image | Ghost | Overall evaluation |
|---|---|---|---|---|---|
| Example G9: | 1 | AA | A | A | A |
| | 5 | AA | AA | AA | AA |
| | 10 | AA | AA | AA | AA |
| | 20 | AA | AA | AA | AA |
| | 30 | AA | AA | AA | AA |
| | 50 | AA | AA | AA | AA |
| | 95 | AA | AA | A | AA |
| Comparative Example G9: | 100 | AA | A | B | B |
| | 200 | AA | B | B | B |
| | 500 | AA | B | B | B |

TABLE G17

(after running)

| | Fluorine atom content (at. ppm) | White spots | Coarse image | Ghost | Overall evaluation |
|---|---|---|---|---|---|
| Example G9: | 1 | A | A | A | A |
| | 5 | AA | AA | A | AA |
| | 10 | AA | AA | AA | AA |
| | 20 | AA | AA | AA | AA |
| | 30 | AA | AA | AA | AA |
| | 50 | AA | AA | AA | AA |
| | 95 | AA | AA | A | AA |
| Comparative Example G9: | 100 | AA | A | B | B |
| | 200 | AA | B | B | B |
| | 500 | AA | B | C | C |

TABLE G18

| Layer | Gas used, & flow rate (sccm) | μW power (W) | Inner pressure (mTorr) | Substrate temp. (°C.) | Layer thickness (μm) |
|---|---|---|---|---|---|
| First Photoconductive layer | $SiH_4$ 500<br>$CH_4$ 150→0 (FIG. 8 pattern)<br>$SiF_4$ (Varied) | 1,000 | 10 | 250 | 17 |
| Second photoconductive layer | $SiH_4$ 500 | 1,000 | 10 | 250 | 3 |
| Surface layer | $SiH_4$ 30<br>$CH_4$ 500<br>$CO_2$ 100<br>$NH_3$ 100<br>$SiF_4$ 10 | 1,000 | 10 | 250 | 0.5 |

TABLE G19

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 150→0 (FIG. 8 pattern)<br>$SiF_4$ 30 ppm (based on $SiH_4$)<br>$CO_2$ (Varied) | 500 | 0.5 | 250 | 28 |
| Second photoconductive layer | $SiH_4$ 500 | 500 | 0.5 | 250 | 2 |
| Surface layer | $SiH_4$ 30<br>$CH_4$ 500<br>$CO_2$ 100<br>$NH_3$ 100<br>$SiF_4$ 10 | 300 | 0.3 | 250 | 0.5 |

TABLE G20

| | Oxygen content in 1st photoconductive layer (at. ppm) | Chargeability | Sensitivity | Residual potential | Potential shift | Overall evaluation |
|---|---|---|---|---|---|---|
| Comparative Example G11: | 5 | AA | AA | AA | A | A |
| Example G11: | 10 | AA | AA | AA | AA | AA |
| | 50 | AA | AA | AA | AA | AA |
| | 200 | AA | AA | AA | AA | AA |
| | 300 | AA | AA | AA | AA | AA |
| | 500 | AA | AA | AA | AA | AA |
| | 1,000 | AA | AA | AA | AA | AA |
| | 2,000 | AA | AA | AA | AA | AA |
| | 5,000 | AA | AA | AA | AA | AA |
| Comparative Example G11: | 7,000 | AA | B | B | AA | B |
| | 10,000 | AA | B | B | AA | B |

TABLE G21

| Layer | Gas used, & flow rate (sccm) | | μW power (W) | Inner pressure (mTorr) | Substrate temp. (°C.) | Layer thickness (μm) |
|---|---|---|---|---|---|---|
| First Photoconductive layer | $SiH_4$ | 500 | 1,000 | 10 | 250 | 28 |
| | $CH_4$ | 150→0 (FIG. 8 pattern) | | | | |
| | $SiF_4$ | 30 ppm (based on $SiH_4$) | | | | |
| | $CO_2$ | (Varied) | | | | |
| Second photoconductive layer | $SiH_4$ | 500 | 1,000 | 10 | 250 | 2 |
| Surface layer | $SiH_4$ | 30 | 1,000 | 10 | 250 | 0.5 |
| | $CH_4$ | 500 | | | | |
| | $CO_2$ | 100 | | | | |
| | $NH_3$ | 100 | | | | |
| | $SiF_4$ | 10 | | | | |

TABLE G22

| Layer | Gas used, & flow rate (sccm) | | RF power (W) | Inner pressure (Torr) | Substrate temp. (°C.) | Layer thickness (μm) |
|---|---|---|---|---|---|---|
| First Photoconductive layer | $SiH_4$ | 500 | 500 | 0.5 | 250 | 17 |
| | $CH_4$ | 150→0 (FIG. 8 pattern) | | | | |
| | $SiF_4$ | 30 ppm (based on $SiH_4$ ) | | | | |
| Second photoconductive layer | $SiH_4$ | 500 | 500 | 0.5 | 250 | 3 |
| Surface layer | $SiH_4$ | 30 | 300 | 0.3 | 250 | 0.5 |
| | CH | (Varied) | | | | |
| | $CO_2$ | (Varied) | | | | |
| | $NH_3$ | (Varied) | | | | |
| | $SiF_4$ | 10 | | | | |
| | $H_2$ | 100 | | | | |

TABLE G23

| a) Carbon content: | Example G13 | | | | | | | |
|---|---|---|---|---|---|---|---|---|
| (at. %) | 10 | 30 | 60 | 60 | 60 | 70 | 70 | 80 |
| b) Oxygen content: (at. %) | 20 | 5 | 3 | 8 | 8 | 4 | 6 | 3 |
| c) Nitrogen content: (at. %) | 20 | 8 | 5 | 5 | 15 | 5 | 9 | 5 |
| Total of b) & c): (at. %) | 40 | 13 | 8 | 13 | 23 | 9 | 15 | 8 |
| Total of a), b) & c): (at. %) | 50 | 43 | 68 | 73 | 83 | 79 | 85 | 88 |
| Chargeability: | A | A | AA | A | A | AA | A | AA |
| Sensitivity: | AA | AA | AA | AA | AA | AA | AA | AA |
| Residual potential: | AA | AA | AA | AA | AA | AA | AA | AA |
| Smeared image: | A | AA | AA | AA | A | AA | AA | AA |
| Image evaluation before running: | A | A | AA | A | A | AA | A | AA |
| Image evaluation after running: | A | A | AA | A | A | AA | A | AA |
| Overall evaluation: | A | A | AA | A | A | AA | A | AA |

| | Comparative Example | | | | | | | | |
|---|---|---|---|---|---|---|---|---|---|
| a) Carbon content: | 11 | | | | | | 12 | 13 | 14 |
| (at. %) | 10 | 10 | 30 | 30 | 60 | 90 | 0 | 50 | 50 |
| b) Oxygen content: (at. %) | 12 | 40 | 2 | 35 | 18 | 2 | 40 | 0 | 10 |
| c) Nitrogen content: (at. %) | 10 | 45 | 3 | 30 | 15 | 4 | 20 | 10 | 0 |
| Total of b) & c): (at. %) | 22 | 85 | 5 | 65 | 33 | 6 | 60 | 60 | 60 |
| Total of a), b) & c): (at. %) | 32 | 95 | 35 | 95 | 93 | 96 | 60 | 60 | 60 |
| Chargeability: | B | A | A | A | A | AA | A | A | A |
| Sensitivity: | A | AA | AA | AA | AA | AA | AA | AA | AA |
| Residual potential: | AA | AA | AA | AA | AA | AA | B | B | B |
| Smeared image: | A | A | AA | A | A | AA | A | A | A |
| Image evaluation before running: | B | A | B | A | A | A | A | A | A |

TABLE G23-continued

| | | | | | | | | | |
|---|---|---|---|---|---|---|---|---|---|
| Image evaluation after running: | B | B | B | B | B | B | B | B | B |
| Overall evaluation: | B | B | B | B | B | B | B | B | B |

TABLE G24

| Layer | Gas used, & flow rate (sccm) | | μW power (W) | Inner pressure (mTorr) | Substrate temp. (°C.) | Layer thickness (μm) |
|---|---|---|---|---|---|---|
| First Photoconductive layer | $SiH_4$ | 500 | 1,000 | 10 | 250 | 17 |
| | $CH_4$ | 150→0 (FIG. 8 pattern) | | | | |
| | $SiF_4$ | 30 ppm (based on $SiH_4$) | | | | |
| Second photoconductive layer | $SiH_4$ | 500 | 1,000 | 10 | 250 | 3 |
| Surface layer | $SiH_4$ | 30 | 1,000 | 10 | 250 | 0.5 |
| | $CH_4$ | (Varied) | | | | |
| | $CO_2$ | (Varied) | | | | |
| | $NH_3$ | (Varied) | | | | |
| | $SiF_4$ | 10 | | | | |
| | $H_2$ | 100 | | | | |

TABLE G25

| Layer | Gas used, & flow rate (sccm) | | RF power (W) | Inner pressure (Torr) | Substrate temp. (°C.) | Layer thickness (μm) |
|---|---|---|---|---|---|---|
| First Photoconductive layer | $SiH_4$ | 500 | 500 | 0.5 | 250 | 17 |
| | $CH_4$ | 150→0 (FIG. 8 pattern) | | | | |
| | $SiF_4$ | 30 ppm (based on $SiH_4$) | | | | |
| Second photoconductive layer | $SiH_4$ | 500 | 500 | 0.5 | 250 | 3 |
| Surface layer | $SiH_4$ | 30 | 300 | 0.3 | 250 | 0.5 |
| | $CH_4$ | 500 | | | | |
| | $CO_2$ | 100 | | | | |
| | $NH_3$ | 100 | | | | |
| | $SiF_4$ | (Varied) | | | | |
| | $H_2$ | (Varied) | | | | |

TABLE G26

| a) Hydrogen content: | Example G15 | | | | | | | | Cp.* G19 | |
|---|---|---|---|---|---|---|---|---|---|---|
| (at. %) | 21 | 30 | 30 | 30 | 48 | 48 | 61 | 61 | 11 | 53 |
| b) Fluorine content: (at. %) | 15 | 3 | 9 | 18 | 3 | 19 | 3 | 8 | 18 | 18 |
| Total of a) & b): (at. %) | 36 | 33 | 39 | 48 | 51 | 67 | 64 | 69 | 29 | 71 |
| Sensitivity: | AA | AA | AA | AA | AA | AA | AA | AA | B | B |
| Residual potential: | AA | AA | AA | AA | AA | AA | AA | AA | B | B |
| Smeared image: | AA | AA | AA | AA | AA | AA | AA | AA | AA | AA |
| Overall evaluation: | AA | AA | AA | AA | AA | AA | AA | AA | B | B |

| a) Hydrogen content: | Cp.* G19 | | Cp* G20 | | | | Cp* G21 | | | |
|---|---|---|---|---|---|---|---|---|---|---|
| (at. %) | 61 | 70 | 11 | 21 | 30 | 48 | 30 | 48 | 70 | 76 |
| b) Fluorine content: (at. %) | 12 | 4 | 24 | 23 | 23 | 21 | 0 | 0 | 0 | 0 |
| Total of a) & b): (at. %) | 73 | 74 | 35 | 44 | 53 | 69 | 30 | 48 | 70 | 76 |
| Sensitivity: | B | B | AA | AA | AA | AA | A | A | A | B |
| Residual potential: | B | A | B | B | B | B | A | A | A | B |
| Smeared image: | AA | AA | AA | AA | AA | AA | A | A | A | B |

TABLE G26-continued

| | | | | | | | | | | |
|---|---|---|---|---|---|---|---|---|---|---|
| Overall evaluation: | B | B | B | B | B | B | A | A | A | B |

TABLE G27

| Layer | Gas used, & flow rate (sccm) | | μW power (W) | Inner pressure (mTorr) | Substrate temp. (°C.) | Layer thickness (μm) |
|---|---|---|---|---|---|---|
| First Photoconductive layer | $SiH_4$ | 500 | 1,000 | 10 | 250 | 17 |
| | $CH_4$ | 150→0 (FIG. 8 pattern) | | | | |
| | $SiF_4$ | 30 ppm (based on $SiH_4$) | | | | |
| Second photoconductive layer | $SiH_4$ | 500 | 1,000 | 10 | 250 | 3 |
| Surface layer | $SiH_4$ | 30 | 1,000 | 10 | 250 | 0.5 |
| | $CH_4$ | 500 | | | | |
| | $CO_2$ | 100 | | | | |
| | $NH_3$ | 100 | | | | |
| | $SiF_4$ | (Varied) | | | | |
| | $H_2$ | (Varied) | | | | |

TABLE G28

| Layer | Gas used, & flow rate (sccm) | | RF power (W) | Inner pressure (Torr) | Substrate temp. (°C.) | Layer thickness (μm) |
|---|---|---|---|---|---|---|
| First Photoconductive layer | $SiH_4$ | 500 | 500 | 0.5 | 250 | 17 |
| | $CH_4$ | 150→0 (FIG. 8 pattern) | | | | |
| | $B_2H_6$ | | | | | |
| | $SiF_4$ | 30 ppm (based on $SiH_4$) | | | | |
| | $CO_2$ | 300 ppm (based on $SiH_4$) | | | | |
| Second photoconductive layer | $SiH_4$ | 500 | 500 | 0.5 | 250 | 3 |
| | $B_2H_6$ | | | | | |
| Surface layer | $SiH_4$ | 30 | 300 | 0.3 | 250 | 0.5 |
| | $CH_4$ | 500 | | | | |
| | $CO_2$ | 100 | | | | |
| | $NH_3$ | 100 | | | | |
| | $SiF_4$ | 10 | | | | |
| | $H_2$ | 100 | | | | |

TABLE G29

| Pattern | $B_2H_6$ content in 1st photoconductive layer (ppm) | $B_2H_6$ content in 2nd photoconductive layer (ppm) |
|---|---|---|
| a | 0 | 0 |
| b | 10 | 0.5 |
| c | 20→1* | 1→0* |
| d | 20→0.5* | 0.5 |

TABLE G30

| Pattern | Chargeability | Sensitivity | Residual potential | Overall evaluation |
|---|---|---|---|---|
| a | AA | A | AA | A |
| b | AA | AA | AA | AA |

TABLE G30-continued

| Pattern | Chargeability | Sensitivity | Residual potential | Overall evaluation |
|---|---|---|---|---|
| c | AA | AA | AA | AA |
| d | AA | AA | AA | AA |

TABLE G31

| Layer | Gas used, & flow rate (sccm) | | μW power (W) | Inner pressure (mTorr) | Substrate temp. (°C.) | Layer thickness (μm) |
|---|---|---|---|---|---|---|
| First Photoconductive layer | $SiH_4$ | 500 | 1,000 | 10 | 250 | 17 |
| | $CH_4$ | 150→0 (FIG. 8 pattern) | | | | |
| | $B_2H_6$ | | | | | |
| | $SiF_4$ | 30 ppm (based on $SiH_4$) | | | | |
| | $CO_2$ | 300 ppm (based on $SiH_4$) | | | | |
| Second photoconductive layer | $SiH_4$ | 500 | 1,000 | 10 | 250 | 3 |
| | $B_2H_6$ | | | | | |
| Surface layer | $SiH_4$ | 30 | 1,000 | 10 | 250 | 0.5 |
| | $CH_4$ | 500 | | | | |
| | $CO_2$ | 100 | | | | |
| | $NH_3$ | 100 | | | | |
| | $SiF_4$ | 10 | | | | |
| | $H_2$ | 100 | | | | |

TABLE H1

| Conditions | Layer structure: First photoconductive layer | Second photoconductive layer | Surface layer |
|---|---|---|---|
| Gas used, flow rate: | | | |
| $SiH_4$ (sccm) | 500 | 500 | 10 |
| $CH_4$ (sccm) | 350→0 (FIG. 8 pattern) | | 750 |
| $SiF_4$ (ppm)* | 50 | | |
| $CO_2$ (ppm)* | 100 | | 1,000 |
| $B_2H_6$ (ppm)* | | | 3 |
| NO (ppm)* | | | |
| $SiF_4$ (sccm) | | | 30 |
| RF power: (W) | 500 | 500 | 300 |
| Inner pressure: (Torr) | 0.5 | 0.5 | 0.5 |
| Substrate temperature: (°C.) | 250 | 250 | 250 |
| Layer thickness: (μm) | 20 | 3 | 0.5 |

*(based on $SiH_4$)

TABLE H2

| Conditions | Layer structure: First photo-conductive layer | Second photo-conductive layer | Surface layer |
|---|---|---|---|
| Gas used, & flow rate: | | | |
| $SiH_4$ (sccm) | 500 | 500 | 10 |
| $CH_4$ (sccm) | 100 | | 750 |
| $SiF_4$ (ppm)* | 50 | | |
| $CO_2$ (ppm)* | 100 | | 1,000 |
| $B_2H_6$ (ppm)* | | | 3 |
| NO (ppm)* | | | |
| $SiF_4$ (sccm) | | | 30 |
| RF power: (W) | 500 | 500 | 300 |
| Inner pressure: (Torr) | 0.5 | 0.5 | 0.5 |
| Substrate temperature: (°C.) | 250 | 250 | 250 |
| Layer thickness: (μm) | 20 | 3 | 0.5 |

*(based on $SiH_4$)

TABLE H3

| | Charge-ability | Sensi-tivity | Residual potential |
|---|---|---|---|
| Example H1: | AA | AA | AA |
| Comparative Example H1: | A | B | B |

TABLE H4

| Conditions | Layer structure: First photo-conductive layer | Second photo-conductive layer | Surface layer |
|---|---|---|---|
| Gas used, & flow rate: | | | |
| $SiH_4$ (sccm) | 500 | 500 | 80 |
| $CH_4$ (sccm) | →0 | | 500 |
| $SiF_4$ (ppm)* | 50 | | |
| $CO_2$ (ppm)* | | | 60 |
| $B_2H_6$ (ppm)* | | | 2 |
| NO (ppm)* | | | |
| $SiF_4$ (sccm) | | | 30 |
| μW power: (W) | 1,000 | 1,000 | 1,000 |
| Inner pressure: (mTorr) | 10 | 10 | 10 |
| Substrate temperature: (°C.) | 250 | 250 | 250 |
| Layer thickness: (μm) | 20 | 3 | 0.5 |

*(based on $SiH_4$)

TABLE H5

| Conditions | Layer structure: First photo-conductive layer | Second photo-conductive layer | Surface layer |
|---|---|---|---|
| Gas used, & flow rate: | | | |
| $SiH_4$ (sccm) | 500 | 500 | 80 |
| $CH_4$ (sccm) | 100 | | 500 |
| $SiF_4$ (ppm)* | 50 | | |
| $CO_2$ (ppm)* | | | 60 |
| $B_2H_6$ (ppm)* | | | 2 |
| NO (ppm)* | | | |
| $SiF_4$ (sccm) | | | 30 |
| μW power: (W) | 1,000 | 1,000 | 1,000 |
| Inner pressure: (mTorr) | 10 | 10 | 10 |
| Substrate temperature: (°C.) | 250 | 250 | 250 |
| Layer thickness: (μm) | 20 | 3 | 0.5 |

*(based on $SiH_4$)

TABLE H6

| Conditions | Layer structure: First photo-conductive layer | Second photo-conductive layer | Surface layer |
|---|---|---|---|
| Gas used, & flow rate: | | | |
| $SiH_4$ (sccm) | 500 | 500 | 10 |
| $CH_4$ (sccm) | 150→0 | | 750 |
| $SiF_4$ (ppm)* | 50 | | |
| $CO_2$ (ppm)* | 100 | | 1,000 |
| $B_2H_6$ (ppm)* | | | 3 |
| NO (ppm)* | | | |
| $SiF_4$ (sccm) | | | 30 |
| RF power: (W) | 500 | 500 | 300 |
| Inner pressure: (Torr) | 0.5 | 0.5 | 0.5 |
| Substrate temperature: (°C.) | 250 | 250 | 250 |
| Layer thickness: (μm) | 20 | Varied | 0.5 |

*(based on $SiH_4$)

TABLE H7

| Layer thickness of Second conductive layer (μm) | Sensitivity (%) |
|---|---|
| 0 | 100 |
| 0.5 | 110 |
| 1.0 | 115 |
| 2.0 | 112 |
| 5.0 | 110 |
| 7.0 | 110 |
| 10.0 | 105 |
| 15.0 | 105 |

TABLE H8

| Conditions | Layer structure: First photo-conductive layer | Second photo-conductive layer | Surface layer |
|---|---|---|---|
| Gas used, & flow rate: | | | |
| $SiH_4$ (sccm) | 500 | 500 | 80 |
| $CH_4$ (sccm) | 200→0 | | 500 |
| $SiF_4$ (ppm)* | 50 | | |
| $CO_2$ (ppm)* | | | 60 |
| $B_2H_6$ (ppm)* | | | 2 |
| NO (ppm)* | | | |
| $SiF_4$ (sccm) | | | 30 |
| μW power: (W) | 1,000 | 1,000 | 1,000 |
| Inner pressure: (mTorr) | 10 | 10 | 10 |
| Substrate temperature: (°C.) | 250 | 250 | 250 |
| Layer thickness: (μm) | 20 | Varied | 0.5 |

*(based on $SiH_4$)

TABLE H9

| Conditions | Layer structure: First photo-conductive layer | Second photo-conductive layer | Surface layer |
|---|---|---|---|
| Gas used, & flow rate: | | | |
| $SiH_4$ (sccm) | 500 | 500 | 10 |
| $CH_4$ (sccm) | Patterns of FIGS. 8 to 10 | | 750 |
| $SiF_4$ (ppm)* | 50 | | |
| $CO_2$ (ppm)* | | | 1,500 |
| $B_2H_6$ (ppm)* | | | 2 |
| NO (ppm)* | | | |
| $SiF_4$ (sccm) | | | 30 |
| RF power: (W) | 500 | 500 | 300 |
| Inner pressure: (Torr) | 0.5 | 0.5 | 0.5 |
| Substrate temperature: (°C.) | 250 | 250 | 250 |
| Layer thickness: (μm) | 20 | 3 | 0.5 |

*(based on $SiH_4$)

TABLE H10

| | Pattern of carbon atom content | Charge-ability | Sensi-tivity | Residual potential |
|---|---|---|---|---|
| Example H5: | FIG. 8 | AA | AA | AA |
| | FIG. 9 | AA | AA | AA |
| | FIG. 10 | AA | AA | AA |
| Comparative | FIG. 11 | A | B | B |
| Example H5: | FIG. 12 | AA | B | B |

TABLE H11

| Conditions | Layer structure: First photo-conductive layer | Second photo-conductive layer | Surface layer |
|---|---|---|---|
| Gas used, & flow rate: | | | |
| $SiH_4$ (sccm) | 500 | 500 | 80 |
| $CH_4$ (sccm) | Patterns of FIGS. 8 to 10 | 500 | |
| $SiF_4$ (ppm)* | 50 | | |
| $CO_2$ (ppm)* | | | 60 |
| $B_2H_6$ (ppm)* | | | 2 |
| NO (ppm)* | | | |
| $SiF_4$ (sccm) | | | 30 |
| μW power: (W) | 1,000 | 1,000 | 1,000 |
| Inner pressure: (mTorr) | 10 | 10 | 10 |
| Substrate temperature: (°C.) | 250 | 250 | 250 |
| Layer thickness: (μm) | 20 | 3 | 0.5 |

*(based on $SiH_4$)

TABLE H12

| Conditions | Layer structure: First photo-conductive layer | Second photo-conductive layer | Surface layer |
|---|---|---|---|
| Gas used, & flow rate: | | | |
| $SiH_4$ (sccm) | 500 | 500 | 15 |
| $CH_4$ (sccm) | varied→0 | | 800 |
| $SiF_4$ (ppm)* | 50 | | |
| $CO_2$ (ppm)* | 1,000 | | 1,000 |
| $B_2H_6$ (ppm)* | | | 3.5 |
| NO (ppm)* | | | |
| $SiF_4$ (sccm) | | | 20 |
| RF power: (W) | 500 | 500 | 300 |
| Inner pressure: (Torr) | 0.5 | 0.5 | 0.5 |
| Substrate temperature: (°C.) | 250 | 250 | 250 |
| Layer thickness: (μm) | 20 | 3 | 0.5 |

*(based on $SiH_4$)

TABLE H13

| Carbon atom content (at. %) | Charge-ability | Sen-si-ti-vity | Resi-dual po-ten-tial | White spots | (1) | (2) | (3) | (4) |
|---|---|---|---|---|---|---|---|---|
| Comparative Example H7: | | | | | | | | |
| 70 | AA | B | A | AA | AA | B | AA | B |
| 60 | AA | B | A | AA | AA | A | AA | B |
| Example H7: | | | | | | | | |
| 50 | AA | A | A | AA | AA | AA | AA | A |

TABLE H13-continued

| Carbon atom content (at. %) | Chargeability | Sensitivity | Residual potential | White spots | (1) | (2) | (3) | (4) |
|---|---|---|---|---|---|---|---|---|
| 40 | AA | AA | A | AA | AA | AA | AA | A |
| 30 | AA | AA | AA | AA | AA | AA | AA | AA |
| 20 | AA | AA | AA | AA | AA | AA | AA | AA |
| 10 | AA | AA | AA | AA | AA | AA | AA | AA |
| 5 | AA | AA | AA | AA | AA | AA | AA | AA |
| 1 | AA | AA | AA | AA | AA | AA | AA | AA |
| 0.5 | A | AA | AA | AA | AA | AA | A | A |
| Comparative Example H7: | | | | | | | | |
| 0.3 | B | AA | AA | B | A | AA | B | B |

(1): Coarse image
(2): Ghost
(3): Spherical protuberances
(4): Overall evaluation

TABLE H14

| Conditions | Layer structure: First photoconductive layer | Second photoconductive layer | Surface layer |
|---|---|---|---|
| Gas used, & flow rate: | | | |
| $SiH_4$ (sccm) | 300 | 250 | 75 |
| $CH_4$ (sccm) | Varied→0 (FIG. 8 pattern) | | 500 |
| $SiF_4$ (ppm)* | 50 | | |
| $Co_2$ (ppm)* | 1,000 | | |
| $B_2H_6$ (ppm)* | | | 10 |
| NO (ppm)* | | | 1,000 |
| $SiF_4$ (sccm) | | | 35 |
| μW power: (W) | 1,000 | 1,000 | 1,000 |
| Inner pressure: (mTorr) | 10 | 10 | 10 |
| Substrate temperature: (°C.) | 250 | 250 | 250 |
| Layer thickness: (μm) | 20 | 4 | 0.5 |

*(based on $SiH_4$)

TABLE H15

| Conditions | Layer structure: First photoconductive layer | Second photoconductive layer | Surface layer |
|---|---|---|---|
| Gas used, & flow rate: | | | |
| $SiH_4$ (sccm) | 300 | 300 | 15 |
| $CH_4$ (sccm) | 200→0 | | 800 |
| $SiF_4$ (ppm)* | Varied | | |
| $CO_2$ (ppm)* | 1,000 | | 1,000 |
| $B_2H_6$ (ppm)* | | | 3.5 |
| NO (ppm)* | | | |
| $SiF_4$ (sccm) | 1 | | 20 |
| RF power: (W) | 500 | 500 | 300 |
| Inner pressure: (Torr) | 0.5 | 0.5 | 0.5 |
| Substrate temperature: (°C.) | 250 | 250 | 250 |
| Layer thickness: (μm) | 20 | 3 | 0.5 |

*(based on $SiH_4$)

TABLE H16

| Fluorine atom content: (at. %) | Cp. *H9 | Example H9 | | | | | | | | Cp. *H9 |
|---|---|---|---|---|---|---|---|---|---|---|
| | 0.5 | 1 | 5 | 10 | 50 | 70 | 80 | 95 | 150 | 300 |
| Evaluation items (before running) | | | | | | | | | | |
| White spots: | AA | AA | AA | AA | AA | AA | AA | AA | AA | AA |
| Coarse image: | B | A | AA | AA | AA | AA | AA | AA | A | A |

TABLE H16-continued (before running)

| Fluorine atom content: | Cp. *H9 | Example H9 | | | | | | | | Cp. *H9 |
|---|---|---|---|---|---|---|---|---|---|---|
| (at. %) | 0.5 | 1 | 5 | 10 | 50 | 70 | 80 | 95 | 150 | 300 |
| Ghost: | B | A | A | AA | AA | AA | AA | A | B | B |

*Comparative Example

TABLE H17

(after running)

| Fluorine atom content: | Cp. *H9 | Example H9 | | | | | | | | Cp. *H9 |
|---|---|---|---|---|---|---|---|---|---|---|
| (at. %) | 0.5 | 1 | 5 | 10 | 50 | 70 | 80 | 95 | 150 | 300 |
| Evaluation items | | | | | | | | | | |
| White spots: | B | A | AA | AA | AA | AA | AA | AA | AA | AA |
| Coarse image: | B | A | AA | AA | AA | AA | AA | AA | B | B |
| Ghost: | B | B | A | AA | AA | AA | AA | A | B | B |

*Comparative Example

TABLE H18

| Conditions | Layer structure | | |
|---|---|---|---|
| | First photo-conductive layer | Second photo-conductive layer | Surface layer |
| Gas used, & flow rate: | | | |
| $SiH_4$ (sccm) | 300 | 250 | 75 |
| $CH_4$ (sccm) | 150→0 | | 500 |
| $SiF_4$ (ppm)* | Varied | | |
| $CO_2$(ppm)* | 1,000 | | |
| $B_2H_6$ (ppm)* | | | 10 |
| NO (ppm)* | | | 1,000 |
| $SiF_4$ (sccm) | | | 35 |
| μW power: (W) | 1,000 | 1,000 | 1,000 |
| Inner pressure: (mTorr) | 10 | 10 | 10 |
| Substrate temperature: (°C.) | 250 | 250 | 250 |
| Layer thickness: (μm) | 20 | 2 | 0.5 |

*(based on $SiH_4$)

TABLE H19

| Conditions | Layer structure | | |
|---|---|---|---|
| | First photo-conductive layer | Second photo-conductive layer | Surface layer |
| Gas used, & flow rate: | | | |
| $SiH_4$ (sccm) | 500 | 500 | 15 |

TABLE H19-continued

| Conditions | Layer structure | | |
|---|---|---|---|
| | First photo-conductive layer | Second photo-conductive layer | Surface layer |
| $CH_4$ (sccm) | 150→0 | | 800 |
| $SiF_4$ (ppm)* | 50 | | |
| $CO_2$(ppm)* | Varied | | 1,000 |
| $B_2H_6$ (ppm)* | | | 3.5 |
| NO (ppm)* | | | |
| $SiF_4$ (sccm) | | | 20 |
| RF power: (W) | 500 | 500 | 300 |
| Inner pressure: (Torr) | 0.5 | 0.5 | 0.5 |
| Substrate temperature: (°C.) | 250 | 250 | 250 |
| Layer thickness: (μm) | 20 | 3 | 0.5 |

*(based on $SiH_4$)

TABLE H20

| Oxygen atom content | Cp.* H11 | Example H11 | | | | | | Cp. *H11 | |
|---|---|---|---|---|---|---|---|---|---|
| (at. %) | 5 | 10 | 100 | 250 | 1000 | 3000 | 5000 | 8000 | 10000 |
| Evaluation items | | | | | | | | | |
| Chargeability: | A | A | AA | AA | AA | AA | AA | AA | AA |
| Sensitivity: | AA | AA | AA | AA | AA | AA | AA | B | B |
| Residual potential: | AA | AA | AA | AA | AA | AA | AA | A | B |
| Potential shift: | A | A | AA | AA | AA | AA | AA | AA | A |

*Comparative Example

TABLE H21

| Conditions | Layer structure: First photo-conductive layer | Second photo-conductive layer | Surface layer |
|---|---|---|---|
| Gas used, & flow rate: | | | |
| $SiH_4$ (sccm) | 500 | 500 | 15 |
| $CH_4$ (sccm) | 150→0 | | Varied |
| $SiF_4$ (ppm)* | 50 | | |
| $CO_2$(ppm)* | 500 | | 1,000 |
| $B_2H_6$ (ppm)* | | | 3.5 |
| NO (ppm)* | | | |
| $SiF_4$ (sccm) | | | 20 |
| RF power: (W) | 500 | 500 | Varied |
| Inner pressure: (Torr) | 0.5 | 0.5 | 0.5 |
| Substrate temperature: (°C.) | 250 | 250 | 250 |
| Layer thickness: (μm) | 20 | 3 | 0.5 |

*(based on $SiH_4$)

TABLE H22

(before running)

| Carbon atom content: | Cp. *H12 | | | Example H12 | | | | | | Cp. *H12 | |
|---|---|---|---|---|---|---|---|---|---|---|---|
| (at. %) | 20 | 40 | 60 | 63 | 70 | 75 | 83 | 86 | 90 | 93 | 95 |
| Evaluation items | | | | | | | | | | | |
| Chargeability: | B | B | A | AA | AA | AA | AA | AA | AA | AA | AA |
| Sensitivity: | B | B | A | AA | AA | AA | AA | A | A | B | B |
| Residual potential: | AA | AA | AA | AA | AA | AA | AA | AA | AA | A | B |
| Smeared image: | B | B | A | AA | AA | AA | AA | AA | A | B | B |
| White spots: | B | B | A | AA | AA | AA | AA | AA | AA | AA | AA |
| Black dots caused by melt-adhesion of toner: | B | B | A | AA | AA | AA | AA | AA | AA | AA | AA |
| Scratches: | B | B | A | AA | AA | AA | AA | AA | AA | AA | AA |

*Comparative Example

TABLE H23

(after running)

| Carbon atom content: | Cp. *H12 | | | Example H12 | | | | | Cp. *H12 | | |
|---|---|---|---|---|---|---|---|---|---|---|---|
| (at. %) | 20 | 40 | 60 | 63 | 70 | 75 | 83 | 86 | 90 | 93 | 95 |
| Evaluation items | | | | | | | | | | | |
| Chargeability: | B | B | A | AA | AA | AA | AA | AA | AA | AA | AA |
| Sensitivity: | B | B | A | AA | AA | AA | AA | A | A | B | B |
| Residual potential: | AA | AA | AA | AA | AA | AA | AA | AA | AA | A | B |
| Smeared image: | B | B | A | AA | AA | AA | AA | AA | A | B | B |
| White spots: | B | B | A | AA | AA | AA | AA | AA | AA | AA | AA |
| Black dots caused by melt-adhesion of toner: | B | B | A | AA | AA | AA | AA | AA | AA | AA | AA |
| Scratches: | B | B | A | AA | AA | AA | AA | AA | AA | AA | AA |

*Comparative Example

TABLE H24

| Conditions | Layer structure: First photo-conductive layer | Second photo-conductive layer | Surface layer |
|---|---|---|---|
| Gas used, & flow rate: | | | |
| $SiH_4$ (sccm) | 300 | 250 | 75 |
| $CH_4$ (sccm) | 150→0 | | Varied |
| $SiF_4$ (ppm)* | 50 | | |
| $CO_2$(ppm)* | 1,000 | | |
| $B_2H_6$ (ppm)* | | | 10 |
| NO (ppm)* | | | 1,000 |
| $SiF_4$ (sccm) | | | 35 |
| μW power: (W) | 1,000 | 1,000 | Varied |
| Inner pressure: (mTorr) | 10 | 10 | 10 |
| Substrate temperature: (°C.) | 250 | 250 | 250 |
| Layer thickness: (μm) | 20 | 3 | 0.5 |

*(based on $SiH_4$)

TABLE H25

| Conditions | Layer structure: First photo-conductive layer | Second photo-conductive layer | Surface layer |
|---|---|---|---|
| Gas used, & flow rate: | | | |
| SiH 4 (sccm) | 500 | 500 | 15 |
| $CH_4$ (sccm) | 150→0 | | 800 |
| $SiF_4$ (ppm)* | 50 | | |
| $CO_2$ (ppm)* | 500 | | 1,000 |
| $B_2H_6$ (ppm)* | | | 3.5 |
| NO (ppm)* | | | |
| $SiF_4$ (sccm) | | | 20 |
| $O_2$ | | | Varied |
| RF power: (W) | 500 | 500 | 300 |
| Inner pressure: (Torr) | 0.5 | 0.5 | 0.5 |
| Substrate temperature: (°C.) | 250 | 250 | 250 |
| Layer thickness: (μm) | 20 | 3 | 0.5 |

*(based on $SiH_4$)

TABLE H26

| | (before running) | | | | | | | | | | |
|---|---|---|---|---|---|---|---|---|---|---|---|
| | Cp* H14 | Example H14 | | | | | | | | Cp. *H14 | |
| Oxygen atom content: | 1 × | 1 × | 3 × | 1 × | 5 × | | | | | | |
| (at. %) | $10^{-5}$ | $10^{-4}$ | $10^{-4}$ | $10^{-3}$ | $10^{-3}$ | 1 | 20 | 25 | 30 | 40 | 50 |
| Evaluation items | | | | | | | | | | | |
| Chargeability: | B | A | AA | AA | AA | AA | AA | AA | AA | AA | AA |
| Sensitivity: | B | A | AA | AA | AA | AA | AA | AA | A | B | B |
| Residual potential: | A | AA | AA | AA | AA | AA | AA | A | A | B | B |
| Smeared image: | B | A | AA | AA | AA | AA | AA | AA | AA | AA | AA |
| White spots: | B | A | AA | AA | AA | AA | AA | AA | AA | AA | AA |
| Black dots caused by melt-adhesion of toner: | B | A | AA | AA | AA | AA | AA | AA | AA | AA | AA |
| Scratches: | A | A | AA | AA | AA | AA | AA | AA | AA | AA | AA |

*Comparative Example

TABLE H27

| | (after running) | | | | | | | | | | |
|---|---|---|---|---|---|---|---|---|---|---|---|
| | Cp* H14 | Example H14 | | | | | | | | Cp. *H14 | |
| Oxygen atom content: | 1 × | 1 × | 3 × | 1 × | 5 × | | | | | | |
| (at. %) | $10^{-5}$ | $10^{-4}$ | $10^{-4}$ | $10^{-3}$ | $10^{-3}$ | 1 | 20 | 25 | 30 | 40 | 50 |
| Evaluation items | | | | | | | | | | | |
| Chargeability: | B | A | AA | AA | AA | AA | AA | AA | AA | AA | AA |
| Sensitivity: | B | A | AA | AA | AA | AA | AA | AA | A | B | B |
| Residual potential: | A | AA | AA | AA | AA | AA | AA | A | A | B | B |
| Smeared image: | A | A | AA | AA | AA | AA | AA | AA | AA | AA | AA |
| White spots: | A | AA | AA | AA | AA | AA | AA | AA | AA | AA | AA |
| Black dots caused by melt-adhesion of toner: | B | A | AA | AA | AA | AA | AA | AA | AA | AA | AA |
| Scratches: | B | A | AA | AA | AA | AA | AA | AA | AA | AA | AA |

*Comparative Example

TABLE H28

| | Layer structure | | |
|---|---|---|---|
| Conditions | First photo-conductive layer | Second photo-conductive layer | Surface layer |
| Gas used, & flow rate: | | | |
| $SiH_4$ (sccm) | 300 | 250 | 75 |
| $CH_4$ (sccm) | 150→0 | | 800 |
| $SiF_4$ (ppm)* | 50 | | |
| $CO_2$ (ppm)* | 1,000 | | |
| $B_2H_6$ (ppm)* | | | 10 |
| NO (ppm)* | | | 1,000 |
| $SiF_4$ (sccm) | | | 35 |
| $O_2$ | | | Varied |
| μW power: (W) | 1,000 | 1,000 | 1,000 |
| Inner pressure: (mTorr) | 10 | 10 | 10 |
| Substrate temperature: (°C.) | 250 | 250 | 250 |
| Layer thickness: (μm) | 20 | 4 | 0.5 |

*(based on $SiH_4$)

TABLE H29

| Conditions | Layer structure: First photo-conductive layer | Second photo-conductive layer | Surface layer |
|---|---|---|---|
| Gas used, & flow rate: | | | |
| $SiH_4$ (sccm) | 300 | 300 | 15 |
| $CH_4$ (sccm) | 150→0 | | 750 |
| $SiF_4$ (ppm)* | 50 | | |
| $CO_2$ (ppm)* | 500 | | 1,000 |
| $B_2H_6$ (ppm)* | | | 3.5 |
| $SiF_4$ (sccm) | | | 20 |
| $N_2$ | | | Varied |
| RF power: (W) | 500 | 500 | 300 |
| Inner pressure: (Torr) | 0.5 | 0.5 | 0.5 |
| Substrate temperature: (°C.) | 250 | 250 | 250 |
| Layer thickness: (μm) | 20 | 3 | 0.5 |

*(based on $SiH_4$)

TABLE H30

| Nitrogen atom content: (at. %) | Cp* H16 (before running) | Example H16 | | | | | | | | Cp. *H16 | |
|---|---|---|---|---|---|---|---|---|---|---|---|
| | 1 × $10^{-5}$ | 1 × $10^{-4}$ | 3 × $10^{-4}$ | 1 × $10^{-3}$ | 5 × $10^{-3}$ | 1 | 20 | 25 | 30 | 40 | 50 |
| Evaluation items | | | | | | | | | | | |
| Chargeability: | B | A | AA | AA | AA | AA | AA | AA | AA | AA | AA |
| Sensitivity: | B | A | AA | AA | AA | AA | AA | AA | A | B | B |
| Residual potential: | AA | AA | AA | AA | AA | AA | AA | A | A | B | B |
| Smeared image: | B | A | AA | AA | AA | AA | AA | AA | AA | AA | AA |
| White spots: | B | A | AA | AA | AA | AA | AA | AA | AA | AA | AA |
| Black dots caused by melt-adhesion of toner: | B | A | AA | AA | AA | AA | AA | AA | AA | AA | AA |
| Scratches: | A | A | AA | AA | AA | AA | AA | AA | AA | AA | AA |

*Comparative Example

TABLE H31

| Nitrogen atom content: (at. %) | Cp* H16 (after running) | Example H16 | | | | | | | | Cp. *H16 | |
|---|---|---|---|---|---|---|---|---|---|---|---|
| | 1 × $10^{-5}$ | 1 × $10^{-4}$ | 3 × $10^{-4}$ | 1 × $10^{-3}$ | 5 × $10^{-3}$ | 1 | 20 | 25 | 30 | 40 | 50 |
| Evaluation items | | | | | | | | | | | |
| Chargeability: | B | A | AA | AA | AA | AA | AA | AA | AA | AA | AA |
| Sensitivity: | B | A | AA | AA | AA | AA | AA | AA | A | B | B |

TABLE H31-continued

| | | (after running) | | | | | | | | | |
|---|---|---|---|---|---|---|---|---|---|---|---|
| Nitrogen | Cp* H16 | Example H16 | | | | | | | | | |
| atom content: | 1 × | 1 × | 3 × | 1 × | 5 × | | | | | Cp. *H16 | |
| (at. %) | $10^{-5}$ | $10^{-4}$ | $10^{-4}$ | $10^{-3}$ | $10^{-3}$ | 1 | 20 | 25 | 30 | 40 | 50 |
| Residual potential: | AA | AA | AA | AA | AA | AA | AA | A | A | B | B |
| Smeared image: | B | A | AA | AA | AA | AA | AA | AA | AA | AA | AA |
| White spots: | B | A | AA | AA | AA | AA | AA | AA | AA | AA | AA |
| Black dots caused by melt-adhesion of toner: | B | A | AA | AA | AA | AA | AA | AA | AA | AA | AA |
| Scratches: | B | A | AA | AA | AA | AA | AA | AA | AA | AA | AA |

*Comparative Example

TABLE H32

| | Layer structure | | |
|---|---|---|---|
| Conditions | First photo-conductive layer | Second photo-conductive layer | Surface layer |
| Gas used, & flow rate: | | | |
| $SiH_4$ (sccm) | 300 | 250 | 75 |
| $CH_4$ (sccm) | 150→0 | | 800 |
| $SiF_4$ (ppm)* | 50 | | |
| $CO_2$ (ppm)* | 1,000 | | |
| $B_2H_6$ (ppm)* | | | 10 |
| $SiF_4$ (sccm) | | | 35 |
| $N_2$ | | | Varied |
| μW power: (W) | 1,000 | 1,000 | 1,000 |
| Inner pressure: (mTorr) | 10 | 10 | 10 |
| Substrate temperature: (°C.) | 280 | 280 | 280 |
| Layer thickness: (μm) | 20 | 3 | 0.5 |

*(based on $SiH_4$)

TABLE H33

| | Layer structure | | |
|---|---|---|---|
| Conditions | First photo-conductive layer | Second photo-conductive layer | Surface layer |
| Gas used, & flow rate: | | | |
| $SiH_4$ (sccm) | 300 | 300 | 15 |
| $CH_4$ (sccm) | 200→0 | | 850 |
| $SiF_4$ (ppm)* | 50 | | |
| $CO_2$ (ppm)* | 500 | | 1,000 |
| $B_2H_6$ (ppm)* | | | Varied |
| $SiF_4$ (sccm) | | | 20 |
| RF power: (W) | 500 | 500 | 300 |
| Inner pressure: (Torr) | 0.5 | 0.5 | 0.5 |
| Substrate temperature: (°C.) | 250 | 250 | 250 |

TABLE H33-continued

| | Layer structure | | |
|---|---|---|---|
| Conditions | First photo-conductive layer | Second photo-conductive layer | Surface layer |
| Layer thickness: (μm) | 20 | 3 | 0.5 |

*(based on $SiH_4$)

TABLE H34

| | (before running) | | | | | |
|---|---|---|---|---|---|---|
| Boron atom | Cp* H18 | Example H18 | | | | |
| content: (at. ppm) | 1 × $10^{-6}$ | 1 × $10^{-5}$ | 5 × $10^{-4}$ | 1 × $10^{-4}$ | 1 × $10^{-2}$ | 7 × $10^{-2}$ |
| Evaluation items | | | | | | |
| Chargeability: | AA | AA | AA | AA | AA | AA |
| Sensitivity: | A | A | AA | AA | AA | AA |
| Residual potential: | B | A | AA | AA | AA | AA |
| Smeared image: | B | AA | AA | AA | AA | AA |
| White spots: | A | AA | AA | AA | AA | AA |
| Black dots caused by melt-adhesion of toner: | A | AA | AA | AA | AA | AA |
| Scratches: | AA | AA | AA | AA | AA | AA |

| Boron atom | Example H18 | | | | | Cp* H18 |
|---|---|---|---|---|---|---|
| content: (at. ppm) | 1 | 1 × $10^2$ | 3 × $10^4$ | 5 × $10^4$ | 1 × $10^5$ | 1 × $10^6$ |
| Evaluation items | | | | | | |
| Chargeability: | AA | AA | AA | AA | A | A |
| Sensitivity: | AA | AA | AA | AA | A | A |
| Residual potential: | AA | AA | AA | AA | AA | AA |
| Smeared image: | AA | AA | AA | AA | AA | AA |
| White spots: | AA | AA | AA | AA | AA | AA |
| Black dots caused by melt-adhesion of toner: | AA | AA | AA | AA | AA | AA |
| Scratches: | AA | AA | AA | AA | AA | AA |

*Comparative Example

TABLE H35

(after running)

| Boron atom | Cp* H18 | Example H18 | | | | |
|---|---|---|---|---|---|---|
| content: (at. ppm) | $1\times10^{-6}$ | $1\times10^{-5}$ | $5\times10^{-4}$ | $1\times10^{-4}$ | $1\times10^{-2}$ | $7\times10^{-2}$ |
| Evaluation items | | | | | | |
| Chargeability: | AA | AA | AA | AA | AA | AA |
| Sensitivity: | B | A | AA | AA | AA | AA |
| Residual potential: | B | A | AA | AA | AA | AA |
| Smeared image: | B | B | A | AA | AA | AA |
| White spots: | B | A | AA | AA | AA | AA |
| Black dots caused by melt-adhesion of toner: | B | A | A | AA | AA | AA |
| Scratches: | AA | AA | AA | AA | AA | AA |

| Boron atom | Example H18 | | | | | Cp* H18 |
|---|---|---|---|---|---|---|
| content: (at. ppm) | 1 | $1\times10^{2}$ | $3\times10^{4}$ | $5\times10^{4}$ | $1\times10^{5}$ | $1\times10^{6}$ |
| Evaluation items | | | | | | |
| Chargeability: | AA | AA | AA | AA | A | A |
| Sensitivity: | AA | AA | AA | AA | A | A |
| Residual potential: | AA | AA | AA | AA | AA | AA |
| Smeared image: | AA | AA | AA | AA | AA | AA |
| White spots: | AA | AA | AA | AA | AA | AA |
| Black dots caused by melt-adhesion of toner: | AA | AA | AA | AA | AA | AA |
| Scratches: | AA | AA | AA | AA | AA | AA |

*Comparative Example

TABLE H36

| Conditions | Layer structure: First photo-conductive layer | Second photo-conductive layer | Surface layer |
|---|---|---|---|
| Gas used, & flow rate: | | | |
| $SiH_4$ (sccm) | 300 | 250 | 75 |
| $CH_4$ (sccm) | 150→0 | | 800 |
| $SiF_4$ (ppm)* | 50 | | |
| $CO_2$ (ppm)* | 1,000 | | |
| $B_2H_6$ (ppm)* | | | Varied |
| NO (ppm)* | | | 2,000 |
| $SiF_4$ (sccm) | | | 35 |
| $O_2$ | | | Varied |
| μW power: (W) | 1,000 | 1,000 | 1,000 |
| Inner pressure: (mTorr) | 10 | 10 | 10 |
| Substrate temperature: (°C.) | 250 | 250 | 250 |
| Layer thickness: (μm) | 20 | 4 | 0.5 |

*(based on $SiH_4$)

TABLE H37

| Conditions | Layer structure: First photo-conductive layer | Second photo-conductive layer | Surface layer |
|---|---|---|---|
| Gas used, & flow rate: | | | |
| $SiH_4$ (sccm) | 300 | 300 | 15 |
| $CH_4$ (sccm) | 120→0 | | 850 |
| $SiF_4$ (ppm)* | 100 | | |
| $CO_2$ (ppm)* | 800 | | 1,000 |
| $B_2H_6$ (ppm)* | | | 300 |
| $SiF_4$ (sccm) | | | Varied |
| RF power: (W) | 500 | 500 | Varied |
| Inner pressure: (Torr) | 0.5 | 0.5 | 0.5 |
| Substrate temperature: (°C.) | 300 | 300 | 300 |
| Layer thickness: (μm) | 20 | 3 | 0.5 |

*(based on $SiH_4$)

TABLE H38

(before running)

| a) Hydrogen content: (at. %) | 11 | | | 21 | | | 30 | | | |
|---|---|---|---|---|---|---|---|---|---|---|
| b) Fluorine content: (at. %) | 0* | 18 | 24 | 0* | 15 | 23 | 0* | 9 | 18 | 23 |
| Total of a) & b): (at. %) | 11 | 29 | 35 | 21 | 36 | 44 | 30 | 39 | 48 | 53 |

TABLE H38-continued

| (before running) | | | | | | | | | | |
|---|---|---|---|---|---|---|---|---|---|---|
| Charge-ability: | A | AA | AA | A | AA | AA | A | AA | AA | AA |
| Sensitivity: | A | A | AA | A | AA | AA | AA | AA | AA | AA |
| Residual potential: | A | A | A | A | AA | A | AA | AA | AA | A |
| Smeared image: | A | AA | AA | A | AA | AA | A | AA | AA | AA |
| White spots: | A | AA | AA | A | AA | AA | A | AA | AA | AA |
| Scratches: | AA | AA | AA | AA | AA | AA | AA | AA | AA | AA |
| Black dots caused by melt-adhesion of toner: | A | AA | AA | A | AA | AA | A | AA | AA | AA |
| Overall evaluation: | A | A | A | A | AA | A | A | AA | AA | A |
| a) Hydrogen content: (at. %) | 48 | | | | 61 | | | 70 | | 76 |
| b) Fluorine content: (at. %) | 0* | 11 | 19 | 23 | 0* | 8 | 12 | 0* | 4 | 0* |
| Total of a) & b): (at. %) | 48 | 59 | 67 | 71 | 61 | 69 | 73 | 70 | 74 | 76 |
| Charge-ability: | A | AA | AA | AA | A | AA | AA | A | AA | A |
| Sensitivity: | AA | AA | AA | A | AA | AA | A | AA | A | A |
| Residual potential: | AA | AA | AA | A | AA | AA | A | AA | AA | A |
| Smeared image: | A | AA | AA | AA | A | AA | AA | A | AA | A |
| White spots: | A | AA | AA | AA | A | AA | AA | A | AA | A |
| Scratches: | AA | AA | AA | AA | AA | AA | AA | AA | AA | AA |
| Black dots caused by melt-adhesion of toner: | A | AA | AA | AA | A | AA | AA | A | AA | A |
| Overall evaluation: | A | AA | AA | A | A | AA | A | A | A | A |

Remarks:
Data in which fluorine atom content is 0 at. % are results of evaluation of Comparative Example H20. Other data are those of Example H20.

TABLE H39

| (after running) | | | | | | | | | | |
|---|---|---|---|---|---|---|---|---|---|---|
| a) Hydrogen content: (at. %) | 11 | | | 21 | | | 30 | | | |
| b) Fluorine content: (at. %) | 0* | 18 | 24 | 0* | 15 | 23 | 0* | 9 | 18 | 23 |
| Total of a) & b): (at. %) | 11 | 29 | 35 | 21 | 36 | 44 | 30 | 39 | 48 | 53 |
| Charge-ability: | A | AA | AA | A | AA | AA | A | AA | AA | AA |
| Sensitivity: | A | A | AA | A | AA | AA | AA | AA | AA | AA |
| Residual potential: | A | A | A | A | AA | A | AA | AA | AA | A |
| Smeared image: | A | AA | AA | A | AA | AA | A | AA | AA | AA |
| White spots: | A | AA | AA | A | AA | AA | A | AA | AA | AA |
| Scratches: | AA | AA | AA | AA | AA | AA | AA | AA | AA | AA |
| Black dots caused by melt-adhesion of toner: | B | AA | AA | B | AA | AA | B | AA | AA | AA |
| Overall evaluation: | B | A | A | B | AA | A | B | AA | AA | A |

a) Hydrogen

TABLE H39-continued

| (after running) | | | | | | | | | | |
|---|---|---|---|---|---|---|---|---|---|---|
| content: (at. %) | 48 | | | | 61 | | | 70 | | 76 |
| b) Fluorine content: (at. %) | 0* | 11 | 19 | 23 | 0* | 8 | 12 | 0* | 4 | 0* |
| Total of a) & b): (at. %) | 48 | 59 | 67 | 71 | 61 | 69 | 73 | 70 | 74 | 75 |
| Chargeability: | A | AA | AA | AA | A | AA | AA | A | AA | A |
| Sensitivity: | AA | AA | AA | A | AA | AA | A | AA | A | A |
| Residual potential: | AA | AA | AA | A | AA | AA | A | AA | AA | A |
| Smeared image: | A | AA | AA | AA | A | AA | AA | A | AA | A |
| White spots: | A | AA | AA | AA | A | AA | AA | A | AA | A |
| Scratches: | AA | AA | AA | AA | AA | AA | AA | AA | AA | AA |
| Black dots caused by melt-adhesion of toner: | B | AA | AA | AA | B | AA | AA | B | AA | B |
| Overall evaluation: | B | AA | AA | A | B | AA | A | B | A | B |

Remarks:
Data in which fluorine atom content is 0 at. % are results of evaluation of Comparative Example H20. Other data are those of Example H20.

TABLE H40

| Conditions | Layer structure: First photoconductive layer | Second photoconductive layer | Surface layer |
|---|---|---|---|
| Gas used, & flow rate: | | | |
| $SiH_4$ (sccm) | 300 | 250 | 75 |
| $CH_4$ (sccm) | 150→0 | | 800 |
| $SiF_4$ (ppm)* | 50 | | |
| $CO_2$ (ppm)* | 1,000 | | |
| $B_2H_6$ (ppm)* | | | 30 |
| NO (ppm)* | | | 2,000 |
| $SiF_4$ (sccm) | | | Varied |
| μW power: (W) | 1,000 | 1,000 | Varied |
| Inner pressure: (mTorr) | 10 | 10 | 10 |
| Substrate temperature: (°C.) | 250 | 250 | 250 |
| Layer thickness: (μm) | 20 | 4 | 0.5 |

*(based on $SiH_4$)

TABLE H41

| Conditions | Layer structure: First photoconductive layer | Second photoconductive layer | Surface layer |
|---|---|---|---|
| Gas used, & flow rate: | | | |
| $SiH_4$ (sccm) | 300 | 300 | 15 |
| $CH_4$ (sccm) | 120→0 | | 850 |
| $SiF_4$ (ppm)* | 100 | | |
| $CO_2$ (ppm)* | 800 | | 1,000 |
| $B_2H_6$ (ppm)* | | | 300 |
| $SiF_4$ (sccm) | | | 30 |
| NO | | | Varied |
| RF power: (W) | 500 | 500 | 300 |
| Inner pressure: (Torr) | 0.5 | 0.5 | 0.5 |
| Substrate temperature: (°C.) | 300 | 300 | 300 |
| Layer thickness: (μm) | 20 | 3 | 0.5 |

*(based on $SiH_4$)

TABLE H42

(before running)

| Total of Nitrogen atom content and oxygen atom content: (at. %) | Cp* H22 $1\times 10^{-5}$ | Example H22 $1\times 10^{-4}$ | $3\times 10^{-4}$ | $1\times 10^{-3}$ | $5\times 10^{-3}$ | 1 | 20 | 25 | 30 | Cp. *H22 40 | 50 |
|---|---|---|---|---|---|---|---|---|---|---|---|
| Evaluation items | | | | | | | | | | | |
| Chargeability: | B | A | AA | AA | AA | AA | AA | AA | AA | AA | AA |
| Sensitivity: | B | A | AA | AA | AA | AA | AA | AA | A | B | B |
| Residual potential: | A | AA | AA | AA | AA | AA | AA | A | A | B | B |
| Smeared image: | B | A | AA | AA | AA | AA | AA | AA | AA | AA | AA |
| White spots: | B | A | AA | AA | AA | AA | AA | AA | AA | AA | AA |
| Black dots caused by melt-adhesion of toner: | B | A | AA | AA | AA | AA | AA | AA | AA | AA | AA |
| Scratches: | B | A | AA | AA | AA | AA | AA | AA | AA | AA | AA |

*Comparative Example

TABLE H43

(after running)

| Total of Nitrogen atom content and oxygen atom content: (at. %) | Cp* H22 $1\times 10^{-5}$ | Example H22 $1\times 10^{-4}$ | $3\times 10^{-4}$ | $1\times 10^{-3}$ | $5\times 10^{-3}$ | 1 | 20 | 25 | 30 | Cp. *H22 40 | 50 |
|---|---|---|---|---|---|---|---|---|---|---|---|
| Evaluation items | | | | | | | | | | | |
| Chargeability: | B | A | AA | AA | AA | AA | AA | AA | AA | AA | AA |
| Sensitivity: | B | A | AA | AA | AA | AA | AA | AA | A | B | B |
| Residual potential: | AA | AA | AA | AA | AA | AA | AA | A | A | B | B |
| Smeared image: | B | B | AA | AA | AA | AA | AA | AA | AA | AA | AA |
| White spots: | B | B | AA | AA | AA | AA | AA | AA | AA | AA | AA |
| Black dots caused by melt-adhesion of toner: | B | B | AA | AA | AA | AA | AA | AA | AA | AA | AA |
| Scratches: | B | B | AA | AA | AA | AA | AA | AA | AA | AA | AA |

*Comparative Example

TABLE H44

| Conditions | Layer structure: First photo-conductive layer | Second photo-conductive layer | Surface layer |
|---|---|---|---|
| Gas used, & flow rate: | | | |
| $SiH_4$ (sccm) | 300 | 250 | 75 |
| $CH_4$ (sccm) | 150→0 | | 800 |
| $SiF_4$ (ppm)* | 50 | | |
| $CO_2$ (ppm)* | 1,000 | | |
| $B_2H_6$ (ppm)* | | | 30 |
| NO (ppm)* | | | varied |
| $SiF_4$ (sccm) | | | 35 |
| μW power: (W) | 1,000 | 1,000 | 1,000 |
| Inner pressure: (mTorr) | 10 | 10 | 10 |
| Substrate temperature: (°C.) | 250 | 250 | 250 |
| Layer thickness: (μm) | 20 | 4 | 0.5 |

*(based on $SiH_4$)

TABLE I1

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 350→0 (FIG. 8 pattern)<br>$SiF_4$ 50→80 ppm (based on $SiH_4$) | 500 | 0.5 | 250 | 17 |
| Second photoconductive layer | $SiH_4$ 500 | 500 | 0.5 | 250 | 3 |
| Surface layer | $SiH_4$ 10<br>$CH_4$ 750<br>$O_2$ 1,000 ppm (based on $SiH_4$)<br>$B_2H_6$ 3 ppm (based on $SiH_4$)<br>$SiF_4$ 30 | 300 | 0.5 | 250 | 0.5 |

TABLE I2

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$SiH_4$ 500<br>$CH_4$ 350<br>$SiF_4$ 50→80 ppm (based on $SiH_4$) | 500<br>500 | 0.5<br>0.5 | 250<br>250 | 17<br>17 |
| Second photoconductive layer | $SiH_4$ 500 | 500 | 0.5 | 250 | 3 |
| Surface layer | $SiH_4$ 10<br>$CH_4$ 750<br>$O_2$ 1,000 ppm (based on $SiH_4$)<br>$B_2H_6$ 3 ppm (based on $SiH_4$)<br>$SiF_4$ 30 | 300 | 0.5 | 250 | 0.5 |

TABLE I3

| | Chargeability | Sensitivity | Residual potential |
|---|---|---|---|
| Example I1: | AA | AA | AA |
| Comparative Example I1: | A | B | B |

TABLE I4

| Layer | Gas used, & flow rate (sccm) | μW power (W) | Inner pressure (Torr) | Substrate temp. (°C.) | Layer thickness (μm) |
|---|---|---|---|---|---|
| First Photoconductive layer | $SiH_4$ 500<br>$CH_4$ 250 (FIG. 8 pattern)<br>$SiF_4$ 50→80 ppm (based on $SiH_4$) | 1,000 | 10 | 250 | 17 |
| Second photoconductive layer | $SiH_4$ 500 | 1,000 | 10 | 250 | 3 |
| Surface layer | $SiH_4$ 80<br>$CH_4$ 500 | 1,000 | 10 | 250 | 0.5 |

TABLE I4-continued

| Layer | Gas used, & flow rate (sccm) | μW power (W) | Inner pressure (Torr) | Substrate temp. (°C.) | Layer thickness (μm) |
|---|---|---|---|---|---|
| | $O_2$ 60 ppm (based on $SiH_4$)<br>$B_2H_6$ 2 ppm (based on $SiH_4$)<br>$SiF_4$ 30 | | | | |

TABLE I5

| Layer | Gas used, & flow rate (sccm) | μW power (W) | Inner pressure (Torr) | Substrate temp. (°C.) | Layer thickness (μm) |
|---|---|---|---|---|---|
| First Photoconductive layer | $SiH_4$ 500<br>$CH_4$ 250<br>$SiF_4$ 50→80 ppm (based on $SiH_4$ ) | 1,000 | 10 | 250 | 17 |
| Second photoconductive layer | $SiH_4$ 500 | 1,000 | 10 | 250 | 3 |
| Surface layer | $SiH_4$ 80<br>$CH_4$ 500<br>$O_2$ 60 ppm (based on $SiH_4$ )<br>$B_2H_6$ 2 ppm (based on $SiH_4$)<br>$SiF_4$ 30 | 1,000 | 10 | 250 | 0.5 |

TABLE I6

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ 50 → 80 ppm (based on $SiH_4$) | 500 | 0.5 | 250 | 17 |
| Second photoconductive layer | $SiH_4$ 500 | 500 | 0.5 | 250 | Varied |
| Surface layer | $SiH_4$ 10<br>$CH_4$ 750<br>$O_2$ 1,000 ppm (based on $SiH_4$)<br>$B_2H_6$ 3 ppm (based on $SiH_4$)<br>$SiF_4$ 30 | 300 | 0.4 | 250 | 0.5 |

TABLE I7

| | Layer thickness of Second conductive layer (μm) | Sensitivity (%) |
|---|---|---|
| Comparative Example I3: | 0 | 100 |
| Example I3: | 0.5 | 110 |
| | 1.0 | 115 |
| | 2.0 | 112 |
| | 5.0 | 110 |
| | 7.0 | 110 |
| | 10.0 | 105 |
| | 15.0 | 105 |
| | 20.0 | 102 |

TABLE I8

| Layer | Gas used, & flow rate (sccm) | μW power (W) | Inner pressure (mtorr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ 50 → 80 ppm (based on $SiH_4$) | 1,000 | 10 | 250 | 17 |
| Second photoconductive layer | $SiH_4$ 500 | 1,000 | 10 | 250 | Varied |
| Surface layer | $SiH_4$ 100<br>$CH_4$ 500<br>$O_2$ 60 ppm (based on $SiH_4$)<br>$B_2H_6$ 2 ppm (based on $SiH_4$)<br>$SiF_4$ 30 | 1,000 | 10 | 250 | 0.5 |

TABLE I9

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ (Varied)<br>$SiF_4$ 50 → 80 ppm (based on $SiH_4$) | 500 | 0.5 | 250 | 17 |
| Second photoconductive layer | $SiH_4$ 500 | 500 | 0.5 | 250 | 3 |
| Surface layer | $SiH_4$ 10<br>$CH_4$ 750<br>$O_2$ 1,500 ppm (based on $SiH_4$)<br>$B_2H_6$ 2 ppm (based on $SiH_4$)<br>$SiF_4$ 30 | 300 | 0.5 | 250 | 0.5 |

TABLE H10

| | Pattern of carbon atom content | Chargeability | Sensitivity | Residual potential |
|---|---|---|---|---|
| Example I5: | FIG. 8 | AA | AA | AA |
| | FIG. 9 | AA | AA | AA |
| | FIG. 10 | AA | AA | AA |
| Comparative Example I5: | FIG. 11 | A | B | B |
| | FIG. 12 | AA | B | B |

TABLE I11

| Layer | Gas used, & flow rate (sccm) | μW power (W) | Inner pressure (mtorr) | Substrate temp. (°C.) | Layer thickness (μm) |
|---|---|---|---|---|---|
| First Photoconductive layer | $SiH_4$ 500<br>$CH_4$ (Varied)<br>$SiF_4$ 50 → 80 ppm (based on $SiH_4$) | 1,000 | 10 | 250 | 17 |
| Second photoconductive layer | $SiH_4$ 500 | 1,000 | 10 | 250 | 3 |
| Surface layer | $SiH_4$ 80<br>$CH_4$ 500<br>$O_2$ 60 ppm (based on $SiH_4$)<br>$B_2H_6$ 2 ppm (based on $SiH_4$)<br>$SiF_4$ 30 | 1,000 | 10 | 250 | 0.5 |

TABLE I12

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ Varied → 0 (FIG. 8 pattern)<br>$SiF_4$ 50 → 80 ppm (based on $SiH_4$) | 500 | 0.5 | 250 | 17 |
| Second photoconductive layer | $SiH_4$ 500 | 500 | 0.5 | 250 | 3 |
| Surface layer | $SiH_4$ 15<br>$CH_4$ 800<br>$O_2$ 1,000 ppm (based on $SiH_4$)<br>$B_2H_6$ 3.5 ppm (based on $SiH_4$)<br>$SiF_4$ 20 | 300 | 0.5 | 250 | 0.5 |

TABLE I13

| Carbon atom content (at. %) | Chargeability | Sensitivity | Residual potential | White spots | (1) | (2) | (3) | (4) |
|---|---|---|---|---|---|---|---|---|
| Comparative Example I7: | | | | | | | | |
| 70 | AA | B | A | AA | AA | B | AA | B |
| 60 | AA | B | A | AA | AA | A | AA | B |

TABLE I13-continued

| Carbon atom content (at. %) | Chargeability | Sensitivity | Residual potential | White spots | (1) | (2) | (3) | (4) |
|---|---|---|---|---|---|---|---|---|
| Example I7: | | | | | | | | |
| 50 | AA | A | A | AA | AA | AA | AA | A |
| 40 | AA | AA | A | AA | AA | AA | AA | A |
| 30 | AA | AA | AA | AA | AA | AA | AA | AA |
| 20 | AA | AA | AA | AA | AA | AA | AA | AA |
| 10 | AA | AA | AA | AA | AA | AA | AA | AA |
| 5 | AA | AA | AA | AA | AA | AA | AA | AA |
| 1 | AA | AA | AA | AA | AA | AA | AA | AA |
| 0.5 | A | AA | AA | AA | AA | AA | A | A |
| Comparative Example I7: | | | | | | | | |
| 0.3 | B | AA | AA | B | A | AA | B | B |

(1): Coarse image
(2): Ghost
(3): Spherical protuberances
(4): Overall evaluation

TABLE I14

| Layer | Gas used, & flow rate (sccm) | μW power (W) | Inner pressure (mtorr) | Substrate temp. (°C.) | Layer thickness (μm) |
|---|---|---|---|---|---|
| First Photoconductive layer | $SiH_4$ 500<br>$CH_4$ Varied → 0 (FIG. 8 pattern)<br>$SiF_4$ 50 → 80 ppm (based on $SiH_4$) | 1,000 | 10 | 250 | 17 |
| Second photoconductive layer | $SiH_4$ 500 | 1,000 | 10 | 250 | 3 |
| Surface layer | $SiH_4$ 75<br>$CH_4$ 500<br>NO 1,000 ppm (based on $SiH_4$)<br>$B_2H_6$ 10 ppm (based on $SiH_4$)<br>$SiF_4$ 35 | 1,000 | 10 | 250 | 0.5 |

TABLE I15

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ (Varied)<br>$B_2H_6$ 30 → 2 ppm (based on $SiH_4$) | 500 | 0.5 | 250 | 17 |
| Second photoconductive layer | $SiH_4$ 500 | 500 | 0.5 | 250 | 3 |
| Surface layer | $SiH_4$ 15<br>$CH_4$ 800<br>$O_2$ 1,000 ppm (based on $SiH_4$)<br>$B_2H_6$ 3.5 ppm (based on $SiH_4$)<br>$SiF_4$ 20 | 300 | 0.5 | 250 | 0.5 |

TABLE I16

| | Fluorine atom content | (before running) White spots | Coarse image | Ghost | Overall evaluation |
|---|---|---|---|---|---|
| Example I9: | FIG. 13 | AA | AA | AA | AA |
| | FIG. 14 | AA | AA | AA | AA |
| | FIG. 15 | AA | AA | AA | AA |
| | FIG. 16 | AA | AA | AA | AA |
| | FIG. 17 | AA | AA | AA | AA |
| | FIG. 18 | AA | AA | AA | AA |
| | FIG. 19 | AA | AA | AA | AA |
| | FIG. 20 | AA | AA | AA | AA |
| Comparative Example I9: | FIG. 21 | AA | AA | B | B |
| | FIG. 22 | AA | AA | B | B |

TABLE I17

| | Fluorine atom content | (after running) White spots | Coarse image | Ghost | Overall evaluation |
|---|---|---|---|---|---|
| Example I9: | FIG. 13 | AA | A | A | A |
| | FIG. 14 | AA | AA | AA | AA |
| | FIG. 15 | AA | AA | AA | AA |
| | FIG. 16 | AA | AA | AA | AA |
| | FIG. 17 | AA | AA | AA | AA |
| | FIG. 18 | AA | AA | AA | AA |
| | FIG. 19 | AA | AA | AA | AA |
| | FIG. 20 | AA | AA | AA | AA |
| Comparative Example I9: | FIG. 21 | AA | A | B | B |
| | FIG. 22 | AA | B | B | B |

TABLE I18

| Layer | Gas used, & flow rate (sccm) | μW power (W) | Inner pressure (mtorr) | Substrate temp. (°C.) | Layer thickness (μm) |
|---|---|---|---|---|---|
| First Photo- | $SiH_4$ 500<br>$CH_4$ 150 → 0 (FIG. 8 pattern) | 1,000 | 10 | 250 | 17 |

TABLE I18-continued

| Layer | Gas used, & flow rate (sccm) | μW power (W) | Inner pressure (mtorr) | Substrate temp. (°C.) | Layer thickness (μm) |
|---|---|---|---|---|---|
| tive layer | $SiF_4$ (Varied)<br>$B_2H_6$ 30 → 2 ppm (based on $SiH_4$) | | | | |
| Second photoconductive layer | $SiH_4$ 500 | 1,000 | 10 | 250 | 3 |
| Surface layer | $SiH_4$ 75<br>$CH_4$ 500<br>NO 1,000 ppm (based on $SiH_4$) | 1,000 | 10 | 250 | 0.5 |

TABLE I19

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ (Varied)<br>$B_2H_6$ 30 → 2 ppm (based on $SiH_4$) | 500 | 0.5 | 250 | 17 |
| Second photoconductive layer | $SiH_4$ 500<br>$B_2H_6$ 2 ppm (based on $SiH_4$) | 500 | 0.5 | 250 | 3 |
| Surface layer | $SiH_4$ 15<br>$CH_4$ 800<br>$O_2$ 1,000 ppm (based on $SiH_4$)<br>$B_2H_6$ 3.5 ppm (based on $SiH_4$)<br>$SiF_4$ 20 | 300 | 0.5 | 250 | 0.5 |

TABLE I20

(before running)

| | Pattern of fluorine atom content | White spots | Coarse image | Ghost | (1) | (2) | (3) | (4) |
|---|---|---|---|---|---|---|---|---|
| Example I11: | FIG. 23 | AA | AA | AA | AA | AA | AA | AA |
| | FIG. 24 | AA | AA | AA | AA | AA | AA | AA |
| | FIG. 25 | AA | AA | AA | AA | AA | AA | AA |
| | FIG. 26 | AA | AA | AA | AA | AA | AA | AA |
| Comparative Example I11: | FIG. 27 | AA | AA | AA | A | AA | A | A |

(1): Temperature characteristics
(2): Chargeability
(3): Uneven image density
(4): Overall evaluation

TABLE I21

(after running)

| | Pattern of fluorine atom content | White spots | Coarse image | Ghost | (1) | (2) | (3) | (4) |
|---|---|---|---|---|---|---|---|---|
| Example I11: | FIG. 23 | AA | AA | AA | AA | AA | AA | AA |
| | FIG. 24 | AA | AA | AA | AA | AA | AA | AA |
| | FIG. 25 | AA | AA | AA | AA | AA | AA | AA |
| | FIG. 26 | AA | AA | AA | AA | AA | AA | AA |
| Comparative Example I11: | FIG. 27 | AA | AA | AA | B | AA | B | B |

(1): Temperature characteristics
(2): Chargeability
(3): Uneven image density
(4): Overall evaluation TABLE I18-continued

| Layer | Gas used, & flow rate (sccm) | μW power (W) | Inner pressure (mtorr) | Substrate temp. (°C.) | Layer thickness (μm) |
|---|---|---|---|---|---|
| | $B_2H_6$ 10 ppm (based on $SiH_4$)<br>$SiF_4$ 35 | | | | |

TABLE I22

| Layer | Gas used, & flow rate (sccm) | μW power (W) | Inner pressure (mtorr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ (Varied)<br>$B_2H_6$ 30 → 2 ppm (based on $SiH_4$) | 1,000 | 10 | 250 | 17 |

TABLE I22-continued

| Layer | Gas used, & flow rate (sccm) | μW power (W) | Inner pressure (mtorr) | Substrate temp. (°C.) | Layer thickness (μm) |
|---|---|---|---|---|---|
| Second photoconductive layer | $SiH_4$ 500<br>$B_2H_6$ 2 ppm (based on $SiH_4$) | 1,000 | 10 | 250 | 3 |
| Surface layer | $SiH_4$ 75<br>$CH_4$ 500<br>NO 1,000 ppm (based on $SiH_4$)<br>$B_2H_6$ 10 ppm (based on $SiH_4$)<br>$SiF_4$ 35 | 1,000 | 10 | 250 | 0.5 |

TABLE I23

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ 50 → 80 ppm (based on $SiH_4$)<br>$B_2H_6$ 40 → 3 ppm (based on $SiH_4$)<br>$CO_2$ (Varied) | 500 | 0.5 | 250 | 17 |
| Second photoconductive layer | $SiH_4$ 500<br>$B_2H_6$ 2ppm (based on $SiH_4$) | 500 | 0.5 | 250 | 3 |
| Surface layer | $SiH_4$ 15<br>$CH_4$ 800<br>$CO_2$ 1,000 ppm (based on $SiH_4$)<br>$B_2H_6$ 3.5 ppm (based on $SiH_4$)<br>$SiF_4$ 20 | 300 | 0.5 | 250 | 0.5 |

TABLE I24

| Oxygen atom content (at. ppm) | Chargeability | Sensitivity | Residual potential | Potential shift | Overall evaluation |
|---|---|---|---|---|---|
| Comparative Example I13: | | | | | |
| 5 | AA | AA | AA | A | A |
| 7 | AA | AA | AA | A | A |
| Example I13: | | | | | |
| 10 | AA | AA | AA | AA | AA |
| 50 | AA | AA | AA | AA | AA |
| 100 | AA | AA | AA | AA | AA |
| 250 | AA | AA | AA | AA | AA |
| 500 | AA | AA | AA | AA | AA |
| 1,000 | AA | AA | AA | AA | AA |
| 3,000 | AA | AA | AA | AA | AA |
| 5,000 | AA | AA | AA | AA | AA |
| Comparative Example I13: | | | | | |
| 5,500 | AA | A | B | AA | B |
| 6,000 | AA | B | B | AA | B |
| 8,000 | AA | B | B | AA | B |

TABLE I25

| Layer | Gas used, & flow rate (sccm) | μW power (W) | Inner pressure (mtorr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ 50 → 80 ppm (based on $SiH_4$)<br>$B_2H_6$ 40 → 3 ppm (based on $SiH_4$)<br>$CO_2$ (Varied) | 1,000 | 10 | 250 | 17 |
| Second photoconductive layer | $SiH_4$ 500<br>$B_2H_6$ 2 ppm (based on $SiH_4$) | 1,000 | 10 | 250 | 3 |
| Surface layer | $SiH_4$ 75<br>$CH_4$ 500<br>$CO_2$ 1,000 ppm (based on $SiH_4$)<br>$B_2H_6$ 10 ppm (based on $SiH_4$)<br>$SiF_4$ 35 | 1,000 | 10 | 250 | 0.5 |

TABLE I26

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ 50 → 80 ppm (based on $SiH_4$)<br>$B_2H_6$ 40 → 3 ppm (based on $SiH_4$)<br>$CO_2$ (Varied) | 500 | 0.5 | 250 | 17 |
| Second photoconductive layer | $SiH_4$ 500<br>$B_2H_6$ 2 ppm (based on $SiH_4$) | 500 | 0.5 | 250 | 3 |
| Surface layer | $SiH_4$ 15<br>$CH_4$ 800<br>$CO_2$ 1,000 ppm (based on $SiH_4$)<br>$B_2H_6$ 3.5 ppm (based on $SiH_4$)<br>$SiF_4$ 20 | 300 | 0.5 | 250 | 0.5 |

TABLE I27

| Pattern of oxygen atom content | Chargeability | Sensitivity | Residual potential | Potential shift | Overall evaluation |
|---|---|---|---|---|---|
| Example I15: | | | | | |
| FIG. 28 | AA | AA | AA | A | A |
| FIG. 29 | AA | AA | AA | AA | AA |
| FIG. 30 | AA | AA | AA | AA | AA |
| FIG. 31 | AA | AA | AA | AA | AA |
| FIG. 32 | AA | AA | AA | AA | AA |
| Comparative Example I15: | | | | | |
| — | AA | AA | AA | B | B |

TABLE I28

| Layer | Gas used, & flow rate (sccm) | μW power (W) | Inner pressure (mtorr) | Substrate temp. (°C.) | Layer thickness (μm) |
|---|---|---|---|---|---|
| First Photoive layer | $SiH_4$ 500<br>$CH_4$ 150 → 0 (FIG. 8 pattern)<br>$SiF_4$ 50 → 80 ppm (based on $SiH_4$)<br>$B_2H_6$ 40 → 3 ppm (based on $SiH_4$) | 1,000 | 10 | 250 | 17 |

TABLE I28-continued

| Layer | Gas used, & flow rate (sccm) | μW power (W) | Inner pressure (mtorr) | Substrate temp. (°C.) | Layer thickness (μm) |
|---|---|---|---|---|---|
| | $CO_2$ (Varied) | | | | |
| Second photo-tive layer | $SiH_4$ 500<br>$B_2H_6$ 2 ppm (based on $SiH_4$) | 1,000 | 10 | 250 | 3 |
| Surface layer | $SiH_4$ 75<br>$CH_4$ 500<br>$CO_2$ 1,000 ppm (based on $SiH_4$)<br>$B_2H_6$ 10 ppm (based on $SiH_4$)<br>$SiF_4$ 35 | 1,000 | 10 | 250 | 0.5 |

TABLE I29

| Layer | Gas used, & flow rate (sccm) | RF power (W) | Inner pressure (Torr) | Substrate temp. (°C.) | Layer thickness (μm) |
|---|---|---|---|---|---|
| First Photo-conduc-tive layer | $SiH_4$ 500<br>$CH_4$ 150 → 0 (FIG. 8 pattern)<br>$SiF_4$ 50 → 80 ppm (based on $SiH_4$)<br>$B_2H_6$ 40 → 3 ppm (based on $SiH_4$)<br>$CO_2$ 500 → 600 ppm (based on $SiH_4$) | 500 | 0.5 | 250 | 17 |
| Second photo-conduc-tive layer | $SiH_4$ 500<br>$B_2H_6$ 2 ppm (based on $SiH_4$) | 500 | 0.5 | 250 | 3 |
| Surface layer | $SiH_4$ 15<br>$CH_4$ (Varied)<br>$CO_2$ 1,000 ppm (based on $SiH_4$)<br>$B_2H_6$ 3.5 ppm (based on $SiH_4$)<br>$SiF_4$ 20 | Varied | 0.5 | 250 | 0.5 |

TABLE I30

(before running)

| Carbon atom content: | Cp. *I17 | | | Example I17 | | | | | | Cp. *I17 | |
|---|---|---|---|---|---|---|---|---|---|---|---|
| (at. %) | 20 | 40 | 60 | 63 | 70 | 75 | 83 | 86 | 90 | 93 | 95 |
| Chargeability: | B | B | A | AA | AA | AA | AA | AA | AA | AA | AA |
| Sensitivity: | B | A | A | AA | AA | AA | AA | A | A | B | B |
| Residual potential: | AA | AA | AA | AA | AA | AA | AA | AA | AA | A | B |
| Smeared image: | AA | AA | AA | AA | AA | AA | AA | AA | AA | A | B |
| White spots: | B | A | AA | AA | AA | AA | AA | AA | AA | AA | AA |
| Scratches: | A | AA | AA | AA | AA | AA | AA | AA | AA | AA | AA |
| Black dots caused by melt-adhesion of toner: | A | AA | AA | AA | AA | AA | AA | AA | AA | AA | AA |

*Comparative Example

TABLE I31

(after running)

| Carbon atom content: | Cp. *I17 | | | Example I17 | | | | | | Cp. *I17 | |
|---|---|---|---|---|---|---|---|---|---|---|---|
| (at. %) | 20 | 40 | 60 | 63 | 70 | 75 | 83 | 86 | 90 | 93 | 95 |
| Chargeability: | B | B | A | AA | AA | AA | AA | AA | AA | AA | AA |
| Sensitivity: | B | B | A | AA | AA | AA | AA | A | A | B | B |
| Residual potential: | AA | AA | AA | AA | AA | AA | AA | AA | AA | A | B |
| Smeared image: | B | B | A | AA | AA | AA | AA | AA | A | B | B |
| White spots: | B | B | A | AA | AA | AA | AA | AA | AA | AA | AA |
| Scratches: | B | B | A | AA | AA | AA | AA | AA | AA | AA | AA |
| Black dots caused by melt-adhesion of toner: | B | B | A | AA | AA | AA | AA | AA | AA | AA | AA |

*Comparative Example

TABLE I32

| Layer | Gas used, & flow rate (sccm) | μW power (W) | Inner pressure (mtorr) | Substrate temp. (°C.) | Layer thickness (μm) |
|---|---|---|---|---|---|
| First Photoconductive layer | $SiH_4$ 300<br>$CH_4$ 150 → 0 (FIG. 8 pattern)<br>$SiF_4$ 70 → 90 ppm (based on $SiH_4$)<br>$B_2H_6$ 40 → 3 ppm (based on $SiH_4$)<br>$CO_2$ 500 → 600 ppm (based on $SiH_4$) | 1,000 | 10 | 250 | 17 |
| Second photoctive layer | $SiH_4$ 250<br>$B_2H_6$ 2 ppm (based on $SiH_4$) | 1,000 | 10 | 250 | 3 |
| Surface layer | $SiH_4$ 75<br>$CH_4$ (Varied)<br>$CO_2$ 1,000 ppm (based on $SiH_4$)<br>$B_2H_6$ 10 ppm (based on $SiH_4$)<br>$SiF_4$ 35 | Varied | 10 | 250 | 0.5 |

TABLE I33

| Layer | Gas used, & flow rate (sccm) | RF power (W) | Inner pressure (Torr) | Substrate temp. (°C.) | Layer thickness (μm) |
|---|---|---|---|---|---|
| First Photoconductive | $SiH_4$ 500<br>$CH_4$ 150 → 0 (FIG. 8 pattern)<br>$SiF_4$ 50 → 80 ppm (based on $SiH_4$)<br>$B_2H_6$ 40 → 3 ppm (based on $SiH_4$)<br>$CO_2$ 500 → 600 ppm (based on $SiH_4$) | 500 | 0.5 | 250 | 17 |
| Second photoctive layer | $SiH_4$ 500<br>$B_2H_6$ 2 ppm (based on $SiH_4$) | 500 | 0.5 | 250 | 3 |
| Surface layer | $SiH_4$ 15<br>$CH_4$ 800<br>$CO_2$ (Varied)<br>$B_2H_6$ 3.5 ppm (based on $SiH_4$)<br>$SiF_4$ 20 | 300 | 0.5 | 250 | 0.5 |

TABLE I34

(before running)

| Oxygen atom content: | Cp* I19 | Example I19 | | | | | | | | Cp. *I19 | |
|---|---|---|---|---|---|---|---|---|---|---|---|
| (at. %) | $1\times10^{-5}$ | $1\times10^{-4}$ | $3\times10^{-4}$ | $1\times10^{-3}$ | $5\times10^{-3}$ | 1 | 20 | 25 | 30 | 40 | 50 |
| Chargeability: | B | A | AA | AA | AA | AA | AA | AA | AA | AA | AA |
| Sensitivity: | B | A | AA | AA | AA | AA | AA | AA | A | B | B |
| Residual potential: | A | AA | AA | AA | AA | AA | AA | A | A | B | B |
| Smeared image: | A | A | AA | AA | AA | AA | AA | AA | AA | AA | AA |
| White spots: | A | AA | AA | AA | AA | AA | AA | AA | AA | AA | AA |
| Scratches: | A | A | AA | AA | AA | AA | AA | AA | AA | AA | AA |
| Black dots caused by melt-adhesion of toner: | B | A | AA | AA | AA | AA | AA | AA | AA | AA | AA |

*Comparative Example

TABLE I35

| | Cp* I19 | Example I19 | | | | | | | | Cp. *I19 | |
|---|---|---|---|---|---|---|---|---|---|---|---|
| | (after running) | | | | | | | | | | |
| Oxygen atom content: | 1 × | 1 × | 3 × | 1 × | 5 × | | | | | | |
| (at. %) | $10^{-5}$ | $10^{-4}$ | $10^{-4}$ | $10^{-3}$ | $10^{-3}$ | 1 | 20 | 25 | 30 | 40 | 50 |
| Chargeability: | B | A | AA | AA | AA | AA | AA | AA | AA | AA | AA |
| Sensitivity: | B | A | AA | AA | AA | AA | AA | AA | A | B | B |
| Residual potential: | A | AA | AA | AA | AA | AA | AA | A | A | B | B |
| Smeared image: | B | A | AA | AA | AA | AA | AA | AA | AA | AA | AA |
| White spots: | B | A | AA | AA | AA | AA | AA | AA | AA | AA | AA |
| Scratches: | A | A | AA | AA | AA | AA | AA | AA | AA | AA | AA |
| Black dots caused by melt-adhesion of toner: | B | A | AA | AA | AA | AA | AA | AA | AA | AA | AA |

*Comparative Example

TABLE I36

| Layer | Gas used, & flow rate (sccm) | μW power (W) | Inner pressure (mtorr) | Substrate temp. (°C.) | Layer thickness (μm) |
|---|---|---|---|---|---|
| First Photoconductive layer | $SiH_4$ 300<br>$CH_4$ 150 → 0 (FIG. 8 pattern)<br>$SiF_4$ 70 → 90 ppm (based on $SiH_4$)<br>$B_2H_6$ 40 → 3 ppm (based on $SiH_4$)<br>$CO_2$ 500 → 600 ppm (based on $SiH_4$) | 1,000 | 10 | 250 | 17 |
| Second photoconductive layer | $SiH_4$ 250<br>$B_2H_6$ 2 ppm (based on $SiH_4$) | 1,000 | 10 | 250 | 3 |
| Surface layer | $SiH_4$ 75<br>$CH_4$ 800<br>$CO_2$ (Varied)<br>$B_2H_6$ 10 ppm (based on $SiH_4$)<br>$SiF_4$ 35 | 1,000 | 10 | 250 | 0.5 |

TABLE I37

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 300<br>$CH_4$ 150 → 0 (FIG. 8 pattern)<br>$SiF_4$ 50 → 80 ppm (based on $SiH_4$)<br>$B_2H_6$ 40 → 3 ppm (based on $SiH_4$)<br>$CO_2$ 500 → 600 ppm (based on $SiH_4$) | 500 | 0.5 | 250 | 17 |
| Second photoconductive layer | $SiH_4$ 300<br>$B_2H_6$ 2 ppm (based on $SiH_4$) | 500 | 0.5 | 250 | 3 |
| Surface layer | $SiH_4$ 15<br>$CH_4$ 750<br>$N_2$ (Varied)<br>$B_2H_6$ 3.5 ppm (based on $SiH_4$)<br>$SiF_4$ 20 | 300 | 0.5 | 250 | 0.5 |

TABLE I38

| Nitrogen | Cp* I21 | Example I21 | | | | | | | | Cp. *I21 | |
|---|---|---|---|---|---|---|---|---|---|---|---|
| | (before running) | | | | | | | | | | |
| atom content: | 1 × | 1 × | 3 × | 1 × | 5 × | | | | | | |
| (at. %) | $10^{-5}$ | $10^{-4}$ | $10^{-4}$ | $10^{-3}$ | $10^{-3}$ | 1 | 20 | 25 | 30 | 40 | 50 |
| Chargeability: | B | A | AA | AA | AA | AA | AA | AA | AA | AA | AA |
| Sensitivity: | B | A | AA | AA | AA | AA | AA | AA | A | B | B |
| Residual potential: | A | AA | AA | AA | AA | AA | AA | A | A | B | B |
| Smeared image: | A | A | AA | AA | AA | AA | AA | AA | AA | AA | AA |
| White spots: | A | AA | AA | AA | AA | AA | AA | AA | AA | AA | AA |
| Scratches: | A | A | AA | AA | AA | AA | AA | AA | AA | AA | AA |
| Black dots caused by melt-adhesion of toner: | B | A | AA | AA | AA | AA | AA | AA | AA | AA | AA |

*Comparative Example

TABLE I39

| Nitrogen atom content: (at. %) | Cp* I21 $1\times10^{-5}$ | Example I21 (after running) $1\times10^{-4}$ | $3\times10^{-4}$ | $1\times10^{-3}$ | $5\times10^{-3}$ | 1 | 20 | 25 | 30 | Cp. *I21 40 | 50 |
|---|---|---|---|---|---|---|---|---|---|---|---|
| Chargeability: | B | A | AA | AA | AA | AA | AA | AA | AA | AA | AA |
| Sensitivity: | B | A | AA | AA | AA | AA | AA | AA | A | B | B |
| Residual potential: | A | AA | AA | AA | AA | AA | AA | A | A | B | B |
| Smeared image: | B | A | AA | AA | AA | AA | AA | AA | AA | AA | AA |
| White spots: | B | A | AA | AA | AA | AA | AA | AA | AA | AA | AA |
| Scratches: | A | A | AA | AA | AA | AA | AA | AA | AA | AA | AA |
| Black dots caused by melt-adhesion of toner: | B | A | AA | AA | AA | AA | AA | AA | AA | AA | AA |

*Comparative Example

TABLE I40

| Layer | Gas used, & flow rate (sccm) | μW power (W) | Inner pressure (mtorr) | Substrate temp. (°C.) | Layer thickness (μm) |
|---|---|---|---|---|---|
| First Photoconductive layer | $SiH_4$ 300<br>$CH_4$ 150 → 0 (FIG. 8 pattern)<br>$SiF_4$ 70 → 90 ppm (based on $SiH_4$)<br>$B_2H_6$ 40 → 3 ppm (based on $SiH_4$)<br>$CO_2$ 500 → 600 ppm (based on $SiH_4$) | 1,000 | 10 | 250 | 17 |
| Second photoconductive layer | $SiH_4$ 250<br>$B_2H_6$ 2 ppm (based on $SiH_4$) | 1,000 | 10 | 250 | 3 |
| Surface layer | $SiH_4$ 75<br>$CH_4$ 700<br>$N_2$ (Varied)<br>$B_2H_6$ 10 ppm (based on $SiH_4$)<br>$SiF_4$ 35 | 1,000 | 10 | 250 | 0.5 |

TABLE I41

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 300<br>$CH_4$ 150 → 0 (FIG. 8 pattern)<br>$SiF_4$ 50 → 80 ppm (based on $SiH_4$)<br>$B_2H_6$ 40 → 3 ppm (based on $SiH_4$)<br>$CO_2$ 500 → 600 ppm (based on $SiH_4$) | 500 | 0.5 | 250 | 17 |
| Second photoconductive layer | $SiH_4$ 300<br>$B_2H_6$ 2 ppm (based on $SiH_4$) | 500 | 0.5 | 250 | 3 |
| Surface layer | $SiH_4$ 15<br>$CH_4$ 850<br>$CO_2$ 1,000 ppm (based on $SiH_4$)<br>$B_2H_6$ (Varied)<br>$SiF_4$ 20 | 300 | 0.5 | 250 | 0.5 |

TABLE I42

| Boron atom content: (at. ppm) | Cp* I23 $1\times10^{-6}$ | Example I23 (before running) $1\times10^{-5}$ | $5\times10^{-4}$ | $1\times10^{-4}$ | $1\times10^{-2}$ | $7\times10^{-2}$ |
|---|---|---|---|---|---|---|
| Chargeability: | AA | AA | AA | AA | AA | AA |
| Sensitivity: | A | A | AA | AA | AA | AA |
| Residual potential: | B | A | AA | AA | AA | AA |
| Smeared image: | A | AA | AA | AA | AA | AA |
| White spots: | A | AA | AA | AA | AA | AA |
| Scratches: | AA | AA | AA | AA | AA | AA |
| Black dots caused by melt-adhesion of toner: | A | AA | AA | AA | AA | AA |

TABLE I42-continued (before running)

| Boron atom content: | Example I23 | | | | | Cp* I23 |
|---|---|---|---|---|---|---|
| (at. ppm) | 1 | $1 \times 10^2$ | $3 \times 10^4$ | $5 \times 10^4$ | $1 \times 10^5$ | $1 \times 10^6$ |
| Chargeability: | AA | AA | AA | AA | A | A |
| Sensitivity: | AA | AA | AA | AA | A | A |
| Residual potential: | AA | AA | AA | AA | AA | AA |
| Smeared image: | AA | AA | AA | AA | AA | AA |
| White spots: | AA | AA | AA | AA | AA | AA |
| Scratches: | AA | AA | AA | AA | AA | AA |
| Black dots caused by melt-adhesion of toner: | AA | AA | AA | AA | AA | AA |

*Comparative Example

TABLE I43

(after running)

| Boron atom content: (at. ppm) | Cp* I23 $1 \times 10^{-6}$ | Example I23 $1 \times 10^{-5}$ | $5 \times 10^{-4}$ | $1 \times 10^{-4}$ | $1 \times 10^{-2}$ | $7 \times 10^{-2}$ |
|---|---|---|---|---|---|---|
| Chargeability: | AA | AA | AA | AA | AA | AA |
| Sensitivity: | B | A | AA | AA | AA | AA |
| Residual potential: | B | A | AA | AA | AA | AA |
| Smeared image: | B | B | A | AA | AA | AA |
| White spots: | B | A | AA | AA | AA | AA |
| Scratches: | AA | AA | AA | AA | AA | AA |
| Black dots caused by melt-adhesion of toner: | B | A | A | AA | AA | AA |

| Boron atom content: | Example I23 | | | | | Cp* I23 |
|---|---|---|---|---|---|---|
| (at. ppm) | 1 | $1 \times 10^2$ | $3 \times 10^4$ | $5 \times 10^4$ | $1 \times 10^5$ | $1 \times 10^6$ |
| Chargeability: | AA | AA | AA | AA | A | A |
| Sensitivity: | AA | AA | AA | AA | A | A |
| Residual potential: | AA | AA | AA | AA | AA | AA |
| Smeared image: | AA | AA | AA | AA | AA | AA |
| White spots: | AA | AA | AA | AA | AA | AA |
| Scratches: | AA | AA | AA | AA | AA | AA |
| Black dots caused by melt-adhesion of toner: | AA | AA | AA | AA | AA | AA |

*Comparative Example

TABLE I44

| Layer | Gas used, & flow rate (sccm) | μW power (W) | Inner pressure (mtorr) | Substrate temp. (°C.) | Layer thickness (μm) |
|---|---|---|---|---|---|
| First Photoconductive layer | $SiH_4$ 300<br>$CH_4$ 150 → 0 (FIG. 8 pattern)<br>$SiF_4$ 70 → 90 ppm (based on $SiH_4$)<br>$B_2H_6$ 40 → 3 ppm (based on $SiH_4$)<br>$CO_2$ 500 → 600 ppm (based on $SiH_4$) | 1,000 | 10 | 250 | 17 |

TABLE I44-continued

| Layer | Gas used, & flow rate (sccm) | μW power (W) | Inner pressure (mtorr) | Substrate temp. (°C.) | Layer thickness (μm) |
|---|---|---|---|---|---|
| Second photoconductive layer | $SiH_4$ 250<br>$B_2H_6$ 2 ppm (based on $SiH_4$) | 1,000 | 10 | 250 | 3 |

TABLE I44-continued

| Layer | Gas used, & flow rate (sccm) | μW power (W) | Inner pressure (mtorr) | Substrate temp. (°C.) | Layer thickness (μm) |
|---|---|---|---|---|---|
| Surface layer | $SiH_4$ 75<br>$CH_4$ 800<br>$NO_2$ 2,000 ppm (based on $SiH_4$)<br>$B_2H_6$ (Varied)<br>$SiF_4$ 35 | 1,000 | 10 | 250 | 0.5 |

TABLE I45

| Layer | Gas used, & flow rate (sccm) | RF power (W) | Inner pressure (Torr) | Substrate temp. (°C.) | Layer thickness (μm) |
|---|---|---|---|---|---|
| First Phototive layer | $SiH_4$ 300<br>$CH_4$ 120 → 0 (FIG. 8 pattern)<br>$SiF_4$ 50 → 80 ppm (based on $SiH_4$)<br>$B_2H_6$ 40 → 3 ppm (based on $SiH_4$)<br>$CO_2$ 500 → 600 ppm (based on $SiH_4$) | 500 | 0.5 | 250 | 17 |
| Second phototive layer | $SiH_4$ 300<br>$B_2H_6$ 2 ppm (based on $SiH_4$) | 500 | 0.5 | 250 | 3 |
| Surface layer | $SiH_4$ 15<br>$CH_4$ 850<br>$CO_2$ 1,000 ppm (based on $SiH_4$)<br>$B_2H_6$ 300 ppm (based on $SiH_4$)<br>$SiF_4$ (Varied) | Varied | 0.5 | 250 | 0.5 |

TABLE I46

| | (before running) | | | | | | | | | |
|---|---|---|---|---|---|---|---|---|---|---|
| a) Hydrogen content: (at. %) | 11 | | | 21 | | | 30 | | | |
| b) Fluorine content: (at. %) | 0* | 18 | 24 | 0* | 15 | 23 | 0* | 9 | 18 | 23 |
| Total of a) & b): (at. %) | 11 | 29 | 35 | 21 | 36 | 44 | 30 | 39 | 48 | 53 |
| Chargeability: | A | AA | AA | A | AA | AA | A | AA | AA | AA |
| Sensitivity: | A | A | AA | A | AA | AA | AA | AA | AA | AA |
| Residual potential: | A | A | A | A | AA | A | AA | AA | AA | A |
| Smeared image: | A | AA | AA | A | AA | AA | A | AA | AA | AA |
| White spots: | A | AA | AA | A | AA | AA | A | AA | AA | AA |
| Scratches: | AA | AA | AA | AA | AA | AA | AA | AA | AA | AA |
| Black dots caused by melt-adhesion of toner: | A | AA | AA | A | AA | AA | A | AA | AA | AA |
| Overall evaluation: | A | A | A | A | AA | A | A | AA | AA | A |
| a) Hydrogen content: (at. %) | 48 | | | | 61 | | | 70 | | 76 |
| b) Fluorine content: (at. %) | 0* | 11 | 19 | 23 | 0* | 8 | 12 | 0* | 4 | 0* |
| Total of a) & b): (at. %) | 48 | 59 | 67 | 71 | 61 | 69 | 73 | 70 | 74 | 76 |
| Chargeability: | A | AA | AA | AA | A | AA | AA | A | AA | A |
| Sensitivity: | AA | AA | AA | A | AA | AA | A | AA | A | A |
| Residual potential: | AA | AA | AA | A | AA | AA | A | AA | AA | A |
| Smeared image: | A | AA | AA | AA | A | AA | AA | A | AA | A |
| White spots: | A | AA | AA | AA | A | AA | AA | A | AA | A |
| Scratches: | AA | AA | AA | AA | AA | AA | AA | AA | AA | AA |
| Black dots caused by melt-adhesion of toner: | A | AA | AA | AA | A | AA | AA | A | AA | A |

TABLE I46-continued

| | | | | | | | | | | |
|---|---|---|---|---|---|---|---|---|---|---|
| | (before running) | | | | | | | | | |
| Overall evaluation: | A | AA | AA | A | A | AA | A | A | A | A |

Remarks:
Data in which fluorine atom content is 0 at. % are results of evaluation of Comparative Example I25. Other data are those of Example I25.

TABLE I47

| | | | | | | | | | | |
|---|---|---|---|---|---|---|---|---|---|---|
| | (after running) | | | | | | | | | |
| a) Hydrogen content: (at. %) | 11 | | | 21 | | | 30 | | | |
| b) Fluorine content: (at. %) | 0* | 18 | 24 | 0* | 15 | 23 | 0* | 9 | 18 | 23 |
| Total of a) & b): (at. %) | 11 | 29 | 35 | 21 | 36 | 44 | 30 | 39 | 48 | 53 |
| Chargeability: | A | AA | AA | A | AA | AA | A | AA | AA | AA |
| Sensitivity: | A | A | AA | A | AA | AA | AA | AA | AA | AA |
| Residual potential: | A | A | A | A | AA | A | AA | AA | AA | A |
| Smeared image: | A | AA | AA | A | AA | AA | A | AA | AA | AA |
| White spots: | A | AA | AA | A | AA | AA | A | AA | AA | AA |
| Scratches: | AA | AA | AA | AA | AA | AA | AA | AA | AA | AA |
| Black dots caused by melt-adhesion of toner: | B | AA | AA | B | AA | AA | B | AA | AA | AA |
| Overall evaluation: | B | A | A | B | AA | A | B | AA | AA | A |
| a) Hydrogen content: (at. %) | 48 | | | | 61 | | | 70 | | 76 |
| b) Fluorine content: (at. %) | 0* | 11 | 19 | 23 | 0* | 8 | 12 | 0* | 4 | 0* |
| Total of a) & b): (at. %) | 48 | 59 | 67 | 71 | 61 | 69 | 73 | 70 | 74 | 76 |
| Chargeability: | A | AA | AA | AA | A | AA | AA | A | AA | A |
| Sensitivity: | AA | AA | AA | A | AA | AA | A | AA | A | A |
| Residual potential: | AA | AA | AA | A | AA | AA | A | AA | AA | A |
| Smeared image: | A | AA | AA | AA | A | AA | AA | A | AA | A |
| White spots: | A | AA | AA | AA | A | AA | AA | A | AA | A |
| Scratches: | AA | AA | AA | AA | AA | AA | AA | AA | AA | AA |
| Black dots caused by melt-adhesion of toner: | B | AA | AA | AA | B | AA | AA | B | AA | B |
| Overall evaluation: | B | AA | AA | A | B | AA | A | B | A | B |

Remarks:
Data in which fluorine atom content is 0 at. % are results of evaluation of Comparative Example I25. Other data are those of Example I25.

TABLE I48

| Layer | Gas used, & flow rate (sccm) | μW power (W) | Inner pressure (mtorr) | Substrate temp. (°C.) | Layer thickness (μm) |
|---|---|---|---|---|---|
| First Photoconductive layer | $SiH_4$ 300<br>$CH_4$ 150 → 0 (FIG. 8 pattern)<br>$SiF_4$ 70 → 90 ppm (based on $SiH_4$)<br>$B_2H_6$ 40 → 3 ppm (based on $SiH_4$)<br>$CO_2$ 500 → 600 ppm (based on $SiH_4$) | 1,000 | 10 | 250 | 17 |
| Second photoconductive layer | $SiH_4$ 250<br>$B_2H_6$ 2 ppm (based on $SiH_4$) | 1,000 | 10 | 250 | 3 |
| Surface layer | $SiH_4$ 75<br>$CH_4$ 800<br>$NO_2$ 2,000 ppm (based on $SiH_4$)<br>$B_2H_6$ 30 ppm (based on $SiH_4$)<br>$SiF_4$ (Varied) | Varied | 10 | 250 | 0.5 |

TABLE I49

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 300<br>$CH_4$ 150 → 0 (FIG. 8 pattern)<br>$SiF_4$ 50 → 80 ppm (based on $SiH_4$)<br>$B_2H_6$ 40 → 3 ppm (based on $SiH_4$)<br>$CO_2$ 500 → 600 ppm (based on $SiH_4$) | 500 | 0.5 | 250 | 17 |
| Second photoconductive layer | $SiH_4$ 300<br>$B_2H_6$ 2 ppm (based on $SiH_4$) | 500 | 0.5 | 250 | 3 |
| Surface layer | $SiH_4$ 15<br>$CH_4$ 850<br>$NO_2$ (Varied)<br>$B_2H_6$ 300 ppm (based on $SiH_4$)<br>$SiF_4$ 30 | 300 | 0.5 | 250 | 0.5 |

TABLE I50

(before running)

| Total of nitrogen atom content and oxygen atom content: (at. %) | Cp. *I27 | Example I27 | | | | | | | | Cp. *I27 | |
|---|---|---|---|---|---|---|---|---|---|---|---|
| | 1 × $10^{-5}$ | 1 × $10^{-4}$ | 3 × $10^{-4}$ | 1 × $10^{-3}$ | 5 × $10^{-3}$ | 1 | 20 | 25 | 30 | 40 | 50 |
| Chargeability: | B | A | AA | AA | AA | AA | AA | AA | AA | AA | AA |
| Sensitivity: | B | A | AA | AA | AA | AA | AA | AA | A | B | B |
| Residual potential: | A | AA | AA | AA | AA | AA | AA | A | A | B | B |
| Smeared image: | A | A | AA | AA | AA | AA | AA | AA | AA | AA | AA |
| White spots: | A | AA | AA | AA | AA | AA | AA | AA | AA | AA | AA |
| Scratches: | A | A | AA | AA | AA | AA | AA | AA | AA | AA | AA |
| Black dots caused by melt-adhesion of toner: | B | A | AA | AA | AA | AA | AA | AA | AA | AA | AA |

*Comparative Example

TABLE I51

| Total of Nitrogen atom content and oxygen atom content: (at. %) | Cp. *I27 $10^{-5}$ | Example I27 (after running) 1 × $10^{-4}$ | 3 × $10^{-4}$ | 1 × $10^{-3}$ | 5 × $10^{-3}$ | 1 | 20 | 25 | 30 | Cp. *I27 40 | 50 |
|---|---|---|---|---|---|---|---|---|---|---|---|
| Chargeability: | B | A | AA | AA | AA | AA | AA | AA | AA | AA | AA |
| Sensitivity: | B | A | AA | AA | AA | AA | AA | AA | A | B | B |
| Residual potential: | A | AA | AA | AA | AA | AA | AA | A | A | B | B |
| Smeared image: | B | A | AA | AA | AA | AA | AA | AA | AA | AA | AA |
| White spots: | B | A | AA | AA | AA | AA | AA | AA | AA | AA | AA |
| Scratches: | A | A | AA | AA | AA | AA | AA | AA | AA | AA | AA |
| Black dots caused by melt-adhesion of toner: | B | A | AA | AA | AA | AA | AA | AA | AA | AA | AA |

*Comparative Example

TABLE I52

| Layer | Gas used, & flow rate (sccm) | μW power (W) | Inner pressure (mtorr) | Substrate temp. (°C.) | Layer thickness (μm) |
|---|---|---|---|---|---|
| First Photoconductive layer | $SiH_4$ 300<br>$CH_4$ 150 → 0 (FIG. 8 pattern)<br>$SiF_4$ 70 → 90 ppm (based on $SiH_4$)<br>$B_2H_6$ 40 → 3 ppm (based on $SiH_4$)<br>$CO_2$ 500 → 600 ppm (based on $SiH_4$) | 1,000 | 10 | 250 | 17 |
| Second photoconductive layer | $SiH_4$ 250<br>$B_2H_6$ 2 ppm (based on $SiH_4$) | 1,000 | 10 | 250 | 3 |
| Surface layer | $SiH_4$ 75<br>$CH_4$ 800<br>$NO_2$ (Varied)<br>$B_2H_6$ 30 ppm (based on $SiH_4$)<br>$SiF_4$ 35 | 1,000 | 10 | 250 | 0.5 |

TABLE I53

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ 50 → 80 ppm (based on $SiH_4$)<br>$B_2H_6$ (Table I54)<br>$CO_2$ 500 → 600 ppm (based on $SiH_4$) | 500 | 0.5 | 250 | 17 |
| Second photoconductive layer | $SiH_4$ 500<br>$B_2H_6$ (Table I54) | 500 | 0.5 | 250 | 3 |
| Surface layer | $SiH_4$ 15<br>$CH_4$ 850<br>$CO_2$ 60 ppm (based on $SiH_4$)<br>$B_2H_6$ 3.5 ppm (based on $SiH_4$)<br>$SiF_4$ 20 | 300 | 0.5 | 250 | 0.5 |

TABLE I54

| Pattern | $B_2H_6$ content in 1st photoconductive layer (ppm) | $B_2H_6$ content in 2nd photoconductive layer (ppm) |
|---|---|---|
| a | 0 | 0 |
| b | 10 | 1.0 |
| c | 25 → 2* | 1 → 0* |
| d | 25 → 1.8* | 1.8 |

*Linearly changed

TABLE I55

| Pattern | Chargeability | Sensitivity | Residual potential |
|---|---|---|---|
| a | 100 | 100 | 100 |
| b | 101 | 95 | 91 |
| c | 103 | 94 | 91 |
| d | 103 | 94 | 90 |

TABLE I56

| Layer | Gas used, & flow rate (sccm) | μW power (W) | Inner pressure (mtorr) | Substrate temp. (°C.) | Layer thickness (μm) |
|---|---|---|---|---|---|
| First Photoconductive layer | $SiH_4$ 300<br>$CH_4$ 120 → 0 (FIG. 8 pattern)<br>$SiF_4$ 70 → 90 ppm (based on $SiH_4$)<br>$B_2H_6$ (Table I54)<br>$CO_2$ 500 → 600 ppm (based on $SiH_4$) | 1,000 | 10 | 250 | 17 |
| Second photoconductive layer | $SiH_4$ 250<br>$B_2H_6$ (Table I54) | 1,000 | 10 | 250 | 3 |
| Surface layer | $SiH_4$ 75<br>$CH_4$ 800<br>NO 500 ppm (based on $SiH_4$)<br>$B_2H_6$ 30 ppm (based on $SiH_4$)<br>$SiF_4$ 35 | 1,000 | 10 | 250 | 0.5 |

TABLE I57

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 350 → 0 (FIG. 8 pattern)<br>$SiF_4$ 50 → 80 ppm (based on $SiH_4$) | 500 | 0.5 | 250 | 17 |
| Second photoconductive layer | $SiH_4$ 500 | 500 | 0.5 | 250 | 3 |
| Surface layer | $SiH_4$ 10<br>$CH_4$ 750<br>$O_2$ 1,000 ppm (based on $SiH_4$)<br>$N_2$ 10<br>$SiF_4$ 30 | 300 | 0.5 | 250 | 0.5 |

TABLE I58

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 350<br>$SiF_4$ 50 → 80 ppm (based on $SiH_4$) | 500 | 0.5 | 250 | 17 |
| Second photoconductive layer | $SiH_4$ 500 | 500 | 0.5 | 250 | 3 |
| Surface layer | $SiH_4$ 10<br>$CH_4$ 750<br>$O_2$ 1,000 ppm (based on $SiH_4$)<br>$N_2$ 10<br>$SiF_4$ 30 | 300 | 0.5 | 250 | 0.5 |

TABLE I59

| | Chargeability | Sensitivity | Residual potential |
|---|---|---|---|
| Example I31: | AA | AA | AA |
| Comparative Example I29: | A | B | B |

TABLE I60

| Layer | Gas used, & flow rate (sccm) | μW power (W) | Inner pressure (mTorr) | Substrate temp. (°C.) | Layer thickness (μm) |
|---|---|---|---|---|---|
| First Photoconductive layer | $SiH_4$ 500<br>$CH_4$ 250 → 0 (FIG. 8 pattern)<br>$SiF_4$ 50 → 80 ppm (based on $SiH_4$) | 1,000 | 10 | 250 | 17 |
| Second photoconductive layer | $SiH_4$ 500 | 1,000 | 10 | 250 | 3 |
| Surface layer | $SiH_4$ 80<br>$CH_4$ 500<br>$O_2$ 60 ppm (based on $SiH_4$) | 1,000 | 10 | 250 | 0.5 |

TABLE I60-continued

| Layer | Gas used, & flow rate (sccm) | μW power (W) | Inner pressure (mTorr) | Substrate temp. (°C.) | Layer thickness (μm) |
|---|---|---|---|---|---|
| | $N_2$ 10<br>$SiF_4$ 30 | | | | |

TABLE I61

| Layer | Gas used, & flow rate (sccm) | μW power (W) | Inner pressure (mTorr) | Substrate temp. (°C.) | Layer thickness (μm) |
|---|---|---|---|---|---|
| First Photoconductive layer | $SiH_4$ 300<br>$CH_4$ 250<br>$SiF_4$ 50 → 80 ppm (based on $SiH_4$) | 1,000 | 10 | 250 | 17 |
| Second photoconductive layer | $SiH_4$ 500 | 1,000 | 10 | 250 | 3 |
| Surface layer | $SiH_4$ 80<br>$CH_4$ 500<br>$O_2$ 60 ppm (based on $SiH_4$)<br>$N_2$ 10<br>$SiF_4$ 30 | 1,000 | 10 | 250 | 0.5 |

TABLE I62

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ 50 → 80 ppm (based on $SiH_4$) | 500 | 0.5 | 250 | 17 |
| Second photoconductive layer | $SiH_4$ 500 | 500 | 0.5 | 250 | Varied |
| Surface layer | $SiH_4$ 10<br>$CH_4$ 750<br>$CO_2$ 10<br>$N_2$ 10<br>$SiF_4$ 30 | 300 | 0.5 | 250 | 0.5 |

TABLE I63

| | Layer thickness of Second conductive layer (μm) | Sensitivity (%) |
|---|---|---|
| Comparative Example I31: | 20.0 | 102 |
| Example I33: | 0 | 100 |
| | 0.5 | 110 |
| | 1.0 | 115 |
| | 2.0 | 112 |
| | 5.0 | 110 |
| | 7.0 | 110 |
| | 10.0 | 105 |
| | 15.0 | 105 |
| | 20.0 | 102 |

TABLE I64

| Layer | Gas used, & flow rate (sccm) | μW power (W) | Inner pressure (mTorr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ 50 → 80 ppm (based on $SiH_4$) | 1,000 | 10 | 250 | 17 |
| Second photoconductive layer | $SiH_4$ 500 | 1,000 | 10 | 250 | Varied |
| Surface layer | $SiH_4$ 80<br>$CH_4$ 500<br>$CO_2$ 10<br>$N_2$ 10<br>$SiF_4$ 30 | 1,000 | 10 | 250 | 0.5 |

TABLE I65

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ (Varied)<br>$SiF_4$ 50 → 80 ppm (based on $SiH_4$) | 500 | 0.5 | 250 | 17 |
| Second photo conductive layer | $SiH_4$ 500 | 500 | 0.5 | 250 | 3 |
| Surface layer | $SiH_4$ 10<br>$CH_4$ 750<br>$O_2$ 1,500 ppm<br>$N_2$ 1,500 ppm (based on $SiH_4$)<br>$SiF_4$ 30 | 300 | 0.5 | 250 | 0.5 |

TABLE I66

| | Pattern of carbon atom content | Chargeability | Sensitivity | Residual potential |
|---|---|---|---|---|
| Example I35: | FIG. 8 | AA | AA | AA |
| | FIG. 9 | AA | AA | AA |
| | FIG. 10 | AA | AA | AA |
| Comparative | FIG. 11 | A | B | B |
| Example I33: | FIG. 12 | AA | B | B |

TABLE I67

| Layer | Gas used, & flow rate (sccm) | μW power (W) | Inner pressure (mtorr) | Substrate temp. (°C.) | Layer thickness (μm) |
|---|---|---|---|---|---|
| First Photoconductive layer | $SiH_4$ 300<br>$CH_4$ (Varied)<br>$SiF_4$ 50 → 80 ppm (based on $SiH_4$) | 1,000 | 10 | 250 | 17 |
| Second photoconductive layer | $SiH_4$ 500 | 1,000 | 10 | 250 | 3 |
| Surface layer | $SiH_4$ 80<br>$CH_4$ 500<br>$O_2$ 1,500 ppm<br>$N_2$ 1,500 ppm (based on $SiH_4$)<br>$SiF_4$ 30 | 1,000 | 10 | 250 | 0.5 |

TABLE I68

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ Varied → 0 (FIG. 8 pattern)<br>$SiF_4$ 50 → 80 ppm (based on $SiH_4$) | 500 | 0.5 | 250 | 17 |
| Second photoconductive layer | $SiH_4$ 500 | 500 | 0.5 | 250 | 3 |
| Surface layer | $SiH_4$ 15<br>$CH_4$ 800<br>$O_2$ 1,000 ppm<br>$N_2$ 1,500 ppm (based on $SiH_4$)<br>$SiF_4$ 20 | 300 | 0.5 | 250 | 0.5 |

TABLE I69

| Carbon atom content (at. %) | Chargeability | Sensitivity | Residual potential | White spots | (1) | (2) | (3) | (4) |
|---|---|---|---|---|---|---|---|---|
| Comparative Example I35: | | | | | | | | |
| 70 | AA | B | A | AA | AA | B | AA | B |
| 60 | AA | B | A | AA | AA | A | AA | B |
| Example I37: | | | | | | | | |
| 50 | AA | A | A | AA | AA | AA | AA | A |
| 40 | AA | AA | A | AA | AA | AA | AA | A |

TABLE I69-continued

| Carbon atom content (at. %) | Chargeability | Sensitivity | Residual potential | White spots | (1) | (2) | (3) | (4) |
|---|---|---|---|---|---|---|---|---|
| 30 | AA | AA | AA | AA | AA | AA | AA | AA |
| 20 | AA | AA | AA | AA | AA | AA | AA | AA |
| 10 | AA | AA | AA | AA | AA | AA | AA | AA |
| 5 | AA | AA | AA | AA | AA | AA | AA | AA |
| 1 | AA | AA | AA | AA | AA | AA | AA | AA |
| 0.5 | A | AA | AA | AA | AA | AA | A | A |
| Comparative Example I35: | | | | | | | | |
| 0.3 | B | AA | AA | B | A | AA | B | B |

(1): Coarse image
(2): Ghost
(3): Spherical protuberances
(4): Overall evaluation

TABLE I70

| Layer | Gas used, & flow rate (sccm) | μW power (W) | Inner pressure (mtorr) | Substrate temp. (°C.) | Layer thickness (μm) |
|---|---|---|---|---|---|
| First Photoconductive layer | $SiH_4$ 300<br>$CH_4$ Varied → 0 (FIG. 8 pattern)<br>$SiF_4$ 50 → 80 ppm (based on $SiH_4$) | 1,000 | 10 | 250 | 17 |
| Second photoconductive layer | $SiH_4$ 500 | 1,000 | 10 | 250 | 3 |
| Surface layer | $SiH_4$ 75<br>$CH_4$ 500<br>$CO_2$ 1,000 ppm<br>$N_2$ 1,500 ppm (based on $SiH_4$)<br>$SiF_4$ 35 | 1,000 | 10 | 250 | 0.5 |

TABLE I71

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ (Varied)<br>$B_2H_6$ 30 → 2 ppm (based on $SiH_4$) | 500 | 0.5 | 250 | 17 |
| Second photoconductive layer | $SiH_4$ 500 | 500 | 0.5 | 250 | 3 |
| Surface layer | $SiH_4$ 30<br>$CH_4$ 500<br>$CO_2$ 100<br>$NH_3$ 100<br>$SiF_4$ 10<br>$H_2$ 100 | 300 | 0.5 | 250 | 0.5 |

TABLE I72

| | Fluorine atom content | (before running) White spots | Coarse image | Ghost | Overall evaluation |
|---|---|---|---|---|---|
| Example I39: | FIG. 13 | AA | A | A | A |
| | FIG. 14 | AA | AA | AA | AA |
| | FIG. 15 | AA | AA | AA | AA |
| | FIG. 16 | AA | AA | AA | AA |
| | FIG. 17 | AA | AA | AA | AA |
| | FIG. 18 | AA | AA | AA | AA |
| | FIG. 19 | AA | AA | AA | AA |
| | FIG. 20 | AA | AA | AA | AA |
| Comparative | FIG. 21 | AA | AA | B | B |
| Example I37: | FIG. 22 | AA | AA | B | B |

TABLE I73

| | Fluorine atom content | (after running) White spots | Coarse image | Ghost | Overall evaluation |
|---|---|---|---|---|---|
| Example I39: | FIG. 13 | AA | A | B | B |
| | FIG. 14 | AA | A | A | A |
| | FIG. 15 | AA | AA | A | A |
| | FIG. 16 | AA | AA | AA | AA |
| | FIG. 17 | AA | AA | AA | AA |
| | FIG. 18 | AA | AA | AA | AA |
| | FIG. 19 | AA | A | AA | A |
| | FIG. 20 | AA | A | A | A |
| Comparative | FIG. 21 | AA | B | B | B |
| Example I37: | FIG. 22 | AA | B | B | B |

TABLE I74

| Layer | Gas used, & flow rate (sccm) | μW power (W) | Inner pressure (mtorr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ (Varied)<br>$B_2H_6$ 30 → 2 ppm (based on $SiH_4$) | 1,000 | 10 | 250 | 17 |
| Second photo- | $SiH_4$ 500 | 1,000 | 10 | 250 | 3 |

TABLE I74-continued

| Layer | Gas used, & flow rate (sccm) | μW power (W) | Inner pressure (mtorr) | Substrate temp. (°C.) | Layer thickness (μm) |
|---|---|---|---|---|---|
| conductive layer | | | | | |
| Surface layer | $SiH_4$ 30<br>$CH_4$ 500<br>$CO_2$ 100<br>$NH_3$ 100<br>$SiF_4$ 10<br>$H_2$ 100 | 1,000 | 10 | 250 | 0.5 |

TABLE I75-continued

| Layer | Gas used, & flow rate (sccm) | RF power (W) | Inner pressure (Torr) | Substrate temp. (°C.) | Layer thickness (μm) |
|---|---|---|---|---|---|
| Surface layer | $SiH_4$ 15<br>$CH_4$ 800<br>$CO_2$ 100<br>$NH_3$ 100<br>$SiF_4$ 10<br>$H_2$ 100 | 300 | 0.5 | 250 | 0.5 |

TABLE I76

(before running)

| | Pattern of fluorine atom content | White spots | Coarse image | Ghost | (1) | (2) | (3) | (4) |
|---|---|---|---|---|---|---|---|---|
| Example I41: | FIG. 23 | AA | AA | AA | AA | AA | AA | AA |
| | FIG. 24 | AA | AA | AA | AA | AA | AA | AA |
| | FIG. 25 | AA | AA | AA | AA | AA | AA | AA |
| | FIG. 26 | AA | AA | AA | AA | AA | AA | AA |
| Comparative Example I39: | FIG. 27 | AA | AA | AA | A | AA | A | A |

(1): Temperature characteristics
(2): Chargeability
(3): Uneven image density
(4): Overall evaluation

TABLE I77

(after running)

| | Pattern of fluorine atom content | White spots | Coarse image | Ghost | (1) | (2) | (3) | (4) |
|---|---|---|---|---|---|---|---|---|
| Example I41: | FIG. 23 | AA | AA | AA | AA | AA | AA | AA |
| | FIG. 24 | AA | AA | AA | AA | AA | AA | AA |
| | FIG. 25 | AA | AA | AA | AA | AA | AA | AA |
| | FIG. 26 | AA | AA | AA | AA | AA | AA | AA |
| Comparative Example I39: | FIG. 27 | AA | AA | AA | B | AA | B | B |

(1): Temperature characteristics
(2): Chargeability
(3): Uneven image density
(4): Overall evaluation

TABLE I75

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ (Varied)<br>$B_2H_6$ 30 → 2 ppm (based on $SiH_4$) | 500 | 0.5 | 250 | 17 |
| Second photoconductive layer | SiH 500<br>$B_2H_6$ 2 ppm (based on $SiH_4$) | 500 | 0.5 | 250 | 3 |

TABLE I78

| Layer | Gas used, & flow rate (sccm) | μW power (W) | Inner pressure (mtorr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ (Varied)<br>$B_2H_6$ 30 → 2 ppm (based on $SiH_4$) | 1,000 | 10 | 250 | 17 |
| Second photoconductive layer | $SiH_4$ 500<br>$B_2H_6$ 2 ppm (based on $SiH_4$) | 1,000 | 10 | 250 | 3 |

TABLE I78-continued

| Layer | Gas used, & flow rate (sccm) | μW power (W) | Inner pressure (mtorr) | Substrate temp. (°C.) | Layer thickness (μm) |
|---|---|---|---|---|---|
| Surface layer | $SiH_4$ 15<br>$CH_4$ 800<br>$CO_2$ 100<br>$NH_3$ 100<br>$SiF_4$ 10<br>$H_2$ 100 | 1,000 | 10 | 250 | 0.5 |

TABLE I79

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ 50 → 80 ppm (based on $SiH_4$)<br>$B_2H_6$ 40 → 3 ppm (based on $SiH_4$)<br>$CO_2$ (Varied) | 500 | 0.5 | 250 | 17 |
| Second photoconductive layer | $SiH_4$ 500<br>$B_2H_6$ 2 ppm (based on $SiH_4$) | 500 | 0.5 | 250 | 3 |
| Surface layer | $SiH_4$ 15<br>$CH_4$ 800<br>$CO_2$ 100<br>$NH_3$ 100<br>$SiF_4$ 10<br>$H_2$ 100 | 300 | 0.5 | 250 | 0.5 |

TABLE I80

| Oxygen atom content (at. ppm) | Chargeability | Sensitivity | Residual potential | Potential shift | Overall evaluation |
|---|---|---|---|---|---|
| Comparative Example I41: | | | | | |
| 5 | AA | AA | AA | A | A |
| 7 | AA | AA | AA | A | A |
| Example I43: | | | | | |
| 10 | AA | AA | AA | AA | AA |
| 50 | AA | AA | AA | AA | AA |
| 100 | AA | AA | AA | AA | AA |
| 250 | AA | AA | AA | AA | AA |
| 500 | AA | AA | AA | AA | AA |
| 1,000 | AA | AA | AA | AA | AA |
| 3,000 | AA | AA | AA | AA | AA |
| 5,000 | AA | AA | AA | AA | AA |
| Comparative Example I41: | | | | | |
| 5,500 | AA | A | B | AA | B |
| 6,000 | AA | B | B | AA | B |
| 8,000 | AA | B | B | AA | B |

TABLE I81

| Layer | Gas used, & flow rate (sccm) | μW power (W) | Inner pressure (mtorr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ 50 → 80 ppm (based on $SiH_4$)<br>$B_2H_6$ 40 → 3 ppm (based on $SiH_4$)<br>$CO_2$ (Varied) | 1,000 | 10 | 250 | 17 |
| Second photoconductive layer | $SiH_4$ 500<br>$B_2H_6$ 2 ppm (based on $SiH_4$) | 1,000 | 10 | 250 | 3 |
| Surface layer | $SiH_4$ 15<br>$CH_4$ 800<br>$CO_2$ 100<br>$NH_3$ 100<br>$SiF_4$ 10<br>$H_2$ 100 | 1,000 | 10 | 250 | 0.5 |

TABLE I82

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ 50 → 80 ppm (based on $SiH_4$)<br>$B_2H_6$ 40 → 3 ppm (based on $SiH_4$)<br>$CO_2$ (Varied) | 500 | 0.5 | 250 | 17 |
| Second photoconductive layer | $SiH_4$ 500<br>$B_2H_6$ 2 ppm (based on $SiH_4$) | 500 | 0.5 | 250 | 3 |
| Surface layer | $SiH_4$ 75<br>$CH_4$ 500<br>$CO_2$ 100<br>$NH_3$ 100<br>$SiF_4$ 10 | 300 | 0.5 | 250 | 0.5 |

TABLE I83

(after running)

| Pattern of oxygen content | Chargeability | Sensitivity | Residual potential | Potential shift | Overall evaluation |
|---|---|---|---|---|---|
| Example I45: | | | | | |
| FIG. 28 | AA | AA | AA | A | A |
| FIG. 29 | AA | AA | AA | AA | AA |
| FIG. 30 | AA | AA | AA | AA | AA |
| FIG. 31 | AA | AA | AA | AA | AA |
| FIG. 32 | AA | AA | AA | AA | AA |
| Comparative Example I43: | | | | | |
| — | AA | AA | AA | B | B |

TABLE I84

| Layer | Gas used, & flow rate (sccm) | μW power (W) | Inner pressure (mTorr) | Substrate temp. (°C.) | Layer thickness (μm) |
|---|---|---|---|---|---|
| First Photoconduc- | $SiH_4$ 500<br>$CH_4$ 150 → 0 (FIG. 8 pattern)<br>$SiF_4$ 50 → 80 ppm (based on $SiH_4$) | 1,000 | 10 | 250 | 17 |

TABLE I84-continued

| Layer | Gas used, & flow rate (sccm) | μW power (W) | Inner pressure (mTorr) | Substrate temp. (°C.) | Layer thickness (μm) |
|---|---|---|---|---|---|
| tive layer | $CO_2$ (Varied) | | | | |
| Second photoconductive layer | $SiH_4$ 500<br>$B_2H_6$ 2 ppm (based on $SiH_4$) | 1,000 | 10 | 250 | 3 |
| Surface layer | $SiH_4$ 75<br>$CH_4$ 500<br>$CO_2$ 100<br>$NH_3$ 100<br>$SiF_4$ 10 | 1,000 | 10 | 250 | 0.5 |

TABLE I85

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ 50 → 80 ppm (based on $SiH_4$) | 500 | 0.5 | 250 | 17 |
| Second photoconductive layer | $SiH_4$ 500 | 500 | 0.3 | 250 | 3 |
| Surface layer | $SiH_4$ 30<br>$CH_4$ (Varied)<br>$CO_2$ (Varied)<br>$NH_3$ (Varied)<br>$SiF_4$ 10<br>$H_2$ 100 | 300 | 0.5 | 250 | 0.5 |

TABLE I86

| | Example I47 | | | | | |
|---|---|---|---|---|---|---|
| a) Carbon content: (at. %) | 10 | 30 | 60 | 60 | 60 | 70 |
| b) Oxygen content: (at. %) | 20 | 5 | 3 | 8 | $5 \times 10^{-3}$ | 4 |
| c) Nitrogen content: (at. %) | 20 | 8 | 5 | 15 | $2 \times 10^{-4}$ | 5 |
| Total of b) & c): (at. %) | 40 | 13 | 8 | 23 | about $5 \times 10^{-3}$ | 9 |
| Total of a), b) & c): (at. %) | 50 | 43 | 68 | 83 | about 60 | 79 |
| Chargeability: | A | A | AA | A | AA | AA |
| Sensitivity: | AA | AA | AA | AA | AA | AA |
| Residual potential: | AA | AA | AA | AA | AA | AA |
| Smeared image: | A | AA | AA | A | AA | AA |
| Image evaluation before running: | A | A | AA | A | AA | AA |
| Image evaluation after running: | A | A | AA | A | AA | AA |
| Overall evaluation: | A | A | AA | A | AA | AA |

TABLE I86-continued

| | Example I47 (cont'd) | | | | |
|---|---|---|---|---|---|
| a) Carbon content: (at. %) | 70 | 70 | 70 | 70 | 80 |
| b) Oxygen content: (at. %) | 6 | $1 \times 10^{-3}$ | 12 | $5 \times 10^{-3}$ | 3 |
| c) Nitrogen content: (at. %) | 9 | 3 | $1 \times 10^{-3}$ | $2 \times 10^{-4}$ | 5 |
| Total of b) & c): (at. %) | 15 | about 3 | about 12 | about $5 \times 10^{-3}$ | 8 |
| Total of a), b) & c): (at. %) | 85 | about 73 | about 82 | about 70 | 88 |
| Chargeability: | A | AA | A | AA | AA |
| Sensitivity: | AA | AA | AA | AA | AA |
| Residual potential: | AA | AA | AA | AA | AA |
| Smeared image: | AA | AA | AA | AA | AA |
| Image evaluation before running: | A | AA | A | AA | AA |
| Image evaluation after running: | A | AA | A | AA | AA |
| Overall evaluation: | A | AA | A | AA | AA |

| | Comparative Example | | | | | | | |
|---|---|---|---|---|---|---|---|---|
| | I45 | | | | | I46 | I47 | I48 |
| a) Carbon content: (at. %) | 10 | 10 | 30 | 30 | 60 | 0 | 50 | 50 |
| b) Oxygen content: (at. %) | 12 | 40 | 2 | 35 | 18 | 40 | 0 | 10 |
| c) Nitrogen content: (at. %) | 10 | 45 | 3 | 30 | 15 | 20 | 10 | 0 |
| Total of b) & c): (at. %) | 22 | 85 | 5 | 65 | 33 | 60 | 60 | 60 |
| Total of a), b) & c): (at. %) | 32 | 95 | 35 | 95 | 93 | 60 | 60 | 60 |
| Chargeability: | B | A | A | A | A | A | A | A |
| Sensitivity: | A | AA | AA | AA | AA | A | AA | AA |
| Residual potential: | AA | AA | AA | AA | AA | B | B | B |
| Smeared image: | A | A | AA | A | A | A | A | A |
| Image evaluation before running: | B | A | B | A | A | A | A | A |
| Image evaluation after running: | B | B | B | B | B | B | B | B |
| Overall evaluation: | B | B | B | B | B | B | B | B |

TABLE I87

| Layer | Gas used, & flow rate (sccm) | μW power (W) | Inner pressure (mTorr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ 50 → 80 ppm (based on $SiH_4$) | 1,000 | 10 | 250 | 17 |
| Second photoconductive layer | $SiH_4$ 500 | 1,000 | 10 | 250 | 3 |
| Surface layer | $SiH_4$ 30<br>$CH_4$ (Varied)<br>$CO_2$ (Varied)<br>$NH_3$ (Varied)<br>$SiF_4$ 10<br>$H_2$ 100 | 1,000 | 10 | 250 | 0.5 |

TABLE I88

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ 50 → 80 ppm (based on $SiH_4$) | 500 | 0.5 | 250 | 17 |
| Second photoconductive layer | $SiH_4$ 500 | 500 | 0.5 | 250 | 3 |
| Surface layer | $SiH_4$ 30<br>$CH_4$ 500<br>$CO_2$ 100<br>$NH_3$ 100<br>$SiF_4$ (Varied)<br>$H_2$ (Varied) | 300 | 0.3 | 250 | 0.5 |

TABLE I89

| | Example I49 | | | | | | | | Cp.* I53 | |
|---|---|---|---|---|---|---|---|---|---|---|
| a) Hydrogen content: (at. %) | 21 | 30 | 30 | 30 | 48 | 48 | 61 | 61 | 11 | 53 |
| b) Fluorine content: (at. %) | 15 | 3 | 9 | 18 | 3 | 19 | 3 | 8 | 18 | 18 |
| Total of a) & b): (at. %) | 36 | 33 | 39 | 48 | 51 | 67 | 64 | 69 | 29 | 71 |
| Sensitivity: | AA | AA | AA | AA | AA | AA | AA | AA | B | B |
| Residual potential: | AA | AA | AA | AA | AA | AA | AA | AA | B | B |
| Smeared image: | AA | AA | AA | AA | AA | AA | AA | AA | AA | AA |
| Overall evaluation: | AA | AA | AA | AA | AA | AA | AA | AA | B | B |

| | Cp.* I53 | | Cp* I54 | | | | Cp* I55 | | | |
|---|---|---|---|---|---|---|---|---|---|---|
| a) Hydrogen content: (at. %) | 61 | 70 | 11 | 21 | 30 | 48 | 30 | 48 | 70 | 76 |
| b) Fluorine content: (at. %) | 12 | 4 | 24 | 23 | 23 | 21 | 0 | 0 | 0 | 0 |
| Total of a) & b): (at. %) | 73 | 74 | 35 | 44 | 53 | 69 | 30 | 48 | 70 | 76 |
| Sensitivity: | B | B | AA | AA | AA | AA | A | A | A | B |
| Residual potential: | B | A | B | B | B | B | A | A | A | B |
| Smeared image: | AA | AA | AA | AA | AA | AA | A | A | A | A |
| Overall evaluation: | B | B | B | B | B | B | A | A | A | B |

*Comparative Example

TABLE I90

| Layer | Gas used, & flow rate (sccm) | μW power (W) | Inner pressure (mTorr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$SiF_4$ 50 → 80 ppm (based on $SiH_4$) | 1,000 | 10 | 250 | 17 |
| Second photoconductive layer | $SiH_4$ 500 | 1,000 | 10 | 250 | 3 |
| Surface layer | $SiH_4$ 30<br>$CH_4$ 500<br>$CO_2$ 100<br>$NH_3$ 100<br>$SiF_4$ (Varied)<br>$H_2$ (Varied) | 1,000 | 10 | 250 | 0.5 |

TABLE I91

| Layer | Gas used, & flow rate (sccm) | RF power (W) | Inner pressure (Torr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$B_2H_6$ (Table I92)<br>$SiF_4$ 50 → 80 ppm (based on $SiH_4$)<br>$CO_2$ 500 → 600 ppm (based on $SiH_4$) | 500 | 0.5 | 250 | 17 |
| Second photoconductive layer | $SiH_4$ 500<br>$B_2H_6$ (Table I92) | 500 | 0.5 | 250 | 3 |
| Surface layer | $SiH_4$ 30<br>$CH_4$ 500<br>$CO_2$ 100<br>$NH_3$ 100<br>$SiF_4$ 10<br>$H_2$ 100 | 300 | 0.3 | 250 | 0.5 |

TABLE I92

| Pattern | $B_2H_6$ content in 1st photoconductive layer (ppm) | $B_2H_6$ content in 2nd photoconductive layer (ppm) |
|---|---|---|
| a | 0 | 0 |
| b | 10 | 0.5 |
| c | 20 → 1* | 1 → 0* |
| d | 20 → 0.5* | 0.5 |

*Linearly changed

TABLE I93

| Pattern | Chargeability | Sensitivity | Residual potential | Overall evaluation |
|---|---|---|---|---|
| a | AA | A | AA | A |
| b | AA | AA | AA | AA |
| c | AA | AA | AA | AA |
| d | AA | AA | AA | AA |

TABLE I94

| Layer | Gas used, & flow rate (sccm) | μW power (W) | Inner pressure (mTorr) | Substrate temp. (°C.) | Layer thickness (μm) |
|---|---|---|---|---|---|
| First Photoconductive layer | $SiH_4$ 500<br>$CH_4$ 150 → 0 (FIG. 8 pattern)<br>$B_2H_6$ (Table I92)<br>$SiF_4$ 50 → 80 ppm (based on $SiH_4$)<br>$CO_2$ 500 → 600 ppm (based on $SiH_4$) | 1,000 | 10 | 250 | 17 |
| Second photoconductive layer | $SiH_4$ 500<br>$B_2H_6$ (Table I92) | 1,000 | 10 | 250 | 3 |
| Surface layer | $SiH_4$ 30<br>$CH_4$ 500<br>$CO_2$ 100<br>$NH_3$ 100<br>$SiF_4$ 10<br>$H_2$ 100 | 1,000 | 10 | 250 | 0.5 |

What is claimed is:

1. An electrophotographic light-receiving member comprising a conductive substrate and a light receiving layer consisting essentially of a photoconductive layer and a surface layer which are successively layered on said conductive substrate, wherein:

said photoconductive layer comprises a non-monocrystalline material containing silicon atoms as a matrix and containing at least carbon atoms, hydrogen atoms and fluorine atoms;

said surface layer comprises a non-monocrystalline material comprising silicon atoms, carbon atoms, hydrogen atoms and halogen atoms;

said carbon atoms in said photoconductive layer are in a non-uniform content in the layer thickness direction, wherein the concentration of said carbon atoms gradually and continuously decreases from the side of the conductive substrate to the side of the surface layer; and said carbon atoms are present in amounts from 0.5 atomic % to 50 atomic % at a lower region of the photoconductive layer on the side of the conductive substrate and are present at substantially 0% at an upper layer region of said photoconductive layer on the side of the said surface layer;

said fluorine atoms in said photoconductive layer are present in amounts not more than 95 atomic ppm and are non-uniformly distributed in the layer thickness direction; and said hydrogen atoms in said photoconductive layer are present in amounts from 1 to 40 atomic %.

2. The electrophotographic light-receiving member according to claim 1, wherein said surface layer further contains an oxygen atom and a nitrogen atom.

3. The electrophotographic light-receiving member according to claim 2, wherein the total content of the carbon atom, oxygen atom and nitrogen atom in said surface layer is in the range of from 40 atomic % to 90 atomic % based on the total content of the silicon atom, carbon atom, oxygen atom and nitrogen atom in said surface layer.

4. The electrophotographic light-receiving member according to claim 2, wherein at least one of said carbon atom, oxygen atom, nitrogen atom and halogen atom in said surface layer is in a non-uniform content in the layer thickness direction.

5. The electrophotographic light-receiving member according to claim 1, wherein said surface layer contains an element belonging to Group III of the periodic table, and at least one of an oxygen atom and a nitrogen atom.

6. The electrophotographic light-receiving member according to claim 5, wherein at least one of said carbon atom, oxygen atom, nitrogen atom, halogen atom and element belonging to Group III of the periodic table in said surface layer is in a non-uniform content in the layer thickness direction.

7. The electrophotographic light-receiving member according to claim 5, wherein said carbon atom in said surface layer is in a content of from 63 atomic % to 90 atomic % at, its outermost surface, based on the total content of the silicon atom and carbon atom.

8. The electrophotographic light-receiving member according to claim 5, wherein said oxygen atom is in a content of not more than 30 atomic %.

9. The electrophotographic light-receiving member according to claim 5, wherein said nitrogen atom is in a content of not more than 30 atomic %.

10. The electrophotographic light-receiving member according to claim 5, wherein the total content of said oxygen atom and nitrogen atom is not more than 30 atomic %.

11. The electrophotographic light-receiving member according to claim 5, wherein said element belonging to Group III of the periodic table is not more than $1\times10^5$ atomic ppm.

12. The electrophotographic light-receiving member according to claim 1, wherein said fluorine atom in said photoconductive layer is in a maximum content at, its interface on the side of said surface layer.

13. The electrophotographic light-receiving member according to claim 1, wherein said halogen atom in said surface layer is in a content of not more than 20 atomic %.

14. The electrophotographic light-receiving member according to claim 1, wherein the total content of the hydrogen atom and halogen atom in said surface layer is in the range of from 30 atomic % to 70 atomic %.

15. The electrophotographic light-receiving member according to claim 1, wherein said photoconductive layer contains an element belonging to Group III or Group V of the periodic table.

16. The electrophotographic light-receiving member according to claim 1, wherein said photoconductive layer contains an oxygen atom.

17. The electrophotographic light-receiving member according to claim 16, wherein said oxygen atom is in a content of from 10 atomic ppm to 5,000 atomic ppm.

18. The electrophotographic light-receiving member according to claim 1, wherein said fluorine atom in said photoconductive layer is in a content of from 1 atomic ppm to 50 atomic ppm.

19. The electrophotographic light-receiving member according to claim 1, wherein said fluorine atom is in a content of from 5 atomic ppm to 50 atomic ppm.

20. The electrophotographic light-receiving member according to claim 1, wherein said photoconductive layer has a first photoconductive layer and a second photoconductive layer in that order from the side of said conductive substrate, and said first photoconductive layer contains said carbon atom and fluorine atom.

21. The electrophotographic light-receiving member according to claim 20, wherein said second photoconductive layer has a layer thickness of from 0.5 μm to 15 μm.

* * * * *

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

[57] ABSTRACT

Line 19, "R" should be deleted.

COLUMN 1

Line 36, "as" should read --in--.

COLUMN 3

Line 3, "so called" should read --so-called--.
Line 4, "phenomena." should read --phenomenon.--.
Line 22, "in case" should read --in the case--.
Line 53, "10" should be deleted.
Line 57, "in case" should read --in the case--.
Line 64, "in case" should read --in the case--.

COLUMN 4

Line 10, "dropoff" should read --drop-off-- and "relative" should read --relatively--.
Line 13, "a" should read --a reason--.
Line 21, "in case" should read --in the case--.
Line 40, "stances" should read --stance--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 5

Line 39, "out changes in the image defects" should read --out increases in the image defects--.

COLUMN 6

Line 17, "in" should be deleted.
Line 18, "atoms" should read --atoms in--.
Line 56, "o" should be deleted.

COLUMN 7

Line 28, "reduced," should read --not present,--.
Line 44, "so called" should read --so-called--.

COLUMN 9

Line 28, "in case" should read --in the case--.

COLUMN 10

Line 9, "inflection" should read --injection--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 11

Line 25, "of" should read --on--.
Line 66, "with" should read --to--.

COLUMN 12

Line 52, "inflection-inhibiting" should read --injection-inhibiting--.
Line 55, "inflection-inhibiting" should read --injection-inhibiting--.
Line 62, "1" should read --11--.

COLUMN 13

Line 65, "much" should read --many--.

COLUMN 15

Line 20, "explained" should be deleted.
Line 67, "their" should be deleted.

COLUMN 16

Line 4, "gasifyable" should read --gasifiable--.
Line 11, "butane-2" should read --butene-2--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 17

Line 48, "$1x10^{x2}$" should read --$1x10^{-2}$--.
Line 49, "$1x10^{4}$" should read --$5x10^{4}$--.

COLUMN 18

Line 14, "its" should read --their--.

COLUMN 20

Line 60, "Paw" should read --raw--.
Line 62, "its" should read --their--.

COLUMN 21

Line 59, "in plane" should read --in-plane--.

COLUMN 22

Line 58, "atom" should read --atoms--.
Line 60, "contents" should read --content--.
Line 61, "atom" should read --atoms--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 23

Line 45, "o" should be deleted.
Line 55, "These" should read --The--.

COLUMN 24

Line 24, "atoms-containing" should read --atom-containing--.
Line 51, "be also" should read --also be--.

COLUMN 25

Line 6, "In case" should read --In the case--.
and ""RFP-CVD" should read --"RF-PCVD--.

COLUMN 26

Line 67, "heating" should read --and--.

COLUMN 27

Line 17, "a" should be deleted.
Line 19, "film" should read --films--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 28

Line 59, "of" should be deleted.

COLUMN 29

Line 4, "SUCh" should read --such--.
Line 12, "SOUrCe" should read --source--.
Line 30, "heatresistant" should read --heat-resistant--.
Line 33, "heating" (first occurrence) should read --and--.

COLUMN 33

Line 46, "Inc" should read --Inc.--.

COLUMN 34

Line 3, "A" should read --The--.
Line 23, "80%." should read --80%".--.
Line 61, "atomic" (second occurrence) should read --atomic %--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 37

Line 34, "are" should read --were--.
Line 37, "are" should read --were--.

COLUMN 38

Line 38, "30%" should read --30 atomic %--.

COLUMN 42

Line 15, "60 atomic" should read --60 atomic %--.

COLUMN 44

Line 31, "are" should read --were--.
Line 33, "are" should read --were--.
Line 34, "are" should read --were--.

COLUMN 45

Line 49, "60 atomic" should read --60 atomic %.--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 47

Line 22, "30%" should read --30 atomic %--.

COLUMN 49

Line 51, "member" should read --members--.

COLUMN 51

Line 39, "60 atomic" should read --60 atomic %--.

COLUMN 54

Line 26, "are taken" should read --were made--.
Line 28, "are" should read --were--.
Line 29, "are" should read --were--.
Line 46, "are" should read --were--.

COLUMN 62

Line 12, "characteristics" should read --Characteristics--.
Line 51, "12 each." should read --12.--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 63

Line 26, "60 atomic" should read --60 atomic %--.
Line 67, "60 atomic" should read --60 atomic %--.

COLUMN 65

Line 16, "phenomenons" should read --phenomena--.
Line 58, "90" should read --90--.

COLUMN 66

Line 10, "are" should read --were--.
Line 12, "are" should read --were--.
Line 13, "are" should read --were--.
Line 59, "D9to" should read --D9 to--.
Line 63, "90" should read --90--.

COLUMN 68

Line 67, "30%" should read --30 atomic %--.

COLUMN 69

After line 3, insert "Comparative Example D21".
Line 6, "%" should read --%.--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 71

Line 26, "member" should read --members--.
Line 33, "improved in" should be deleted.

COLUMN 73

Line 5, "produced," should read --produced.--
Line 63, "ppm" should read --ppm,-- and "in the photoconductive layer," should be deleted.

COLUMN 74

Line 56, "member" should read --members--.
Line 57, "is" should read --was--.
Line 59, "member is" should read --members was--.
Line 61, "are" should read --were--.

COLUMN 75

Line 5, "Inc" should read --Ink.--.
Line 58, "was" should read --were--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 76

Line 41, "Give" should read --give--.
Line 58, "Glow-discharging" should read --glow-discharging--.

COLUMN 79

Line 34, "are" should read --were--.
Line 35, "are" should read --were--.

COLUMN 81

Line 65, "Were" should read --were--.

COLUMN 84

Line 23, "pW" should read --μW--.

COLUMN 85

Line 22, "all the" should be deleted.

COLUMN 86

Line 30, "F5," should read --F5.--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 89

Line 14, "18," should read --F18,--.
Line 32, "was" should read --were--.

COLUMN 91

Line 30, "24," should read --F24--.

COLUMN 92

Line 23, "on" should read --of--.
Line 61, "lines" should read --"lines--.
Line 62, "without" should read --with--.

COLUMN 93

Line 7, "atom content" should be deleted.

COLUMN 98

Line 4, "to" (third occurrence) should be deleted.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 100

Line 4, insert "Comparative Example G2".
Line 5, "electrophoto-graphic" should read --electrophotographic--.
Line 16, "EXAMPLE G3" should read --EXAMPLE G3 &--.
Line 38, "EXAMPLE G4" should read --EXAMPLE G4 &--.

COLUMN 101

Line 54, "member" should read --members--.
Line 60, "EXAMPLE G7" should read --EXAMPLE G7 &--.

COLUMN 102

Line 18, "on" should read --of--.
Line 34, "EXAMPLE G8" should read --EXAMPLE G8 &--.
Line 54, "EXAMPLE G9" should read --EXAMPLE G9 &--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 103

Line 27, "EXAMPLE G10" should read --EXAMPLE G10 &--.

COLUMN 106

Line 67, "set" should read --set within the range--.

COLUMN 107

Line 1, "within the range" should be deleted.

COLUMN 108

Line 1, "seem" should read --seen--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 109

Line 4, "electrophoto-graphic" should read --electrophotographic-- and "member" should read --members--.
Line 15, "thus-produced" should read --thus produced--.
Line 44, "Evaluation" should read --Characteristics--.
Line 66, "Evaluation on" should read Characteristics of--.

COLUMN 110

Line 57, "electrophoto-graphic" should read --electrophotographic--.
Line 64, "member" should read --members--.
Line 65, "has" should read --have--.
Line 67, "causes" should read --cause--.

COLUMN 111

Line 32, "member" should read --members--.
Line 65, "Ghost" should read --ghost--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 112

Line 4, "Ghost" should read --ghost--.
Line 11, "Give" should read --give--.
Line 13, "electrophoto-graphic" should read --electrophotographic--.

COLUMN 114

Line 18, "atom" should read --atomic ppm--.
Line 67, "93" should read --93--.

COLUMN 115

Line 3, "on them" should read --of the light-receiving members 10--.
Line 14, "and atom" should read --and carbon atom--.
Line 43, "member" should read --members--.
Line 48, "member" should read --members--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 116

Line 7, "1x10" should read --$1x10^{-5}$--.
Line 15, "267" should read --26--.
Line 48, "member" should read --members--.

COLUMN 117

Line 53, "member" should read --members--.

COLUMN 118

Line 55, "produce" should read --produced--.
Line 58, "10" should be deleted.
Line 59, "member" should read --members--.

COLUMN 119

Line 20, "on" should read --of--.

COLUMN 120

Line 6, "member" should read --members--.
Line 33, "on" should read --of--.
Line 65, "electrophoto-graphic" should read --electrophotographic--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 121

Line 15, "member" should read --members--.

COLUMN 122

Line 17, "EXAMPLE I3" should read --EXAMPLE I3 &--.
Line 38, "100." should read --100%.--.
Line 45, "EXAMPLE I4" should read --EXAMPLE I4 &--.
Line 54, "pW" should read --μW--.

COLUMN 123

Line 53, "member" should read --members--.
Line 62, "member" should read --members--.

COLUMN 124

Line 51, "member" should read --members--.

COLUMN 125

Line 29, "$siF_4$" should read --$SiF_4$--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 128

Line 26, "5,000ppm" should read --5,000 atomic ppm-.

COLUMN 129

Line 6, "content" should read --atom content--.
Line 9, "content" should read --atom content--.
Line 25, "an" should be deleted.
Line 26, "member" should read --members--.

COLUMN 130

Line 46, "Table," should read --Table I30,--.

COLUMN 131

Line 15, "member" should read --members--.

COLUMN 134

Line 32, "member" should read --members--.

COLUMN 135

Line 44, "member" should read --members--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 136

Line 57, "E29" should read --I29--.
Line 67, "each" should be deleted.

COLUMN 137

Line 30, "54" should read --I54--.

COLUMN 138

Line 33, "EXAMPLE I33" should read --EXAMPLE I33 &--.
Line 62, "EXAMPLE I34" should read --EXAMPLE I34 &--.

COLUMN 139

Line 30, "member" should read --members--.
Line 31, "was" should read --were--.
Line 40, "12 each," should read --12,--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 140

Line 3, "member" should read --members--.
Line 9, "12 each," should read --12,--.
Line 12, "member" should read --members--.
Line 67, "%," should read --%.--.

COLUMN 141

Line 38, "was" should read --were--.

COLUMN 142

Line 24, "$siF_4$" should read --$SiF_4$--.

COLUMN 146

Line 38, "An electropho-" should read --Electropho- --.

COLUMN 149

Line 66, "vary" should read --very--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 150

Line 19, "Since also" should read --Also, since--.

COLUMN 151

Line 45, "and," should read --and--.
Line 49, "also" should be deleted.

COLUMN 154

Table A10, "Seni-" should read --Sensi- --.

COLUMN 156

Table A14, "images" should read --ness--.

COLUMN 159

Table A22, "23)" should read --A23)--.
Table A23, "Comparative A17 Example A13" should read --Example A17: Comparative Example A13:--.
Table A24, "Comparative Example A17 Example A13" should read --Example A17: Comparative Example A13:--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 169

```
Table B23, "Comparative  should --Example B23:
            Example B23:   read   Comparative
            Example B13:"         Example B13:--.
Table B24, "Comparative  should --Example B23:
            Example B23:   read   Comparative
            Example B13:"         Example B13:--.
Table C1, "(mTorr)" should read --(Torr)--.
```

COLUMN 171

```
Table C2, "(mTorr)" should read --(Torr)--.
Table C2, " 250     should      --250
            250      read         250
            250"                  250--.
```

COLUMN 173

```
Table C6, "(mTorr)" should read --(Torr)--.
Table C9, "(mTorr)" should read --(Torr)--.
```

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 175

Table C12, "(mTorr)" should read --(Torr)--.

COLUMN 177

Table C16, "(mTorr)" should read --(Torr)--.

COLUMN 179

Table C19, "(mTorr)" should read --(Torr)--.

COLUMN 183

Table C26, "$SiF_4$" should read --$CO_2$--.
Table C26, "$CO_2$ 1,000 ppm (based on $SiH_4$)" should be deleted.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 190

Table C35, "250" should read --300--.
Table C36, "Nydrogen" should read --Hydrogen--.

COLUMN 203

Table D20, "Example D9 (cont'd)" should be deleted.
Table D20, "a) Carbon content: b) Oxygen" should read --a) Carbon content: (at.%) b) Oxygen--.

COLUMN 204

Table D20, "Table D20-continued" should read --Table D20-continued Example D9 (cont'd)--.
Table D20, insert "5" after "85".
Table D21, "Surface" should read --Surface layer--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 207

Table D26, "Comparative" should be deleted.
Table D26, "Example" should read --Comparative Example--.
Table D27, "Comparative" should be deleted.
Table D27, "a Example D13:" should read --a Comparative Example D13:--.
Table D28, "17" should read --20--.

COLUMN 208

Table E2, "0.5 250 3 0.3 250 0.5" should read --0.5 250 3 0.3 250 0.5--.

COLUMN 210

Table E8, "(Torr)" should read --(mTorr)--.

COLUMN 212

Table E14, "(before" should read --(after--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 215

Table E25, "flow rate" should read --flow rate--.

COLUMN 216

Table E25, "flow rate" should read --flow rate--.
Table E26, "flow rate" should read --flow rate--.

COLUMN 217

Table E27, "Table E27-continued" should read
--Table E27-continued
Example E15 (cont'd)--.

COLUMN 218

Table E28, "flow rate" should read --flow rate--.
Table E29, "flow rate" should read --flow rate--.

COLUMN 219

Table E31, "flow rate" should read --flow rate--.
Table E32, "flow rate" should read --flow rate--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 220

Table E35, "flow rate" should read --flow rate--.
Table F1, "flow rate" should read --flow rate--.

COLUMN 221

Table F4, "flow rate" should read --flow rate--.
Table F5, "flow rate" should read --flow rate--.
Table F6, "flow rate" should read --flow rate--.
Table F6, "Surface" should read --Surface layer--.

COLUMN 222

Table F8, "flow rate" should read --flow rate--.
Table F9, "flow rate" should read --flow rate--.

COLUMN 223

Table F11, "flow rate" should read --flow rate--.
Table F12, "flow rate" should read --flow rate--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 226

Table F18, "Example F9:" should read --Example F9:--.
Table F21, "(at·ppm)" should read --(at.ppm)--.

COLUMN 227

Table F21, "(at·ppm)" should read --(at.ppm)--.
Table F21, "F11: " should read --F11: --.

COLUMN 229

Table F27, "(at·%)" should read --(at.%)--.
Table F27, "86 90 93" should read --86 90 93--.
Table F28, "(at·%)" should read --(at.%)--.

COLUMN 231

Table F31, "(at·%)" should read --(at.%)--.
Table F32, "(at·%)" should read --(at.%)--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 233

Table F35, "(at·%)" should read --(at.%)--.
Table F36, "(at·%)" should read --(at.%)--.
Table F36, "F17" should read --F19--.

COLUMN 234

Table F36, "F17" should read --F19--.
TAble F36, "F17" should read --F19--.

COLUMN 235

Table F39, "(at·%)" should read --(at.%)--.
Table F39, "(at·%)" should read --(at.%)--.
Table F40, "(at·%)" should read --(at.%)--.

COLUMN 238

Table F43, "Remarks: Data" should read
--Remarks: *Data--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 239

Table F44, "Remarks: Data" should read --Remarks: *Data--.

Table F47, " Cp*F25 Oxygen and Nitrogen content: atom (at. %)" should read --Oxygen and Nitrogen content: atom (at.%)--.

COLUMN 241

Table F48, " Cp*F25 Oxygen and Nitrogen content: atom (at. %)" should read --Oxygen and Nitrogen content: atom (at.%)--.

COLUMN 245

Table G7, "Second" should read --second--.

COLUMN 246

Table G12, "(Varied)" should read --Varied--.

Table G14, "(Varied)" should read --Varied--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL. Page 32 of 53

It is certified that error appears in the above-identified patent and that said Letters Patent is hereby corrected as shown below:

COLUMN 250

Table G22, "CH" should read --$CH_4$--.

COLUMN 253

Table G26, "

| | | | | | | | | | | |
|---|---|---|---|---|---|---|---|---|---|---|
| Overall evaluation: | B | B | B | B | B | B | A | A | A | B |

"

should read

--

| | | | | | | | | | | |
|---|---|---|---|---|---|---|---|---|---|---|
| Overall evaluation: | B | B | B | B | B | B | A | A | A | B |

* Comparative Example

--.

COLUMN 254

Table H1, "used," should read --used, &--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 255

Table H4, "80 500 60 2 30 1,000 10" should read --80 500 60 2 30 1,000 10--.

COLUMN 258

Table H11, "500 80 500 " should read --500 80 500--.

COLUMN 259

Table H14, "$Co_2$" should read --$CO_2$--.

COLUMN 265

Table H23, "__ _____ 86 90 93" should read --_____ __ 86 90 93--.

Table H25, "SiH 4" should read --$SiH_4$--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL. Page 34 of 53

It is certified that error appears in the above-identified patent and that said Letters Patent is hereby corrected as shown below:

COLUMN 267

Table H26, "

TABLE H26

(before running)

| | Cp* H14 | Example H14 | | | | | | | | | Cp *H14 | |
|---|---|---|---|---|---|---|---|---|---|---|---|---|
| Oxygen atom content: | 1 × | 1 × | 3 × | 1 × | 5 × | | | | | | | |
| (at. %) | $10^{-5}$ | $10^{-4}$ | $10^{-4}$ | $10^{-3}$ | $10^{-3}$ | 1 | 20 | 25 | 30 | 40 | 50 | " |

should read

--

Table H26

(before running)

| Cp* H14 | Example H14 | | | | | | | | | Cp.*H14 | |
|---|---|---|---|---|---|---|---|---|---|---|---|
| Oxygen atom content: (at.%) | 1× $10^{-5}$ | 1× $10^{-4}$ | 3× $10^{-4}$ | 1× $10^{-3}$ | 5× $10^{-3}$ | 1 | 20 | 25 | 30 | 40 | 50 |

--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL. Page 35 of 53

It is certified that error appears in the above-identified patent and that said Letters Patent is hereby corrected as shown below:

COLUMN 267

Table H27, "

TABLE H27

(after running)

| | Cp* H14 | Example H14 | | | | | | | | | Cp. *H14 | |
|---|---|---|---|---|---|---|---|---|---|---|---|---|
| Oxygen atom content: | 1 × | 1 × | 3 × | 1 × | 5 × | | | | | | | |
| (at. %) | $10^{-5}$ | $10^{-4}$ | $10^{-4}$ | $10^{-3}$ | $10^{-3}$ | 1 | 20 | 25 | 30 | 40 | 50 | |

"

should read

--

Table H27

(after running)

| | Cp* H14 | Example H14 | | | | | | | | | Cp.*H14 |
|---|---|---|---|---|---|---|---|---|---|---|---|
| Oxygen atom content: (at.%) | 1× $10^{-5}$ | 1× $10^{-4}$ | 3× $10^{-4}$ | 1× $10^{-3}$ | 5× $10^{-3}$ | 1 | 20 | 25 | 30 | 40 | 50 |

--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL. Page 36 of 53

It is certified that error appears in the above-identified patent and that said Letters Patent is hereby corrected as shown below:

COLUMN 269

Table H30, "

TABLE H30

(before running)

| Nitrogen | Cp* H16 | Example H16 | | | | | | | | | Cp *H16 | |
|---|---|---|---|---|---|---|---|---|---|---|---|---|
| atom content: | 1 × | 1 × | 3 × | 1 × | 5 × | | | | | | | |
| (at. %) | $10^{-5}$ | $10^{-4}$ | $10^{-4}$ | $10^{-3}$ | $10^{-3}$ | 1 | 20 | 25 | 30 | 40 | 50 | " |

should read

--

Table H30

(before running)

| Nitrogen atom content: (at.%) | Cp* H16 | Example H16 | | | | | | | | | Cp.*H16 |
|---|---|---|---|---|---|---|---|---|---|---|---|
| | | 1× $10^{-5}$ | 1× $10^{-4}$ | 3× $10^{-4}$ | 1× $10^{-3}$ | 5× $10^{-3}$ | 1 | 20 | 25 | 30 | 40 | 50 |

--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL. Page 37 of 53

It is certified that error appears in the above-identified patent and that said Letters Patent is hereby corrected as shown below:

COLUMN 269

Table H31, "

TABLE H31

(after running)

| Nitrogen | Cp* H16 | Example H16 | | | | | | | | | Cp. *H16 | | |
|---|---|---|---|---|---|---|---|---|---|---|---|---|---|
| atom content: | 1 × | 1 × | 3 × | 1 × | 5 × | | | | | | | | |
| (at. %) | $10^{-5}$ | $10^{-4}$ | $10^{-4}$ | $10^{-3}$ | $10^{-3}$ | 1 | 20 | 25 | 30 | 40 | 50 | " |

should read

--

Table H31

(after running)

| | Cp* H16 | Example H16 | | | | | | | | | Cp.*H16 |
|---|---|---|---|---|---|---|---|---|---|---|---|
| Nitrogen atom content: (at.%) | | 1× $10^{-5}$ | 1× $10^{-4}$ | 3× $10^{-4}$ | 1× $10^{-3}$ | 5× $10^{-3}$ | 1 | 20 | 25 | 30 | 40 | 50 |

--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 270

Table H31, "

TABLE H31-continued (after running)

| Nitrogen | Cp* H16 | Example H16 | | | | | | | | Cp *H16 | |
|---|---|---|---|---|---|---|---|---|---|---|---|
| atom content: | 1 × | 1 × | 3 × | 1 × | 5 × | | | | | | |
| (at. %) | $10^{-5}$ | $10^{-4}$ | $10^{-4}$ | $10^{-3}$ | $10^{-3}$ | 1 | 20 | 25 | 30 | 40 | 50 |

"

should read

--

Table H31-continued (after running)

| Cp* H16 | Example H16 | | | | | | | | | Cp.*H16 | |
|---|---|---|---|---|---|---|---|---|---|---|---|
| Nitrogen atom content: (at.%) | 1× $10^{-5}$ | 1× $10^{-4}$ | 3× $10^{-4}$ | 1× $10^{-3}$ | 5× $10^{-3}$ | 1 | 20 | 25 | 30 | 40 | 50 |

--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 275

Table H38, "Data" should read --*Data--.

COLUMN 277

Table H39, "Data" should read --*Data--.
Table H40, "$B_2$ $H_6$" should read --$B_2H_6$--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL. Page 40 of 53

It is certified that error appears in the above-identified patent and that said Letters Patent is hereby corrected as shown below:

COLUMN 279

Table H42, "

TABLE H42

(before running)

| Total of Nitrogen atom content and oxygen atom content: (at. %) | Cp* H22 | Example H22 | | | | | | | | | Cp.*H22 | |
|---|---|---|---|---|---|---|---|---|---|---|---|---|
| | $1\times10^{-5}$ | $1\times10^{-4}$ | $3\times10^{-4}$ | $1\times10^{-3}$ | $5\times10^{-3}$ | 1 | 20 | 25 | 30 | 40 | 50 |

should read

--

Table H42

(before running)

| Total of Nitrogen atom content and oxygen atom content: (at.%) | Cp* H22 | Example H22 | | | | | | | | | Cp.*H22 |
|---|---|---|---|---|---|---|---|---|---|---|---|
| | $1\times10^{-5}$ | $1\times10^{-4}$ | $3\times10^{-4}$ | $1\times10^{-3}$ | $5\times10^{-3}$ | 1 | 20 | 25 | 30 | 40 | 50 |

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL. Page 41 of 53

It is certified that error appears in the above-identified patent and that said Letters Patent is hereby corrected as shown below:

COLUMN 279

Table H43, "

TABLE H43

(after running)

| Total of Nitrogen atom content and oxygen atom content: (at. %) | Cp* H22 | Example H22 | | | | | | | | Cp. *H22 | |
|---|---|---|---|---|---|---|---|---|---|---|---|
| | $1\times10^{-5}$ | $1\times10^{-4}$ | $3\times10^{-4}$ | $1\times10^{-3}$ | $5\times10^{-3}$ | 1 | 20 | 25 | 30 | 40 | 50 |

"

should read

--

Table H43

(after running)

| Total of Nitrogen atom content and oxygen atom content: (at.%) | Cp* H22 | Example H22 | | | | | | | | Cp.*H22 | |
|---|---|---|---|---|---|---|---|---|---|---|---|
| | $1\times10^{-5}$ | $1\times10^{-4}$ | $3\times10^{-4}$ | $1\times10^{-3}$ | $5\times10^{-3}$ | 1 | 20 | 25 | 30 | 40 | 50 |

--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 281

Table I2, "$SiH_4$ 500 500 0.5 250 17" should be deleted.
Table I4, "(Torr)" should read --(mTorr)--.

COLUMN 282

Table I4, "(Torr)" should read --(mTorr)--.
Table I5, "(Torr)" should read --(mTorr)--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL. Page 43 of 53

It is certified that error appears in the above-identified patent and that said Letters Patent is hereby corrected as shown below:

COLUMN 287

Table I18, "

TABLE I18-continued

| Layer | Gas used, & flow rate (sccm) | | μW power (W) | Inner pressure (mtorr) | Substrate temp. (°C.) | Layer thickness (μm) |
|---|---|---|---|---|---|---|
| | $SiF_4$ (Varied) | | | | | |
| tive layer | $B_2H_6$ 30 → 2 ppm (based on $SiH_4$) | | | | | |
| Second photo-conductive layer | $SiH_4$ | 500 | 1,000 | 10 | 250 | 3 |
| Surface layer | $SiH_4$ | 75 | 1,000 | 10 | 250 | 0.5 |
| | $CH_4$ | 500 | | | | |
| | NO | 1,000 ppm (based on $SiH_4$) | | | | |

"

should read --

Table I18 -continued

| Layer | Gas used, & flow rate (sccm) | | μW power (W) | Inner pressure (mtorr) | Substrate temp. (°C) | Layer thickness (μm) |
|---|---|---|---|---|---|---|
| tive layer | $SiF_4$ | (Varied) | | | | |
| | $B_2H_6$ | 30 → 2 ppm (based on $SiH_4$) | | | | |
| Second photo-conductive layer | $SiH_4$ | 500 | 1,000 | 10 | 250 | 3 |
| Surface layer | $SiH_4$ | 75 | 1,000 | 10 | 250 | 0.5 |
| | $CH_4$ | 500 | | | | |
| | NO | 1,000 ppm (based on $SiH_4$) | | | | |
| | $B_2H_6$ | 10 ppm (based on $SiH_4$) | | | | |
| | $SiF_4$ | 35 | | | | |

--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 290

| | | | |
|---|---|---|---|
| Table I26, | "Photo-tive" | should read | --Photo-conduc-tive-- |

(both occurrences).

| | | | |
|---|---|---|---|
| Table I28, | "Photo-tive" | should read | --Photo-conduc-tive-- |

(both occurrences).

COLUMN 291

| | | | |
|---|---|---|---|
| Table I28, | "Photo-tive" | should read | --Photo-conduc-tive-- |

(both occurrences).

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 294

Table I34, "

TABLE I34

(before running)

| | Cp* I19 | Example I19 | | | | | | | | Cp. *I19 | |
|---|---|---|---|---|---|---|---|---|---|---|---|
| Oxygen atom content: (at. %) | $1\times10^{-5}$ | $1\times10^{-4}$ | $3\times10^{-4}$ | $1\times10^{-3}$ | $5\times10^{-3}$ | 1 | 20 | 25 | 30 | 40 | 50 |

"

should read

--

Table I34

(before running)

| | Cp* I19 | Example I19 | | | | | | | | Cp.*I19 | |
|---|---|---|---|---|---|---|---|---|---|---|---|
| Oxygen atom content: (at.%) | $1\times10^{-5}$ | $1\times10^{-4}$ | $3\times10^{-4}$ | $1\times10^{-3}$ | $5\times10^{-3}$ | 1 | 20 | 25 | 30 | 40 | 50 |

--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 295

Table I35, "

TABLE I35

(after running)

| | Cp* I19 | Example I19 | | | | | | | | Cp. *I19 | |
|---|---|---|---|---|---|---|---|---|---|---|---|
| Oxygen atom content: (at. %) | $1\times10^{-5}$ | $1\times10^{-4}$ | $3\times10^{-4}$ | $1\times10^{-3}$ | $5\times10^{-3}$ | 1 | 20 | 25 | 30 | 40 | 50 |

"

should read

--

Table I35

(after running)

| | Cp* I19 | Example I19 | | | | | | | | Cp.*I19 | |
|---|---|---|---|---|---|---|---|---|---|---|---|
| Oxygen atom content: (at.%) | $1\times10^{-5}$ | $1\times10^{-4}$ | $3\times10^{-4}$ | $1\times10^{-3}$ | $5\times10^{-3}$ | 1 | 20 | 25 | 30 | 40 | 50 |

--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL. Page 47 of 53

It is certified that error appears in the above-identified patent and that said Letters Patent is hereby corrected as shown below:

COLUMN 296

Table I38, "

TABLE I38

(before running)

| Nitrogen | Cp* I21 | Example I21 | | | | | | | | Cp. *I21 | |
|---|---|---|---|---|---|---|---|---|---|---|---|
| atom content: | 1 × | 1 × | 3 × | 1 × | 5 × | | | | | | |
| (at. %) | $10^{-5}$ | $10^{-4}$ | $10^{-4}$ | $10^{-3}$ | $10^{-3}$ | 1 | 20 | 25 | 30 | 40 | 50 |

"

should read

--

Table I38

(before running)

| | Cp* I21 | Example I21 | | | | | | | | Cp* I21 | |
|---|---|---|---|---|---|---|---|---|---|---|---|
| Nitrogen atom content: (at.%) | $1\times 10^{-5}$ | $1\times 10^{-4}$ | $3\times 10^{-4}$ | $1\times 10^{-3}$ | $5\times 10^{-3}$ | 1 | 20 | 25 | 30 | 40 | 50 |

--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL. Page 48 of 53

It is certified that error appears in the above-identified patent and that said Letters Patent is hereby corrected as shown below:

COLUMN 297

Table I39, "

TABLE 139

(after running)

| Nitrogen | Cp* I21 | Example I21 | | | | | | | | Cp *I21 | |
|---|---|---|---|---|---|---|---|---|---|---|---|
| atom content: | 1 × | 1 × | 3 × | 1 × | 5 × | | | | | | |
| (at. %) | $10^{-5}$ | $10^{-4}$ | $10^{-4}$ | $10^{-3}$ | $10^{-3}$ | 1 | 20 | 25 | 30 | 40 | 50 |

"

should read

--

Table I39

(after running)

| Cp* I21 | Example I21 | | | | | | | | | Cp* I21 | |
|---|---|---|---|---|---|---|---|---|---|---|---|
| Nitrogen atom content: (at.%) | 1× $10^{-5}$ | 1× $10^{-4}$ | 3× $10^{-4}$ | 1× $10^{-3}$ | 5× $10^{-3}$ | 1 | 20 | 25 | 30 | 40 | 50 |

--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 298

Table I41, "Photo-tive" should read --Photo-conduc-tive--

(both occurrences).

COLUMN 301

Table I44, "$NO_2$" should read --NO--.

COLUMN 302

Table I45, "Photo-tive" should read --Photo-conduc-tive--

(both occurrences).

COLUMN 303

Table I46, "Data" should read --*Data--.
Table I47, "Data" should read --*Data--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL. Page 50 of 53

It is certified that error appears in the above-identified patent and that said Letters Patent is hereby corrected as shown below:

COLUMN 305

Table I48, "$NO_2$" should read --NO--.
Table I49, "$NO_2$" should read --NO--.
Table I50, "

TABLE I50

(before running)

| Total of nitrogen atom content and oxygen atom content: (at. %) | Cp. *I27 | Example I27 | | | | | | | | | Cp. *I27 |
|---|---|---|---|---|---|---|---|---|---|---|---|
| | $1\times10^{-5}$ | $1\times10^{-4}$ | $3\times10^{-4}$ | $1\times10^{-3}$ | $5\times10^{-3}$ | 1 | 20 | 25 | 30 | 40 | 50 |

"

should read
--

Table I50
(before running)

| Total of nitrogen atom content and oxygen atom content: (at.%) | Cp.*I27 | Example I27 | | | | | | | | | Cp.*I27 |
|---|---|---|---|---|---|---|---|---|---|---|---|
| | $1\times10^{-5}$ | $1\times10^{-4}$ | $3\times10^{-4}$ | $1\times10^{-3}$ | $5\times10^{-3}$ | 1 | 20 | 25 | 30 | 40 | 50 |

--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 307

Table I51, "

TABLE I51

(after running)

| Total of Nitrogen atom content and oxygen atom content: (at. %) | Cp. *I27 | Example I27 | | | | | | | | Cp. *I27 | |
|---|---|---|---|---|---|---|---|---|---|---|---|
| | $1\times10^{-5}$ | $1\times10^{-4}$ | $3\times10^{-4}$ | $1\times10^{-3}$ | $5\times10^{-3}$ | 1 | 20 | 25 | 30 | 40 | 50 |

"

should read --

Table I51

(after running)

| | Cp.*I27 | Example I27 | | | | | | | | Cp.*I27 | |
|---|---|---|---|---|---|---|---|---|---|---|---|
| Total of Nitrogen atom content and oxygen atom content: (at.%) | $1\times10^{-5}$ | $1\times10^{-4}$ | $3\times10^{-4}$ | $1\times10^{-3}$ | $5\times10^{-3}$ | 1 | 20 | 25 | 30 | 40 | 50 |

--.

Table I52, "$NO_2$" should read --NO--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 309

Table I59, " Charge-ability should read -- Charge-ability

AA AA

A " A --.

COLUMN 310

Table I61, "300" should read --500--.

Table I63, "Comparative 20.0 102

Example I31: 0 100" should read

--Comparative 0 100

Example I31: -- and

"20.0 102" should read

--Comparative 20.0 102

Example I31: --.

COLUMN 312

Table I67, "300" should read --500--.

COLUMN 313

Table I70, "300" should read --500--.

UNITED STATES PATENT AND TRADEMARK OFFICE

CERTIFICATE OF CORRECTION

PATENT NO. : 5,582,944

DATED : December 10, 1996

INVENTOR(S) : MASAAKI YAMAMURA ET AL.

It is certified that error appears in the above-identified patent and that said Letters Patent is hereby corrected as shown below:

COLUMN 324

Table I94, "Photo- tive " should read --Photo- conduc- tive --.

COLUMN 325

Line 16, "at," should read --at--.
Line 34, "at," should read --at--.

Signed and Sealed this

Thirtieth Day of September, 1997

Bruce Lehman

*Attest:*

BRUCE LEHMAN

*Attesting Officer*

*Commissioner of Patents and Trademarks*